US006939079B2

(12) United States Patent
Lloyd

(10) Patent No.: US 6,939,079 B2
(45) Date of Patent: Sep. 6, 2005

(54) HOT-IN-PLACE ASPHALT RECYCLING MACHINE AND PROCESS

(75) Inventor: Peter Lloyd, Mississaugua (CA)

(73) Assignee: Enviro Pavo, Inc., Scarborough (CA)

( * ) Notice: Subject to any disclaimer, the term of this patent is extended or adjusted under 35 U.S.C. 154(b) by 60 days.

(21) Appl. No.: 10/860,682

(22) Filed: Jun. 3, 2004

(65) Prior Publication Data

US 2004/0247388 A1 Dec. 9, 2004

Related U.S. Application Data

(62) Division of application No. 10/171,798, filed on Jun. 14, 2002, now Pat. No. 6,769,836.
(60) Provisional application No. 60/371,756, filed on Apr. 11, 2002, now abandoned.

(51) Int. Cl.[7] ..... E01C 23/12
(52) U.S. Cl. ..... 404/91; 90/95
(58) Field of Search ..... 404/90, 91, 92, 404/93, 94, 95, 101; 299/36.1, 39.2

(56) References Cited

U.S. PATENT DOCUMENTS 4,124,325 A * 11/1978 Cutler ..... 404/75
4,453,856 A * 6/1984 Chiostri et al. ..... 404/91
4,473,320 A * 9/1984 Register ..... 404/91
4,588,231 A * 5/1986 Silay et al. ..... 299/39.6
4,780,022 A * 10/1988 Ohiba et al. ..... 404/90
4,793,730 A * 12/1988 Butch ..... 404/77
4,946,307 A * 8/1990 Jakob ..... 404/92
5,472,292 A * 12/1995 Wiley ..... 404/79
6,220,782 B1 * 4/2001 Yates ..... 404/75
6,416,249 B1 * 7/2002 Crupi ..... 404/91
6,695,530 B2 * 2/2004 Crupi ..... 404/91
6,769,836 B2 * 8/2004 Lloyd ..... 404/75

* cited by examiner

*Primary Examiner*—Gary S. Hartmann
(74) *Attorney, Agent, or Firm*—Michael P. Mazza

(57) ABSTRACT

A process and device for the recycling of asphalt including at least one one preheater unit. The preheater having a heater, scarifying rakes, and a bin to dispense aggregate. Also include is a recycling machine having a heater, scarifying rakes, a plurality of extension mills, a main mill, as well as a pug mill having first and second downwardly rotating rotors, the pug mill mixes asphalt and liquid additives together to form a homogenous mix; and at least one screed for laying the homogeneously mixed asphalt to grade.

24 Claims, 80 Drawing Sheets

HOT-IN-PLACE ASPHALT RECYCLING MACHINE AND PROCESS

This application is a Divisional of Ser. No. 10/171,798 filed Jun. 14, 2002 now U.S. Pat. No. 6,769,836, which claims priority to provisional patent application Ser. No. 60/371,756 filed Apr. 11, 2002 now abandoned.

BACKGROUND OF THE INVENTION

The invention relates to a process and machinery (Preheaters and Recycling Machine) for accurately heating, milling/profiling, handling and placement to grade of 100% Hot In-place Recycled (HIR) asphalt mixed with various types of rejuvenating fluids, liquid polymers and aggregates, with or without the addition of new, virgin asphalt (produced by a standard asphalt plant). The asphalt pavement is heated and softened by two or more Preheaters, physically scarified by one or more sets of carbide cutters (rakes), profiled and collected by mills, measured and mixed with rejuvenating fluid, polymer liquid (if required) and washed aggregate (if required) in a pug mill. The type, and amount of additives required to 100% HIR asphalt pavement is specified by pre-engineering using core samples taken from the asphalt pavement at regular intervals.

The 100% HIR of asphalt pavement is achieved by the addition of rejuvenator fluid, liquid polymers (if required) and washed aggregate (if required). Rejuvenator fluid must be accurately metered, as too much rejuvenator fluid will cause the recycled asphalt to bleed (rejuvenator fluid rising to the surface) softening the compacted surface. Too little fluid will not restore flexibility back into the recycled asphalt.

Liquid polymers such as Latex are added to increase the performance of the 100% recycled asphalt (Superpave specifications) by increasing flexibility while reducing rutting and cracking over a wider operating temperature range.

Adding aggregate (typically washed sand) during the 100% HIR process will modify the asphalt's physical properties and the air void ratio (percentage of air entrenched in the asphalt and generally specified at between 3–5%).

Adding rejuvenating fluid alone to the recycled asphalt will generally reduce the air-void ratio while adding washed sand tends to increase the air-void ratio. Adding aggregates that contain dust (unwashed) will generally reduce the air void ratio. Pre-engineering determines the correct specification and application rates for rejuvenating fluid, polymer liquid and aggregate. The Recycling Machine is designed with modular pin-on attachments for increased flexibility.

SUMMARY OF THE INVENTION

The present invention has a wide range of processing capabilities. For example, it can be used in, among others, the following applications:

1. 100% HIR: The old asphalt pavement is heated by a plurality of Preheaters to soften the asphalt for processing by the Recycling Machine. The final Preheater may be fitted with carbide cutters, asphalt collection blades (rake assembly) and an aggregate distribution system. The old asphalt is physically scarified by carbide cutters (rakes), profiled and collected by mills, measured and mixed with rejuvenating fluid, polymer liquid (if required) and washed aggregate (if required) in a pug mill. In one embodiment of the present invention, as described below, the asphalt from the heated surface does not need to be lifted. The type and amount of additives required to 100% HIR asphalt pavement is specified by pre-engineering using core samples taken from the asphalt pavement at regular intervals.

The 100% HIR of asphalt pavement is achieved by the addition of rejuvenator fluid, liquid polymers (if required) and washed aggregate (if required). Liquid polymers such as Latex are added to increase the performance of the 100% recycled asphalt (Superpave specifications) by increasing flexibility while reducing rutting and cracking over a wider operating temperature range.

Adding aggregate (typically washed sand) during the 100% HIR process will modify the asphalt's physical properties and the air void ratio (percentage of air entrenched in the asphalt and is generally specified at between 3–5%). The 100% recycled asphalt is placed to grade as a single course (layer) by a standard paving screed (attached to the Recycling Machine).

The Recycling Machine can be equipped with an optional front asphalt hopper/variable speed chain slat conveyor, truck pusher bar, variable speed central belt conveyor and electronic belt scale and conveyor hopper/diverter valve. A surge bin/vertical elevator, auger/divider/strike off blade, and screed assembly are also provided. The Recycling Machine's mills, pug mill, auger/divider/strike off blade and screed assembly, process and place the 100%, recycled asphalt. When equipped with the optional equipment, the Recycling Machine's on-board computer meters the new asphalt, which may be stored in a hopper, into the surge bin/vertical elevator, auger/divider/strike off blade and screed assembly for startup. The optional equipment also allows the Recycling Machine to perform the 100% HIR Remix method.

2. 100% HIR (Remix): In this application, the old asphalt pavement is heated by three or more Preheaters to soften the asphalt for processing by the Recycling Machine. The final Preheater may be fitted with carbide cutters, asphalt collection blades (rake assembly) and an aggregate distribution system. The Recycling Machine can be equipped with a front asphalt hopper/variable speed chain slat conveyor, truck pusher bar, variable speed central belt conveyor and electronic belt scale, conveyor hopper/diverter valve, surge bin/vertical elevator, auger/divider/strike off blade, and screed assembly. New asphalt is delivered from the hot mix plant by highway dump trucks and discharged into the Recycling Machine's hopper. The Recycling Machine's on-board computer meters the new asphalt (stored in the hopper) proportionally (approximately 10% to 15% by weight of the asphalt being 100% recycled) on to the central belt conveyor. A hopper/diverter valve diverts the new asphalt into the surge bin's vertical elevator. The vertical elevator is positioned in the 100% processed asphalt's windrow to continuously pickup asphalt. The processed asphalt and the metered, new asphalt are blended at the vertical elevator and delivered to the surge bin. The new asphalt may also be diverted directly on to the 100% recycled asphalt (windrow) exiting the pug mill.

3. 100% HIR (Integral Overlay): In this application, the old asphalt pavement is heated by a plurality of Preheaters to soften the asphalt for processing by the Recycling Machine. The final Preheater may be fitted with carbide cutters, asphalt collection blades (rake assembly) and an aggregate distribution system. The Recycling Machine is equipped with a front asphalt hopper/variable speed chain slat conveyor, truck pusher bar, variable speed central conveyor, shuttle conveyor, primary asphalt distribution auger/divider/strike off blade, secondary asphalt distribution auger and primary/secondary screed assemblies. New asphalt is delivered from the hot mix plant by highway dump trucks and discharged into the Recycling Machine's front hopper. The Recycling Machine's mills, pug mill, primary auger/divider/strike off blade and screed assembly, process and place the 100% recycled asphalt. The Recycling Machine's on-board computer meters the new asphalt (stored in a hopper) via the central conveyor and shuttle conveyor to the secondary asphalt auger and screed assembly and if required, to the primary auger/divider/strike off blade and primary screed assembly. The new asphalt is placed by the secondary screed assembly on top of the 100% recycled asphalt (being laid to grade by the primary screed assembly) resulting in a hot, thermal bonding between the two layers. The 100% recycled and new asphalt is not mixed together, as in the Remix method. Both the primary and the secondary screed assemblies feature a novel grade control system used to place the asphalt to grade while also controlling the depth differential (generally 0.5 to 1 inch) of the asphalt laid between the two screed assemblies.

A standard, asphalt-paving machine used in the industry is designed to lay hot, plant mix asphalt delivered from the asphalt plant by dump trucks. The paving machines are either rubber tire or track driven machines. Neither type has any hydraulic suspension to raise and lower the paving machine's mainframe. The asphalt is generally dumped into the front hopper of the paving machine where it is conveyed rewards by two, independently controlled, slat conveyors. The conveyed asphalt drops into two, independently driven, variable speed, hydraulically driven augers. The left auger receives asphalt from the left conveyor and the right auger from the right conveyor. The augers convey asphalt out from the center of the paving machine to the ends of the screed's extensions. Electronic level sensors are attached to the ends of the left and right side extension screeds to control the speed of the independently driven augers and conveyors. If the level of asphalt drops in one or both of the extension screeds, the auger(s) and conveyor(s) will increase in speed, delivering more asphalt. The level of asphalt (head of material) should be maintained across the complete width of the screed assembly. Generally the asphalt will be to the height of the auger's drive shafts (half full) with the augers slowly turning (without stopping) while conveying asphalt to the screed's extensions. Behind the two augers is the screed assembly, which is responsible for spreading (laying) the hot asphalt to a specific depth and grade. The screed assembly consists of the main screed and a left and right extension screed. The main screed is fixed in width while the extension screeds can be hydraulically extended or retracted as the paving machine is operating, thereby altering the paving width. The screed is attached to the paving machine's mainframe by screed tow arms that reach forward to behind the front hopper. The screed tow arms are attached to the paving machine's mainframe by the left and right side tow points. The tow points can be pinned into position for manual control. A skilled operator uses crank handles at either side of the screed to adjust the screed's angle of attack. The screed allows more asphalt to flow under its plate (screed rises) when its angle of attack is increased (front of the screed plate is higher than the rear) and visa versa. For automated control of the screed, the left and right crank handles are locked into position. Hydraulically raising or lowering the screed arm's tow points controls the screed's angle of attack. Raising a tow point will increase the angle of attack and visa versa. The automatic grade control sensors that control the tow points are mounted to the rigid tow arms and sense the asphalt's grade using averaging beams, joint matcher, string lines or a non-contact, sonic sensor beams. The averaging beams and the joint matcher make physical contact with the asphalt's surface and are towed by the paving machine, generally one on either side. The string line is a long string or wire that is erected using surveying equipment. The paving machine uses the string line as a fixed, reference grade. The mounting position of the sensors can be adjusted (distance from the tow point) to control the response of the system. Generally the screed's reaction to grade deviations needs to be slow to produce a smooth riding, asphalt surface. The sensors should be mounted closer to the tow point to achieve a slow, smooth reaction. Mounting the sensor closer to the screed's pivot point (away from the tow point) speeds up the reaction time and is better suited to joint matching applications. For surfaces where the right hand averaging beam cannot practically be used due to obstructions, poorly graded shoulders, curbs, etc., an electronic slope sensor, attached to the main screed can be substituted in place of the right averaging beam and sensor. The slope sensor allows the percentage of grade to be electronically adjusted while the paving machine is processing. For accurate grade and slope control Topcon's Paver System Four or Five together with their Smoothtrack® 4 Sonic Tracker II™ averaging beams are highly recommend. Attached to each of the screed's tow arms is an aluminum beam fitted with four (non-contacting) sonic sensors that electronically average the surface's grade. Topcon's electronic Slope Sensor is mounted to the screed assembly. The Sonic Trackers and the Slope Sensor work together to determine the screed's position relative to the desired grade and generate correction signals that are used by the Recycling Machine's on-board computer to hydraulically control the screed arm's tow points.

To produce a quality, asphalt surface that meets all engineering specifications requires considerable operator skill, knowledge and equipment capable of properly performing the work. Consistency is one of the keys when producing a quality; asphalt surface and the following major points should be followed when laying new asphalt with a paving machine or 100% recycled asphalt with a recycling machine with attached screed(s):

a. Processing should be continuous with no stops. Stopping the screed assembly allows it to settle into the hot asphalt, causing depressions. Stopping for too long a period causes the asphalt in front of the screed assembly to cool, resulting in the screed assembly rising when forward travel is resumed.
b. The processing speed should remain as consistent as possible. An increase in speed will cause the screed assembly to rise while a decrease will cause the screed assembly to sink.
c. The temperature of the asphalt in front of the screed assembly (head) should remain consistent. If the temperature drops the screed assembly will rise and visa versa.
d. The asphalt in front of the screed assembly should remain at a consistent level, across the complete width of the main screed and the screed's extensions. An increase in asphalt level will cause to screed assembly to rise while a decrease will cause it to sink.

The cold planer (milling machine or grinder) is generally a heavy, high-powered machine fitted with a large diameter, cutting drum. Attached to the cutting drum are replaceable carbide teeth and holders. The cold planer is designed to mill to grade, asphalt and concrete surfaces. The carbide cutters are generally sprayed with water, which is used for cooling and dust control. The milling drum discharges the milled product on to a high capacity, rubber conveyor belt that delivers the material to a fleet of waiting dump trucks to be hauled away. The cutting drum's depth of cut (width is fixed) is manually or automatically controlled. Automatic grade control is generally accomplished by using the same sensors as the paving machine; however, long averaging beams are not generally used. More common, is the fixed string line, single sonic sensor on each side or Topcon's Smoothtrack® 4 Sonic Tracker II™ averaging beam on each side. The automatic grade control sensors on the cold planer automatically control the cutting drum's depth by raising or lowering the machine's mainframe to which the drum is attached. Three or four hydraulically activated legs (struts) are fitted with hydraulically driven tracks are used to propel the machine. The struts also turn to provide steering and raise and lower to provide the necessary grade control. The automatic grade control sensors that control the struts are mounted to the mainframe (generally close to the centerline of the cutting drum) and sense the asphalt's grade using left and right side sonic sensors. For surfaces where the right hand sensor cannot practically be used due to obstructions, poorly graded shoulders, curbs, etc., an electronic or hydraulic slope sensor, attached to the mainframe can be substituted in place of the right sensor. The slope sensor allows the grade (percentage) to be electronically adjusted while the planing machine is milling material.

Prior 100% HIR recycling machines have systems designed to process and lay 100% recycled asphalt to grade using a standard, asphalt-paving screed. Recycling machines fitted with an attached screed have had major problems with the varying amount of processed, recycled asphalt, which collects in front of the screed assembly, especially when milling to grade (averaging the high and low areas). Milling to grade causes the volume of recycled asphalt to vary as high and low areas of pavement are milled. High sections increase the amount of asphalt being processed, while low sections require supplemental asphalt, to make up any deficiency. The only way, until now, that the amount of asphalt in front of the screed assembly could be controlled was by manually increasing the angle of attack (raising) of the screed assembly to release excess asphalt, or reduce the angle of attack (lowering) to collect asphalt. Manual, operator adjustment of the screed assembly generally results in bumps and an inconsistent grade of the finished asphalt surface (mat). Others have tried to resolve the problem by removing the screed assembly from the recycling machine. The recycling machine (less screed) either conveys the heated, recycled asphalt into a standard paving machine positioned under the rear of the recycling machine, or leaves a windrow of hot asphalt on the milled asphalt's surface, which is picked up by a windrow conveyor attached to the paving machine. The front hopper of the paving machine stores any excess asphalt when not required by the screed assembly.

The following problems arise when the screed assembly is removed from the recycling machine:

a. Increased costs: A paving machine and windrow conveyor must be purchased and operated in addition to the recycling machine. Shipping both units requires a trailer as the units are not self transportable.
b. Reduced asphalt temperature: The temperature of the recycled asphalt contained in the windrow drops the further the windrow conveyor and paving machine are positioned from the recycling machine. Heat is also lost at the windrow conveyor and paving machine as the hot asphalt is handled. Low asphalt temperatures cause the screed assembly to tare the mat (open surface). This also causes a problem with final mat compaction during rolling. Asphalt meeting Superpave specifications generally requires higher temperatures to be maintained behind the screed assembly with the steel drum roller operating as close to the screed assembly as practicably possible.
c. Increased segregation: Hot asphalt should always be moved as a mass to prevent segregation. The windrow conveyor and paving machine increase the handling operations of the hot asphalt, causing the larger aggregate to separate (segregate) and tumble to the sides, causing marks in the finished mat. Asphalt meeting Superpave specifications generally uses a larger size aggregate than conventional asphalt. Segregation will become a greater problem with the larger aggregates.
d. Increased pollution and increased equipment train length: The windrow conveyor opens up the hot, asphalt windrow as the asphalt is conveyed upwards into the paving machine's front hopper. Excessive smoke (natural byproduct of hot asphalt) is produced (if the asphalt is at the correct temperature) causing a problem to the paving machine's operators. Asphalt meeting Superpave specifications will cause even greater problems with smoke due to the higher temperatures.
e. Safety: Safety is an issue when processing with an open windrow. It is quite common for automobiles to try and cross the heated windrow, only to become stuck in 200 to 300+ Deg F. asphalt. Animals have seriously burnt their feet, as have humans with open footwear! Recycling machines with an attached screed assembly do not suffer from the above problems, as there is no open windrow.

The following problems have, until now, prevented current 100% HIR systems and machines from producing quality, recycled asphalt that meets pre-engineered specifications:

1. Inconsistent heating of the asphalt pavement to the proper depth required for 100% HIR.
2. Inconsistent smoothness when milling with 100% HIR machines.
3. Inconsistent smoothness and surface defects, caused by asphalt handling problems when using an attached screed assembly using 100% HIR machines.
4. Inconsistent ratio of new asphalt to 100% recycled asphalt when using the Remix method.
5. Inability to process asphalt around utility structures and obstructions.
6. Inaccurate and inconsistent application of liquid additives.
7. Inaccurate and inconsistent application of additional aggregate.
8. Improper mixing of rejuvenator fluid, washed aggregate and reworked asphalt.
9. Inability to remove moisture from the reworked asphalt.
10. Inconsistent depth differential between the 100% recycled asphalt and the new asphalt when using the Integral Overlay method.

The present invention solves the above-mentioned problems.

1. Inconsistent Heating of the Asphalt Pavement to the Proper Depth required for 100% HIR A critical step in the 100% HIR of asphalt pavement is getting the heat down into the asphalt to a depth (2" or more) that will produce an average temperature that is hot enough to properly process the asphalt, without damaging the asphalt. Experience has shown that different mixes of asphalt absorb heat at different rates. For instance, asphalt with the addition of steel mill slag absorbs heat at a much different rate than asphalt with the addition of asbestos or rubber. The amount of moisture contained in the asphalt also plays an important part in the way that heat is absorbed with high percentages reducing the heating efficiency. When asphalt is not heated to sufficient depth, the following problems will occur:

The milling equipment will fracture the aggregate (stone) in the asphalt, degrading the asphalt's physical structure.

Insufficient moisture will not be driven out of the asphalt, in the form of steam, preventing the proper coverage and bonding of liquid additives to the asphalt's aggregate.

The effective mixing of additives (aggregate and rejuvenator fluid) will be reduced due to the asphalt not flowing correctly in the mills and pug mill.

The screed assembly will tear the finished mat due to low asphalt temperatures.

If the asphalt is over heated (generally the top surface) and the heat does not penetrate to the required depth, the following problems will occur:

The surface of the asphalt will be chard (burnt), causing degradation of the asphalt's asphalt cement (AC) content and high levels of pollution, caused by fire and smoke.

The added rejuvenator fluid and polymer liquids will be degraded when they make contact with the overheated asphalt as the light fluid fractions will flash off (evaporate).

If the asphalt is inconsistently heated, to a sufficient depth, all of the above problems will occur, plus the screed assembly will sink and climb with the change in the asphalt's temperature. Cold asphalt will make the screed climb (raise) while overheated asphalt will cause the screed to sink. Both conditions will cause grade and surface smoothness problems.

It can be seen that the temperature of the asphalt is critical to the 100% HIR process.

The present invention is able to maintain a consistent temperature through the use of, among other things, a temperature sensor in the pug mill which is designed to measure the final temperature of the asphalt leaving the pug mill (windrow). In addition, the pug mill's discharge (100% recycled asphalt) is formed into a lightly compacted windrow by a parallelogram ski that measures the volume and temperature of the asphalt. An on-board computer monitors the windrow's temperature and makes small adjustments to the forward processing speed, set by the operator. A decrease in the asphalt's temperature will cause a slight decrease in forward processing speed, allowing the Recycling Machine's (and the Preheaters) heater boxes greater time to heat the asphalt to the required depth. An increase in the asphalt's temperature will cause a slight increase in forward processing speed, allowing the Recycling Machine's heater box less time to heat the asphalt surface. The final temperature (pug mill discharge) of the 100% recycled asphalt will be fairly consistent, as the on-board computers attached to the three or more Preheaters and the Recycling Machine automatically monitor and control the complete heating process.

For manual operation, (each Preheater under its own on-board computer control) the Preheaters are equipped with electronic ground speed and asphalt, surface temperature monitoring and control. Each Preheater is set to track a preset (asphalt surface) heat range. The Preheaters and the Recycling Machine, monitor the temperature before, during and after the heater boxes. The Preheater's front and rear heat sensors measure the asphalt surface's heat differential, across the heater box and control the amount of heat by turning on and off the individual, electronically controlled burners. Heat sensors in each burner monitor and control each individual burner, while flame detectors shut down burners when flame (caused by crack filler or painted lines) is detected.

The Preheaters and the Recycling Machine may also be linked by wireless control (Ethernet). Satellite communication may also be used to replace the wireless control system. Each machine may also be fitted with a satellite Global Positioning System (GPS). The Recycling Machine and Preheater's on-board GPS computers will allow all of the machines to self steer and maintain the correct spacing (in relation to the Recycling Machine) for proper heat transfer to the asphalt. Data for the on-board GPS computers will be determined by a pickup truck, fitted with a mechanical, center lane guide and GPS sensor(s) positioned at the center of the truck. Two sensors will be used to provide greater accuracy. The pickup truck will be driven down the road (mechanical center lane guide positioned over center of road) prior to processing, with the GPS sensors readings being recorded into a portable computer fitted with a removable disk or a memory card (Zip or flash). The data will be downloaded into all of the machine's on-board computers. The truck can also be equipped with a metal detection boom with left and right side, hydraulically operated extension booms. A series of metal detectors are attached to the booms and detect iron utility structures in the asphalt's surface. The extension booms are hydraulically moved in and out to follow the width of the asphalt surface to be recycled. Electronic position sensors (LVDT) measure the position of the boom's extensions. The GPS computer records and stores the location of all iron structures. The Recycling Machine and the Preheaters will also be fitted with GPS sensors. The sensors may be fitted to the front and the rear of Recycling Machine and the Preheaters. The on-board computers compare the machine's actual position, to the stored position, recorded by the pickup truck's sensors. The on-board, computers monitor the Preheater's spacing and monitors and controls the steering (front and rear) when the automatic steering mode is selected. All GPS equipped machines are programmed to steer accurately down the center of the lane, not the center of the road. The Recycling Machine's processing width can be varied, while in operation, therefore the operators can process varying lane widths on both sides of machine. For safety reasons the machine operators can override the GPS control system at any time.

For large areas or straight-line work, a laser beam can be used to automatically guide (self-steer) the pickup truck in a straight line. Once the data has been stored to disk or memory and downloaded in to each machine's on-board computer, each pass is programmed at a selected width from the last pass. It is also possible to use the on-board GPS system fitted to each machine to program the coordinates directly, rather than using the data obtained by the pickup truck GPS system.

The GPS's metal detection readings are used by the final Preheater (unit ahead of the Recycling Machine) and the Recycling Machine's GPS and on-board computers to automatically raise and lower the rake/blades assemblies, extension mills, main mill and the pug mill, preventing damage to the sub-assemblies and iron utility structures. All machines fitted with the GPS system will also be equipped with sonic sensors mounted at the front of the machines. An operator warning horn will sound if an obstruction, such as an automobile is detected. The machine is programmed to stop when a minimum distance is reached.

The wireless data transmission will allow all of the machines to communicate with each other, providing accurate and efficient heating.

The system can be designed to operate under the following parameters:

All Preheaters and the Recycling Machine will be under their own control until processing speed and control has been established and stabilized.

The Recycling Machine (master) will control the spacing of the Preheaters (slaves) using wireless, GPS or satellite control.

The lead Preheater will produce as much heat as possible without damaging the asphalt's surface.

All other Preheaters following the lead Preheater will regulate their heat output based upon the temperature of the asphalt's surface ahead and behind (heat differential) their heating elements (boxes). Each Preheater is designed to produce as much heat as possible without damaging the asphalt's surface.

The final Preheater is equipped with a rake scarification/blade collection system and aggregate distribution bin, controlled by the Preheater's on-board computer. The aggregate bin must be occasionally filled with aggregate by a wheel loader. Space must be provided not only for the wheel loader, but also for the dump trucks discharging asphalt into the front hopper of the Recycling Machine. This necessitates the final Preheater being controlled by the operator (taken out of automatic control). All of the Preheaters ahead of the final Preheater will automatically move ahead once the final Preheater has reached a preset distance from the Preheater ahead (positions monitored by the on-board GPS systems). As the Preheaters move ahead their heating output will automatically increase (if possible) due to the increase in the heat differential across their heating elements (boxes). Once the aggregate bin has been filled or the dump truck has been released, the final Preheater is returned to automatic control. All of the Preheaters will slow down, allowing the Recycling Machine to catch up. The heating output of the Preheaters is automatically reduced during the catch up period due to the decrease in the heat differential across their heating elements (boxes), thereby preventing overheating of the asphalt.

The Recycling Machines heating system is designed to fine-tune the asphalt's final temperature before the asphalt is processed by the rake scarification and milling systems. The heating system is programmed to operate at 50% or less of its heating capacity (50% or less of the electronically controlled burners on the main heater box turned on). When the final Preheater is fitted with a rake scarification/blade collection system and aggregate bin the Recycling Machine's heating system must produce enough heat to remove any remaining moisture in the aggregate without degrading the asphalt. The scarifying process breaks the asphalt's surface, limiting the amount of heat that can be applied. The average temperature of the heating system can be set and controlled by the on-board computer. Individual, electronic burners will maintain this average by regulating their heat output. Infrared sensors monitor the asphalt's temperature, ahead of the heating system. The mill's grade control shoes (located behind the heating system) are fitted with heat thermocouples that monitor the temperature of the asphalt's surface, ahead of the rakes and mill assemblies. This temperature information, together with the pug mill's discharge (windrow) temperature and the operator's input for the base processing speed, controls the actual processing speed of the Recycling Machine. For instance, the operator has set the base processing_speed to 20 feet per minute, based upon information displayed upon his monitor (screen). The on-board computer is programmed to monitor key operating parameters such as Preheater/Recycling Machine's asphalt processing temperature differentials and the Recycling Machine's engine percentage load factor and will display a recommended base processing speed. The temperature of the asphalt in the windrow has been programmed at a set point of 320° F. The thermocouples on the grade shoes are reading 550° F. and the heating system is operating at 50% of its output. As the windrow temperature increases to 325° F. and the mill's grade shoes average temperature increases to 560° F. the Recycling Machine's actual processing speed increases automatically. The Recycling Machine's on-board computer will also send information by wireless or GPS to all of the Preheater's on-board computers to speed up their forward travel speed. When the Preheaters are at 100% of their heating capacity and the temperature differential across their heating systems begins to increase to a preset, set point, it signals that the train is getting to the point of going too fast for the asphalt to properly absorb heat. The Recycling Machine's on-board computer monitors all of the Preheater's temperature differentials (via wireless or satellite link) and will start to slow down its processing speed and the Preheaters, allowing more time for the asphalt to absorb the heat. The infrared temperature sensors in front of the Recycling Machine's heater box can instantly turn the heating system up to 100% capacity if the asphalt's temperature reaches a preset minimum set point. This can occur when the final Preheater's aggregate distribution system deposits a higher percentage of aggregate when its grade profiling system traverses a high section in the asphalt's surface. The increased volume of aggregate (generally washed, damp sand is used to modify the asphalt's air void ratio) will reduce the asphalt's surface temperature and the extra heat will be required to drive out the excess moisture and bring the aggregate up to the proper temperature. The temperature drop could also be the result of the Preheater's rake scarification/blade collection system (set to scarify at 2 inches or more) releasing large quantities of moisture (steam) out of the heated asphalt. The Recycling Machine's heating system is designed to operate at 100% of its heating output (all of the electronically controlled burners turned on), once the processing speed reaches a pre-set limit (around 22 feet per minute). 100% heating capacity is also used if the asphalt's temperature at the rear of the final Preheater heating system suddenly drops to a minimum temperature, set point when operating at below 22 feet per minute. If the temperature behind the final Preheater does not return to its normal operating temperature range within 10 feet, the Recycling Machine's on-board computer (using data obtained from the final Preheater by wireless or satellite transmission) will slow the Recycling Machine and Preheaters down using the GPS. This electronic monitoring, transmission and control loop is continuously repeated, providing maximum heating efficiency and processing speed.

2. Inconsistent Smoothness when Milling with 100% HIR Machines:

The accuracy of the milled surface (grade) and the accurate placement of asphalt on to the milled surface determine the smoothness of the compacted, asphalt mat. If either one is incorrect the riding quality (smoothness) will be reduced. The present invention is fitted with two types of on-board, computer controlled, automatic grade control systems that monitor pavement grade to automatically control all of the milling and screed assembly operations:

a. Full, mainframe grade control: For asphalt surfaces requiring the accurate milling and placement of asphalt (highway and airport runways) a novel grade and slope control system has been developed. When using full, mainframe grade control, the mills and screed arm tow points are mechanically, electronically or hydraulically locked to the grade of the Recycling Machine's mainframe. The system can utilize Topcon's Paver System Four or Five together with their Smoothtrack® 4 Sonic Tracker II™ (non-contact) averaging beam(s) or mechanical averaging beam(s) on one or both sides of the Recycling Machine's rear end. All of the mechanical averaging beams are attached and towed by the Recycling Machine's mainframe while Topcon's Smoothtrack™ 4 Sonic Tracker II™ averaging beam(s) are fixed to the mainframe as they do not have to be towed. All of the beams longitudinal track the asphalt's surface. The longer the beam the greater the averaging effect. Topcon's Smoothtrack® 4 Sonic Tracker II™ averaging beams are preferred as they do not make contact with the asphalt's surface, thereby eliminating marking (scuffing) of the previously finished mat and can also be used on the curb side (right) of the Recycling Machine. They also provide increased accuracy and easier setup/operation. The mechanical averaging beams use electrical or hydraulic sensors (attached to the Recycling Machine's rigid main frame) to sense the grade (position) of the beam. Wands or arms attached to the sensors make physical contact with the beams or travelling string line (string line attached to the beam). Whichever sensor system is used, the Recycling Machine's grade (mainframe) is controlled as explained in the following example. The Recycling Machine's rear, left side axle and mainframe begin to sink (lower) in grade, compared to the left side averaging beam's grade (the Recycling Machines right side grade remains on grade). The grade control system will signal for hydraulic oil to be sent to the left, rear axle's, hydraulic leveling cylinder (attached between the mainframe and the rear axle assembly). The left hydraulic cylinder extends and tilts the mainframe, keeping the mainframe on grade. The electronic or hydraulic sensor automatically stops the hydraulic oil supply to the left hydraulic cylinder as the mainframe is raised back to match the averaging beam's grade. The grade of the frame has to change to produce input into the sensors; however, this change in grade is small and has little or no effect on the final grade of the asphalt's surface. The right hydraulic leveling cylinder is under the control of the right averaging beam and sensor. For surfaces where the right hand, mechanical averaging beam cannot practically be used due to obstructions, poorly graded shoulders, curbs, etc., the electronic slope sensor (located at the rear end of the Recycling Machine's mainframe) can be substituted in place of the right averaging beam and sensor. The slope sensor allows the percentage of grade to be electronically adjusted while the Recycling Machine is processing. Topcon's Smoothtrack® 4 Sonic Tracker II™ averaging beams together with Topcon's frame mounted electronic slope sensor allow averaging on both sides or cross slope to be specified. To allow the above grade and slope control system to operate the Recycling Machine is designed with a hydraulic, three-point suspension system that lifts and lowers both ends of the Recycling Machine's mainframe as well as tilting it. Two hydraulic cylinders per axle assembly are attached between the mainframe and front and rear axle assemblies. The two front cylinders (front axle assembly) are hydraulically connected in parallel, while the rear axle's hydraulic cylinders are individually controlled, thus forming a three-point suspension system. The front and rear axle assemblies are fitted with hydraulic wheel motors and rubber tires, inflated with dry nitrogen to high pressures to prevent the tire's side walls from deflecting which would have a negative effect on grade control. Both axle assemblies can steer 40 degrees in both directions, providing accurate steering. The rear tires contact the heated asphalt's surface, milled by the main and extension mills (located ahead of the rear axle). The front axle assembly follows the original, heated asphalt's surface and is free to oscillate when working on uneven surfaces. Grade changes will cause the front axle assembly and to some degree the front of the mainframe to rise and fall, however, this has little effect on the rear end of the mainframe due to the frame's long length. As noted above, input from the left and/or right side averaging beams or the left side averaging beam and electronic slope sensor are used to control the operation of the two individual hydraulic cylinders attached between the rear of the mainframe and the rear axle assembly. The Recycling Machine's mainframe is said to be "locked to grade" by the sensors. The extension mills and the main mill are raised and lowered in relation to the mainframe by four, individual (left and right) hydraulically operated sliding struts, controlled by four automatic grade control sensors. When utilizing full, mainframe, grade sensing, the mills automatic grade control sensors sense the mainframe's position. Fine adjustments can be made to the depth of cut by adjusting each, individual sensor. This is desirable when setting the cutting depth between the extension mills and the main mill. The screed arm's tow points can be locked mechanically (pinned) to the mainframe.

The screed is attached to the screed tow points (left and right side of the recycling machine) by pivoting, rigid arms. The tow points can be pinned into position for manual control by a skilled operator who uses crank handles at either side of the screed assembly to adjust the screed's angle of attack. The screed assembly allows more asphalt to flow under its plates (screed assembly rises) when its angle of attack is increased (front of the screed's plates higher than the rear) and visa versa. For automated control of the screed assembly, the left and right crank handles are locked into position. Hydraulically raising or lowering the tow points controls the screed assembly angle of attack. Raising a tow point will increase the angle of attack and visa versa. The automatic grade control sensors that control the tow points are mounted to the rigid screed arms and sense the asphalt's grade using Topcon's Smoothtrack® 4 Sonic Tracker II™ averaging beams, mechanical averaging beam(s), joint matcher or string lines. The mounting position of the sensors can be adjusted (distance from the tow point) to control the response of the system. When the mechanical averaging beams (towed) are used the screed arm's sensors, sense of the same averaging beams used by the Recycling Machine's mainframe grade control sensors. The right hand, screed tow point can be controlled by using a second electronic slope control, attached to the screed. Generally the mainframe and the screed assembly would both be operating with individual, electronic slope controllers. A major advantage of using the automatic grade controls to control the screed assembly tow points (even though the mainframe is locked to grade already) is due to the influence of varying, asphalt levels (in front of the screed assembly), travel speed, asphalt density and heat. Example: If the Recycling Machine is (fitted with mechanical averaging beams on both sides) slowed for traffic, the screed assembly will tend to sink (less asphalt flow under the screed plates) whereas the mainframe will remain at grade as the rear axle's wheels are tracking a solid, milled asphalt surface. The automatic grade sensors mounted on the screed's tow arms will sink with the screed assembly, however, the mechanical averaging beam's grade remains consistent. As the sensors sink they signal and control the hydraulic oil flow into the tow point's cylinders, raising the tow points, which increases the screed assemblies angle of attack, resulting in a consistent grade. Other recycling machines have manual adjustments on the mills for depth control or have automatic grade controls fitted to the mills with very short skis or pans. The problem with both systems is in following the original, uneven surface grade causes the mills to profile to the original grade, rather than averaging the grade as in the case of the long averaging beams. For example: A utility trench, stretching transversely across the complete width of the asphalt pavement has settled (depression) by 2 inches. The short grade skis or pans attached to the mills will follow in and out of the depression causing the mills to cut to the same profile. This depression will show up in the finished mat as a depression, after final rolling. The long averaging skies, by comparison, would hardly notice the same depression. Finally, if the milled grade is continuously varying (up and down) then the recycling machine's and/or the paving machine's wheels or tracks are following the undulating grade, causing their automatic grade controls to work harder while controlling the screed assembly grade. It is interesting to note that the grade of the asphalt being laid by any screed assembly, if the automatic grade controls are set properly, will remain very consistent, even with an undulating, milled base surface. However, during final compaction of the asphalt by the rollers, the finished mat will follow, to a degree, the profile of the undulating, milled base surface, thereby producing a mat with poor smoothness characteristics.

b. Left and right side averaging skies for the extension mills and the main mill: For secondary roads, city streets and asphalt surfaces where full, mainframe grade averaging is not practicable using long, mechanical averaging beams, the recycling machine is equipped with left and right side skis, or optional, averaging skis. The skis are located ahead of the extension and main mills. The two averaging ski assemblies contact the heated, unprocessed asphalt (original grade) and are manually adjustable in width, allowing setup for various processing widths. The extension mills (left and right side) are hydraulically adjustable in width and crown while the main mill, located behind the extension mills is of fixed width. The left ski automatically controls the grade (depth of cut) of the left extension mill and the left side of the main mill. The right ski controls the grade of the right extension mill and right side of the main mill. The left and right ski assemblies are connected by a jointed, cross beam to which various attachments, used to contact the heated asphalt surface, can be added. In its simplest form, two sliding shoes (the shoes contact the heated surface) are mounted to the cross beam and follow the profile of the asphalt's surface, generally in the wheel ruts created by traffic, as this is generally the smoothest part of the surface on badly rutted asphalt. In its most complex form two sets of shoes (one on either side of the Recycling Machine) are attached to the cross beam by pivoting beams, allowing the transverse surface across the asphalt to be averaged. Left and right extension beams are attached (when space permits) to the jointed, cross beam, allowing the shoes to reference the surface to the left and right of the Recycling Machine. The left side shoe(s) can be replaced by wheels attached to averaging beams, running in line (longitudinally) with the Recycling Machine and on the asphalt surface processed on the previous pass. The wheels are used to prevent marking of the previously finished mat. This allows the mills to profile to the grade of the previously finished surface. Shoes can also be used if wheels are not required. The mill's grade control system can transversely or longitudinally average the asphalt surface, providing far greater accuracy than simple, shorts shoe sensors, mounted directly on to the extension and/or main mill. The left and right side of the grade control cross beam are attached by two pivoting links to the left and right side, sensor control stations that house the hydraulic (electronic are optional) grade control sensors. The left, sensor control station controls the left extension mill and left side of the main mill, while the right, sensor control station controls the right side of the mills. Both the extension mills and main mill are raised and lowered by four (two for the extension mills, two for the main mill) hydraulically operated, sliding struts attached to the machine's mainframe. The sliding struts on the extension mills attached between the Recycling Machine's mainframe and the extension mill's mainframe. The left and right side extension mills are attached to the extension mill's mainframe by hydraulic cylinders, allowing the extension mills to pivot (crown), independently to the extension mill mainframe. The sliding struts for the main mill attach directly to the main mill's mainframe. Attached to each sliding strut is a manually adjustable height screw, which the grade control sensors touch (sense). Each grade control sensor (attached to the sensor control station) monitors the position of the height screws. The following example will explain the operation of grade correction for the right hand side. The Recycling Machine is entering an intersection with a raised section of asphalt pavement. The right hand averaging shoes (in contact with the heated asphalt surface) begins to rise, causing the sensor control station to rise. The two right hand, grade control sensors (attached to the sensor control station), move away from the sliding strut adjuster screws and supplies hydraulic oil to the hydraulic cylinders attached between the mainframe and the sliding struts. The sliding struts are automatically raised, moving the adjuster screws up to match the position of the sensor control station, cutting of the supply of hydraulic oil. The sliding struts/adjuster screws will always follow the position of the sensor control stations. Manual adjustment is provided to allow for fine adjustments to each individual strut to fine tune the milling height between the extensions and the main mill. Manually crowning of the left and right extension mill by the operator is possible without effecting the position of the sliding struts. This is desirable when working in city streets with poor grade, intersections, driveways and irregular curbs and/gutters. With this grade control system with both mills sensing the sensor control stations, any sliding strut can be manually raised or lowered, without effecting the other sensors. The left and right sensor control stations are mounted to the Recycling Machine's mainframe by a parallelogram linkage, which raises and lowers the grade control sensors in absolute alignment with the sliding struts. The sensor control stations are also attached to the mainframe by a hydraulic lift/damper cylinder. The function of the hydraulic lift/damper cylinder is to carry a percentage of the sensor control station, beam and averaging shoe's weight, preventing the shoes from sinking into the hot asphalt. The hydraulic lift/damper cylinder is also responsible for dampening the mechanical action of the grade system by restricting oil flow. The sensor control stations also incorporate flat springs for connection between the jointed, cross beam. The spring deflects if a sudden movement occurs as in the case of the shoes riding up and over a raised utility structure. The spring(s), working together with the hydraulic lift/damper cylinder prevent the sudden movement of the sensor control station(s), which in turn prevents the mills from suddenly raising, leaving a high section in the milled surface. The same applies if the shoes suddenly drop into a transverse depression, the spring deflects and the cylinder dampens. It is important to note that the rear wheels of the Recycling Machine follow the grade set by the main mill assembly.

3. Inconsistent Smoothness and Surface Defects, Caused by Asphalt Handling Problems when Using an Attached Screed Using 100% HIR Machines As mentioned before (when discussing paving machines), producing a quality, asphalt surface that meets all engineering specifications requires considerable skill, knowledge and the proper equipment. Consistency is one of the keys, with the following innovations providing the consistency when 100% recycling with the Enviro-Pave Recycling Machine:

a. Processing should be continuous with no stops. Stopping the screed assembly allows it to settle into the asphalt, causing a depression. Weight transfer from the screed assembly to the Recycling Machine's mainframe has been tried and found to work, however when forward travel was resumed the screed assembly would still tend to sink. Two hydraulic cylinders (attached between the mainframe and screed assembly) are used to raise and lower the screed assembly. When processing, the two hydraulic cylinders are floating (oil can freely flow in and out of both ends of the cylinders). When forward travel must be stopped the cylinder's hydraulic float is cut off and oil is directed into one end of the cylinders (screed raise) at a pressure high enough to transfer weight from the screed assembly to the mainframe. Transferring weight prevents the heavy screed assembly from sinking into the mat. A time delay, controlled by the on-board computer has now been added, allowing the screed time to stabilize with asphalt flow as forward travel is resumed. This delay will be equal to one or more lengths of the screed's main plate.

b. The processing speed should remain as consistent as possible. An increase in speed will cause the screed to rise while a decrease will cause the screed to sink. An optical encoder, mounted to one of the rear axle assembly drive motors will provides the equivalent of cruise control by monitoring the drive wheel's RPM. The on-board computer will control the flow of hydraulic oil in the drive system to maintain a consistent speed. Varying loads on the Recycling Machine will have no effect on the processing speed.

c. The temperature of the asphalt in front of the screed (head) should remain consistent as noted in detail above.

d. The asphalt in front of the screed assembly should remain at a consistent level across the complete width of the screed and screed extensions. An increase in asphalt level will cause to screed to rise while a decrease will cause it to sink. Generally, recycling machines fitted with an attached screed assembly have had problems when the screed assembly carried too much asphalt. This resulted in the screed assembly becoming uncontrollable. It was also common for the screed operator to load the screed assembly with an excessive amount of asphalt as it gave a reserve of asphalt for when the screed's extensions suddenly became low in asphalt due to poor asphalt flow from the auger assembly. Carrying too much asphalt with the screed assembly also allowed the asphalt to stop moving at the screed's extensions, resulting in the asphalt losing temperature and sticking to the screed's face. The cold asphalt caused quality problems in the finished mat, if and when it passed under the screed's extensions.

The following innovations are designed to control the head (amount) and distribution of asphalt across the main screed and screed extensions while reducing material segregation:

A heated (automated heat control and propane burner) and insulated, asphalt surge bin and vertical elevator, located inside the rear end of the Recycling Machine's mainframe, automatically stores and releases hot asphalt to maintain a constant volume (head) of material in front of the screed assembly. The surge bin and vertical elevator are connected to the Recycling Machine's mainframe by two hydraulic cylinders. The surge bin discharges the stored, hot asphalt through two (left and right side), bottom discharging, rotary valves located above and in front of the auger/divider/strike off blade assembly, which is located in front of the screed assembly. The left rotary valve supplies the left auger while the right rotary valve supplies the right auger. An integral, vertical elevator picks up the excess, 100% recycled asphalt (not required by the screed assembly) from the windrow exiting the Recycling Machine's pug mill (mixing chamber) and elevates it up the front face of the elevator into the surge bin, for storage. The Recycling Machine's on-board computer automatically starts and stops the vertical elevator by measuring the pressure in the two hydraulic cylinders and the height of material exiting the pug mill by monitoring the pug mill's volume sensing ski. The hydraulic pressure is proportional to the weight of the asphalt in the bin. The surge bin's holding capacity is sufficient for continuous operation without having to add new asphalt and once full, provides enough stored asphalt for the start-up of the process before the Recycling Machine's windrow is established. Attached to the front side of the vertical elevator is a small hopper/diverter valve that can receive new asphalt from the optional front asphalt hopper/drag conveyor and the central conveyor. The hydraulically operated diverter valve allows new asphalt to be elevated by the vertical elevator into the surge bin for storage, or be discharged on to the windrow as additional material. Projects requiring additional asphalt include, shoulder widening, modification to existing grade or surfaces with a shortage of existing asphalt. Diverting new asphalt to the surge bin allows the bin to be filled at the beginning of the daily shift. Once the bin is initially filled recycled asphalt can be collected from the windrow for the remaining shift. This not only provides new asphalt, but also provides control over the startup procedure. The Recycling Machine's screed assembly is positioned over the asphalt's surface at the start of the new joint (the end of the previous joint). The screed assembly is set on to two starter spacers and the screed's cranks are nulled (neutralized) and set. The front asphalt hopper is filled with hot mix asphalt, delivered by truck from the asphalt plant. The variable speed drag chain conveyor (part of the front hopper) delivers the asphalt to the variable speed, central conveyor. The central conveyor (runs through the center of the machine) moves the asphalt to the hopper/diverter valve, attached to the surge bin's, vertical elevator. Asphalt is diverted to the vertical elevator and the surge bin is automatically filled to the correct level by monitoring the hydraulic pressure in the two surge bin support cylinders. The augers and surge bin's rotary valves are turned on to automatic, on-board computer control. The left and right augers will increase to maximum speed, as no asphalt is available to operate the two augers, electronic level sensors, located at the end of the screed's extensions. The surge bin's bottom discharging, rotary valves (left and right side) are automatically opened by sensing the speed of the individual augers, allowing asphalt to flow to the ends of the screed's extensions and the auger's electronic, level sensors. Once the screed's extensions are full of asphalt, the augers automatically slow down and stop, while the surge bin's rotary valves are automatically closed. As asphalt was flowing out of the surge bin's rotary valves the on-board computer was automatically replenishing the surge bin to a full state. Once full the on-board computer automatically stops the elevator by measuring the surge bin's hydraulic cylinders pressure. The hopper/diverter valve is fitted with an electronic sensor that controls the speed of the central conveyor. When the hopper is full the conveyor is stopped. Once the supply of asphalt to the screed assembly has been meet the Recycling Machine's processing equipment is put into operation and the machine moves forward, preventing the screed from settling. Asphalt is now diverted from the vertical elevator to the asphalt's surface to form a windrow of new material. As the diverter valve opens the electronic sensor detects the drop in the level of asphalt in the hopper/diverter valve and restarts the central conveyor and the front hopper's drag chain. The central conveyor (in this case a belt conveyor) is fitted with an electronic belt scale, used to measure the weight of asphalt being conveyed. The on-board computer is programmed to supply the correct amount of asphalt to form a windrow by monitoring the individual speed of the auger. Gradually, as the pug mill's discharge rate increase (greater volume of asphalt being processed), the on-board computer proportionally reduces the flow of new asphalt by monitoring the individual auger's speed, measuring the volume of material exiting the pug mill's, variable ski (asphalt volume measurement and the amount of weight on the conveyor belt's scale. When 100% HIR recycling is being conducted and new asphalt is not required after the initial startup period, the front hopper, belt conveyor and the hopper/diverter valve can be emptied by discharging and blending the asphalt automatically into the asphalt surge bin. The vertical elevator picks up the 100% recycled asphalt from the windrow while the new asphalt (delivered from the front asphalt hopper) is blended in the vertical elevator, preventing variations in the finished mat's surface texture. Generally the surge bin/vertical elevator are only required for 100% HIR once the process has been established. For asphalt surfaces requiring major grade corrections the front asphalt hopper and central conveyor can be used to automatically supplement and blend new asphalt into the process. In this case the on-board computer monitors the individual auger's speeds, measures the volume of 100% recycled asphalt exiting the pug mill's variable ski, the amount of weight on the conveyor belt's scale and the amount of asphalt stored in the asphalt surge bin/vertical elevator. The on-board computer will maintain the asphalt surge bin's level by scalping asphalt from the windrow, when processing volume is high and supplying new asphalt as processing volume decreases. An electronic temperature sensor monitors the new asphalt's temperature on the central belt conveyor and automatically discharges the conveyor (into the asphalt surge bin/vertical elevator) when the temperature drops to a minimum value. This situation is possible when new asphalt is not required over longer periods of time (the asphalt's grade has improved. The front asphalt hopper's discharge remains shut off as the conveyor discharges. The on-board computer always leaves sufficient space in the asphalt surge bin for the volume of asphalt carried by the conveyor. Temperature sensors also measure the temperature of the asphalt stored in the front asphalt hopper assembly. The asphalt tends to drop at a slower rate as the front hopper has an insulated bottom and sides. Also the asphalt retains heat better when stored in bulk. The Recycling Machine operator is visually warned when the temperature drops to a level requiring action. If new asphalt is not available to supplement the existing asphalt in the front hopper the on-board computer will automatically discharge the hopper by slowly restarting the hopper's discharge and the central belt conveyor, thereby delivering new asphalt to the rear hopper/diverter valve. The asphalt will be diverted to the heated windrow exiting the pug mill. The strike off blade, which is part of the auger/divider assembly, is designed to carry the excess amount of asphalt without effecting the operation of the screed assembly.

The screed auger/divide/strike off blade assembly, located in front of the screed assembly is responsible for conveying the heated asphalt windrow to all areas of the main screed and the screed extensions. The screed extensions (left and right side) are hydraulically extendable and are used to vary the paving width. The screed auger/divider/strike off blade assembly has two, independently controlled augers (left and right side) designed to split the hot, asphalt windrow and distribute asphalt to either end of the main screed and screed extensions. Individual auger speed is automatically controlled by industry standard, proportional, electronic level controls (paddles), located at either end of the screed's extensions. As the asphalt level (head) drops at one or either end of the screed's extensions the paddles signal the on-board computer to increase the auger(s) speed to convey more asphalt. As the asphalt is conveyed from the centrally located windrow the head of asphalt in front of the main/extension screed rises, raising the paddle(s) thereby slowing the auger(s). Generally both augers will be running at a continuous, slow speed, supplying a consistent flow of asphalt across the screed assembly. The screed auger/divider/strike off blade assembly can be hydraulically raised or lowered to adjust for varying depths of asphalt being process by the Recycling Machine. The operation of the screed auger assembly, described above, can be found on any paving machine and works well when laying thick lays of asphalt. It has not proved to be as successful when used with 100% HIR Recycling Machines laying 50 mm or less of recycled asphalt, particularly when working on slopes. Generally there has always been a problem splitting the asphalt windrow with just the screed auger assembly, especially when working on slopes. The high side of the screed extension (crown of the pavement) would generally be starved of asphalt. To overcome the problem the screed auger/divider/strike off blade assembly is fitted with a centrally mounted, hydraulically controlled, mechanical divider, designed to physically split the windrow and feed it into the left or the right auger (the auger requiring the greater amount of asphalt). The angle of the divider is controlled by the on-board computer and uses the left or right auger's speed as a reference. As the auger(s) speed increases beyond a preset speed (level of asphalt dropping in front main screed and/or either screed extension) the on-board computer turns the hydraulic divider, diverting a greater percentage of the asphalt windrow into the auger requiring asphalt (the auger with the greatest speed). The position of the divider is electronically monitored, allowing the divider to turn proportionally to the individual auger's speed. If both augers are rotating at the same speed the divider remains in the straight-ahead position. If the on-board computer determines that any auger's speed is still increasing (divided windrow is not providing enough asphalt to the speeding auger) the rotary discharge valve of the asphalt surge bin, located above the speeding auger is automatically opened, providing additional, heated asphalt. The additional asphalt continues to flow from the asphalt surge bin until the auger slows to a predetermined speed, where upon the rotary discharge valve is automatically closed. If the on-board computer determines that the speed of both augers are too high (lack of asphalt in the windrow and at the screed assembly) both of the asphalt surge bin's rotary valves are opened, thereby providing additional heated asphalt to both augers. The operation and control of the screed auger/divider/strike off blade assembly and the asphalt surge bin are designed to handle the heated asphalt in a slow and gentle manner so as to reduce segregation, heat loss and emissions. The asphalt surge bin automatically refills from the windrow when the volume of asphalt exceeds the volume required by the screed assembly, typically when milling through a high area of asphalt pavement. Attached to the front of the auger/divider is the manually adjustable strike off blades (left and right side). The blades functions as tunnels for the augers allowing asphalt to be conveyed more efficiently, without causing segregation. The strike of blades also limits the amount of asphalt that can physically reach the left and right side augers flights and also the screed assemblies front face. The two, strike off blades are adjustable in height and taper with the height of blades becoming greater towards the end of the augers, allowing more asphalt to flow under the blades towards the end of the augers. If a sudden surge of asphalt (highly unlikely due to the electronic control, larger asphalt surge bin and high capacity, vertical elevator) does occur when milling through a high section of asphalt, the auger/divider/strike off blade will carry the extra head of asphalt.

4. Inconsistent Ratio of New Asphalt to 100% Recycled Asphalt when Using the Remix Method.

The general procedure used by other HIR recycling machines to introduce a percentage of new asphalt into the recycled asphalt (Remix) is to monitor the forward speed of the recycling machine. This procedure is not that desirable due to the fact that the volume of asphalt being recycled at any given time is constantly changing due to uneven surface grade and varying processing width, on variable width machines. The other problem is where the new asphalt is delivered for mixing with the recycled asphalt. which often results in the asphalt being dropped in front of the recycling machine's heating system. The problem with this approach is that the new asphalt is subjected to unnecessary heat, which rapidly deteriorates the new asphalt.

The following innovations allow the present invention to provide a true ratio between the 100% recycled and new asphalt without degrading the new asphalt.

The present invention is equipped with a front asphalt hopper/variable speed chain slat conveyor, truck pusher bar, variable speed central belt conveyor and electronic belt scale, conveyor hopper/diverter valve, surge bin/vertical elevator, auger/divider/strike off blade and screed assembly. The Remix process starts by using the same method as the 100% HIR process. The Recycling Machine's screed assembly is positioned over the asphalt's surface at the start of the new joint (the end of the previous joint). The screed assembly is set on to two starter spacers and the screed's cranks are nulled (neutralized) and set. The front asphalt hopper is filled with hot mix asphalt, delivered by truck from the asphalt plant. The variable speed drag chain conveyor (part of the front hopper) delivers the asphalt to the variable speed, central conveyor. The central conveyor (runs through the center of the machine) moves the asphalt to the hopper/diverter valve, attached to the surge bin's, vertical elevator. Asphalt is diverted to the vertical elevator and the surge bin is automatically filled to the correct level by monitoring the hydraulic pressure in the two surge bin support cylinders. The augers and surge bin's rotary valves are turned on to automatic, on-board computer control. The left and right augers will increase to maximum speed, as no asphalt is available to operate the two augers, electronic level sensors, located at the end of the screed's extensions. The surge bin's bottom discharging, rotary valves (left and right side) are automatically opened by sensing the speed of the individual augers, allowing asphalt to flow to the ends of the screed's extensions and the auger's electronic, level sensors. Once the screed's extensions are full of asphalt, the augers automatically slow down and stop, while the surge bin's rotary valves are automatically closed. As asphalt was flowing out of the surge bin's rotary valves the on-board computer was automatically replenishing the surge bin to a full state. Once full the on-board computer automatically stops the elevator by measuring the surge bin's hydraulic cylinders pressure. The hopper/diverter valve is fitted with an electronic sensor that controls the speed of the central conveyor. When the hopper is full the conveyor is stopped. Once the supply of asphalt to the screed assembly has been meet the Recycling Machine's processing equipment is put into operation and the machine moves forward, preventing the screed from settling. Asphalt is now diverted from the vertical elevator to the asphalt's surface to form a windrow of new material. As the diverter valve opens the electronic sensor detects the drop in the level of asphalt in the hopper/diverter valve and restarts the central conveyor and the front hopper's drag chain. The central conveyor (in this case a belt conveyor) is fitted with an electronic belt scale, used to measure the weight of asphalt being conveyed. The on-board computer is programmed to supply the correct amount of asphalt to form a windrow by monitoring the individual speed of the auger. Gradually, as the pug mill's discharge rate increases (greater volume of asphalt being processed), the on-board computer proportionally reduces the flow of new asphalt by monitoring the individual auger's speed, measuring the volume of material exiting the pug mill's variable ski (asphalt volume measurement and the amount of weight on the conveyor belt's scale).

Once the windrow has been established by monitoring the flow of asphalt through the pug mill, the on-board computer automatically switches to its Remix program. The surge bin/vertical elevator is used to scalp off a percentage of 100%, recycled asphalt in the windrow. An adjustable (proportional) electronic sensor is used to set and control the scalping depth of the vertical elevator, allowing the elevator to follow the varying windrow's height. The belt conveyor and the front hopper's drag chain start supplying new asphalt to the hopper/diverter valve, allowing the two asphalt flows to blend together in the vertical elevator's slats. The central belt conveyor is fitted with an electronic belt scale, used to measure the weight of asphalt being conveyed. The on-board computer is programmed to calculate and control the correct amount of new asphalt being blended into the 100% recycled asphalt (10% to 15%). This is accomplished by measuring the volume of material exiting the pug mill's variable ski (material volume measurement and the amount of weight on the conveyor's belt scale. The variable speed, drag chain in the front hopper and the variable speed central, belt conveyor supplies the correct amount of new asphalt. The belt conveyor is designed to operate at a higher speed than the hopper drag chain, preventing spillage at the drag chain's discharge point on to the belt conveyor. The two conveyors are fitted with optical encoders to monitor the speed of both units, allowing the on-board computer to monitor and control the speed ratio between the two conveyors. As the amount of new asphalt increases or decreases, based upon the volume of asphalt being recycled the vertical elevators speed is proportional changed to pick up more or less recycled asphalt. This is possible as the inlet to the vertical elevator is always flooded (built up) with asphalt. The blend of recycled and new asphalt is delivered to the heated and insulated surge bin. The on-board computer, monitoring the weight of the bin will always try and maintain the bin at 50% of its capacity. This is achieved by automatically controlling the discharge flow from the surge bin's two, rotary valves, by monitoring the individual screed auger's speed (auger/divider/strike off blade assembly). The auger with the highest speed will receive proportional, more asphalt. By blending the new asphalt with a proportion of the 100% recycled asphalt (picked up from the windrow) in the surge bin/vertical elevator provides a little more mixing than would otherwise be possible if the hopper/diverter valve dumped asphalt directly on to the windrow. If the extra blending (mixing) is found not to be required then the asphalt can be diverted and dropped on to the 100% recycled asphalt's windrow. It should be noted that the augers do mix the asphalt as it is moved across the front face of the screed assembly. One might ask why not introduce the new asphalt onto the mills or the pug mill. Pre-engineering, using core samples, taken at regular intervals, determine how much rejuvenator fluid and/or polymer liquid must be added by the Recycling Machine and how much washed aggregate the final Preheater must add. Adding new asphalt would complicate the testing procedure.

5. Inability to Process Asphalt Around Utility Structures and Obstructions.

Utility structures and other obstructions have until now presented one of the greatest challenges to the HIR of asphalt, especially in city work. An example would be a utility structure located in the center of the lane being processed. To prevent damage to the Recycling Machine's carbide milling teeth (main and extension mills) and to the iron utility structure(s) located in the asphalt's surface, the mill(s) are lifted, leaving an unprocessed section of asphalt across the width of the lane. When dealing with utility structures and obstructions the following methods are typically used:

a. Ignore the problem. Raise the scarification and/or mill systems and let the screed assembly place recycled asphalt on top of the old asphalt. The result is a width of asphalt up to 1 m (3 ft.) or more in length (in the direction of travel) that has not been recycled (rejuvenated) to pre-engineered specifications. The section will not be compacted to the same degree as the recycled asphalt by the rolling equipment, thus leaving a bump in the mat (asphalt surface) of old asphalt b. Raise the scarification and/or mill systems and use hand tools (rakes and shovels) to loosen the old asphalt. This is almost impossible without stopping the recycling machine and is dangerous to workers, as they must reach into the processing area of the machine. Recycling machines that have scarification systems that float over and around obstructions have been somewhat successful as the asphalt is loose enough to hand move (where possible) without stopping the Recycling Machine. The asphalt remaining on the heated surface mixes with the recycled asphalt, collected and stored in front of the screed assembly. The asphalt picked up by hand shovel is generally, thrown back into the mills for processing.

c. Before 100% HIR of the asphalt surface the area around the obstruction(s) is cold milled with a small milling machine. The milled asphalt is collected and removed and the surface is swept if processing is to be conducted at a later date. This works well, except that a reduction in the volume of material available for recycling occurs, resulting in new asphalt having to be added or a change in profile/grade at the time of recycling. Filling the cold milled sections with new virgin asphalt and compacting before recycling works well, but presents compaction problems (bump in surface) and in some cases, changes to the finished mat's surface texture. The major objection to this approach is the added cost, traffic delays and possible driving hazard due to the open, milled sections, if not paved immediately.

d. Recycling machines that produce a windrow of asphalt (screed assembly removed) for pickup by a windrow conveyor, attached to a standard paving machine have a greater opportunity to work around utility structures and obstructions. To date hand-tools, powered machines and even a hydraulic arm fitted with a blade, mounted to the windrow conveyor, scrape and collect the unprocessed asphalt. The hydraulic arm requires the windrow conveyor/paving machine to stop, marking the finished mat (the screed sinks into the asphalt surface due to it's own weight, vibration from the windrow conveyor and the operation of the hydraulic arm). Other problems exist when using a separate windrow conveyor and paving machine, i.e. increased costs, reduced asphalt temperature, increased segregation, increased pollution and increased equipment train length. In addition, the proper mixing of the old asphalt (asphalt scraped from the heated surface) does not take place as the old asphalt is generally placed on to the open windrow, throwing off the quality of the recycled asphalt contained within the windrow. Safety is another issue when processing with an open windrow. It is quit common for automobiles to try and cross the heated windrow only to become stuck in 250 to 300+ Deg F. asphalt. Animals have seriously burnt their feet, as have humans with open footwear! Recycling machines with an attached screed do not suffer from the above problems, as there is no open windrow.

The present invention scarifies and cleans around utility structures and obstructions without stopping the HIR Recycling Machine, allowing the scarified asphalt to be collected and properly mixed with additives:

The rake scarification/blade collection system fitted to the final Preheater (Preheater ahead of the Recycling Machine) and the Recycling Machine are identical. The blades are attached to the four, main rake, pivoting bodies, located behind the spring loaded, carbide cutters attached to the same bodies. When approaching a utility structure or obstruction (Preheater followed by the Recycling Machine) the Preheater's operator tilts the required, individual rake bodies, leaving the carbide cutters in the heated asphalt while at the same time lowering the trailing blades. Hydraulic force pushes the blades into the scarified surface 50 mm (2") or more, scraping and collecting the heated asphalt. Once past the utility structure/obstruction, the blades are raised at a controlled rate (rate is adjustable and once set is automatic), releasing the collected asphalt in a 50 to 75 mm (2 to 3") layer. Raising the blades does not effect the operation of the carbide cutters. Hand tools or a small two-wheel drive machine with adjustable blade, similar to a walk behind rotovator (without the rotor) are used (if required) for the final cleanup with the asphalt being spread on to the heated, scarified surface ahead or behind the area being scraped and cleaned. Plenty of space and time exists for this process as the Recycling Machine is generally trailing the Preheater by up to 9 to 12 m (30 to 40 ft.). The Recycling Machine's rake blades are available if further cleaning is required when approaching the same utility structure/obstruction using the same procedure as used by the Preheater. Raising the main mill on the Recycling Machine for utility structures/obstructions will automatically stop the flow of rejuvenator fluid to the main mill and the pug mill, preventing the fluid from reaching the milled, base surface, thereby eliminating eventual bleeding of the finished, compacted surface. When the main mill is manually raised for utility structures/obstructions, the on-board computer calculates and stores in it's memory the amount of rejuvenator fluid that would have been sprayed into the asphalt being recycled, if the main mill had not been raised. When the main mill is lowered (taken off manual control) into the heated surface (controlled again by the automatic grade/slope controls) it collects and feeds the asphalt into the pug mill for final mixing. Lowering of the main mill allows the rejuvenator fluid flow to commence. The stored (memory) amount of rejuvenator fluid, together with the required processing amount of fluid (determined by the pug mill) results in increased fluid flow required for the increased volume of asphalt at that particular section (rake scarified asphalt covered with a layer of asphalt collected by the rake blades). The ratio of rejuvenator fluid to asphalt being recycled remains consistent.

Blades are not required on the extension rakes as the extension mills are fully adjustable (raise/lower, in/out and tilt up/down) and can be used to cut and clean around most utility structures/obstructions in their path. The extension mills are fitted with a cutter blade at each outer end, providing cleaning to the edge of utility structures/obstructions and curbs and gutters. Final cleaning on each side of the Recycling Machine is easily accomplished with hand tools, even while moving.

The above, innovations allows any processing work required around utility structures and obstructions to be accomplished before the Recycling Machine recycles the old asphalt, rather than after recycling and result in the following advantages:

The old asphalt that has been moved from around utility structures, obstructions and sections across the asphalt's surface (where the mills can not be used) remains on the surface for 100% processing by the Recycling Machine.

The complete width of the asphalt can be checked and worked upon. This is not the case after the Recycling Machine has processed the asphalt as the wide (approximately 36") windrow covers the center section of the width.

6. Inaccurate and Inconsistent Application of Liquid Additives.

While other 100% HIR equipment have systems designed to monitor and control the application of rejuvenator fluid into the reworked (recycled) asphalt, none appears to have the ability to monitor and control the application of liquid polymers together with rejuvenating fluid. Generally, recycling machines control the rejuvenator's application rate by monitoring the machines processing speed (distance traveled). Distance traveled, by itself, produces inaccurate and inconsistent results as the volume of asphalt being processed changes constantly as density, depth of cut, pavement profile and width of cut (machines with variable width heating, scarification and milling systems) all vary.

The problem is solved by a liquid distribution system using two or more positive displacement, diaphragm pumps. The pumps accurately meter light (unheated) and heavy (heated) rejuvenator fluids and liquid polymers. Ground speed sensing (distance traveled) and application rate (manually input into the on-board computer using pre-engineered data) together with asphalt volume sensing and temperature correction factors, provide accurate and consistent results, which are verifiable through laboratory testing.

7. Inaccurate and Inconsistent Application of the Aggregate.

The present invention and methods often uses a plurality of Preheaters. Often three or more Preheaters are used, operating ahead of the AR Recycling Machine to soften the asphalt surface to a depth of 50 mm (2") or more. The final Preheater is fitted with a rake/blade scarification/collection system and aggregate distribution system.

In prior processes, the machine's processing speed (distance traveled) is generally used to control the aggregate's distribution rate. Distance traveled, by itself, provides inaccurate and inconsistent application rates as the volume of aggregate being spread must be constantly changed as the volume of asphalt pavement being recycled constantly changes due to variations in processing depth (profile) and width.

The problem is solved by the present invention through the spreading washed aggregate (sand, small stone, steel mill slag etc.) directly on to the heated asphalt surface by an aggregate distribution bin (controlled and monitored by the on-board computer) attached to the final Preheater. Ground speed sensing and application rate (manual input into the on-board computer using pre-engineered data), together with proprietary width measurement (width of asphalt being processed) and asphalt surface profile sensing, provide accurate and consistent results, which are verifiable, through laboratory testing.

8. Improper Mixing of Rejuvenator Fluid, Washed Aggregate and Reworked (Recycled) Asphalt:

The amount of time available for mixing has until now, been inadequate to produce a homogeneous mix. To date the mixing of rejuvenator fluid and aggregates into the reworked asphalt is generally accomplished by one of the following methods:

a. The heated, milled asphalt is removed from the surface and conveyed to a pug mill on-board the recycling machine where mixing (rejuvenator fluid and aggregate) takes place as a continuous or batch process. The pug mill discharges the asphalt into the front hopper of a standard paving machine (attached to the recycling machine) or in front of the recycling machine's screed assembly for final placement and compaction. Aggregate segregation, loss of heat and emissions are all increased.

b. The recycling machine mills and collects the heated asphalt and aggregate (if added) while leaving it on the heated surface. The collected, milled asphalt/aggregate passes into an in-line pug mill or mixing auger. The pug mill or mixing auger discharge is generally unrestricted, resulting in reduced retention (less mixing) of the recycled asphalt and additives and increased segregation caused by the larger aggregate (stone) rolling down the windrow's sides.

c. Scarification systems (no mills, pug mill or other mixing devices) use cutters to penetrate into the heated asphalt's surface while aggregate and rejuvenator fluids are spread directly on to the heated asphalt. The only mixing that takes place is by the action of the cutters and to some degree, the action of the screed's distribution auger. Limited and inconsistent mixing result, as the scarified asphalt and additives are not collected and mixing by any mechanical apparatus.

The crown and curb (left and right) side, recycled asphalt, are not completely mixed together to form a homogeneous mix (only applies to processes where the asphalt is not removed from the surface). Dirty, curbside recycled asphalt will show up in the finished mat (asphalt behind the screed assembly) on the curbside section as discolored asphalt (dull, as the dirt/dust absorbs more of the asphalt's liquid). Sweeping the asphalt surface reduces the buildup of dirt and dust, but cannot remove it completely from the cracked or porous asphalt.

The fine aggregates contained in and added to the recycled asphalt remain behind the mill(s), mixing auger or pug mill (if fitted) as a fine layer on the milled surface. To obtain a homogenous mix, all of the reworked asphalt and additives require collection for mechanical mixing.

The following innovations found in the present invention increase the mixing and/or mixing time in the HIR Recycling Machine:

a. Three or more Preheaters, operating ahead of the HIR Recycling Machine softening the asphalt surface to a depth of 50 mm (2") or more. The final Preheater is fitted with a rake/blade scarification/collection system and aggregate distribution system. The rake/blade system is the first of the processing equipment to break the heated asphalt's surface, releasing moisture (steam) and loosening the heated asphalt. The rake's carbide cutters form grooves 50 to 75 mm (2–3") or more into which the washed aggregate (sand, small stone, steel mill slag etc.) falls. Spreading the damp aggregate on to a heated surface in a thin, ribbed layer not only allows any moisture to evaporate quickly, it also promotes greater mixing by the Recycling Machine's rakes, mills and pug mill. The deposited aggregate starts to absorb liquid asphalt from the heated asphalt (asphalt to be recycled) before being processed by the heating, milling and mixing stages.

b. The Recycling Machine's heating system (heater box) features flexible, stainless steel mesh skirts around the parameter of the heater box to retain heat. The skirts are also designed to touch (drag) the heated asphalt's surface. The front skirt spreads the aggregate (applied by the final Preheater) into a thin layer. The Recycling Machine's heater box gently applies additional heat to the spread aggregate and asphalt surface, thereby removing any remaining, trapped moisture. Excess moisture in any part of the mixing process will prevent the proper coating and adhesion of existing asphalt binders, additional rejuvenator fluid and polymer liquid to the aggregates contained in or mixed into the recycled asphalt. The rake/blade system attached to the Recycling Machine further mixes the added aggregate and heated asphalt before the milling/mixing stages.

c. The Recycling Machine's extension mill and main mill rotors (rotating carbide cutters) all feature shallow flighting designed to reduce the rotors material conveying efficiency. Attached to backside of the flighting are replaceable carbide cutting teeth and holders. The shallow flighting, together with the carbide cutters (rotating in a down-cut direction), causes the heated/milled asphalt to build up in front of the rotors rather than immediately being conveyed away. Rejuvenator fluid added at the main mill's rotor and aggregates distributed on to the heated asphalt surface, ahead of the 100% HIR Recycling Machine (by final Preheater) are continuously mixed by the main mill's carbide teeth. The main mill's material discharge is offset to one end of the rotor. The rotor provides premixing of the old (recycled) asphalt, rejuvenating fluid and aggregate before discharging into the offset front rotor of the pug mill.

d. The offset front rotor of the pug mill (receives material from the main mill's offset discharge) is equipped with carbide-faced paddles (two per arm) arranged in a spaced, spiral pattern. The spaced, spiral pattern reduces material conveying efficiency, increases dwell time and the mixing action of the recycled asphalt and additives. The spiral section of the pug mill's offset front rotor feeds the recycled asphalt and additives into the pug mill's mixing chamber. The offset front rotor is also equipped with carbide faced, paddles (two and four per arm), arranged in an alternating left and right hand pattern (located in the mixing chamber). The spiral section and the alternating paddle section of the offset front rotor receive rejuvenator fluid and if required, polymer additive. The recycling Machine's on-board computer automatically controls (stages) the application of rejuvenator fluid and liquid polymer. The main mill is the first to receive rejuvenator fluid followed by the pug mill's front rotor (spiral section) and finally the alternating paddle section of the pug mill's front rotor. Liquid polymer is only sprayed into the pug mill when rejuvenator fluid flow is established in the main mill and/or the pug mill. Staging the rejuvenator fluid's application to the processed asphalt's flow through the mills and pug mill provides increased mixing time, greater coverage and less chance of the fluid additives coming into contact with the milled, base surface. The pug mill's offset front rotor completely mixes the left and right (crown and curb) side asphalt while the pug mill's rear rotor completes the final mixing and discharge of the asphalt into a formed windrow. The pug mill's rear rotor (discharge rotor) diameter is greater than the front rotor and is equipped with carbide-faced paddles (two and four per arm) arranged in an alternating left/right hand pattern. The front and rear rotors do not intermesh, allowing the rotor speeds to be set individually for varying, asphalt specifications. Both design features increase the throughput of recycled asphalt and promote increased mixing/tumbling and moisture (steam) release.

e. An adjustable trip blade is located between the pug mill's front and rear rotor assemblies. The trip blade is the full width of the mixing chamber. The trip blade scrapes the milled, base surface, lifting any asphalt and additives missed by the front rotor assemblies paddles (the rotor paddles do not make contact with the milled base). As paddle tip wear increases the amount of asphalt missed would increase, reducing the mixing efficiency of the pug mill. Rejuvenator fluid (polymer additives were not tried) could not be sprayed into the prototype pug mill as the fluid would come into direct contact with the milled base surface in the mixing chamber and would not be collected and mixed by the rotor assemblies paddles. Bleeding of the finished mat (the width of the pug mill mixing chamber) resulted when using rejuvenator fluid. The trip blade improves mixing and allows rejuvenator fluid and polymer liquid to be sprayed directly into the pug mill's front rotor assembly. Competitive recycling machines fitted with a mixing auger or standard pug mill do not scrape the base surface in the mixing chamber or in the case of a mixing auger, the discharge section. The result is incomplete mixing, especially as rotating components wear. An external, single screw adjuster sets the trip blade's height. A hydraulic cylinder connects the trip blade to the screw adjuster. The hydraulic cylinder allows the trip blade to rotate if contact with a utility structure occurs, preventing damage to the trip blade and utility structure. The trip blade resets automatically.

f. The asphalt being discharged out of the pug mill is restricted through a variable (mechanical) opening (parallelogram ski) located behind the pug mill's rear rotor assembly. The ski is hydraulically adjustable for pre-load (vertical pressure exerted on to the asphalt windrow) and provides light compaction to the windrow and resistance to asphalt flow through the pug mill. The ski also measures the volume of asphalt exiting the pug mill and generates a proportional electronic signal used in calculating the required amount of rejuvenator fluid and polymer liquid to be added to the reworked (recycled) asphalt. Other recycling machines do not restrict the asphalt's flow to improve mixing or compact the windrow to reduce segregation.

g. Discharge from the pug mill's rear rotor is to the centerline of the Recycling Machine. Testing has shown that central discharging mills (not offset), even when used with an efficient in line pug mill or mixing auger (mixing on the milled surface) will not achieve complete crown and curbside mixing of the asphalt/additives into a homogeneous mix. The offset main mill's rotor assembly together with the pug mill's offset front rotor and rear rotor assemblies, completely mix the crown and curbside asphalt into a homogeneous mix.

h. Spring loaded (floating) blades located behind the extension mills, main mill and pug mill collect the fine aggregates and fluid additives by scraping the milled surface. The blades (replaceable) are adjustable in height to compensate for blade wear and carbide rotor teeth (replaceable) wear. The springs keep the blades forced down on to the milled surface and also provide protection against damage to iron utility structures by allowing the blades to ride up and over the utility structure. Scraping the milled, asphalt surface collects the finer aggregates and liquid additives, thereby producing a consistent and homogeneous asphalt mix. Other recycling machines generally use fixed blades or no blades, resulting in a remaining layer of fine aggregates and liquid additives on the milled surface. Liquid additives remaining in direct contact with the milled surface produce bleeding of the finished mat (streaks).

9. Inability to Remove Moisture from Reworked Asphalt:

Moisture removal in prior systems is limited due to inadequate heat penetration, insufficient mechanical mixing and the lack of moisture extraction systems. The positive removal of moisture (steam) at the mills and pug mill or mixing auger is generally, not used.

Moisture removal in the present invention may be done in four stages:

a. Three or more Preheaters, operating ahead of the Recycling Machine softening the asphalt surface to a depth of 50 mm (2") or more. The final Preheater is fitted with a rake/blade scarification/collection system. The rake/blade system is the first of the processing equipment to break the heated, asphalt surface, releasing moisture (steam) and loosening the asphalt without damaging the asphalt's larger aggregate. The rake's carbide cutters are hydraulically adjustable for down force (pressure compensated), are spring-loaded and mounted on pivoting frames, allowing the cutters to follow varying pavement profiles and scarify around iron utility structures. Penetration into the heated asphalt is generally deeper than the Recycling Machine's main and extension mill profiling depth. The Preheater's rake/blade carbide cutters loosen the asphalt, allowing the trapped moisture (steam) to release before further scarification, milling and mixing by the Recycling Machine's rakes, mills and pug mill.

b. The Recycling Machine's electronically controlled and monitored heating system produces convection and infrared heating and is used to drive off any remaining moisture in the added aggregate (damp, washed sand, deposited on to the heated asphalt by the final Preheater's aggregate distribution system). The Recycling Machine's rakes/blades are identical in design and operation to the Preheater's rakes/blades and produce further mixing of the aggregate into the heated asphalt. The rakes also cut deeper into the loosened asphalt, releasing more moisture in the form of steam.

c. Automatic grade/slope sensors control the depth of cut of the extension and the main mills. The mills mill and tumble the loosened, heated asphalt, mixing additives and releasing steam. A venturi (using the heater box blower air supply to create a negative air pressure) draws steam through the main mill's enclosed support frame, venting it to the top of the Recycling Machine.

d. The offset pug mill is fitted with a moisture extraction system. A venturi (as above) creates a negative air pressure in the pug mill's mixing chamber. The pug mill's front and rear rotors tumble and mix the restricted asphalt enclosed in the mixing chamber. The air extraction system reduces the moisture level in the reworked (recycled) asphalt by drawing off and venting the released steam to the top of the Recycling Machine.

10. Inconsistent Depth Differential Between the 100% Recycled Asphalt and the New Asphalt when Using the Integral Overlay Method.

Integral Overlay recycling machines have been around for many years. They are popular with contractors as the new asphalt can be used to hide the poorly recycled asphalt below and still produce a very good looking, new surface that generally stands up well over time. It is possible to hide all sorts of imperfections, as it is difficult to sometimes see the recycled surface as the secondary screed assembly is laying new material directly on to it. However, in prior systems and processes, three major problems are generally encountered:

a. The quality of heat produced by the preheaters and the recycling machine are incapable of producing a deep penetrating heat, without setting the asphalt's surface on fire.

b. The recycled asphalt could not be processed using pre-engineering specifications as the machine was manually operated with no on-board computers to monitor and control the recycling process.

c. The depth differential between the recycled asphalt and the new asphalt was inconsistent.

The following innovations of the present invention allow the Recycling Machine with Integral Overlay to 100% recycle existing asphalt while laying a high quality, new asphalt surface to grade, while meeting the smoothness tests.

The Recycling machine is equipped with the same, two grade control systems, as described earlier on.

The front asphalt hopper and central belt conveyor are the same as for 100% HIR method, except that a short, shuttle conveyor is used to supply new asphalt to the rear, secondary auger and screed assemblies. The level of asphalt in the secondary auger and screed assembly controls the asphalt's flow from the front hopper and central belt conveyor assemblies. A proportional, electronic sensor (located in the feed chute used to supply asphalt to the secondary auger) signals the on-board computer to speed up the front asphalt hopper's and central belt conveyor's discharge rate. The position of the shuttle conveyor can be manually, or, automatically controlled by the on-board computer allowing new asphalt (delivered by the central conveyor) to spill into the primary auger/divider/strike off blade assembly when insufficient recycled asphalt is available to maintain the correct head of asphalt in front of the primary screed assembly. The design of the shuttle conveyor allows new asphalt to be delivered to both the primary and secondary auger and screed assemblies at the same time.

The primary auger/divider/strike off blade is identical in operation and control, as described earlier on.

The primary and secondary screeds are attached to the Recycling Machine's mainframe by screed arms attached to a left and right side adjustable tow points in the same manner as described earlier. The only difference being the length of the screed arms used on the primary and secondary screeds.

The major difference is in the control of the primary and secondary screed's grade and slope control system. Both the primary and secondary screed arms are attached to the same tow point (one on either side of the machine,) which can either be pinned into position, or controlled by the automatic grade control system, as described earlier.

Topcon's Smoothtrack® 4 Sonic Tracker II™ averaging beams and electronic slope sensor are again used, as described earlier, however the averaging beams and electronic slope control are only attached to the secondary screed's (rear screed) screed arms. The secondary screed assembly is allowed to float and features the same weight transfer system, as described earlier. The primary screed assembly requires no grade, or slope controls and is also allowed to float, but not to the same degree as the secondary screed assembly. The primary screed assembly senses the position of the secondary screed assembly through two, proportional, electronic or hydraulic sensors. The sensors are attached to the left and right side of the secondary screed's tow arms and sense the position of the left and right side of the primary screed's tow arms. The height of the sensor plates can be adjusted to set the height differential between the primary and the secondary screed assemblies, which is generally ½" to 1½". The two screed sensors send information to the on-board computer, which in turn, operates two hydraulic, 4 way proportional, directional control valves. The secondary screed assembly is the master while the primary is the slave and tries to match every move made by the secondary screed assembly (master). To accomplish this the primary screed assembly is attached to the Recycling Machine's mainframe by two identical, hydraulic cylinders, used to attach the secondary screed to the mainframe. The four hydraulic cylinder's prime function is to raise and lower both screed assemblies. The secondary screed assembly cylinders are allowed to float (move up and down freely) as all of the cylinder's hydraulic ports are connected to tank (return) when laying asphalt. The primary screed assembly cylinders are also allowed to float; however the hydraulic cylinder's ports are connected to tank through flow control valves. The system works in the following manner: At the start of the recycling operation the Recycling Machine is backed up to the previously finished joint that has been preheated. The secondary screed assembly is lowered on to starting blocks and the screed cranks are nulled out (neutralized) and set. The primary screed assembly is lowered on to the asphalt's surface and the screed cranks are nulled out and then given one turn up, to slightly raise the front of the screed's plates. This setting will allow the screed assembly to automatically rise when asphalt builds up in front of the screed. The machine operator places the Recycling Machine into automatic mode, allowing the on-board computer to monitor and control all of the automatically programmed operations. Asphalt is delivered from the front asphalt hopper, by the central conveyor to the shuttle conveyor. The shuttle conveyor supplies asphalt to the secondary screed augers. The augers feed the asphalt out to the ends of the secondary screed's extensions until the electronic asphalt sensors, attached to the screed extension's end plates stop the augers (the asphalt is at the correct level). Once the secondary auger and screed assemblies have been fully supplied with new asphalt the on-board computer moves the shuttle conveyor allowing new asphalt to spill into the primary auger/divider/strike off blade assembly. New asphalt will be delivered until the electronic asphalt sensors, attached to the primary screed extension's end plates stop the augers (the asphalt is at the correct level). At this position the secondary screed assembly is at a higher position than the primary screed assembly. The secondary screed's tow arm sensors are signaling the on-board computer to power the two proportional, directional control valves that send hydraulic oil to the primary screed's two hydraulic cylinders. The primary screed assembly is trying to be raised by hydraulic pressure, however this is not possible, as the hydraulic pressure is set at a low pressure, preventing the screed assembly from being raised. The operator then puts the processing equipment (scarification rakes, mills, pug mill, rejuvenator and heating system) into operation and moves the Recycling Machine briskly away, preventing the secondary screed from settling into the new asphalt while the primary screed assembly rises due to the asphalt in front of the screed assembly and also the limited hydraulic pressure trying to lift the screed. The front asphalt hopper will automatically provide new asphalt, on demand, to the primary and secondary screed assemblies. As the Recycling Machine starts to 100% recycle and rejuvenate the heated asphalt, as discussed previously, the primary auger/divider/strike-off plate begins to split and convey the windrow of 100% recycled asphalt, out to the primary screed's extensions. As the primary screed was rising, hydraulic oil was being forced out of the partially restricted cylinders through the cylinder's head end ports and flow control valves. The oil being supplied from the proportional valves (variable flow controlled by the sensor's outputs) to the rod end of the cylinders is also flowing through the rod end, flow control valves. The greater the flow of hydraulic oil from the proportional valves, the greater the differential in pressure across the flow control, valves. The screed sensors will eventually turn off the proportional valves when the primary screed assembly reaches the set point (differential height). The control of the system is to slowly change the forces working on the primary screed assembly, keeping it at the set, height differential. The sensors only respond when the primary screed tries to move away from the set differential. An example would be when the head of asphalt in front of the primary screed increases as the Recycling Machine mills through a high section. The primary auger/divider/strike off blade would hold back and control most of the mass, however there will be more asphalt reaching the screed (due to the pressure of the buildup), which will causes the screed to rise. When the reverse happens (lack of material), the screed will sink. As noted before the hydraulic pressure is too low to keep the screed raised and at the correct level. This is not a problem, as the secondary screed will continue to set the correct grade by laying a greater amount of new asphalt. This condition will rarely occur as the on-board computer monitors the primary auger/divider/strike off blade's individual auger's speeds and allows the shuttle conveyor to spill extra, new asphalt into the augers, maintaining the head of asphalt in front of the primary screed assembly. When using the Integral Overlay process, the primary screed assembly should be prevented from exceeding the height of the secondary screed. If this were allowed to happen, the 100% recycled asphalt would replace the new asphalt. To prevent the primary screed assembly from getting into this position the hydraulic pressure used for down force on the primary screed's hydraulic cylinders is set to a higher pressure than the pressure used to raise the screed assembly. This is possible as the Recycling Machine is heavy and will not by lifted by the pressure in the primary screed's hydraulic cylinders.

BRIEF DESCRIPTION OF THE DRAWINGS

These and other features, objects and advantages of the present invention will become apparent from the following description and drawings wherein like reference numerals represent like elements in several views, and in which.

"DETAILED DESCRIPTION OF THE PREFERRED EMBODIMENTS"

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
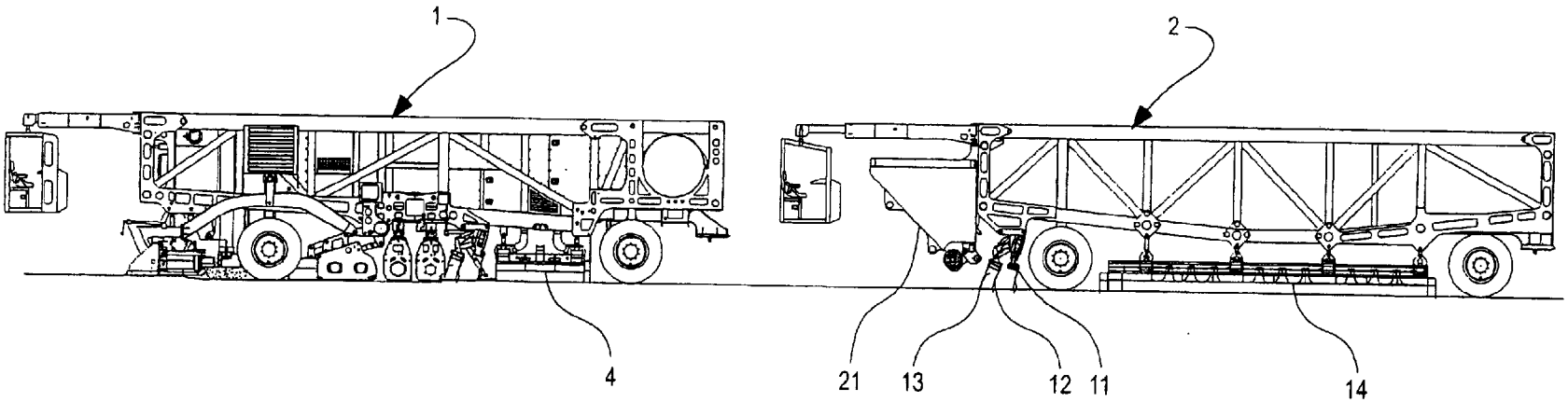
FIG. 1 a side view of the 100% HIR Recycling Machine and Preheater in the working mode FIG. 2 a side view of the 100% HIR Recycling Machine showing major sub-assemblies FIG. 3 a side view of the Preheater showing major sub-assemblies FIG. 4 a plan and end view of the Recycling Machine's heater box and suspension FIGS. 5A, 5B end views showing the Recycling Machine's heater box extension air supply pivot FIGS. 6A, 6B, 6C front, cross-section and plan views of the Recycling Machine's electronic burner FIG. 7 a plan view of Recycling Machine's main heater box and extension burner layout FIG. 8 a side view of the Recycling Machine's offset boom and cab FIG. 9 a plan view of the Recycling Machine's offset boom and cab FIG. 10 an end view of the Recycling Machine's rear axle assembly FIG. 11 a plan view of the Recycling Machine's front and rear axle assembly FIG. 12 an end view of the Recycling Machine's front axle assembly in a tilted position FIGS. 13A, 13B side views of the Recycling Machine's grade control system for the main and extension mills FIG. 14 a plan view of the Recycling Machine's grade control system for the main and extension mills showing the transversal, jointed cross beam FIG. 15 a side view of the Recycling Machine's, mill grade control system FIG. 16 an exploded side view of the Recycling Machine's, mill grade control system FIG. 17 an end view of the Recycling Machine's, mill grade control standard two ski assembly FIG. 18 an end view of the Recycling Machine's, mill grade control transverse averaging ski assembly FIG. 19 a side view of the Recycling Machine's, mill grade control longitudinal averaging ski assembly FIG. 20 a side view of the Recycling Machine's, mill grade control longitudinal averaging ski assembly with non-contact, sonic sensors FIG. 21 an end view of the Recycling Machine's, mill grade control system with a single ski assembly and cross slope sensor FIG. 22 a side view of the Recycling Machine's asphalt surge bin and vertical elevator FIG. 23 an end view of the Recycling Machine's asphalt surge bin and vertical elevator FIG. 24 a side view of the Recycling Machine's, hopper/diverter valve FIGS. 25A, 25B, 25C side views of the Recycling Machine's, hopper/diverter valve shown in three modes of operation FIG. 26 a side view of the Recycling Machine's auger/divider/strike-off blade assembly FIG. 27 a plan view of the Recycling Machine's auger/divider/strike off blade assembly FIG. 28 an end view of the Recycling Machine's auger/divider/strike off blade assembly FIGS. 29A, 29B plan views of the Recycling Machine's auger/divider/strike off blade assembly showing the divider in two positions FIG. 30 a side view of the Recycling Machine fitted with a front asphalt hopper, central belt conveyor and asphalt surge bin/vertical elevator FIG. 31 a simplified side view of the Recycling Machine fitted with a front asphalt hopper, central belt conveyor and asphalt surge bin/vertical elevator FIG. 32 a side view of the Recycling Machine and front asphalt hopper assembly and central belt conveyor in the raised position FIG. 33 a side view of the Recycling Machine and front asphalt hopper assembly and central belt conveyor in the lowered position FIGS. 34A, 34B, 34C side views of the Recycling Machine's front asphalt hopper assemblies clip-on attachment frame and safety locks FIG. 35 a side view of the Recycling Machine's central belt conveyor assembly FIG. 36 a side view of the Recycling Machine's automatic belt tension assembly FIGS. 37A, 37B, 37C a side, plan and end view of the Recycling Machine's rake scarification/blade collection assembly FIG. 38 a side view of the Recycling Machine's rake scarification/blade collection assembly with a main rake/blade in the lowered position FIG. 39 a side view of the Recycling Machine's rake scarification/blade collection assembly with a main rake/blade in the lowered position with the blade collecting asphalt FIG. 40 a plan view of the Recycling Machine's rake scarification/blade collection assembly with a main rake/blade showing a utility structure FIG. 41 a plan view of the Recycling Machine's extension mills, main mill and pug mill showing the flow of asphalt when processing FIG. 42 an end view of the Recycling Machine's extension mills with one extension mill crowned FIG. 43 an end view of the Recycling Machine's extension mill with spring loaded blade in the full down position FIG. 44 an end view of the Recycling Machine's extension mill with spring loaded blade in the full up position FIG. 45 an end view of the Recycling Machine's main mill FIG. 46 a plan view of the Recycling Machine's main mill showing asphalt discharge FIG. 47 an end view of the Recycling Machine's main mill with spring loaded blade in the normal working position and also the rejuvenator spray bar FIG. 48 a schematic of the Recycling Machine's rejuvenator and supplemental liquid distribution system FIG. 49 a plan view of the Recycling Machine's extension mills, main mill and pug mill showing the rejuvenator/liquid polymer spray bars FIG. 50 a side view of the Recycling Machine's pug mill assembly FIG. 51 an end view of the Recycling Machine's pug mill assembly FIG. 52 a plan view of the Recycling Machine's pug mill showing the front and rear rotor assemblies FIG. 53 a plan view of the Recycling Machine's pug mill showing the inlet and outlet of asphalt FIG. 54 a side view of the Recycling Machine's pug mill with ski assembly at rest FIG. 55 a side view of the Recycling Machine's pug mill with ski assembly in the raised position FIG. 56 a end view of the Recycling Machine's pug mill with ski assembly at rest showing the electronic, rotary sensor FIG. 57 a side view of the Recycling Machine's pug mill with trip blade FIG. 58 a side view of the Recycling Machine's pug mill with trip blade in the tripped position FIG. 59 a side view of the Recycling Machine's pug mill showing an exploded view of the trip blade FIG. 60 a side view of the Recycling Machine's front asphalt hopper fitted with a metal detection boom assembly FIG. 61 a plan view of the Recycling Machine's rake/blade and metal detection boom assembly FIG. 62 an end view of the Preheater's aggregate distribution bin and width measuring system FIG. 63 a side view of the Preheater's aggregate distribution bin FIG. 64 a side view of the Preheater's aggregate distribution bin showing a spring loaded blade in the normal position FIG. 65 a side view of the Preheater's aggregate distribution bin showing a spring loaded blade in the open position FIG. 66 a side view of the Preheater's aggregate distribution bin and asphalt surface profile measuring system FIG. 67 a side view of the Recycling Machine showing the major sub-assemblies used with the 100% HIR with Integral Overlay method FIG. 68 a side view of the Recycling Machine's rear end showing the major sub-assemblies used with the 100% HIR with Integral Overlay method FIG. 69 a side view of the Recycling Machine's rear end showing the primary and secondary screed assemblies and tow arms FIG. 70 a cross section view of the Recycling Machine's secondary screed arm hydraulic cylinder FIGS. 71A, 71B side views of the Recycling Machine in the highway transportation mode FIG. 72 a side view of the Recycling Machine's clip-on, front transportation stinger assembly retracted FIG. 73 a side view of the Recycling Machine's clip-on, front transportation stinger assembly extended FIG. 74 a side view of the Recycling Machine's clip-on, front transportation stinger assembly exploded FIGS. 75A, 75B side views of the Recycling Machine's clip-on, front transportation stinger showing the clip-on frame and safety latches FIG. 76 a side view of the Recycling Machine's clip-on, rear transportation frame assembly FIG. 77 a side view of the Recycling Machine's clip-on, rear transportation frame assembly in a forward position FIG. 78 a side view of the Recycling Machine's clip-on, rear transportation frame assembly showing the safety latches FIG. 79 a side view of the Recycling Machine with a clip-on, rear transportation frame and front asphalt hopper assembly in the highway transportation mode FIG. 80 a side view of the Preheater with a clip-on, rear transportation frame and front stinger assembly in the highway transportation mode
Figure 2:
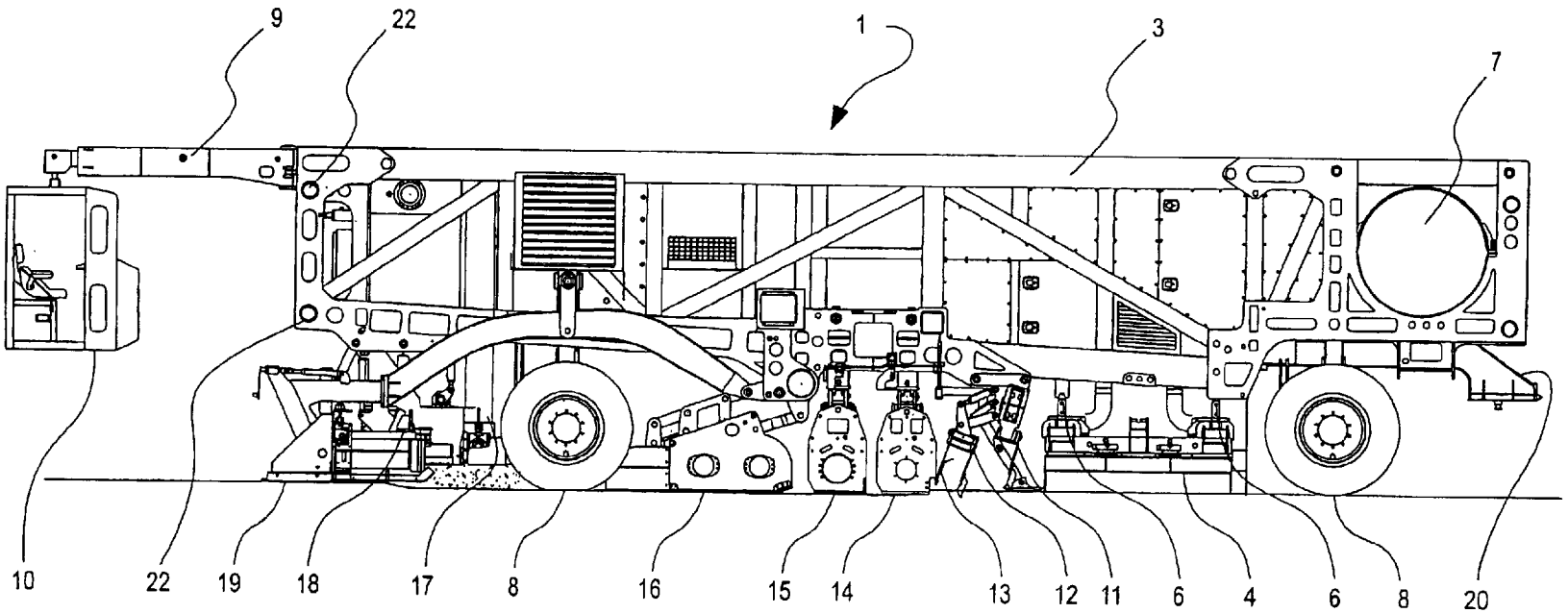
Figure 3:
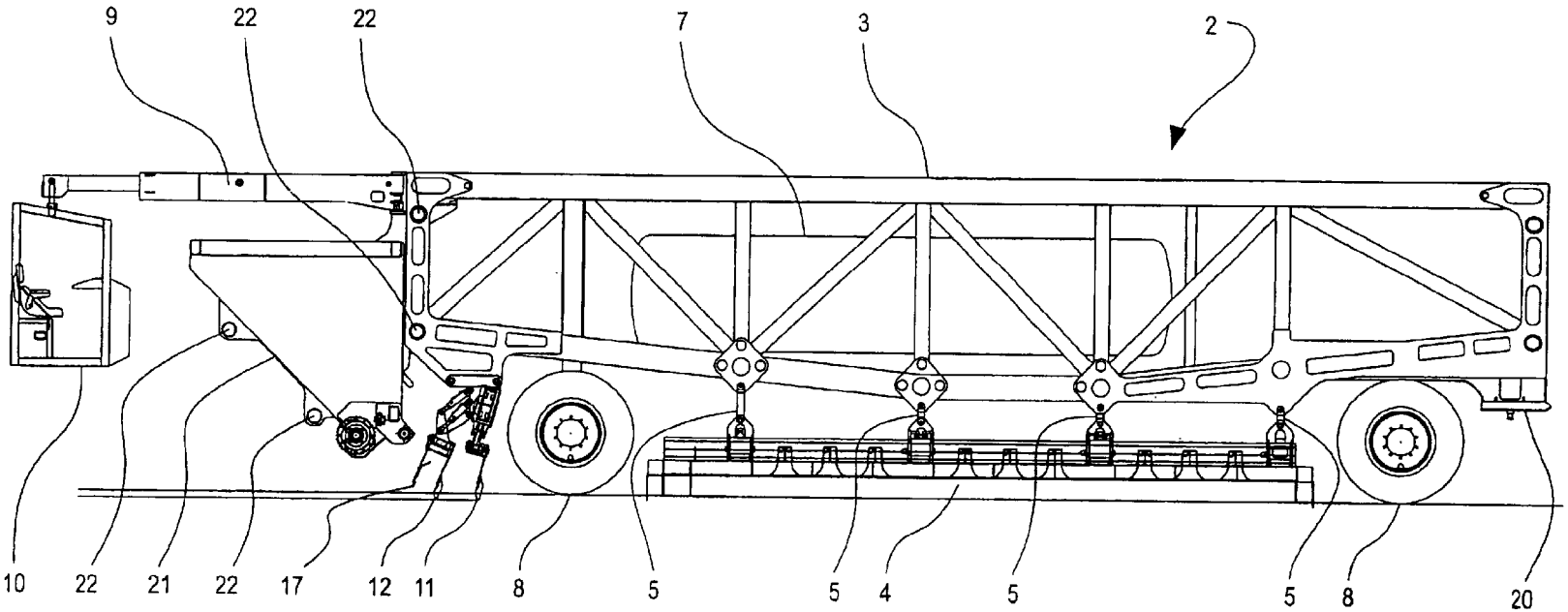

FIGS. 1–3 show a Recycling Machine 1 configured for 100% HIR and a Preheater 2 (only one shown), both shown in the working mode. A plurality of Preheaters may be used within three or more Preheaters typically being located ahead of the Recycling Machine. The Preheaters are responsible for delivering deep, penetrating heat into the asphalt. Preheaters not fitted with a clip-on aggregate bin 21 and the rake/blade scarification/collection system 11 can be fitted with an optional thermal insulation blanket, around the edges (not shown) which is used to reflect heat into the heated asphalt surface and shield the asphalt from the cooling effects of wind. The final Preheater (shown ahead of the Recycling Machine) is fitted with an on-board computer-controlled, aggregate distribution bin and rake/blade scarification/collection system. Aggregate, such as washed sand is added in controlled proportions (determined by prior testing of the asphalt) and adjusts the air-void ratio and the structural properties of the recycled asphalt. It is also possible to add combinations of aggregates by premixing or by fitting more than one Preheater with aggregate distribution bins. The Recycling Machine and Preheaters are fitted with main heater boxes 4. Attached to the main heater boxes are the left and right side hydraulically operated, extension boxes, which provide on the go, variable heating width adjustment. The fuel is clean burning propane and is mixed with pressurized air in individual, electronically monitored and controlled burner assemblies. The air pressure, burner operation, heat shutdown and emergency heat shutdown is monitored and controlled by the on-board computer for safety and efficiency. The burners produce infrared heat (stainless steel cones and underside stainless steel mesh glow red) and forced hot air to heat the asphalt. The burner flame is of the high swirl type (flat flame) and does not contact the asphalt's surface. The spacing of the machines allows the heat to soak (penetrate) into the asphalt. Close spacing provides high surface heat, but less depth of heat. Spacing the machines further apart, can in some conditions, increase the depth of heat into the asphalt, however, in windy, cold or damp conditions, reduced depth of heat can result. Insulation blankets are available (mounted behind the Preheaters) to reduce the heat loss to the atmosphere and increase the heat penetration into the asphalt. Electronic monitoring and control of the heater boxes on the Preheaters and Recycling Machine provides automatic heat control.

Preheater 2 is shown in FIGS. 1 and 3 fitted with the clip-on aggregate bin 21 and rake/blade scarification/collection system 11, 12 and 13. The mainframes 3, on both machines are fabricated out of carbon rectangular steel tubing with the main tubes forming air plenums. Pressurized air, supplied by a hydraulically driven, variable speed centrifugal blower (monitored by an electronic pressure sensor) maintains the mainframe's 3 tubes (plenum) at a constant pressure. The on-board computer controls a hydraulic, variable displacement, piston pump (driven by the diesel engine) using information provided by the air plenum's electronic pressure sensor. The pump provides oil flow to the air blower's hydraulic drive motor. Air pressure remains constant as ambient temperature, air density, altitude or air demand (volume) change. Changes in air demand occur as the extension boxes are raised and lowered. Raising the extension boxes automatically cuts off the air supply, reducing the required blower volume. The Preheater's main heater box 4 attaches to the main frame 3 by eight equally spaced pivoting links 5. The pivoting links allow the heater box to thermally expand while also allowing the mainframe 3 to structurally support the heater box 4. The air supply to main heater box 4 from mainframe 3 is by four equally spaced, flexible hoses (not shown). As shown in FIG. 2, the Recycling Machine's main heater box 4 attaches to the mainframe 3 by four hydraulic cylinders and a suspension system 6, allowing the heater box to raise/lower, tilt and side shift. Propane tanks 7, on both of the machines are industry standard, mobile units fitted with fluid withdrawal from the tank bottom and vapor withdrawal from the top. Heated vaporizer(s) vaporize the liquid propane while a single stage regulator reduces the gas pressure for the burner's supply. Regulated vapor pressure (top of the propane tank) supplies the burners at a slightly higher pressure than set by the single stage regulator, thereby providing propane vapor discharge priority and reducing excessive tank pressure in high ambient temperatures. The Recycling Machine and Preheater both feature four wheel drive supplied by hydraulic, radial piston motors, driving wheels 8 while providing infinite speed in both directions. The drive wheels 8 steer 40 degrees to the left and right (front and rear) on both of the machines. Hydraulic booms 9 fitted to both machines allow the operators to move around the rear end of the machines for better viewing. The Preheater's boom allows a wheel loader to dump aggregate into the aggregate bin 21 with the boom swung completely to curb side for traffic safety. Cab 10, attached to boom 9 are fitted on both machines and house the operator controls station (electronic) and machine monitoring readouts.

FIG. 2 illustrates the Recycling Machine's 1 subassemblies (described later, in detail) which comprise extension rakes 11, main rakes 12, rake blades 13, extension mills 14, main mill 15, offset pug mill 16, surge bin/vertical elevator 17, auger/divider/strike-off blade 18 and screed/tow arms 19. Stinger 20 hydraulically extends and retracts from the main frame 3, reducing the Recycling Machine's length, while in the working mode. The Recycling Machine can also be fitted with an optional clip-on, front asphalt hopper with a $5^{th}$ wheel pin attachment. Either attachment allows towing by a highway truck tractor, without the removal of the front end, attachment. The Preheater's stinger 20 also allows towing by a highway truck tractor. The rear end of the Recycling Machine 1 and Preheater 2 mainframes 3 feature attachment tubes 22 allowing clip-on transportation frames (described in detail later) to be attached for highway transportation. The Recycling Machine and Preheater's subassemblies and/or clip-on attachments can be removed or left in-place for transportation. Attachments left in-place for transportations are also fitted with attachment tubes 22 as shown in FIG. 3 on the Preheater's aggregate bin 21.

In summary, both machines feature a commonality of parts and systems, allowing for interchangeability of components for transportation, service and manufacturing.

Figure 4A:
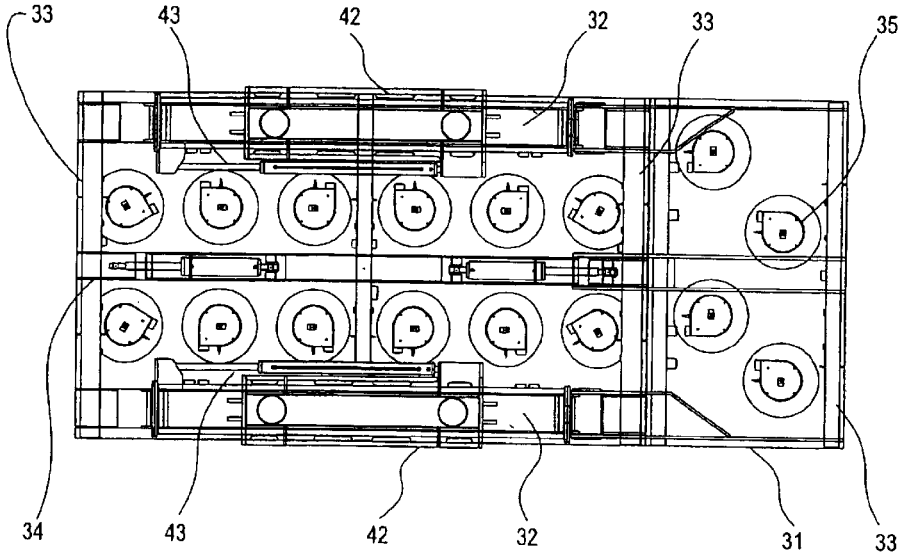
Figure 4B:
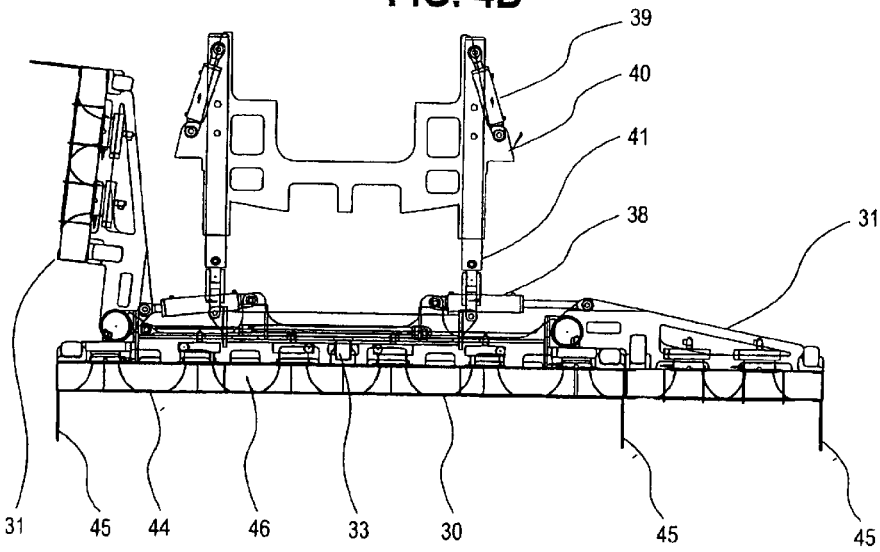
Figures 5A, 5B:
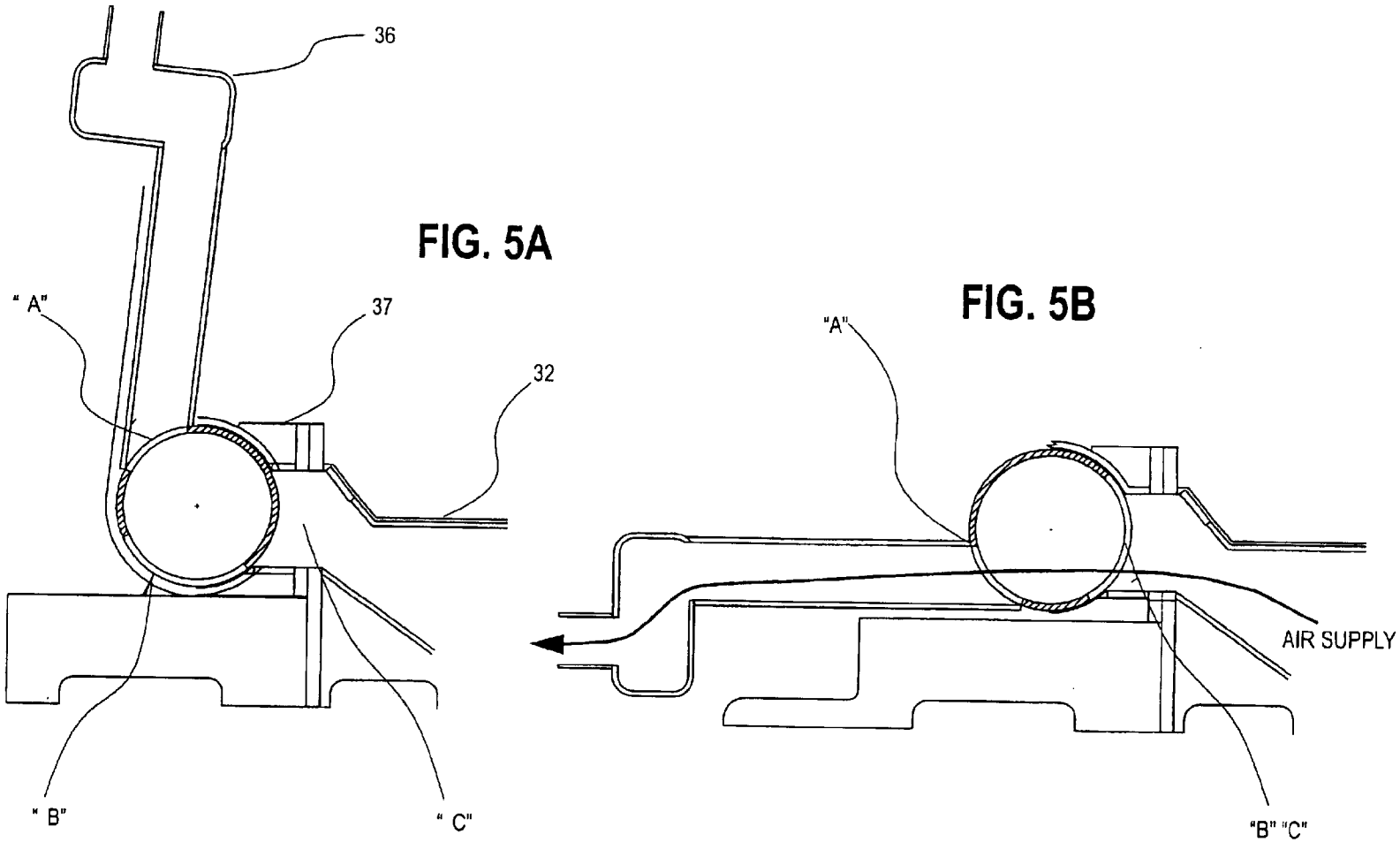

The Recycling Machine's and the Preheater's heater boxes are basically the same in construction and operation, however, the Recycling Machine's heater box will be described in detail due to additional features, such as hydraulic raise/lower, tilt and side shift as shown in FIGS. 4 and 5. The Recycling Machine's heater box consists of the main box 30 and the left and right extension boxes 31 (only the R.H. one is shown on the plan view). The extension boxes are used to increase the heating width of the Recycling Machine as it is processing asphalt. FIG. 4 shows the plan and front view with the left extension in the raised (transport) position and the right extension in the lowered, heating position. The two extension boxes 31 are supported and pivot on frames (two) 32. Frames 32 also supply air to the individually controlled, electronic burners 35, located on both the main and the extension boxes while gas supply tubes 33 supply propane to the burners. The middle support frame 34 spans the three gas tubes 33 and provides support for the main box's top deck.

FIG. 5 shows the extension box's frame/air tube 36 in both the raised and lowered (heating) position. The stationary pivot 37 is attached (bolted) to the main box's frame 32. Frame/air tube 36 and has two rectangular air passages ("A" and "B") located in the rotating pivot. Passage "A" (rotating pivot) is connected to the burner's air supply tubes while passage "B" (rotating pivot) slides past passage "C" in the stationary pivot 37. When the extension box 31 is in the raised position passage "C" is blocked. In the lowered (heating) position passages "B" and "C" are aligned, allowing air to flow into the extension frame's air supply tubes 36 through passage "A". The stationary pivots 37 allow the extension boxes 31 to be raised and lowered by hydraulic cylinders 38 that are attached between the middle support frame 34 and the extension frame 36 and also provide automatic air control to the extensions, reducing air consumption, by shutting off the air supply when the burners are not required. Electronic sensors detect the extension box's 31 position. The on-board computer automatically cuts off the gas supplies when the boxes are raised 10 degrees from heating position. As noted above, the main heater and extension boxes are constructed from rectangular steel tubing. The tubing is used to distribute propane and air to the individual burners. Passing propane and air through the tubes reduces weight, plumbing complexity and increases the surface area on propane delivery system, allowing the propane to completely vaporize, particularly in cold weather. Preheaters have their heater boxes mounted through equally spaced links 5 attached to the mainframe. The mainframe provides the structural rigidity to the heater box. The heater box and mainframe are raised, lowered and tilted using the Preheater's front and rear axle's, hydraulic cylinders. The Recycling Machine's main heater box 30 and extension heater boxes 31, are raised, lowered and tilted by four (two per side) individual, hydraulic cylinders 39 that are mounted to the support frame 40 and the sliding suspension tube 41. The two left and the two right cylinders are hydraulically plumbed in parallel, allowing each side to be raised individually (tilt) or together. Cylinders 39 are in compression (rod being forced into the cylinder) when carrying the weight of the heater box and together with hydraulic counterbalance valves prevents the box from drifting down (anti-drift) which allows the height of the box to be set and maintained at any position. The sliding suspension tubes 41 are raised and lowered by hydraulic cylinders 39 and slide through the support frame 40. The suspension tubes 41 are attached to frames (two) 42 through universal joints, allowing movement for tilt and misalignment. Two hydraulic cylinders 43 are attach between frame 32 and frames 42. The hydraulically cylinders are connected in parallel and are equalized in hydraulic flow, allowing the frames 32 (attached to main heater box) to slide through frames 42, side shifting the heater box for operation around tight bends or for offset heating. The frames 42 receive air from the Recycling Machine's mainframe 3 through four flexible hoses (not shown). The hoses function as a flexible joints and also weak links (fuses), protecting against the unlikely event of combustion blow back. The on-board computer, providing for safety and efficiency, controls the air/fuel mixture, as well as the ignition and shut down. The electronically monitored and controlled burners 35 receive their air supply from frames 42 and their gas supply from tubes 33. The on-board computer automatically controls the air pressure. The electronically controlled burners 35 produce infrared heat, (stainless steel cones glow red) and hot forced air to heat the asphalt. The stainless steel mesh 44 (heated by burners 35), also produces infrared heat, while flexible stainless steel wire mesh skirts 45, surround the perimeter of the heater boxes, containing the heated air. Ceramic fiber insulation 46 surrounds the burner cones and is packed between the mesh 44 and the heater boxes top deck. The burner's flame features a flat, high swirl pattern, with no flame contact with heated surface. The burners are non-adjustable (only for initial setup) and are set up to provide a blue flame for reduced emissions and greater fuel economy.

Figure 6C:
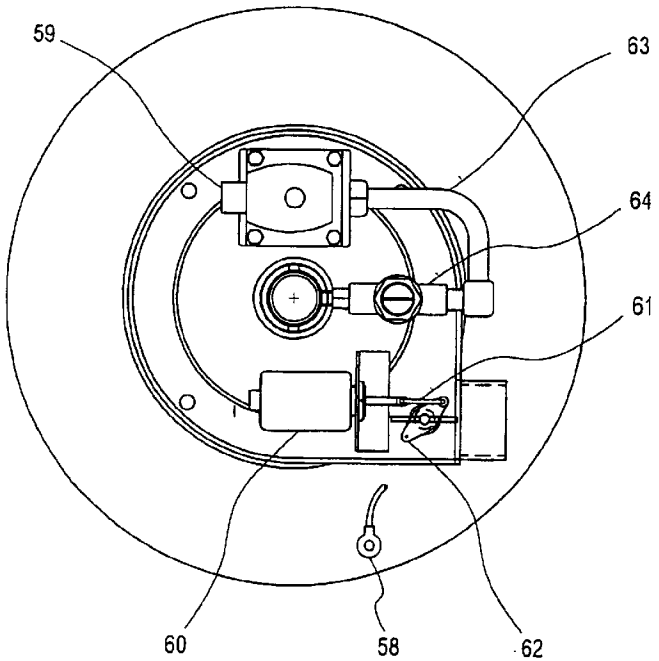
Figure 6A:
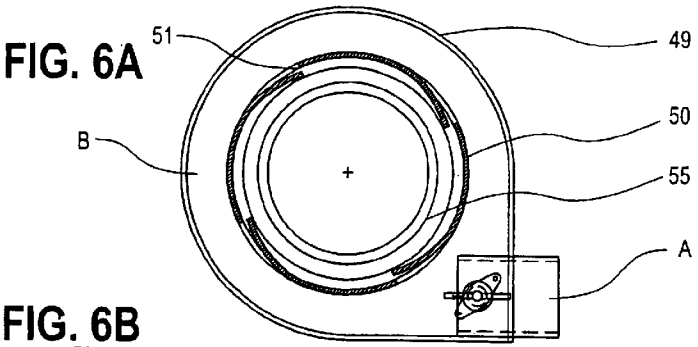
Figure 6B:
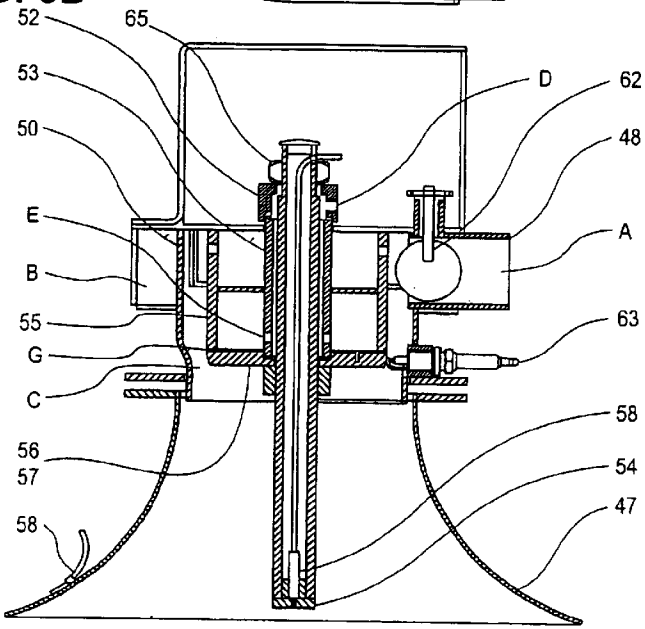

FIG. 6 show the individually controlled, electronic burner 35 and the stainless steel cone 47. The burners 35 are attached to the heater box's top decks by studs and lock nuts, which are part of cone 47. Heat resistant gaskets insulate the cones and burners from the deck, reducing the amount of heat transfer to deck's surface. Combustion air enters the burner through inlet 48 ("A") and flows around air plenum housing 49, and venturi tube 50. Plenum "B" causes the air supply to continuously spin, due to the offset (tangential) inlet 48 ("A"). The spinning air is forced past vanes 51 in venturi tube 50, which has a section of reduced area "C" near its outlet to increase the air's velocity. This increases combustion efficiency. The section of reduced area "C" creates a venturi, which increases the air's velocity and causes a pressures drop, at the propane's 360 degree, supply orifice "G". Propane enters the burner at "D", through collar 52 and passes down between the gas tube 53 and the retainer tube 54 and exits through holes "E", filing the surge chamber in inner tube 55. The venturi plate 56 and the inner tube 55 are spaced apart by stainless steel wires 57, forming a 360-degree orifice "G". The reduced area "C" increases the air's velocity and together with the spinning air and 360 degree propane supply, produce an efficient, clean flame that clings to the burner cone's 47, inside wall. The propane is completely burnt within the top 4 inches of the cone 47, causing the cone to glow and producing infrared heat. The heat of combustion provides additional heat and drives away any moisture from under heater boxes through the heater box's flexible side skirts. Thermocouples (not shown) positioned at various locations throughout the heater box's underside, monitor the heater box's heat output. Electronic flame detectors (not shown) monitor the asphalt's surface for local flame propagation. Each burner senses the surrounding heat at thermocouples 58 that is centrally located in the retainer tube 54 and attached to the burner cone 47. The on-board computer receives information from each burner's thermocouples and controls the operation of the electrical gas valve 59 and the air control solenoid 60. Solenoid 60 is attached to link 61 and together, rotates butterfly valve 62, which in turn opens, or closes the air supply. Opening valve 59 allows propane (regulated at constant pressure) to flow through the tube 63 to trimmer valve 64. Trimmer valve 64 is used for the initial setup of gas flow (air/fuel mixture). The burner's internal parts can be disassembled and cleaned by undoing the retainer nut 65.

In addition, the temperature of each heater may be controlled by the use of pulsing the fuel provided to the burner. This may be done by pulsing the electrical gas valve 59 to open and close as desired or by using a variable control valve.

Figure 7:
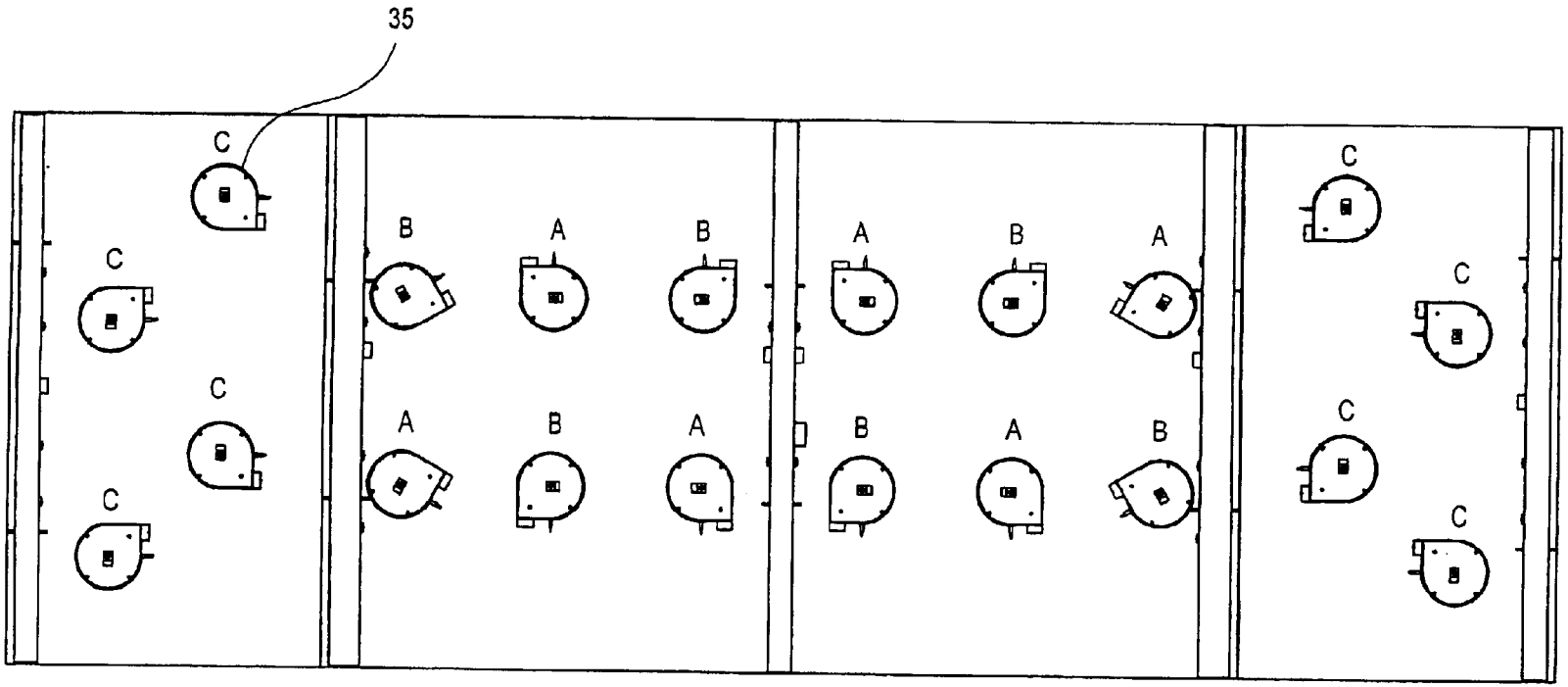
Figure 8:
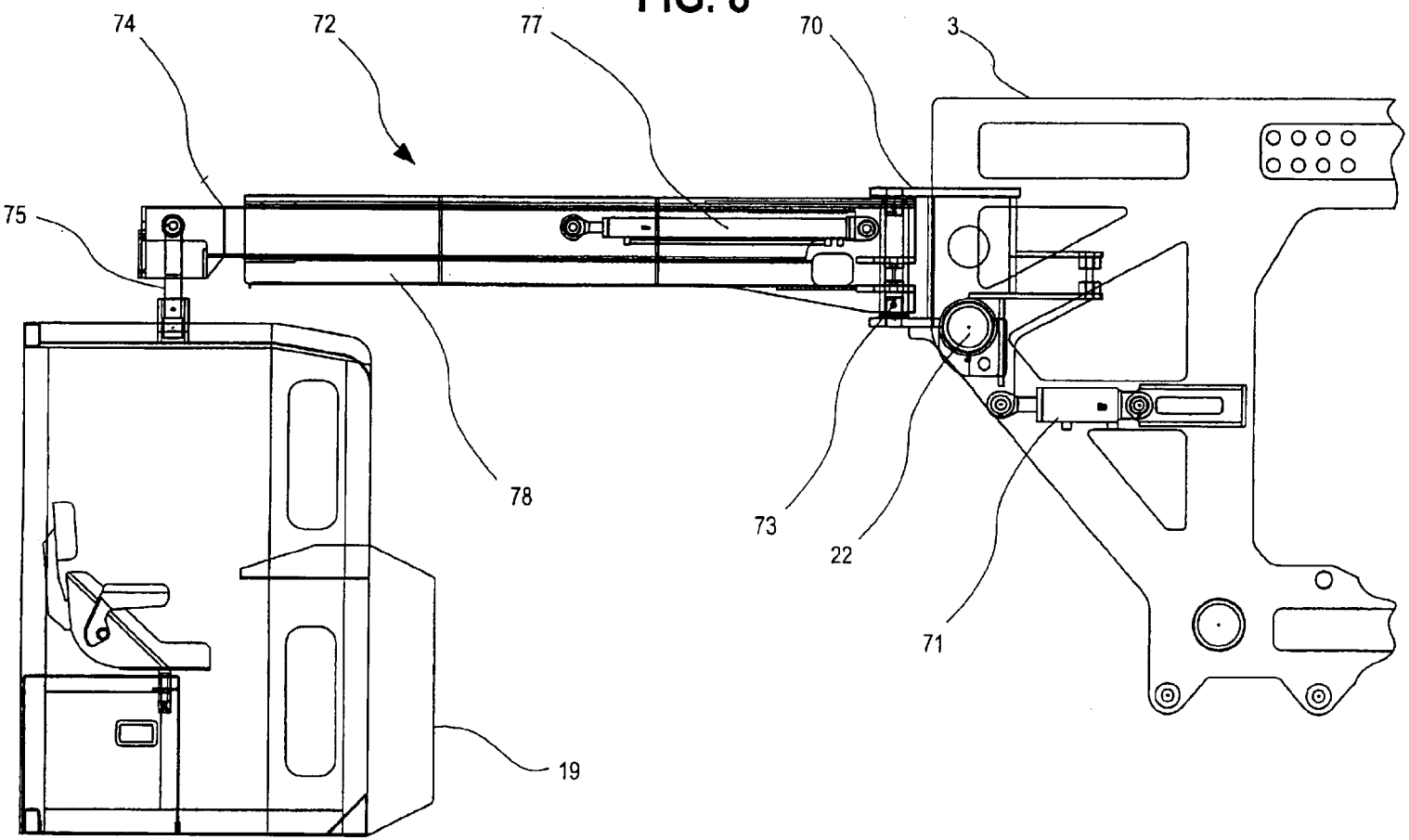
Figure 9:
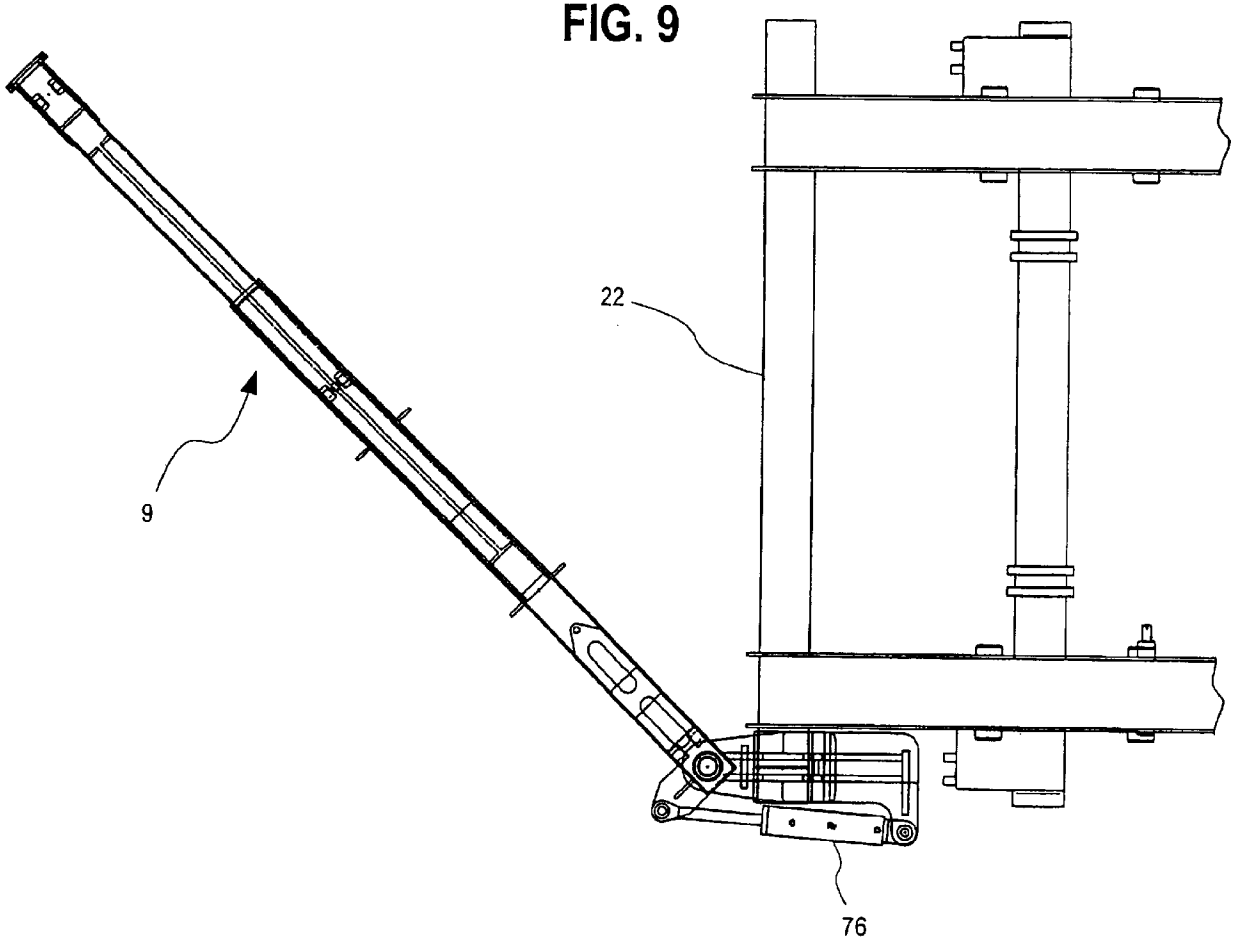

As shown in FIG. 7 the electronically controlled burners 35 feature left and right rotating air flows and are mounted to the heater boxes in a specific pattern, giving excellent heat coverage and heated air flow patterns. The main heater box is a two stage heating system. Under low heating requirements, (determined by the on-board computer) the main burners "A" and extension burners "C" (if extension (s) are energized) are operational. Gas supply to the "B" burners is shut-off by electrical gas valves 59, however, the air supply remains on, providing cooling for the "B" burners. The on-board computer turns on the "B" burners when extra heat is required (as described in detail before). The on-board computer monitors each of the individual burner's thermocouples 58 and local flame detectors (not shown) and turns off the individual burner's gas supply when excessive, localized heat or flame is detected, such as crack filler or a paint lines flaring up. The solenoid 60, link 61 and butterfly valve 62 shut off the air supply for re-ignition when the burner has automatically shut down. The electronic ignition system (not shown) fires the spark plug 63, when the gas valve 59 turns on. The reduction of air (valve 62 closed) and the excess of propane gas produce a rich mixture at the orifice's 360 degree, discharge area "G", allowing the spark plug 63 to ignite the propane rich mixture. Once the heater boxes have reached their operating temperature (burner cone 47 glowing) ignition will take place without the use of the spark plug, however, the plug still fires as an added margin of safety FIGS. 8 and 9 show the (Reference FIG. 2) Recycling Machine's mainframe 3 and operators cab 19 and offset boom assembly 9. This design allows not only the transportation frame to be attached easier, but also affords better access for the wheel loader when filling the aggregate bin. Pivot frame 70 is attached to the mainframe's top tube 22 on the left or the right hand side. Raising and lowering of the boom and cab assemblies is achieved by rotating pivot frame 70 around the mainframe's top cross tube 22 by hydraulic cylinder 71. The boom height is restricted, preventing contact with power lines. Hydraulic counterbalance valves are fitted to the hydraulic cylinder 71 to prevent hydraulic drift. The boom's outer frame 72 is attached to the pivot frame 70 by pin 73. The boom's outer frame 72 houses the inner, sliding tube 74. The cab 19 is attached to the inner tube 74 by pivoting link 75. The hydraulic cylinder 76 swings the boom and cab, allowing the operator to work from both sides of machine, while remaining out of way of screed operator and other ground personal. The hydraulic cylinder 77 slides the inner, sliding tube 74 through the outer frame 72, extending the boom and cab. The Preheaters are fitted with a similar boom and cab assembly, the only difference being, a longer inner, sliding tube 74. The boom's outer frame 72 is constructed to form a lower, enclosed channel 78 for the passage and protecting of the electrical and hydraulic hoses.

Figure 10:
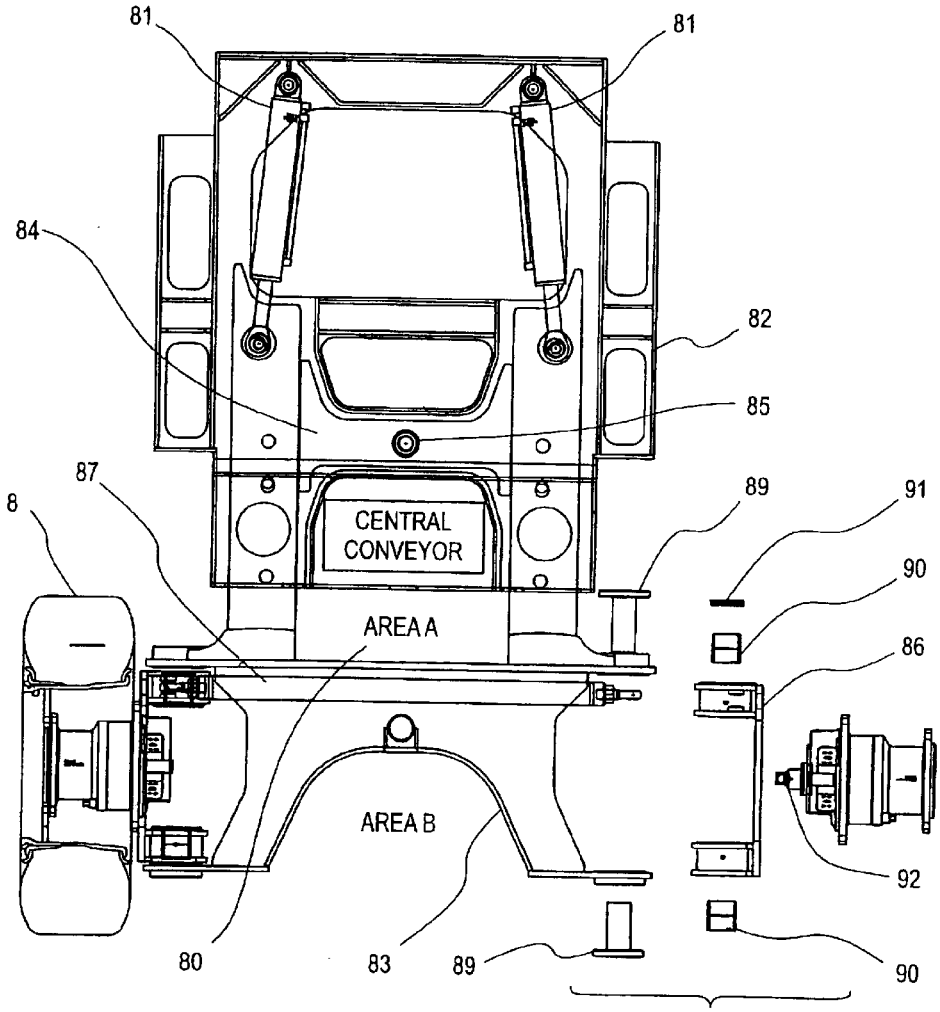
Figure 11:
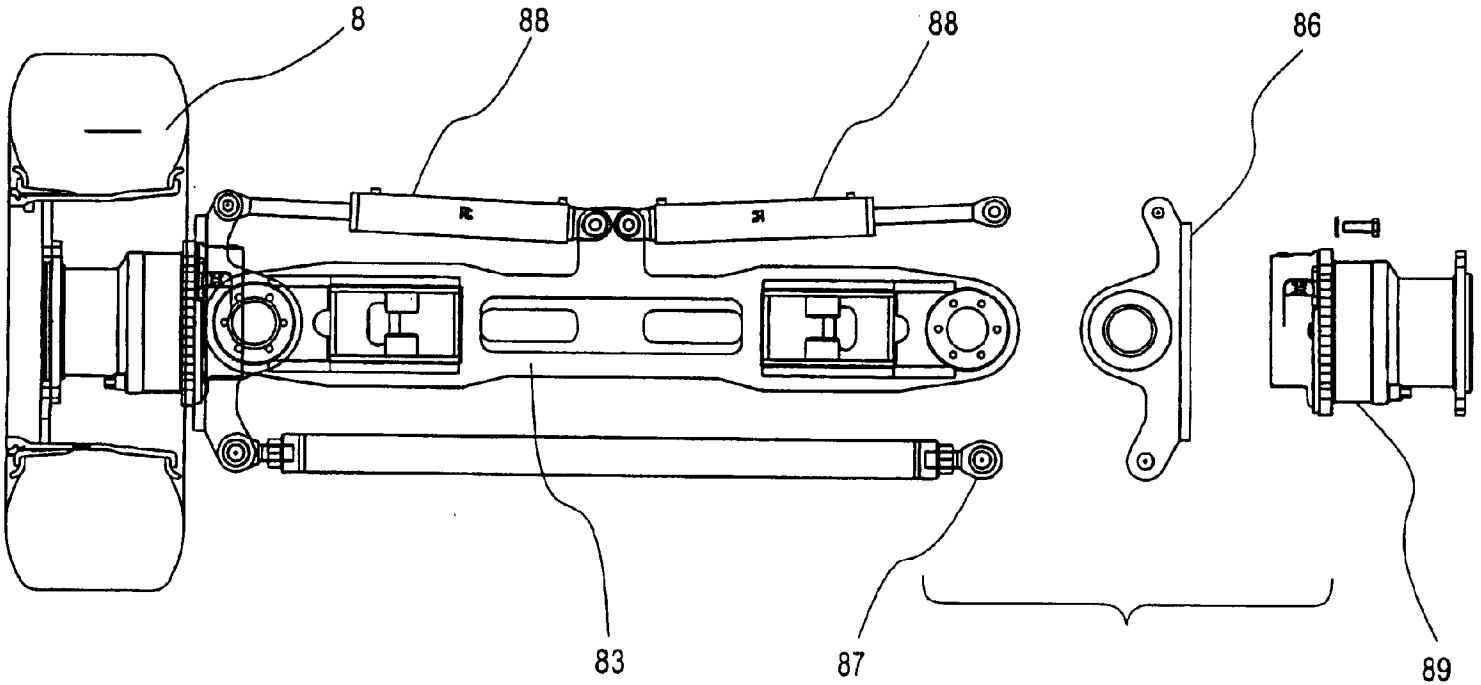
Figure 12:
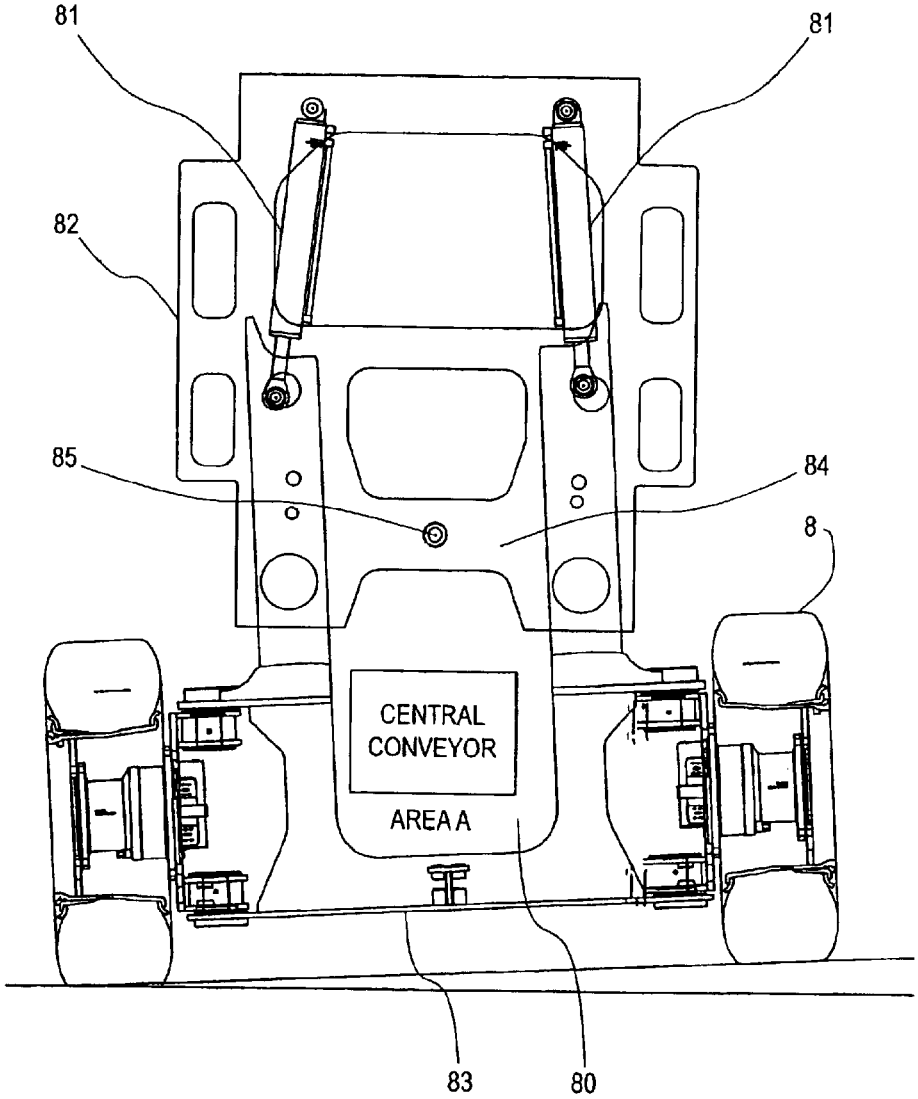
Figure 13A:
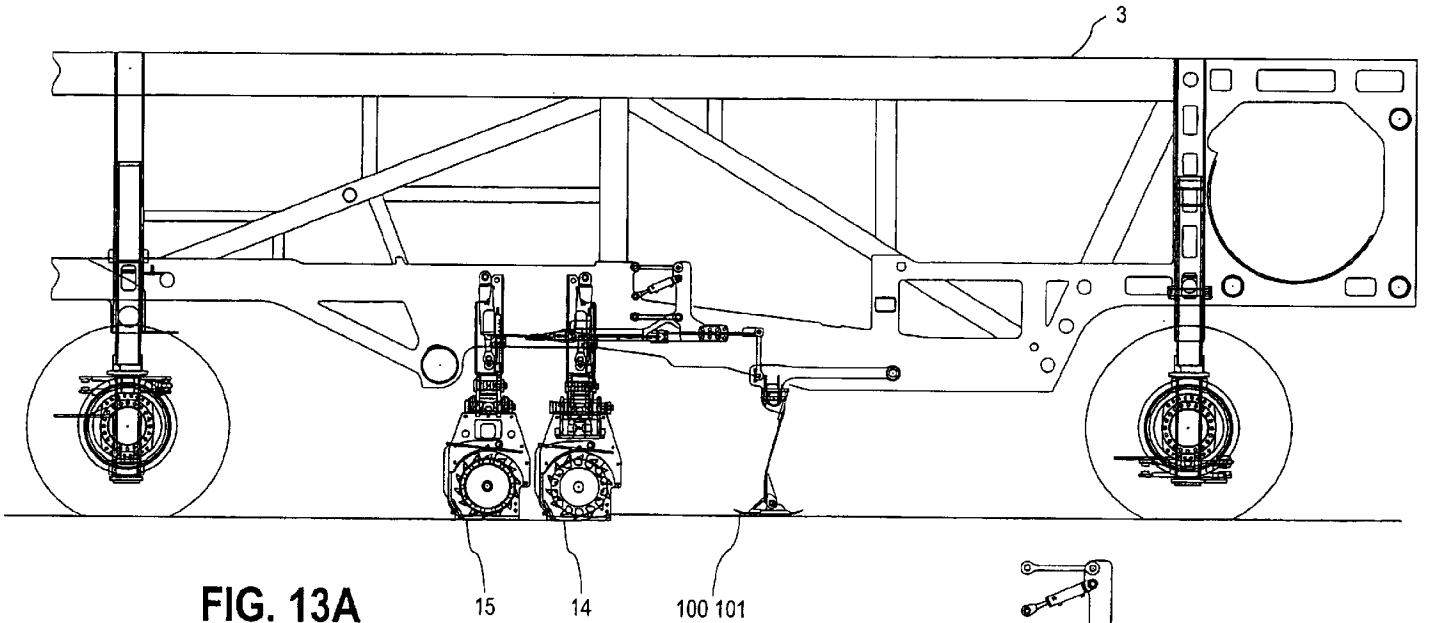
Figure 13B:
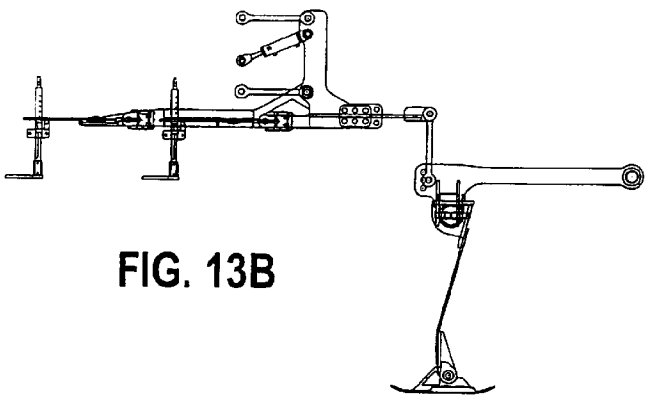
Figure 14:
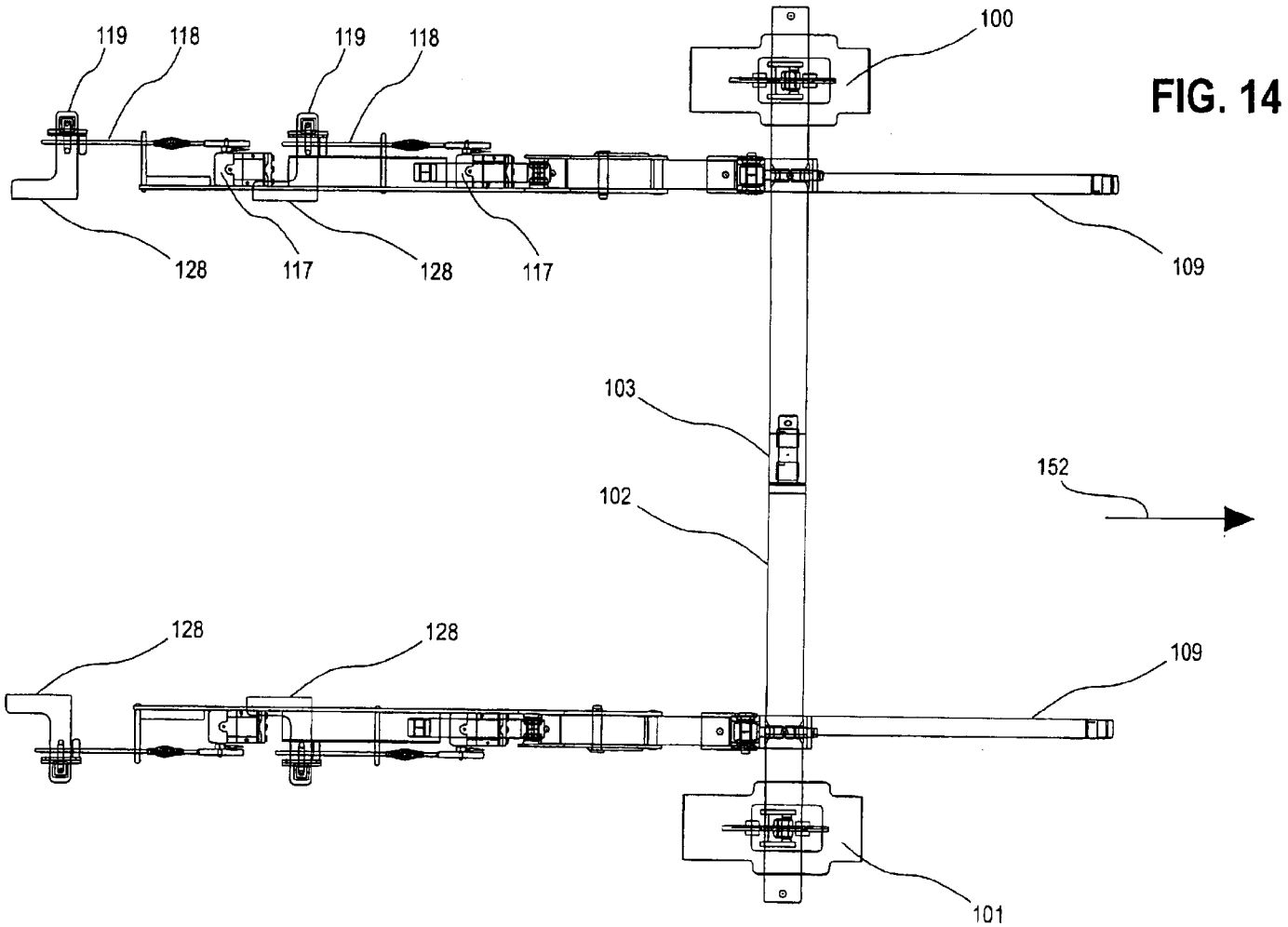
Figure 15:
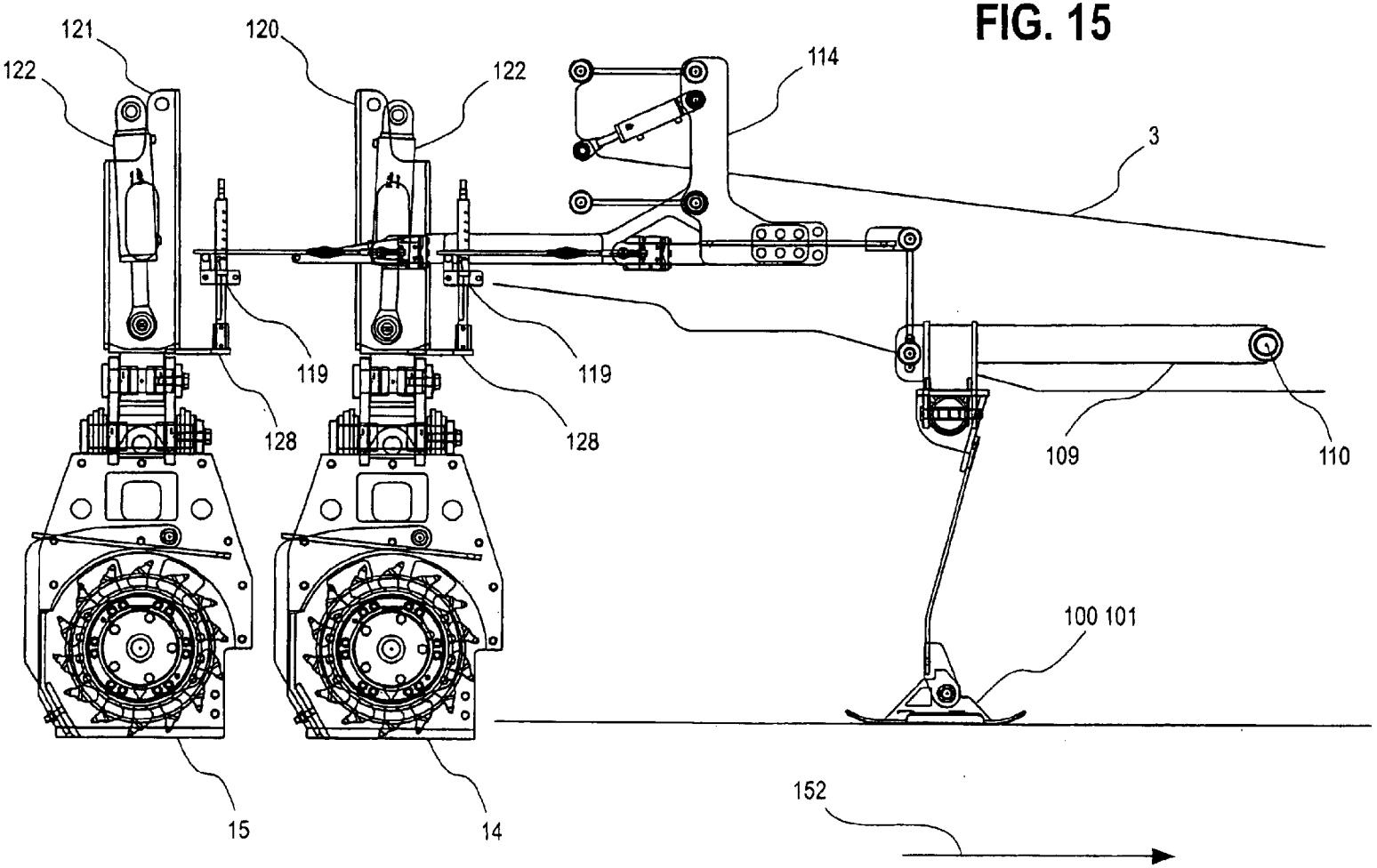

FIGS. 10, 11 and 12 show the Recycling Machine's front and rear axle assemblies and drive wheels 8. The axle assemblies are hollow to create a passage 80 (area "A"). The passages or opening allow the passing of a central belt conveyor through both axles and a clip-on, hydraulic stinger/$5^{th}$ wheel pin 20 (hooks up to a highway, truck tractor unit for self-transportation) to pass through the front axle FIG. 12. The conveyor may be any conveying system known to those of skill in the art including, but not limited to, belts, chains, augers, slats, air-conveyance, liquid conveyance, and vibrating troughs. Both axles are raised and lowered by hydraulic cylinders 81. The cylinders are attached to the front and rear axle's support frames 82, both of which are attached to the Recycling Machine's mainframe 3. The front axle's hydraulic cylinders are hydraulically connected in parallel, allowing the front axle's frame 83 to slide up and down the support frame 82. The pivoting slider 84 (shown in tilted position) is attached to the support frame 82 by pin 85 and locates (prevents side to side movement while allowing the axle to tilt) the axle's frame 83 in support frame 82. The slider also prevents the axle's frame 83 from bending in at its top section due to the natural bending moment when carrying the weight of the Recycling Machine. Hydraulic cylinders 81 are angled to help counter the bending forces on the axle's support frame 83. Oil transfer between the hydraulic cylinders allows the front axle to tilt (follow ground surface) on the pivoting slider 84 without adversely effecting, the main frame's height. An electronic position sensor maintains the front axle's height position, relative to the position of pivoting slider 84. This is used when lowering the front end of the Recycling Machine's mainframe (lower limit) and also prevents oil leakage in the hydraulic cylinders from causing the front end to settle over time. The electronic position sensor detects any relative change in height and signals the on-board computer to supply more or less hydraulic oil to the front cylinders, thereby raising or lowering the mainframe and cutting off the sensors signal. The rear axle assembly FIG. 10 slides up and down the pivoting slider 84 by the same manner as the front axle assembly. Oscillation of the pivoting slider 84 is around pin 85 allowing the mainframe 3 to be tilted in relation to the rear axle assembly. The rear axle's hydraulic cylinders 81 are operated individually by (hydraulic or electronic) automatic height controllers (two) or by the operator to control the mainframe's height and tilt (slope). Equal flow to both cylinders causes the rear axle's frame 83 to slide past the pivoting slider 84 causing the Recycling Machine's mainframe to raise or lower, but not tilt. Greater flow to one or the other cylinder causes the pivoting slider 84 to pivot around pin 85, tilting the mainframe assembly. In normal operation it is the front axle assembly that automatically tilts (floats) due to the varying grade of the asphalt's surface, while the Recycling Machine's main frame stays level, due to the control of the rear axle's cylinders. Both of the pivoting sliders 84 are located below the mid-point of frames 82 to reduce the side-to-side movement of the front and rear axle frames 83. This provides side clearance for the central conveyor. The automatic slope control systems as described in detail above can be used to control the Recycling Machine's mainframe cross slope. Individual control of the rear axle's hydraulic cylinders, together with the front axle's hydraulic cylinders connected hydraulically, in parallel, form a three-point suspension, allowing the mainframe to ride over uneven surfaces, thereby reducing stress in the mainframe. Machine operation is stable as the rear wheels are operating on a milled to grade surface, controlled by automatic grade controls. As mentioned earlier, the front axle's frame FIG. 12, 83 is designed to allow a centrally located conveyor and transportation stinger ($5^{th}$ wheel pin, not shown) to pass through its center section 80 (area "A") allowing the axle to raise, lower and tilt the mainframe. The rear axle's frame FIG. 10, 83 is configured to create a space which allows the pug mill's discharge (asphalt windrow) to pass under the frame (area "B") and conveyor to pass over the top (area "A"). Future front clip-on units will be able to receive products consisting of granular, liquid or a mixture of both. Products will be metered and controlled by the on-board computer. Products will be conveyed to the rear of Recycling Machine for complete mixing by the main mill and/or the pug mill. The conveying of materials will be by chain conveyor, belt conveyor, auger, liquid, (wet line) or air conveyance. All conveying systems are designed to pass through the front axle and if required, the rear axle.

Both axles are fitted with steering hubs 86, tag link 87, and steering cylinders 88. The steering hubs 86 pivot 40 degrees in both directions, around axle kingpins 89, bushing 90 and thrust bearing 91. The tag link 87 and steering cylinders 88 are mounted in a low position on the front axle, allowing the conveyor to pass. The rear axle has a high mounted tag link 87 and steering cylinders 88, allowing the pug mill's windrow to pass under the axle's frame and the conveyor to pass through the top, center section. The four drive wheels 8, are driven by low speed, high torque, radial piston, hydraulic motors 89 fitted with fail safe, spring applied, hydraulic pressure released, disc brakes. Speed and direction are infinitely variable. The combination of four-wheel drive, front and rear, 40 degrees wheel articulation (steering), in both directions, allow the Recycling Machine to work safely in hilly conditions and tight city work. One of the rear hydraulic motors 89 is fitted with an electronic ground speed encoder 92, used by the on-board computer to calculate rejuvenator requirements and machine processing speed.

FIGS. 13–21 show the main and extension mill's grade control system. A left-hand 100 and right-hand ski assembly 101 are used to contact the heated, unprocessed asphalt (original grade) slightly ahead of the midway point of the Recycling Machine's long wheelbase, mainframe assembly 3. The extension mill 14 and the main mill 15 are located slightly behind the midway point of the machine's wheelbase. The rear wheels are riding on the milled grade, while the front wheels are following the original grade. Even if the front end of the Recycling Machine's mainframe 3 is moving up and down on an uneven grade, there is little error introduced into the milled grade, due to the location of the grade ski assemblies 100 and 101.

Figure 16:
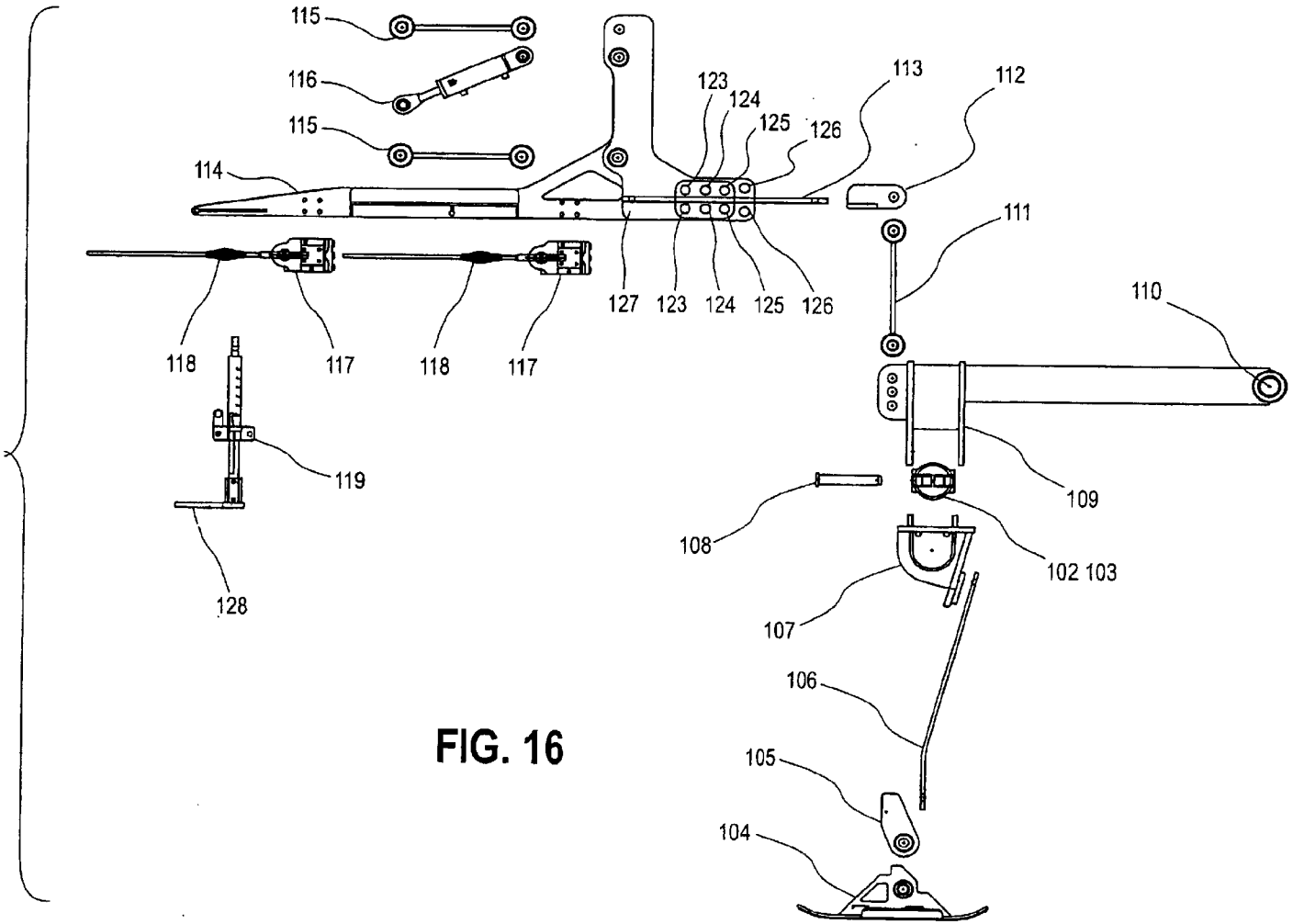

The main and the extension mill's grade control system is manually adjustable, allowing setup for various surface conditions and processing widths. The extension mills (left and right side) are hydraulically adjustable in width and crown, while the main mill, located behind the extension mills is fixed in width. The left ski assembly 100 automatically controls the grade (depth of cut) of the left extension mill and the left side of the main mill. The right ski assembly 101 automatically controls the grade of the right extension mill and the right side of the main mill. The left and right ski assemblies are connected by a jointed, cross beam 102 to which various attachments (used to contact the heated asphalt surface) can be attached. The rotating/sliding joint 103 is located at the mid-point of the crossbeam 102, allowing the beam to rotate and expand in length as the left and right ski assemblies move up and down. Two sliding shoes 104 contact the heated asphalt. As shown in FIG. 16, shoes 104 attaches to pivot arms 105 allowing the shoes to pivot and follow the heated asphalt's surface. Pivot arms 105 attaches to flat springs 106, which in turn attaches to the adjustable clamping brackets 107. The flat springs 106 are used to prevent damage to the ski assemblies, if contact with a raised utility structure should occur. The springs are designed to bend and then spring back to their original position on hitting an obstruction. The clamping bracket 107 can be clamped on to the crossbeam 102 at any location. Generally the further out they are placed, the greater the accuracy (stability). Narrow spacing may be used when following wheel ruts in the asphalt's surface (created by traffic). Pins 108 attach the crossbeam 102 to the left and the right side tow arms 109 that are attached by pins 110 to the mainframe of the Recycling Machine 3. The tow arms pivot on pins 110, allowing the ski assemblies to follow the asphalt's surface. Movement (raising and lowering) of the left and right side ski assemblies is transferred into the pivoting link 111, which is attached between the tow arms 109 and flat spring clamp 112.

The flat spring 113 is clamped to the grade control station's frame 114. The grade control station's frame 114 is attached to the Recycling Machines mainframe 3 by pivoting links 115 and hydraulic cylinder 116. The pivoting links 115 form a parallelogram linkage allowing the grade control station's frames 114 to remain absolutely parallel to the mainframe when being raised or lowered by the grade ski assemblies. Attached to the grade control station's frames are the hydraulic (or optional electronic) sensors 117 and wands 118 that make contact with the adjustable height control screws 119. Brackets 128 attach the height control screws 119 to the extension mill sliders 120 and main mill sliders 121. Four individually controlled, hydraulic cylinders 122 attached between the Recycling Machine's mainframe 3 and the mill sliders 120 and 121 are used to hydraulically raise and lower the left and right side of the extension and main mills. The left, sensor control station operates the left extension mill and left side of the main mill, while the right, sensor control station operates the right side of the mills. Each grade control sensor 117 (attached to the sensor control station) and wand 118 monitors the position of the height screws 119 allowing the height of each sliding strut to be adjusted individually to the position of the grade control station's frame 114.

FIG. 16 shows a close up, side view of the mill's grade control system. As the ski assemblies 100 and 101 are pulled along by the Recycling Machine's mainframe they follow the grade of the asphalt's heated surface, which raises or lowers the pivoting link 111, spring clamp 112, flat spring 113 and grade control station's frame 114. The function of the hydraulic lift/damper cylinder 116 is to carry a percentage of the grade control station's frame, crossbeam and averaging ski assembly's weight, preventing the shoes 104 from sinking into the hot asphalt, which causes inaccurate reading. The amount of weight transferred by the cylinder 116 can be adjusted by varying the hydraulic pressure on the head end of the cylinder. The weight transfer pressure can be electronically switched in and out by the on-board computer. Increasing the hydraulic pressure will reduce the weight carried by the ski shoes 104. The grade control station's frame movement must be dampened to prevent the mills from following major imperfection in the asphalt's surface. The hydraulic lift/damper cylinder 116 dampens the mechanical action of the grade system by restricting the cylinder's hydraulic, oil flow (similar to an automotive shock absorber). Adjustable hydraulic flow control valves are electronically switched in and out by the on-board computer when dampening is required. Dampening and weight transfer are both possible, at the same time. The hydraulic cylinder is also used to raise the complete grade system by increasing the hydraulic pressure on the head end of the cylinder. The flat spring 113 is designed to deflect if the ski assembly is suddenly pushed up by an obstruction or suddenly sinks due to a pothole or any other type of depression. The rate of the flat spring is adjustable by changing the outer pivot point of the spring by moving two pins 123 (located above and below the spring). To do this, a plurality of adjustment points 124–126 is provided to change the effective length of spring 113. The spring is attached to the grade control station's frame 114 at point 127. Moving the two pins 123 away from point 127 will increase the spring rate. In the dampening mode, the hydraulic lift/dampening cylinder restricts the movement of the grade control station causing the flat spring 113 to deflect. The hydraulic and mechanical adjustments provide a wide range of control for all operating conditions and ski attachments. The grade sensors 117 (hydraulic type shown) are attached the grade control stations. The wands 118 are attached to the grade sensor's rotating shaft and rest on the adjustable height screws 119, which are attached by brackets 128 to the sliders 120 of the extension and 121 of the main mills. Any change in the position of the grade control stations will raise both sensors 117 causing the wands 118 to pivot (move away from their neutral position) on the adjustable height adjuster screws 119 and rotate the sensor shafts. The sensors send hydraulic oil to the individual hydraulic cylinders 122, raising or lowering the extension and main mill assemblies. As the mills are raised or lowered the height adjuster screws 119 return the wands back to their neutral position, cutting off the hydraulic oil flow to the hydraulic cylinders. The mill grade control system also corrects for grade changes caused by the Recycling Machine's front axle assembly following the uneven grade of old asphalt surfaces. Changes to the mainframe's front height, in relation to the ski assemblies, will cause the mainframe to pivot around the rear axle's wheel centerline. The ski assemblies 100 and 101, which are following the asphalt's surface, position the grade control station's frames 114. The height adjuster screws 119 follow the mainframe's position (hydraulic cylinders 122 have not moved at this point) causing the wand's position to change, which in turn will hydraulically (cylinders 122 receive hydraulic oil from the hydraulic sensors 117) raise or lower the sliders, mills and height adjuster screws, again neutralizing the system. The height adjustment screws 119 allow manual adjustment to each individual mill slider to fine-tune the milling height between the extension mills and the main mill. The extension mills 14

(left and right side) feature manually, hydraulic crowning of the milling rotors. The machine operator can adjust the crown without effecting the position of the sliders, which control the depth of the extension and main mills.

Figure 17:
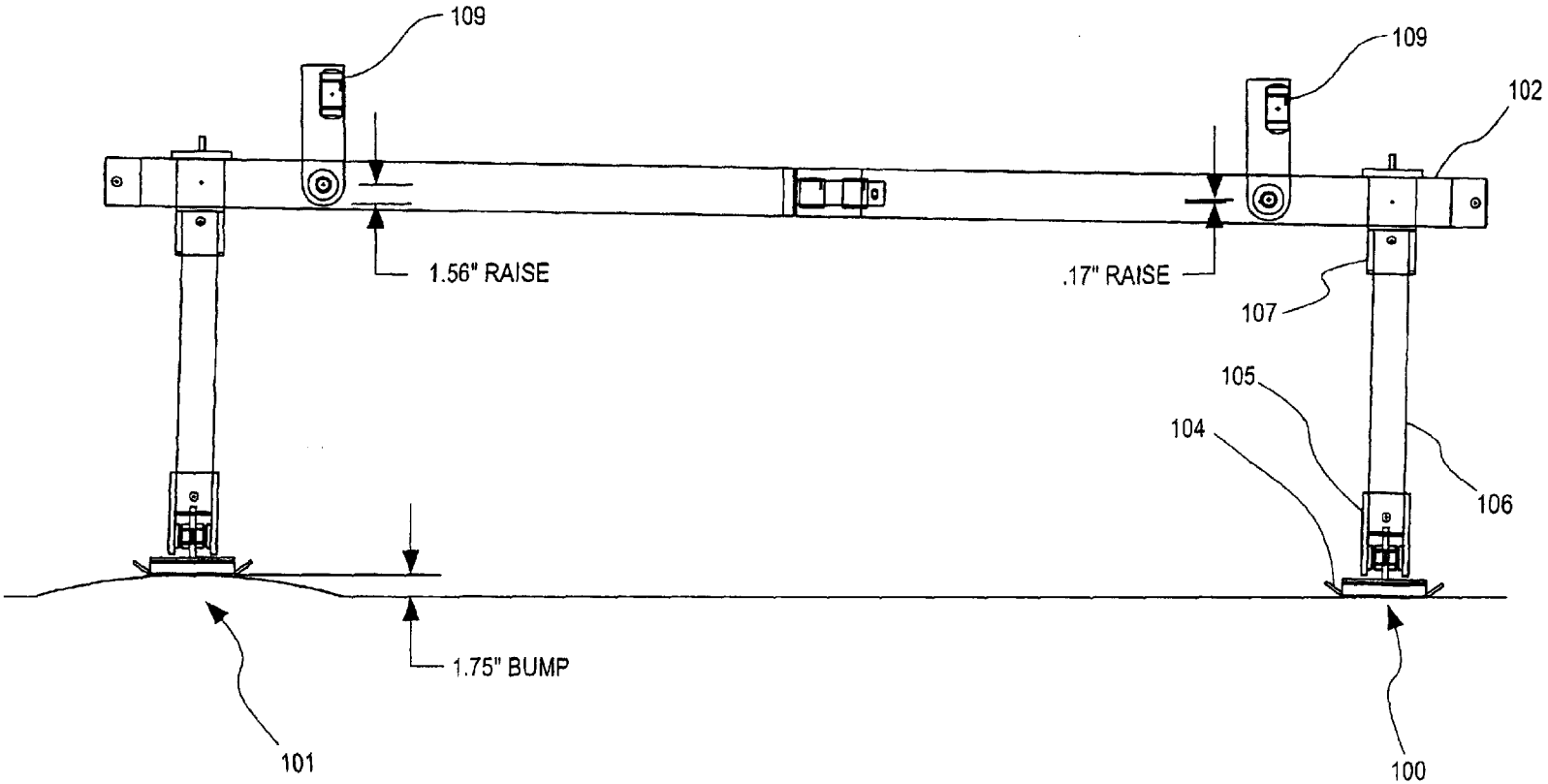
Figure 18:
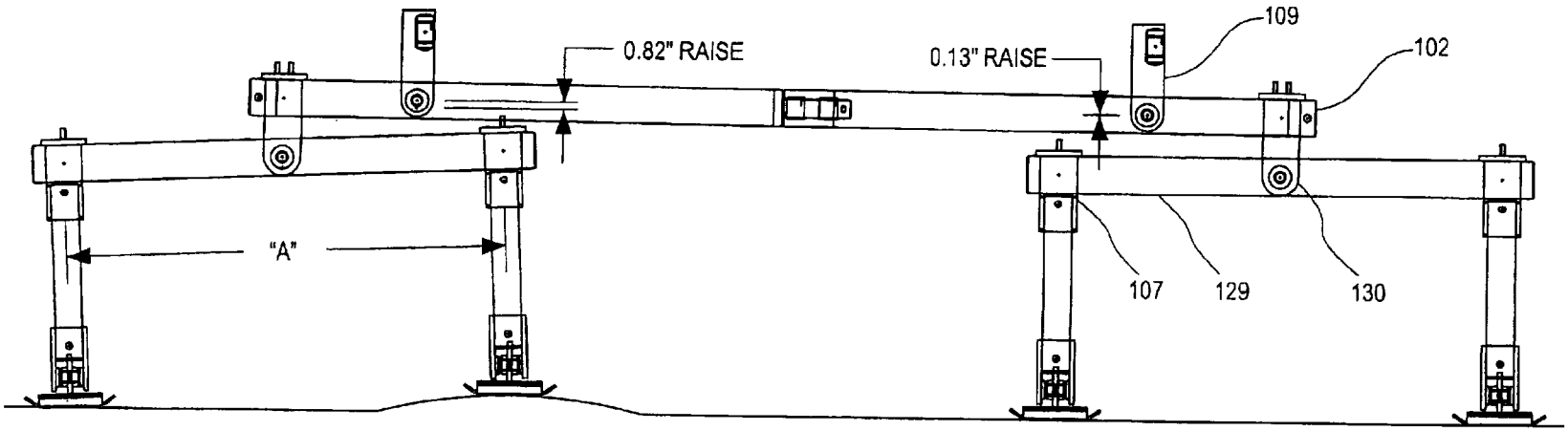

For processing requiring greater milling accuracy the standard two ski assemblies shown in FIG. 17 can be replaced by the transversal averaging ski assemblies shown in FIG. 18. Both assemblies are shown with one ski assembly riding over a 1.75" bump. The standard ski would transmit an upward movement of 1.56" into the tow arms 109 which would cause the 1.56" of movement to be transmitted to the link 111. The transversal averaging ski would reduce the upward movement to 0.82" riding over the same bump, causing 0.82" to be transmitted to link 111. The wider the "A" dimensions the greater the averaging effect. Lowering the number transmitted to link 111 results in less movement of the mills in response to an aberration in the road surface. The sub beams 129 are attached to the jointed, crossbeam 102 by pivoting bracket 130. When the width of processing allows, the length of the crossbeam 102 can be increased with plug-in extensions allowing the averaging skis to be moved further out from the Recycling Machine's longitudinal centerline, again improving the averaging effect.

Figure 19:
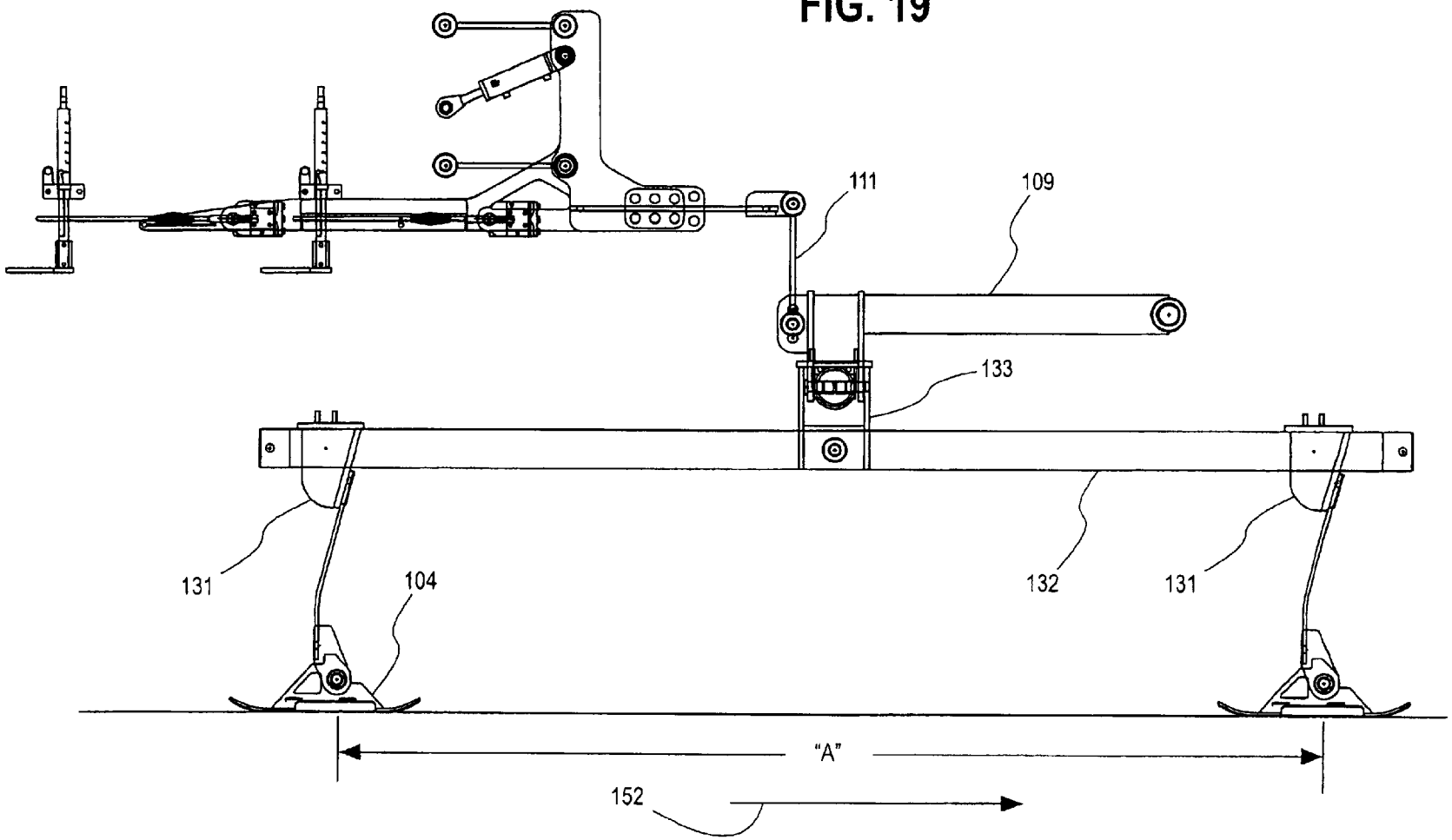

As shown in FIG. 19, an additional embodiment of the invention includes longitudinal averaging ski assembly set up with the ski assemblies at a wide distance ("A"). This is only possible when the ski assemblies can be widened out to a width greater than the Recycling Machine's heater box, rake extensions and extension mills, such as multi-lane highways and airport runways. Adjustable brackets 131 attach the ski assemblies to longitudinal beam 132 that pivot around bracket 133. The beam 132 can be increased in length by attaching plug-in extensions. It is also possible to attached longitudinal sub-pivoting beams together with four ski assemblies similar to the transversal setup but operating in the longitudinal axis. The ski assemblies can be replaced with wheel assemblies when operating on surfaces that could be marked by the ski assembly shoes 104.

Figure 20:
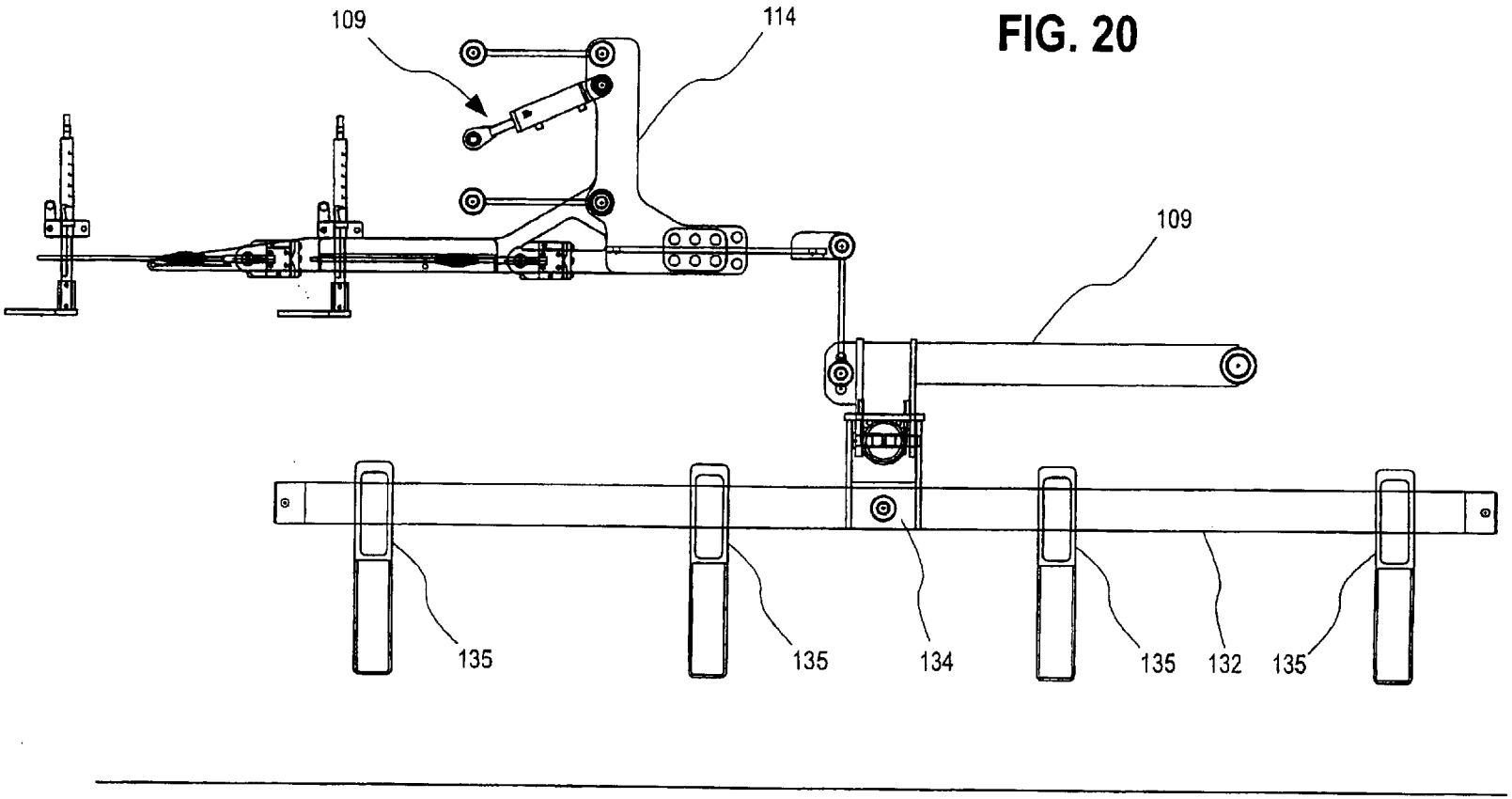

FIG. 20 shows another embodiment of the present invention where the mechanical longitudinal averaging ski assemblies are replaced with Topcon's Smoothtrack® 4 Sonic Tracker II™ non-contact, averaging beams (one on either side of the Recycling Machine). The longitudinal beam 132 is attached to the standard, jointed crossbeam 102 by fixed bracket 134, which prevents beam 132 from pivoting. The non-contact sonic sensors 135 are attached to beam 132. The hydraulic operation of the lift/damper cylinder 116 is controlled by Topcon's electronic control system. The hydraulic damper and pressure transfer system are not used in this application, as the hydraulic cylinder must operate in the standard, double acting mode. The mill's depth of cut is electronically set using the Topcon keypad. The electronic, sonic grade control system controls the oil flow to hydraulic cylinder 116, which positively raises or lowers the grade control station's frames 114, beam 132 and sensors 135. The mills follow the position of the grade control station's frames.

Figure 21:
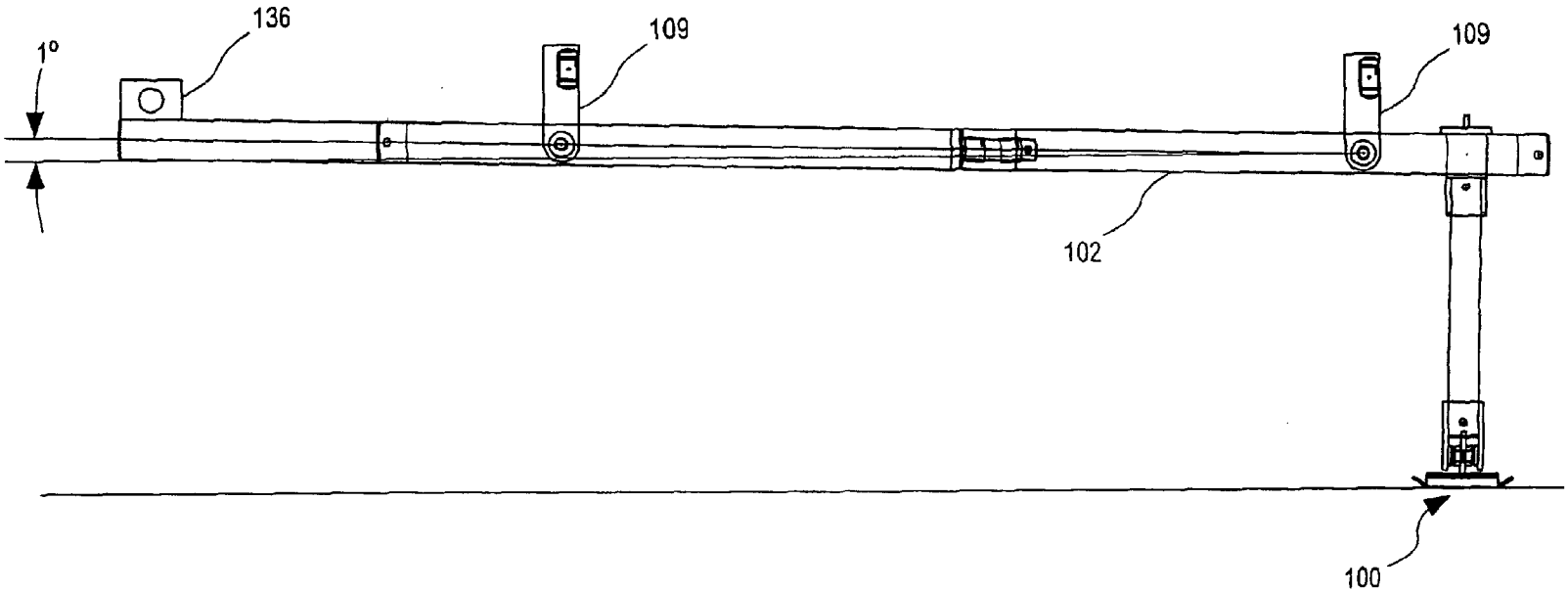

FIG. 21 shows the standard, left-hand transverse ski assembly 100 (looking from the front of the Recycling Machine) attached to the jointed crossbeam 102. Attached to the right side of the jointed crossbeam 102 is the electronic slope sensor 136. Both the left-hand ski assembly 100 and the slope control 136 sensor are mounted as far away from each other as possible, increasing the slope sensor's accuracy due to the leverage effects. The left lift/damper cylinders 116 is set to operate on the damper and weight transfer control, while the right cylinder is set for double acting operation (dampening and weight transfer turned off). In operation, the left-hand ski follows the asphalt's surface, which in turn raises or lowers the left side of the crossbeam 102. The left-hand tow arm 109 transfers this motion into the left grade control station as discussed previously. The slope control sensor 136 (set to one-degree slope, in the drawing) electronically monitors the angle of the crossbeam 102. The slope sensor will pick up any change in angle and the electronic control system will control the oil flow into the right-hand cylinder 116, returning the right-hand grade control station and crossbeam 102 back to the one-degree setting.

The main and extension mill grade control system can also be set up to operate the two rear axle cylinders 81, providing the reference for full, main frame grade control (as discussed earlier). In this case fully extending the hydraulic cylinders 116 raises the left and right grade control station's frames 114, thereby hydraulically locking the mills to the mainframe's grade. Adjusting the height adjustments screws 119 can individually control adjustments to the mills depth of cut.

Figure 22:
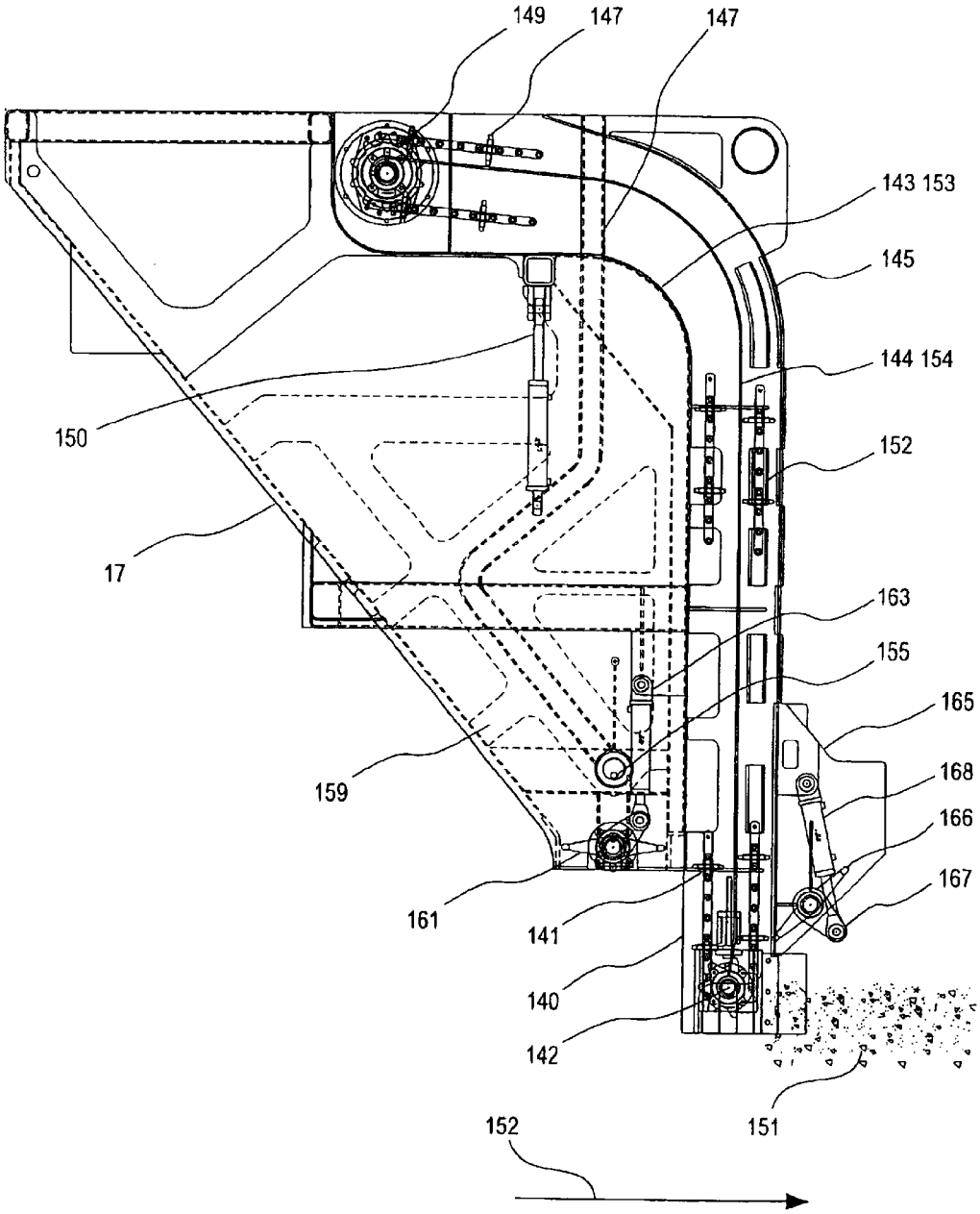
Figure 23:
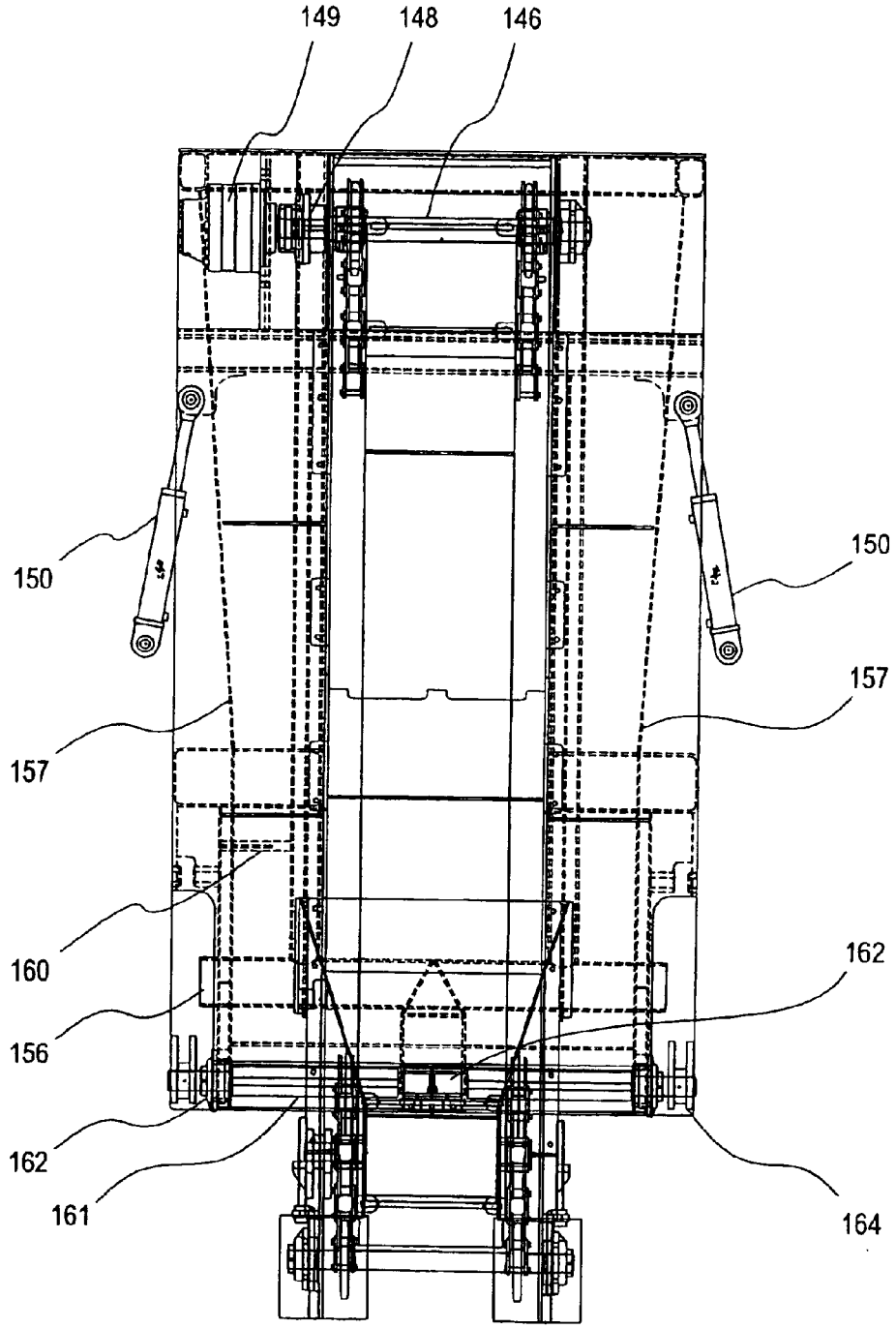

FIGS. 22 and 23 show the heated, insulated and covered asphalt surge bin/vertical elevator 17. The vertical elevator 140, consists of frame 141, lower idler shaft 142, inner chain guide 143, middle chain guide 144, outer chain guide 145, drive shaft 146, slatted chain 147, motor coupling 148, and hydraulic drive motor 149. Hydraulic cylinders 150 raise and lower the surge bin/elevator 17 into the windrow 151 when the machine moves along path of travel indicated by arrow 152. The on-board computer monitors a pressure transducer, used to record the head end hydraulic pressure (load carrying pressure) in the hydraulic cylinders 150. At a set pressure increase (bin full of asphalt) the hydraulic drive motor 149 is stopped, stopping the pickup of recycled asphalt from windrow 151. As asphalt is released out of the bin the cylinder's hydraulic pressure decreases. The hydraulic motor 149 is re-started when a preset minimum pressure is reached, again allowing asphalt to be picked up from the windrow, This allows for the automatic filling of the bin. The vertical elevator 140 can also run in manual mode, controlled by the ground operator. Asphalt is lifted, vertically up the front face of the conveyor frame 152, by slatted chain 147, operating between two vertical wear plates 144 and 145. The wear plates are the full width of the slated chain, preventing the asphalt from falling back and segregating. The surge bin 17 is constructed with insulation attached to the outer walls and provides heat retention for the stored asphalt. Propane (vapor from top of the propane tank) is supplied to the burner 155, which is mounted in a horizontal, double walled tube 156, spanning the complete width of the bin's sides 157. The double wall tube prevents direct flame contact with the outer tube (in contact with asphalt), preventing the asphalt from being overheated. Two vertical tubes 158 are used to exhaust the horizontal burner tube to the top of the bin, for safety. The tubes are angled using bends and are attached to vertical baffle plates 159 Controlled heat, transmitted over a large effective area by 156, 157, 158 and 159, increases the heat transfer to the stored asphalt and reduces oxidation. Burner control is automatic and is controlled by an adjustable bin thermostat 160. The surge bin's rotary discharge valves (left and right side) 161 are mounted in four replaceable bearings 162 and are opened/closed by two independently controlled, hydraulic cylinders 163 attached to arms 164. The arms 164 are used to turn the rotary discharge valves 161 allowing the stored (heated) asphalt to fall into the left and right auger screws (located in front of the screed assembly). Attached to the front of the vertical elevator is the hopper/diverter valve assembly 165. The hopper receives new asphalt from the front asphalt hopper (an option attached to the front of the Recycling Machine) via the optional central conveyor (both described in detail later). Rotary valve 166 is attached by arm 167 to the hydraulic cylinder 168. In the position shown, the valve would be directing the asphalt delivered by the conveyor into the vertical elevator for delivery into the bin for storage.

Figure 24:
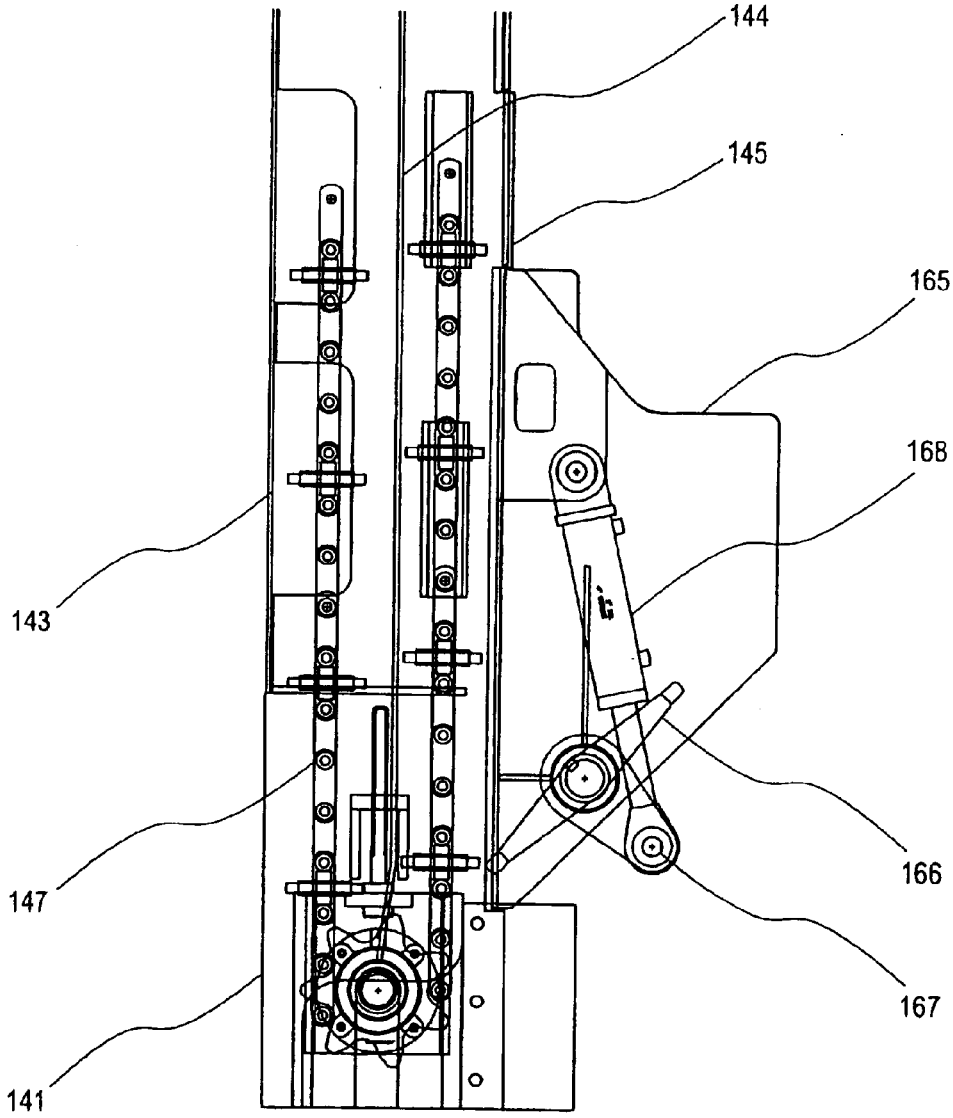

FIG. 24 shows a close up side view of the hopper/diverter valve with the rotary valve 166 in the closed position.

Figure 25C:
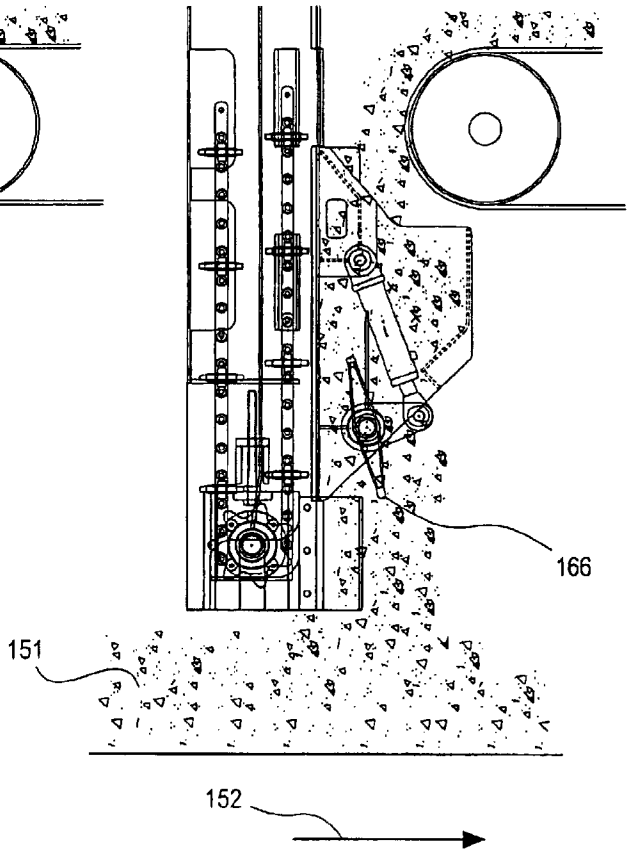
Figure 25B:
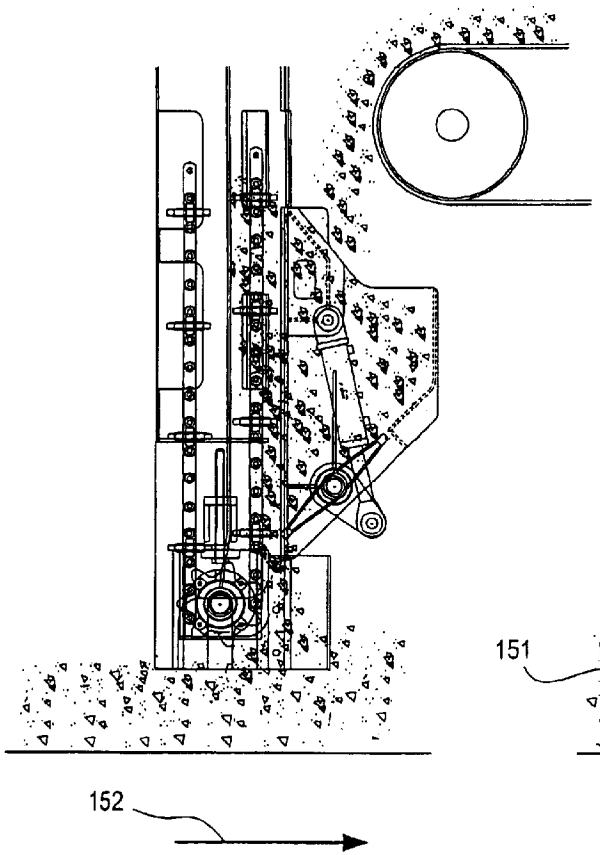
Figure 25A:
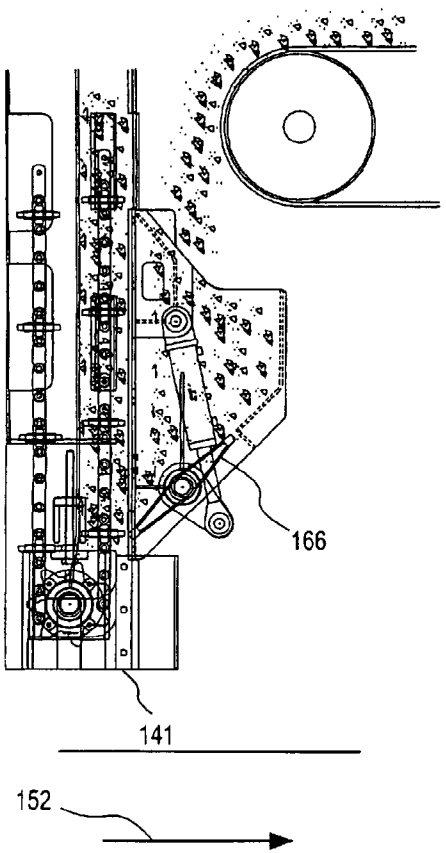
Figure 26:
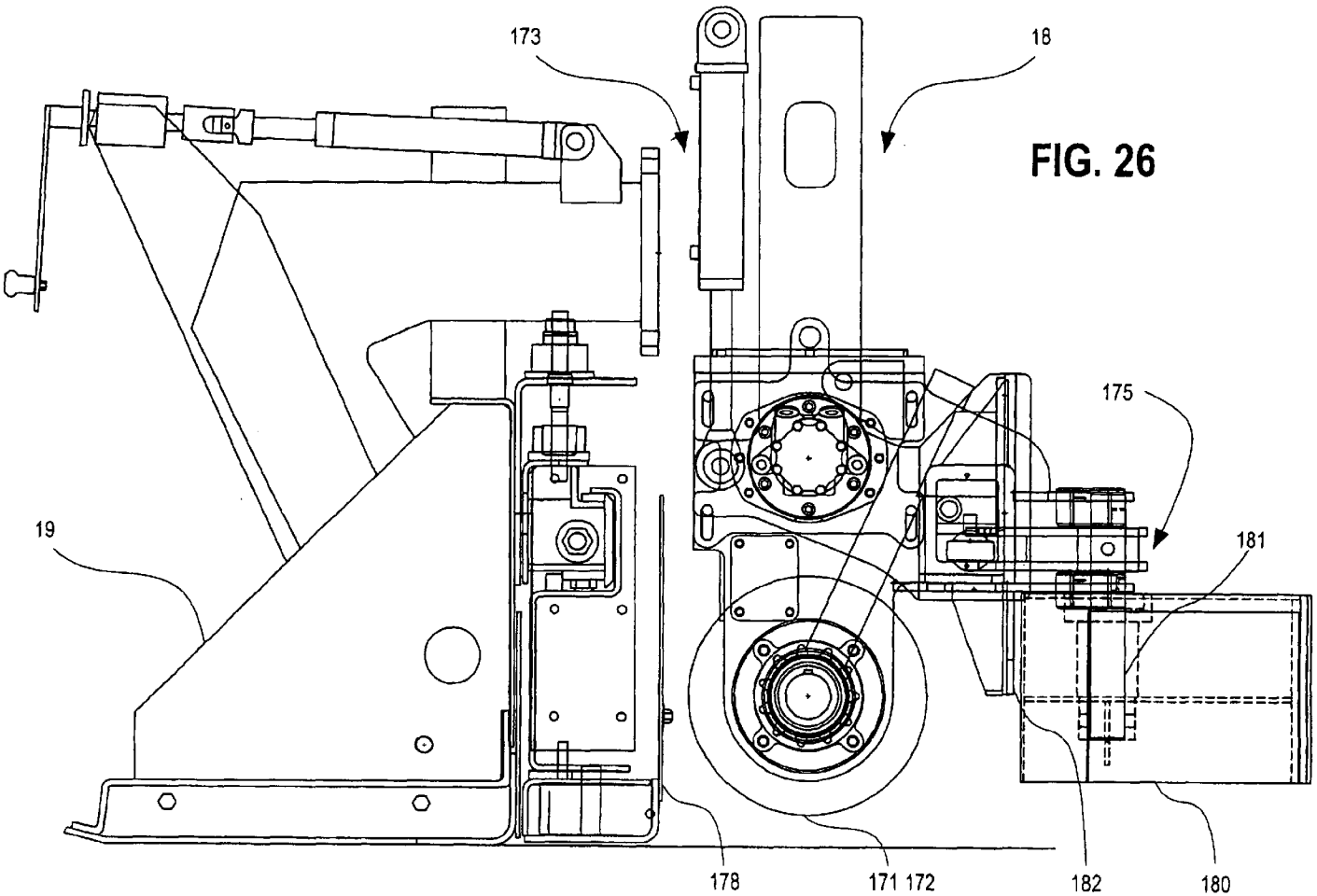
Figure 27:
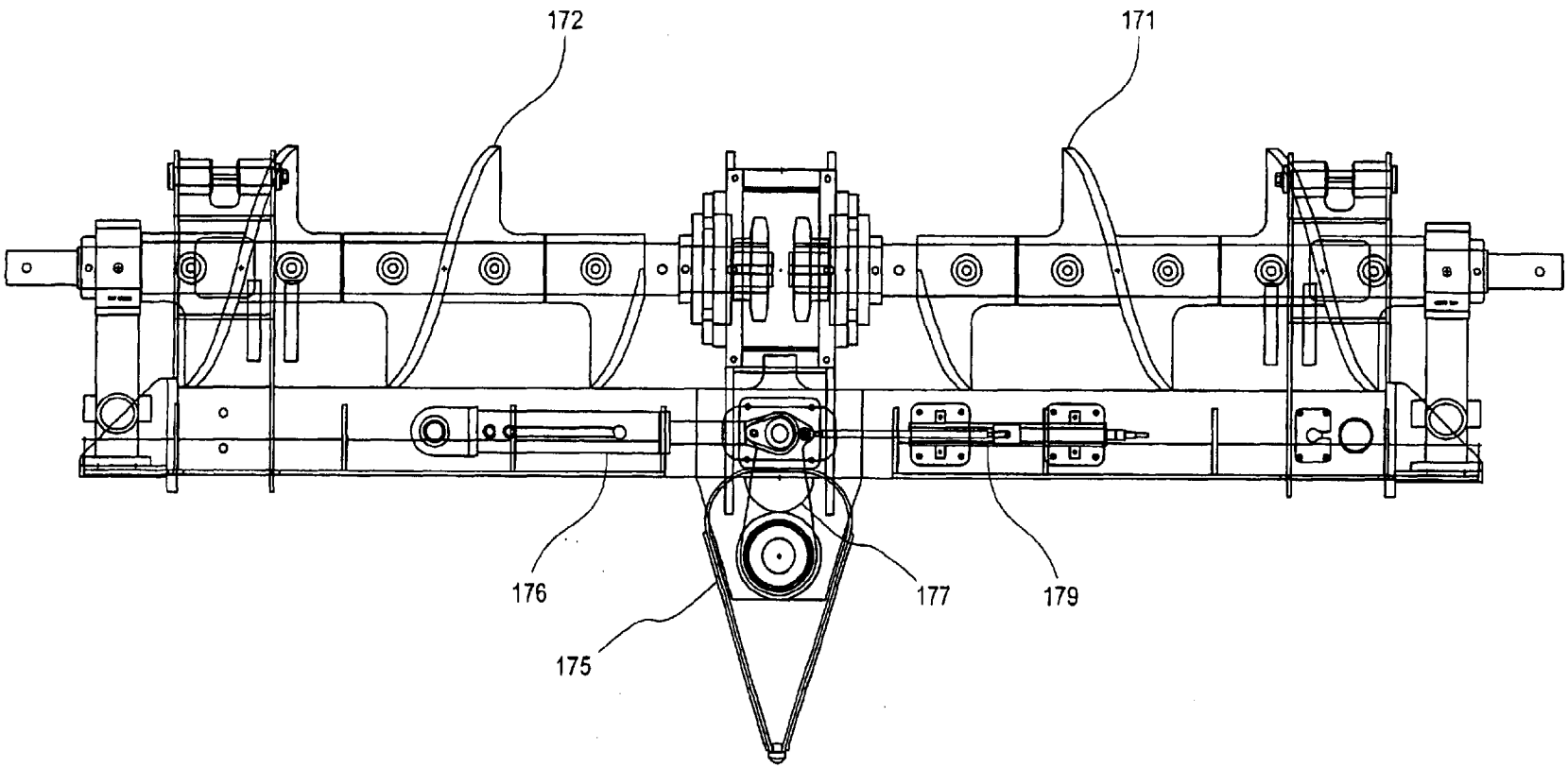
Figure 28:
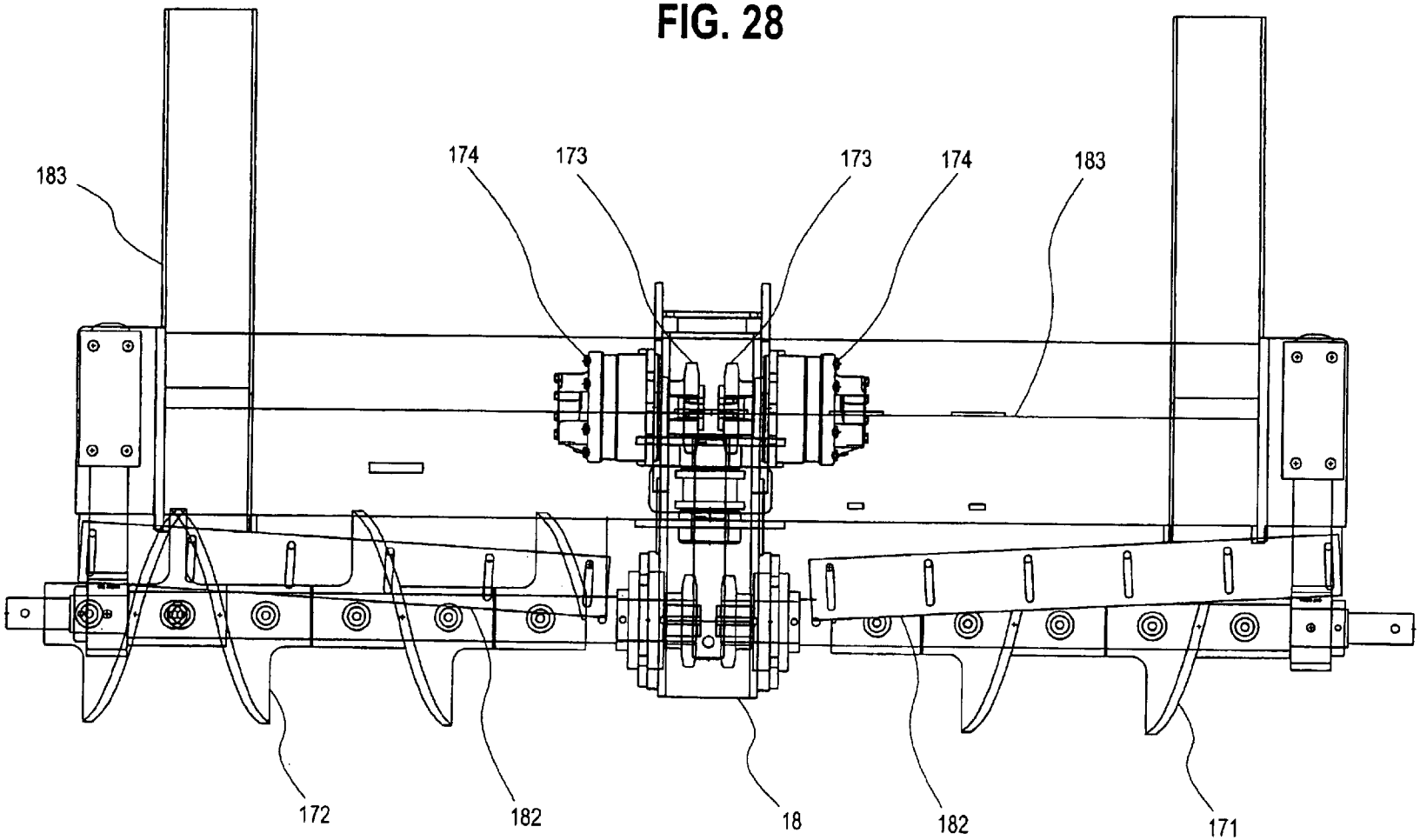

FIG. 25 shows the hopper/diverter valve in the three operating modes traveling in the direction shown by arrow 152. FIG. 25A shows the conveyor discharging new asphalt into the hopper. In this mode the rotary valve 166 is closed and the vertical elevator 141 is running. New asphalt is carried up the front of the vertical elevator and fills the surge bin. This operation is used when the surge bin must be initially filled with new asphalt (no windrow has been established). Due to the off-center boom location, the bin may be top loaded manually as well. FIG. 25B shows the conveyor discharging new asphalt into the hopper for a Remix operation. In this mode the rotary valve is closed and the vertical elevator is running and also picking up 100% recycled asphalt from the windrow 151 left by the pug mill. New asphalt is being blended with the recycled asphalt in the vertical elevator and is being carried up the vertical elevator, filling the surge bin. FIG. 25C shows the conveyor discharging new asphalt into the hopper. In this mode the rotary valve is open and the vertical elevator is not running. The amount of 100%, recycled asphalt contained in the windrow 151, left by the pug mill, is not sufficient to maintain a constant head of asphalt in front of the screed assembly. New asphalt passes through the rotary valve (bypassing the vertical elevator) directly on to the windrow or the milled asphalt's surface. The on-board computer determines when the Recycling Machine's front hopper and conveyor supplies new asphalt by monitoring the volume of asphalt flowing through the pug mill's volume sensing ski. Both the "B" and "C" modes can be used when the "Remix Method" (new asphalt is proportionally mixed with 100% recycled asphalt) is required. The "B" and "C" also allow the Recycling Machine to process asphalt surfaces requiring more asphalt than is available, such as increasing the structural strength of the original asphalt, grade changes and shoulder widening.

FIGS. 26–29 shows the asphalt auger/divider/strike-off blade assembly 18. The auger/divider/strike-off blade assembly 18 distributes material evenly to left and right side of the screed assembly 19. The screed assembly 19 is an industry standard unit with all major adjustments being electric/electronic over hydraulic. The screed may be equipped with left and right side extensions. The auger/divider/strike-off blade assembly 18 consists of a left 171 and right 172 auger (looking from the front of the machine) rotated by individual sprocket/chain drives 173 and hydraulic motors 174. The auger's speed is infinitely variable in both directions, allowing asphalt contained in the windrow 151 to be moved in all directions across the front face of the screed assembly. The windrow divider 175 splits the asphalt windrow 151 and assists the left and right augers 171 and 172 in the distribution of the asphalt windrow 151, especially on cross slopes and during conditions requiring high volumes of continuous material to either side of the screed assembly. Two hydraulic cylinders 173 are attached between the Recycling Machine's mainframe 3 and the augers mainframe 183, allowing the auger/divider/strike-off blade assembly 18 to be raised and lowered for varying depths of asphalt laid by the screed assembly. The windrow divider 175 is positioned (turned) by the hydraulic cylinder 176 and arm 177 and is controlled manually or, automatically by the on-board computer. Two electronic sensors (not shown) are located at the end of the screed's extensions and determine the level of the asphalt in front of the screed and screed extensions. As the level of asphalt in front of the screed assembly drops, the electronic sensor(s) automatically speed up the appropriate auger 171 or 172, delivering more asphalt across the front face of the screed 178. The angle of the divider 175 is controlled proportional to the speed of each individual auger. An electronic feedback LVDT 179 compares the divider's rotational position to each individual auger's speed. The divider is fitted with replaceable and adjustable blades 180 allowing the height of the divider to be set in relation to the auger's height. For major height adjustments, adding or removing spacers to the rotational shaft 181 moves the divider up and down.

Figure 29A:
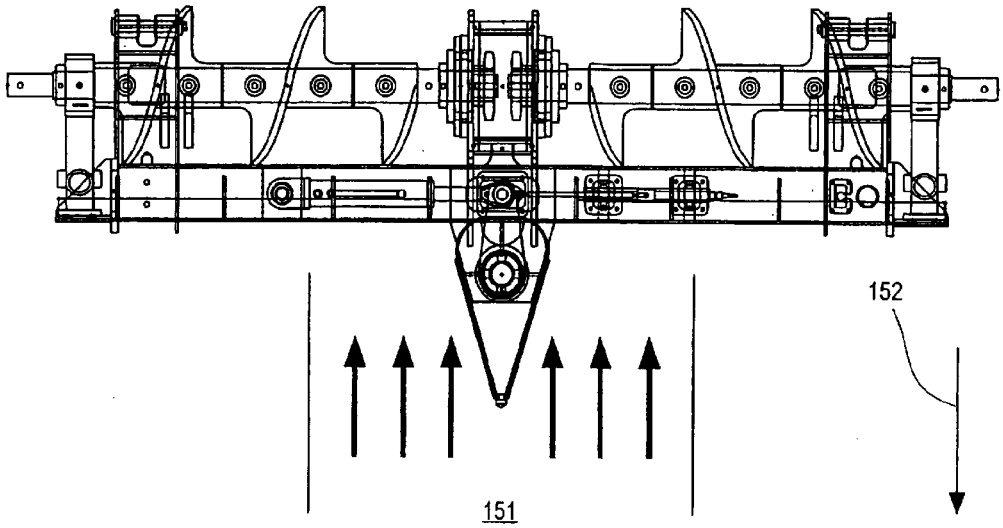
Figure 29B:
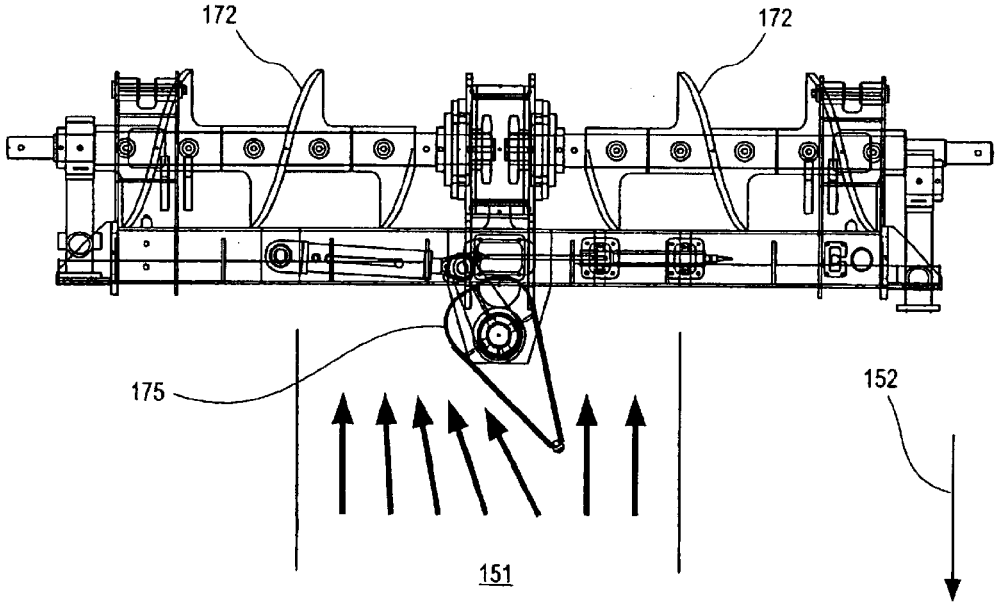

FIG. 29 shows the asphalt auger/divider/strike-off blade assembly with the divider 175 in the straight-ahead position "A". Both augers are being controlled to the same speed by the electronic sensors mounted on the screed's extensions. The windrow 151 is being split equally to both augers and the asphalt head in front of the screed assembly is even. "B" shows the position of the divider at its maximum rotational angle (in one direction, deflecting a greater proportion of asphalt into the faster auger). The right-hand auger's speed has increased as a result of the right-hand side of the screed and screed extension running low on asphalt. The right-hand sensor has sped up the right-hand auger 172 in an effort to maintain sufficient supply of asphalt at the section of the screed laying the greatest volume of asphalt. The on-board computer has proportionally increased the rotational angle of the divider to match the increased speed of the right-hand auger. The divider angle can be programmed to degrees/per auger RPM, allowing the gain (sensitivity) of the system to be varied for varying applications and asphalt types. To meet additional demands for material, the surge bin rotary valves 161 will open allowing stored asphalt to be dumped into the augers. The manually adjustable strike-off blades 182 are attached to the auger's mainframe 183 and are used to control the flow of asphalt to the left and right augers, preventing excessive asphalt build-up in the augers and in front of the screed assembly, which would cause the screed to rise, due to the increased pressure. The strike off-blades (left and right side) are slotted, allowing for adjustment in height and taper. The height of blade becomes greater towards the end of the augers, allowing more asphalt to flow under the blades towards the end of the augers.

Figure 30:
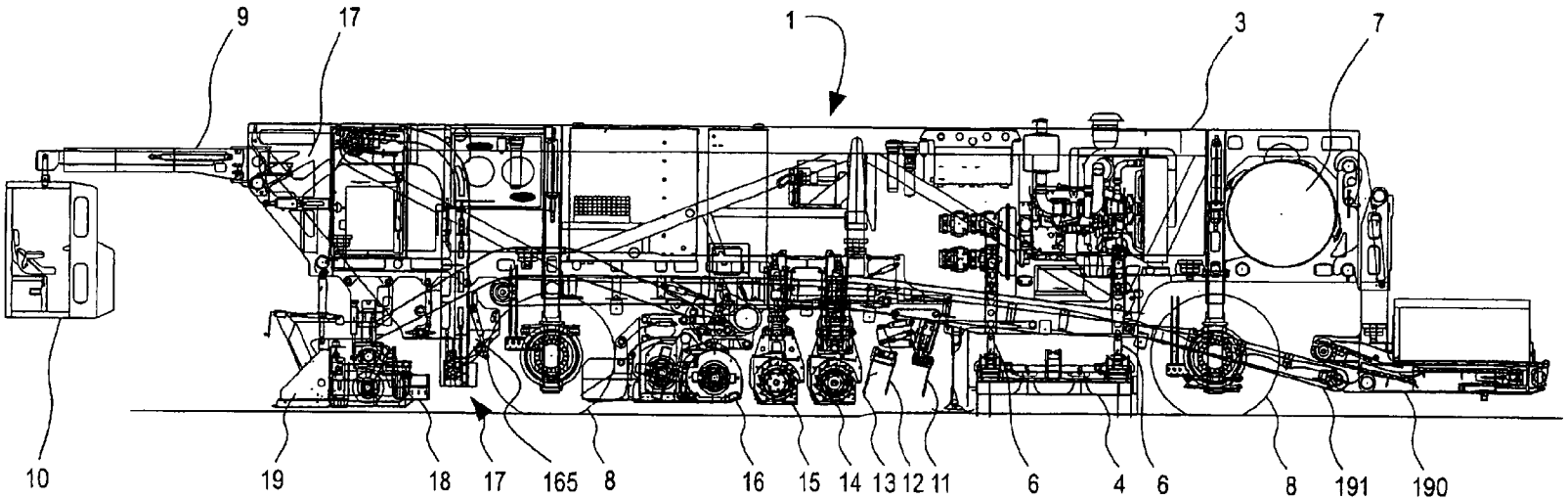

FIG. 30 shows a detailed side view the Recycling Machine 1 with the attached clip-on, front asphalt hopper/$5^{th}$ wheel pin assembly 190 and the central conveyor assembly 191, which runs down the center of the machine to feed new asphalt to the hopper/diverter valve assembly 165. As explained previously, the hopper and central conveyor are used to provide new asphalt when using the "Remix Method" or when extra asphalt is required, such as for shoulder widening.

Figure 31:
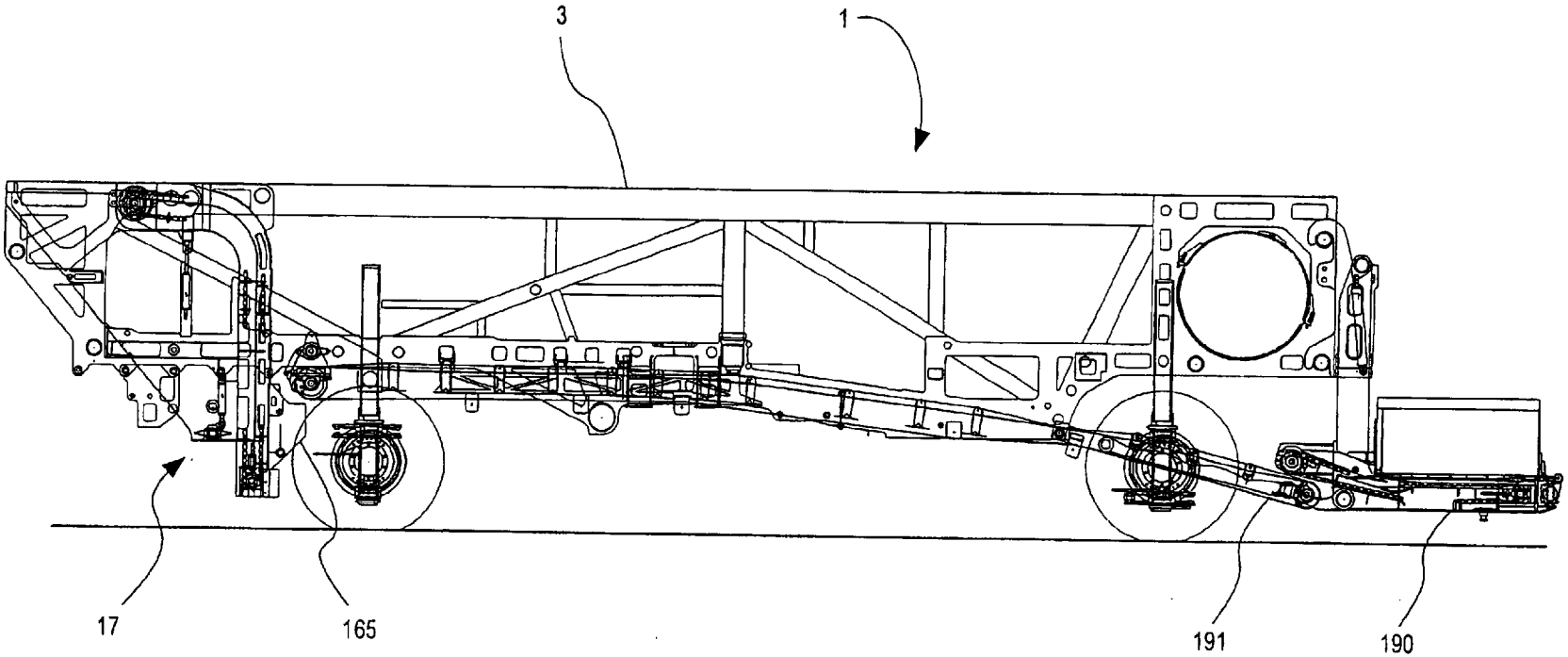

FIG. 31 shows a simplified view of the Recycling Machine 1 with the major sub-assemblies removed for clarity. Shown are the mainframe 3, clip-on, front asphalt hopper/$5^{th}$ wheel-pin assembly 190, central conveyor assembly 191, hopper/diverter valve 165 and asphalt surge bin/vertical elevator 17.

Figure 32:
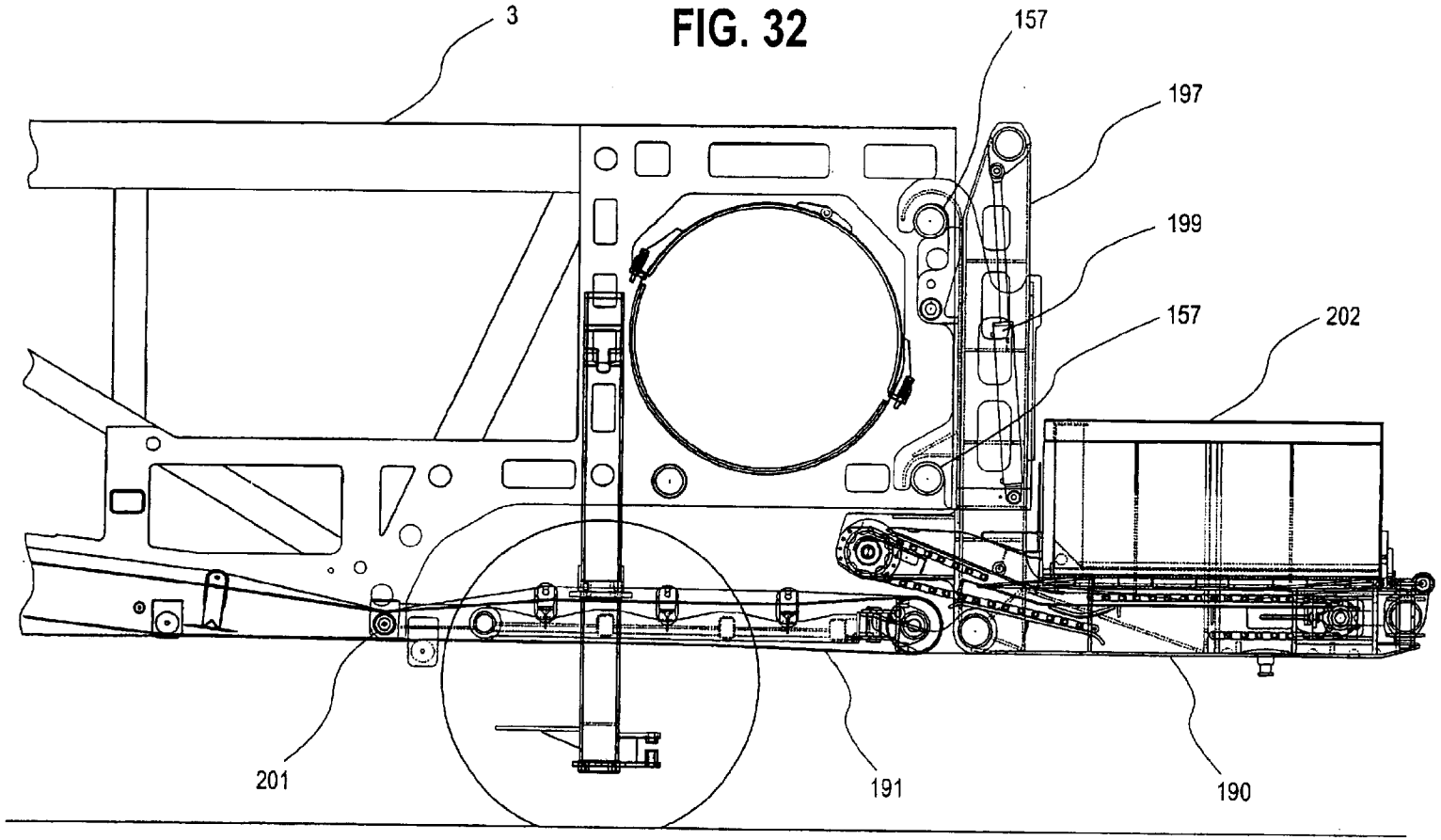
Figure 33:
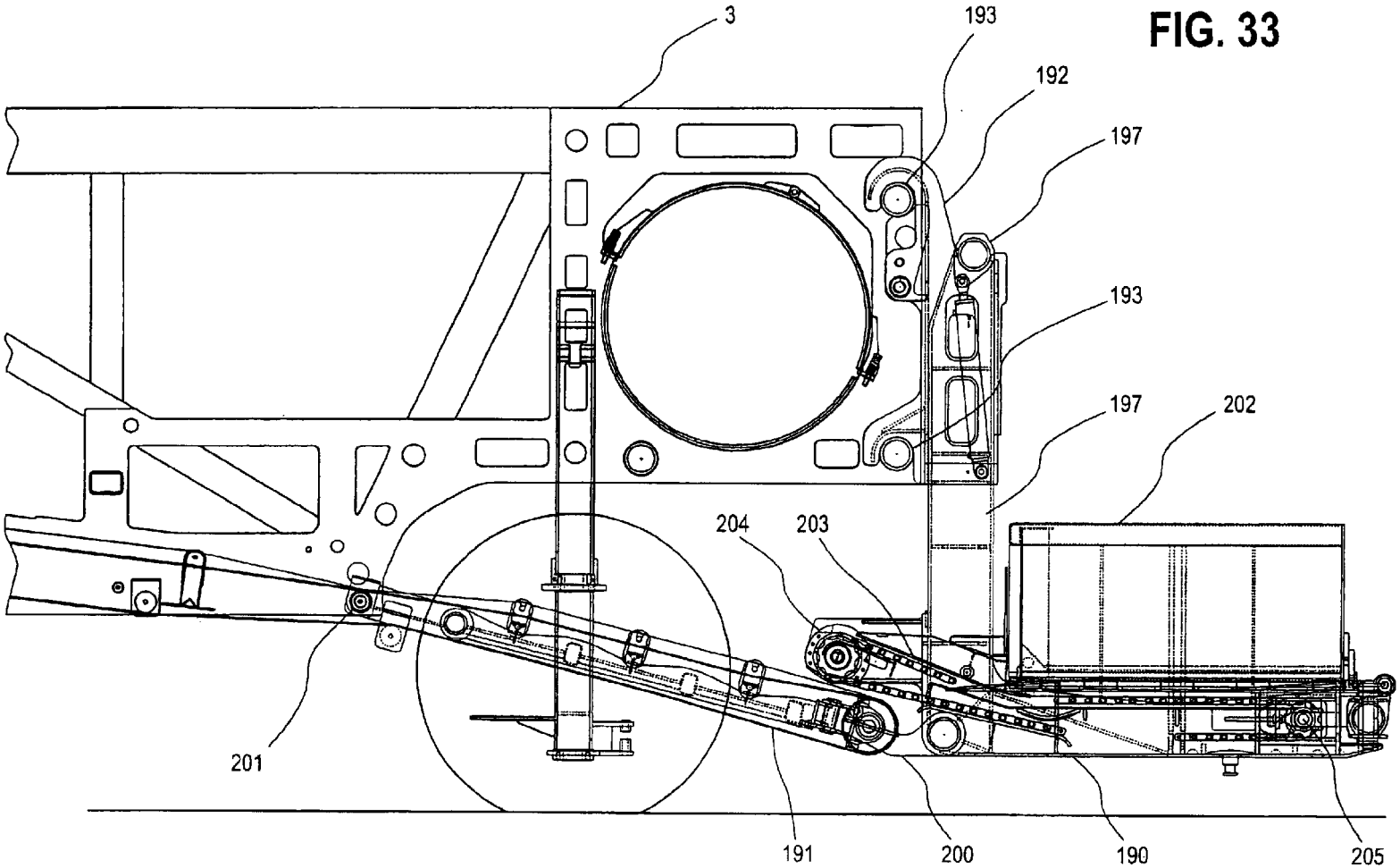

FIG. 32 shows the clip-on, front asphalt hopper/$5^{th}$ wheel pin assembly 190 in its raised position and FIG. 33 shows the clip-on, front asphalt hopper/5$^{th}$ wheel pin assembly 190 in its lowered position. The clip-on frame 192 is attached to the Recycling Machine's mainframe 3 top and bottom tubes 193.

Figure 34C:
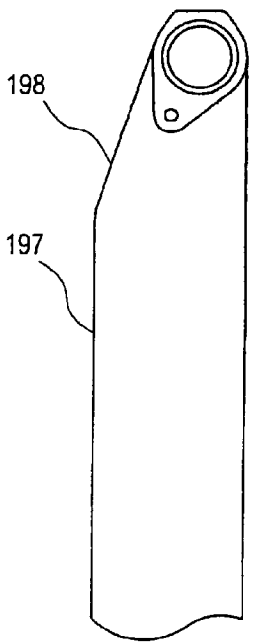
Figure 34B:
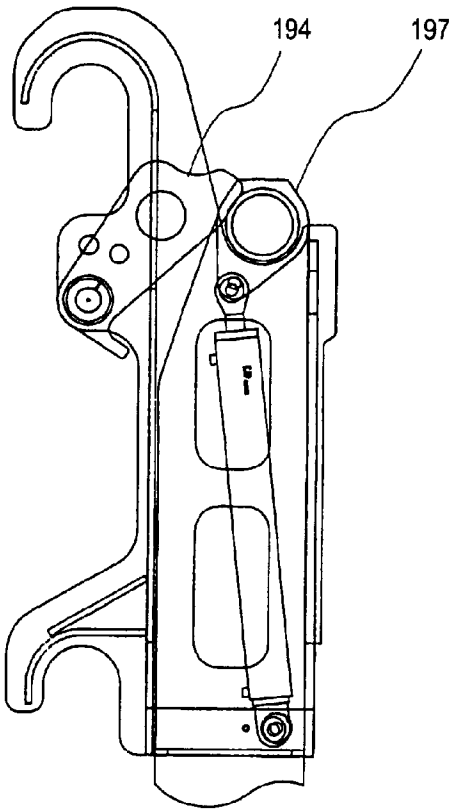
Figure 34A:
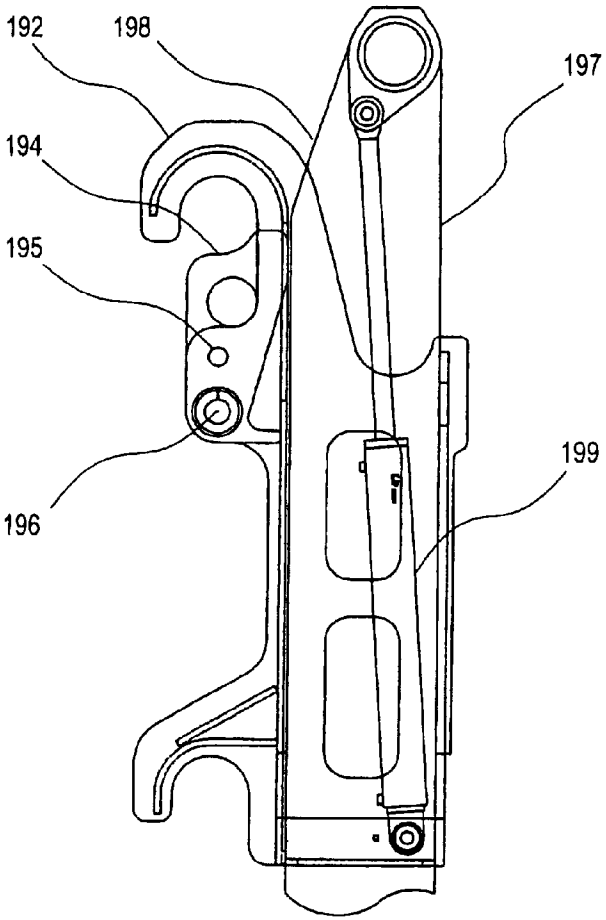

FIG. 34 shows the frame 192 with its safety locks 194 in the open and closed position. The two safety locks 194 (one on either side of the frame 192) are mechanically pinned into position by safety pins 195. Pivot pins 196 allow the safety locks to be opened when the safety pins are removed. The safety locks can only by opened when the clip-on, front asphalt hopper/5$^{th}$ wheel pin assembly 190 is in the lowered position as the top section of the frame assembly 197 is tapered at point 198 and only allows clearance in this position. This design feature provides a fail-safe attachment mechanism for transportation (raised position) as the frame assembly 197 physically prevents the safety lock from opening, even if the safety pins were not installed. The hydraulic cylinders 199 are attached between frame 192 and frame 197. Extending the hydraulic cylinders 199 raises the front asphalt hopper/5$^{th}$ wheel pin assembly 190. An electronic pressure transducer is used to measure the pressure in the hydraulic cylinders 199. The on-board computer monitors the amount of asphalt in the front hopper using the pressure in the cylinders as a reference. The pressure is checked at the beginning of the work day by the on-board computer to determine a base line for the assembly weight of the front asphalt hopper/5$^{th}$ wheel pin assembly, as it will change with accumulated asphalt deposits. The on-board computer gives the operator a graphical display of the weight of asphalt in the front hopper. The on-board computer may also signal the dump truck drivers when to discharge more asphalt into the front hopper. The signal may be audio, electronic or the use of a red and green light, located on the front of the Recycling Machine. Both lights are visible in the truck's side mirror. The systems may also use a live bottom (moving floor) trailer with electronic wireless control of the hydraulically driven, variable speed, live bottom floor, which is generally a belt or slat conveyor. The Recycling Machine will automatically control the discharge rate of asphalt into the front hopper. The front asphalt hopper/5$^{th}$ wheel pin assembly can be raised and lowered while asphalt is being discharged on to the conveyor assembly 191, however the height is limited by electronically monitoring the position of frame assembly 197. Two arms 200 (one on either side of the frame assembly) are attached to frame assembly 197 and contact the conveyor assembly 191, allowing the front section of the conveyor to follow the movement (raise and lower) of the front asphalt hopper/5$^{th}$ wheel pin assembly. The central conveyor assembly 191 is attached to a Recycling Machine's mainframe 3 at point 201, reference of the front axle. This allows the front section of the belt conveyor to pivot. Any change in the conveyer's tension during this movement is taken up by an automatic tensioning system. New asphalt is dumped into the front hopper 202 by dump truck and is conveyed by drag chain 203 to conveyor assembly 191. A fixed strike-off blade (not shown) controls the height of the asphalt being picked up by the drag chain. The hydraulic motor(s) 204 provide an infinite speed, drive for the drag chain 203 that is controlled by the on-board computer. The asphalt's discharge rate is controlled by electronically monitoring (electrical encoder attached to the rear drive shaft of the conveyor assembly 191 and the front idler shaft 205 of the drag chain 203) the conveyor's speed. The ratio in drag chain speed to conveyor speed is programmed into the on-board computer and determines the depth of material deposited on to the conveyor. The amount of asphalt to be delivered by the conveyor is determined by the on-board computer.

Figure 35:
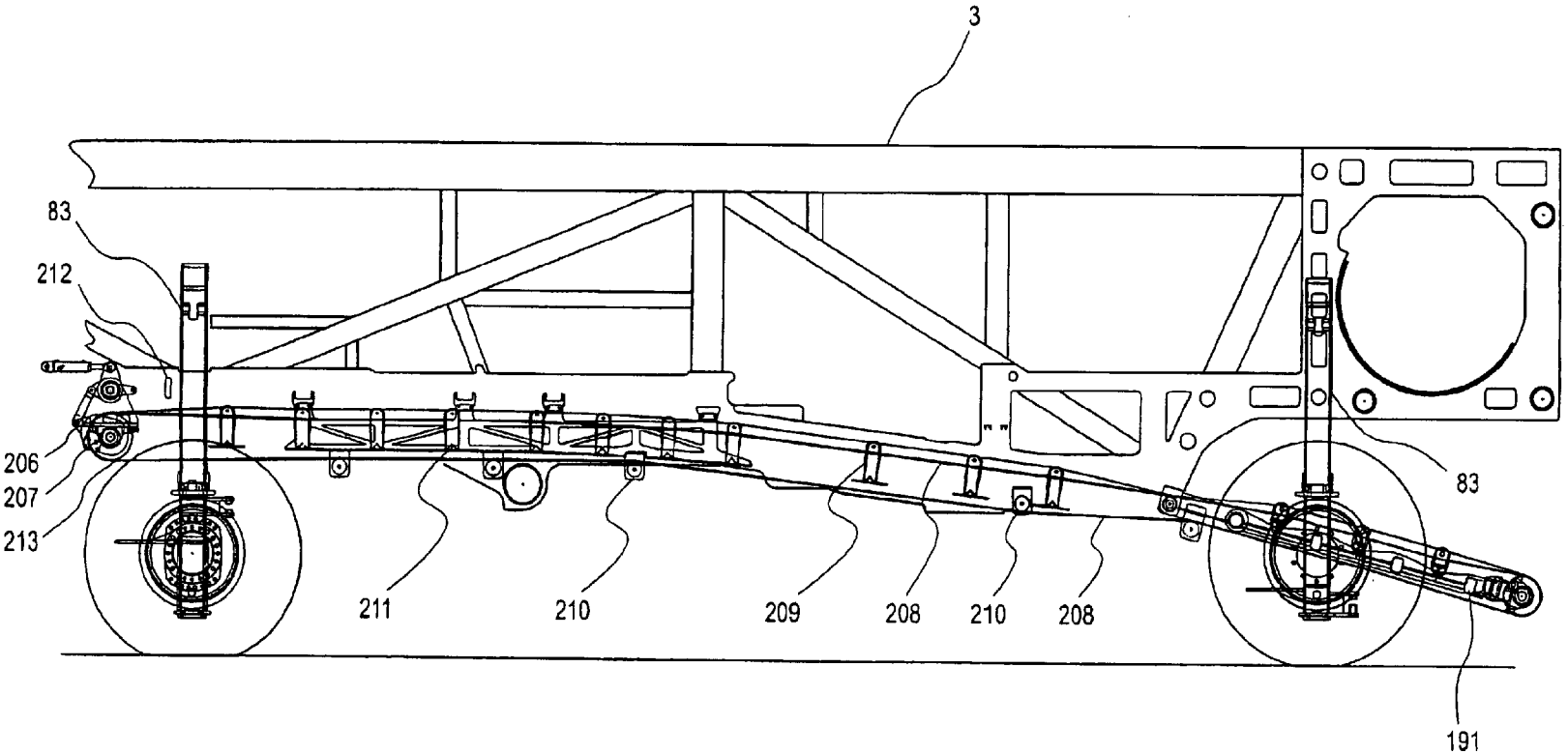

FIG. 35 shows the central conveyor assembly 191 passing through the front axle and rear axles 83. Because the conveyor is located through the passages in the axles, it can be attached to the bottom of the mainframe 3 or supported by the bottom of the mainframe 3. The conveyor delivers new asphalt to the hopper/diverter valve 165 or to the optional secondary auger/screed assemblies (not shown) and the primary auger/divider/strike off blade and screed assembles used in 100% HIR with Integral Overlay. For the Remix method, the hydraulic drive motor's 207 speed is adjusted proportionally to pug mill material discharge rate. The ratio of new material that can be added to the 100% recycled asphalt exiting the pug mill is set between 0 to 50%, with 10 to 15% being the norm.

For the Integral Overlay method, the speed of the drive motor 207 is matched to the asphalt requirements of secondary auger/screed assemblies and also the primary auger/divider/strike off blade and screed assembles. A shuttle conveyor 23 is used to deliver asphalt from the central conveyor assembly 191 to either the secondary auger/screed assemblies or to the primary auger/divider/strike-off blade assemblies (as discussed in detail later). A proportional, electronic level sensor, mounted in the feed chute to the secondary auger assembly, electronically monitors the asphalt's level. As the material level drops, (more asphalt required by the secondary screed assembly) the drive motor's speed increases (proportional control). As the asphalt's level increases in the feed chute (less asphalt required by the secondary screed assembly) the drive motor's speed is decreased and will eventually stop.

In another embodiment, a conveyor belt is used. The conveyor belt 208 is manufactured from a high temperature material and is carried by troughing idlers 209 and return idlers 210. The idlers (except the front pivoting section that passes through the front axle) are mounted directly to the Recycling Machine's mainframe for most of the span to reduce weight. Troughing idler 211 is a single point belt scale and is used to measure the weight of asphalt on the belt. By measuring the volume of asphalt exiting the pug mill's discharge (volume sensing ski) and knowing the design weight of the asphalt being 100% recycled, the on-board computer can calculate the correct speed of the conveyor belt, based upon the weight of asphalt passing the scale. A belt scale may be used when the Remix method is required. For greater accuracy the conveyor assembly is designed for the addition of a second belt scale troughing idler. When new asphalt is being supplied to the rear end of the Recycling Machine (100% HIR method) when there is occasionally a deficit of 100% recycled asphalt, the asphalt in the conveying system tends to loss heat at a greater rate than the asphalt stored in bulk in the front hopper. An infrared sensor 212 monitors the temperature of the asphalt on the belt. The on-board computer will automatically, slowly discharge the belt when the temperature drops to a minimum level. The front asphalt hopper's drag chain will remain shut down, keeping the asphalt in the front asphalt hopper in bulk form, which helps retain the asphalt's temperature. When using the Remix or Integral Overlay method, heat loss is minimal as asphalt is being continuously supplied. The front asphalt hopper is also equipped with temperature sensors and will automatically discharge, as discussed previously. The belt conveyor is the preferred conveyor of asphalt, rather than a steel drag conveyor, as the rubber belt better retains the asphalt's temperature, requires less drive torque, reduces segregation, produces less noise, wears less and is lighter in construction. The belt is driven at the rear end of the Recycling Machine by reduction gearbox 206 by hydraulic motor 207 and a crowned and lagged pulley 213.

Figure 36:
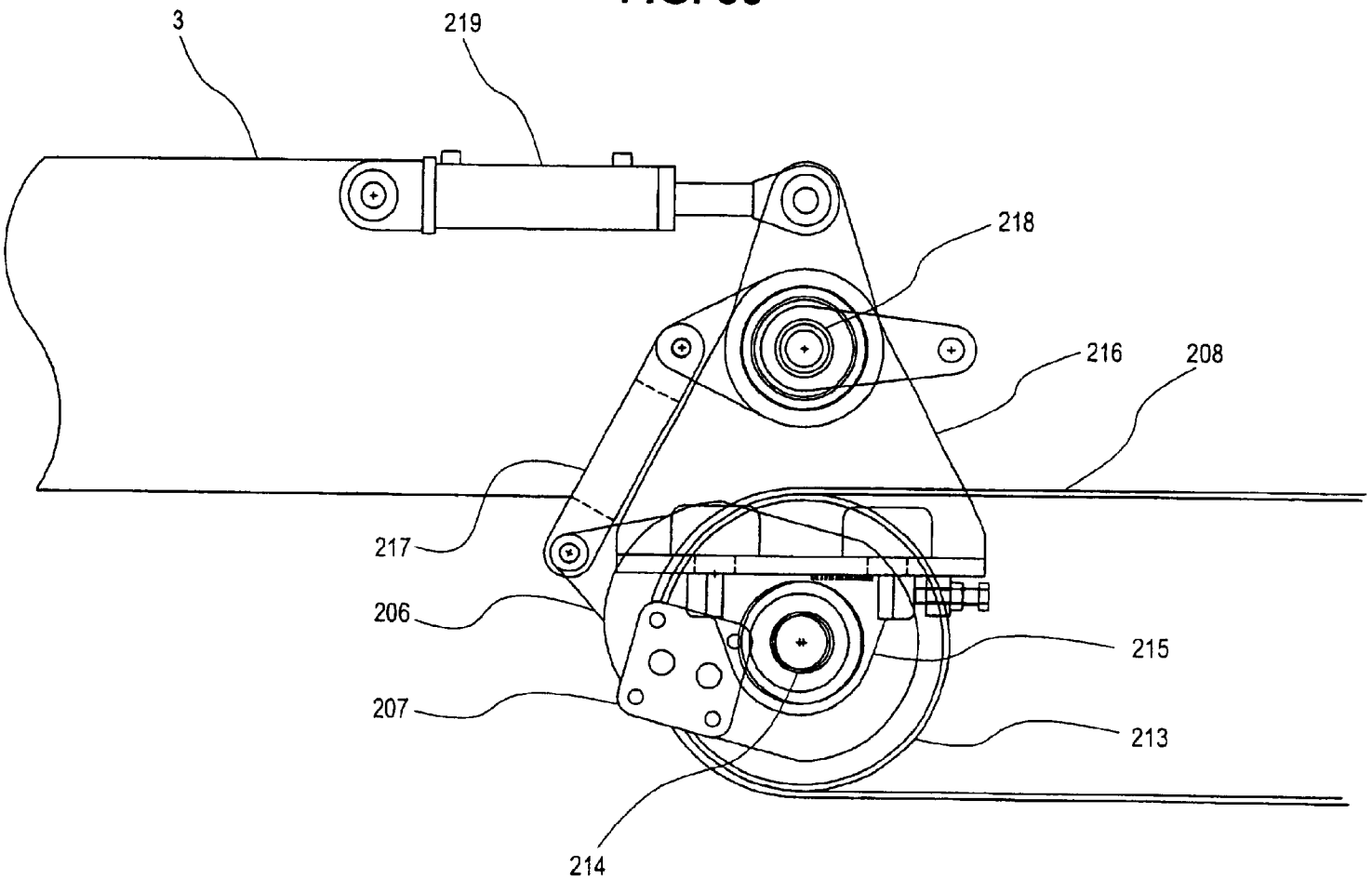

FIG. 36 shows the automatic, hydraulic belt tension assembly. The drive pulley 213 and drive shaft 214 is supported by two adjustable bearings 215, mounted to the pivoting bracket 216. The hydraulic motor 207 is attached to the reduction gearbox 206, which is supported by the drive shaft 214 (the driveshaft goes through the reduction gearbox). The torque link 217 attaches the reduction gearbox to the pivoting bracket 216. The pivoting bracket is attached to the Recycling Machine's mainframe 3 by pivot bearings 218 (one on either side of the mainframe). The hydraulic cylinders 219 (one on either side of the main frame) are attached between the main frame 3 and pivoting bracket 216. The hydraulic pressure in the head end of the two cylinders is fully adjustable, allowing the belt to be continuously tensioned while the belt is in operation. The hydraulic cylinders extend and turn the pivoting bracket 216 on the pivot bearings 218, thereby pulling on the belt. The on-board computer only tensions the belt to full tension when the belt is going to be used. When the belt is not in use, the belt is relaxed to a low state of tension, thereby reducing the stress on the belt. The hydraulic control system allows the automatic belt tension assembly to float, under pressure, allowing the front of the conveyor to pivot (raise and lower) while retaining the correct belt tension.

As discussed earlier, utility structures and other obstructions found in asphalt pavement have, until now, presented one of the greatest challenges to the HIR of asphalt, especially in city work.

Figure 37A:
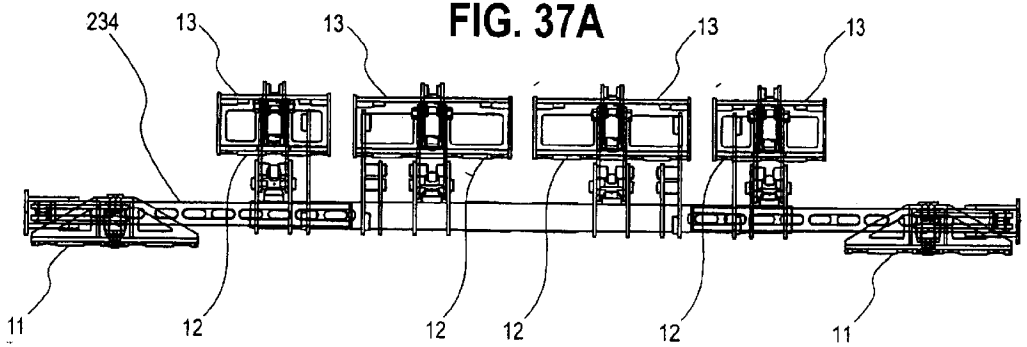
Figure 37B:
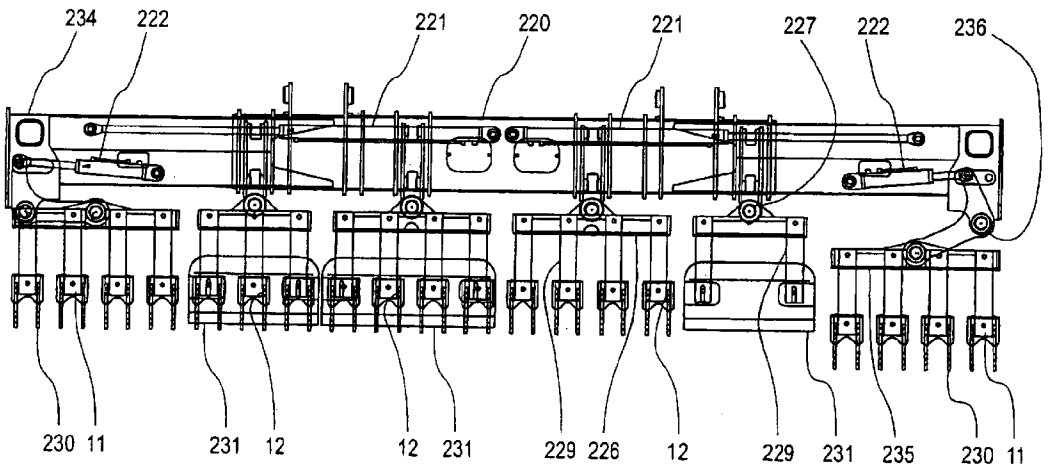
Figure 37C:
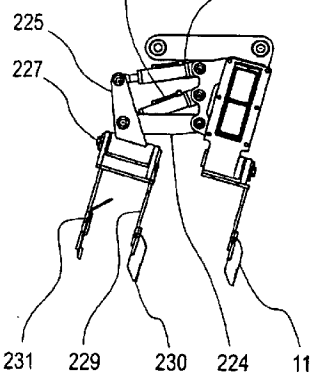

FIG. 37 shows the details of the rake/blade scarification/collection system 11, 12 and 13 fitted to the Recycling Machine, and the Preheater located ahead of the Recycling Machine. This assembly consists of a mainframe 220, mounted to the Recycling Machine and Preheater's mainframe 3. The mainframe 220 receives a continuous flow of air from the Recycling Machine and Preheater's mainframe 3 providing cooling for the hydraulic cylinders 221 and 222. The extension rakes 11 may be extended hydraulically, allowing the processing width to be changed (operator control) while the machine is working. Hydraulic tilt cylinders 223 and parallel links 224 are attached to the mainframe 220 and the vertical legs 225. The pivoting frames 226 are attached to the vertical legs 225 by pivot pins 227 allowing the four main rake/blade pivoting frames 226 to pivot and follow the asphalt's surface and also ride up and over iron utility structures. Hydraulic cylinders 228 are attached to the mainframe 220 and the bottom parallel links 224 allowing the vertical legs 225, pivoting frames 226, flat springs 229, carbide cutter assemblies 230 and blade assemblies 231 to be raised and lowered. The flat springs and carbide teeth assemblies are attached to the front face of the pivoting frames 226. The hydraulic pressure in cylinders 228 are adjustable, thereby increasing or decreasing the penetration force of the carbide teeth into the heated, softened asphalt. The carbide teeth are set back 15 degrees from vertical when at rest. Working forces bend the springs further back, increasing the set back angle, thereby reducing aggregate fracture and allowing the teeth to ride up and over undulating surface and/or iron utility structures. The on-board computer automatically raises all of the rakes when reverse drive direction is selected, preventing damage to the flat spring 229. The hydraulic circuit for cylinders 228 allows oil to be forced out of the cylinder (float up) by the upward force developed by the carbide cutter assemblies. Hydraulic oil re-enters the cylinder, under controlled (adjustable) pressure, forcing the carbide cutter assemblies back into the heated asphalt. Other recycling machines that are only fitted with milling units (no scarification teeth) are limited to how close to obstructions they can mill. The milling units must be lifted to prevent damage to the milling unit's carbide teeth and iron utility structures. Scarified asphalt should be removed (scraped away) from any part of the asphalt surface that cannot be milled and collected by the main mill to facilitate proper mixing and the later placement of 100% recycled asphalt. Attached to the rear face of the four pivoting frames 226 are flat springs 229 fitted with a plurality of blades 231. Blades 231 are mechanically adjustable in height, allowing adjustment for blade and carbide cutter wear.

Figure 38:
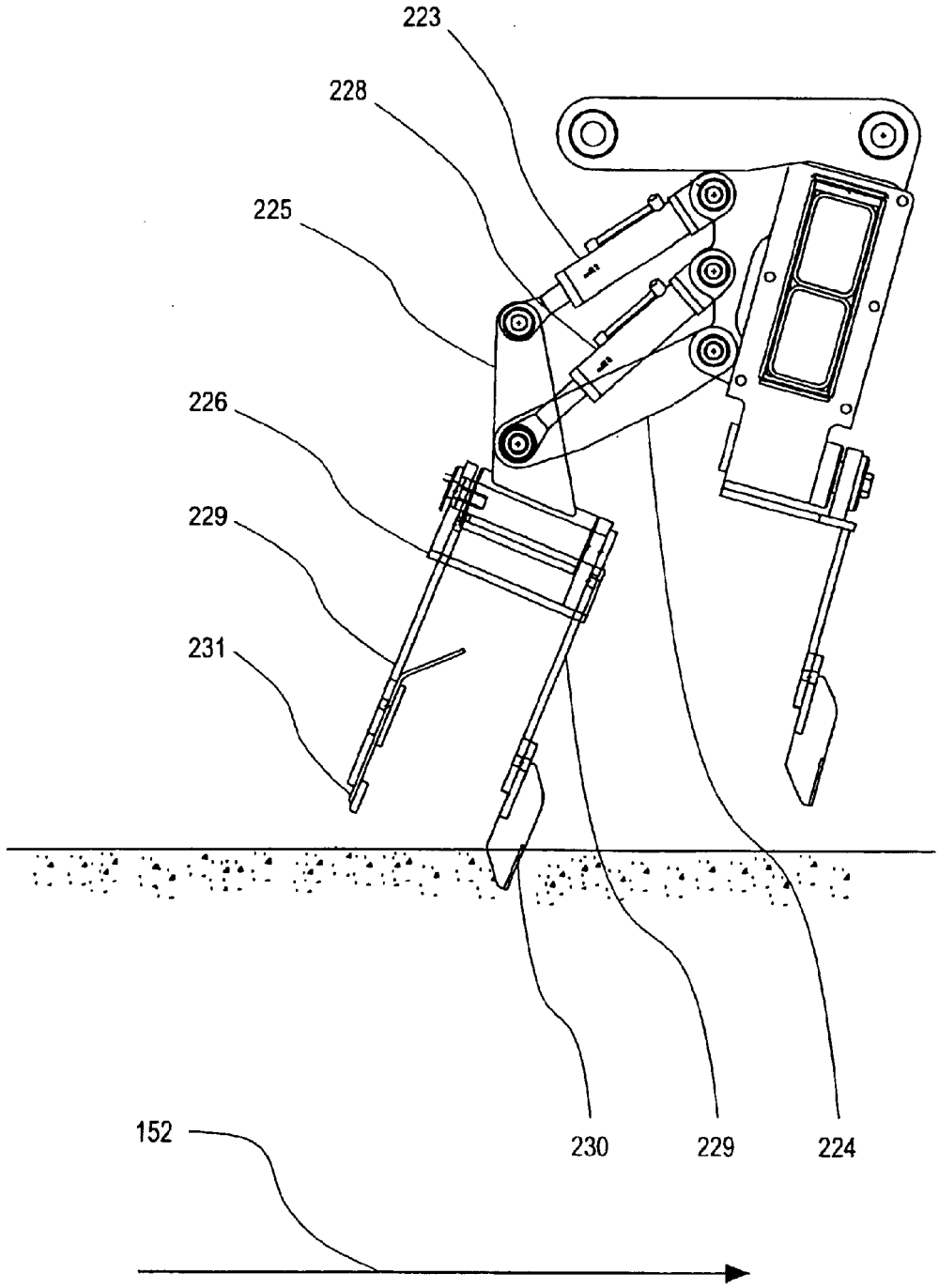
Figure 39:
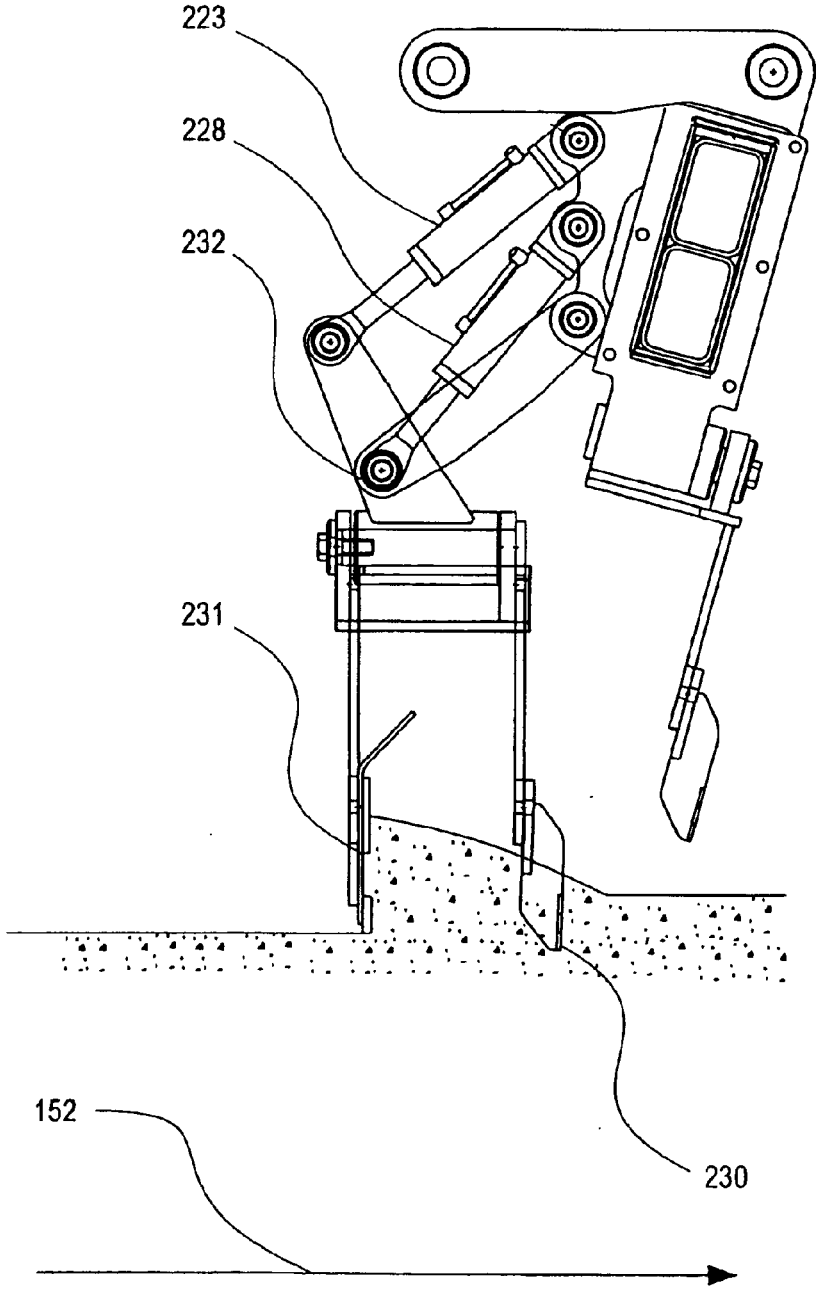

FIG. 38 shows the operation with a blade 231 in a raised position and FIG. 39 the operation of a blade 231 in a lowered position. In the "blade raised" position (normal scarification) the tilt cylinder 223 remains collapsed (not hydraulically extended). Cylinder 223, together with parallel link 224 form a parallelogram linkage, keeping the carbide cutters 230 at the correct angle of attack as they raise and lower (float) due to changes in the asphalt pavement's profile. As shown in FIG. 39, when the blades 231 are required to scrape and collect the scarified asphalt (main mill raised by the operator to clear obstruction), tilt cylinder 223 extends causing the vertical leg 225 to pivot around the rear pivot pin 232 attached to parallel link 224 and cylinder 228. The carbide cutters 230 continue to scarify the heated asphalt independent of the blade position.

Figure 40:
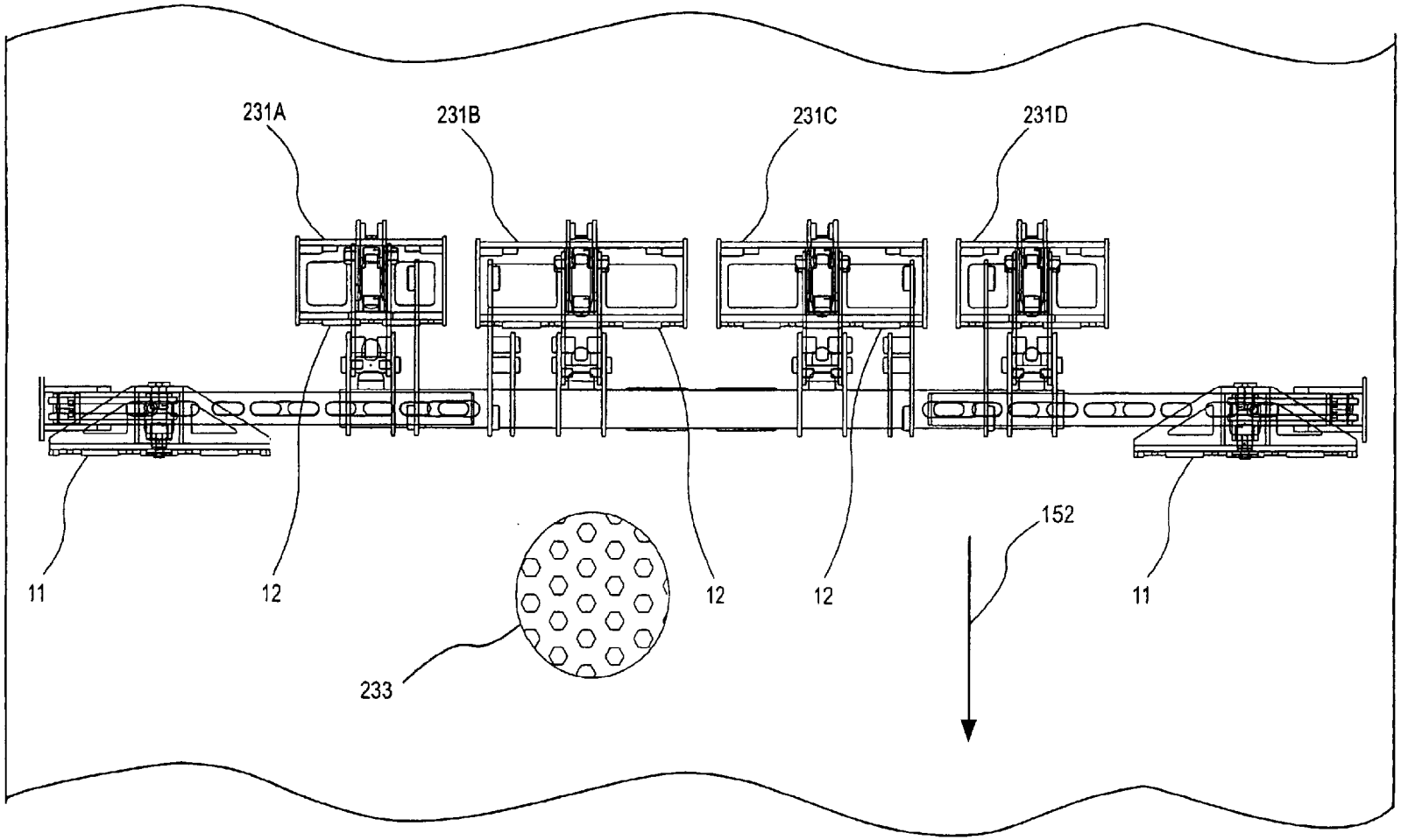

The blades may be broken down into sections 231A-231D as shown in FIG. 40. When an obstacle is encountered 233 in the heated asphalt's surface, the operator may raise any section desired by activating a lifting mechanism such as a hydraulic cylinder associated with each blade section. Section 231B's blade would remain raised to clear the utility structure 233 while sections 231A, 231C and 231D's blades would be lowered to collect asphalt. While the blade 231 is shown as being linked to the rake by frame 226, the blade and rake do not need to be linked together. The blade assemblies may be configured to work independently of the rakes. Cylinder 223 bottoms out (fully extends) holding the blades in the lowered position. Cylinder 228 still provides hydraulic down pressure (force) on the carbide cutters 230 and blades 231. When encountering an obstruction while scraping, cylinder 228 together with carbide cutter springs and blade springs 229 allow the complete assembly to hydraulically float up and over the obstruction, as before. In the event of blade 231 being overloaded by excessive asphalt or an obstruction, cylinder 223 will collapse, allowing the blade 231 to automatically raise. The hydraulic pressure setting (relief valve) of the head end oil supply to the hydraulic cylinder 223 adjusts the amount of load required to collapse the cylinder. The operation of the blades can be fully controlled by the on-board computer when the optional metal detection assemblies are fitted, as described in detail later on.

Cylinders 221, FIG. 37 attached to the mainframe 220 and the extension frames 234 allow the extension rakes 11 to hydraulically extend and retract, varying the scarification width on the fly. The extension frames (left and right side) 234 slide in and out of the mainframe 220. The extension's pivoting frame 235 is fitted with the same flat springs 229 and carbide cutter assemblies 230 as the main rake assemblies. Pivoting frame 235 is raised/lowered by pivot arm 236 and hydraulic cylinder 222. The cylinder's hydraulic pressure is variable (same as cylinder 228, explained above), increasing or decreasing the penetration force of the carbide cutter assemblies 230 into the heated, softened asphalt.

Extending or retracting the extension rakes automatically raises the pivot arm 236, preventing the carbide cutter assemblies 230 from jamming sideways into the heated asphalt. The extension rakes may include blade assemblies but are not generally required since clean up around obstructions can be performed by the extension mills (sliding in and out) and/or hand shoveling. Shoveling is possible on either side of the Recycling Machine with material returned to the extension or main mill for processing.

Figure 41:
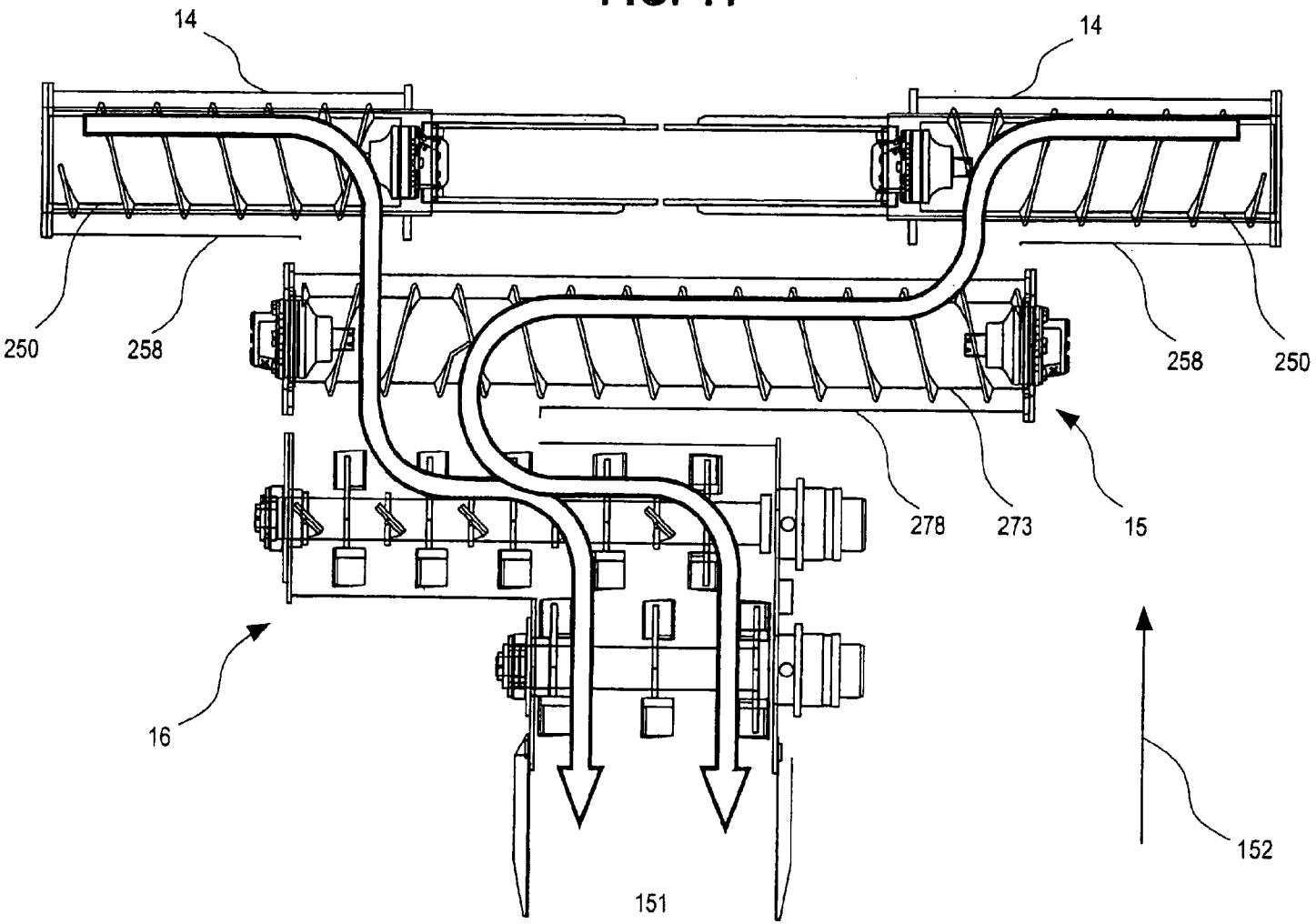

FIG. 41 shows the flow of heated asphalt through the extension mills 14, offset discharging main mill 15, and offset pug mill 16. The carbide cutting teeth are not shown on the extension and main mill for clarity. The extension and main mills are directly behind the Recycling Machine's rake scarification and blade collection system and are responsible for profiling and collecting the heated and loosened asphalt surface. As mentioned previously the mills also release further moisture in the form of steam. The main mill and the pug mill are also responsible for the mixing of liquid additives into the recycled asphalt. The pug mill provides the final mixing of all products into a homogeneous, 100% recycled asphalt windrow 151.

Figure 42:
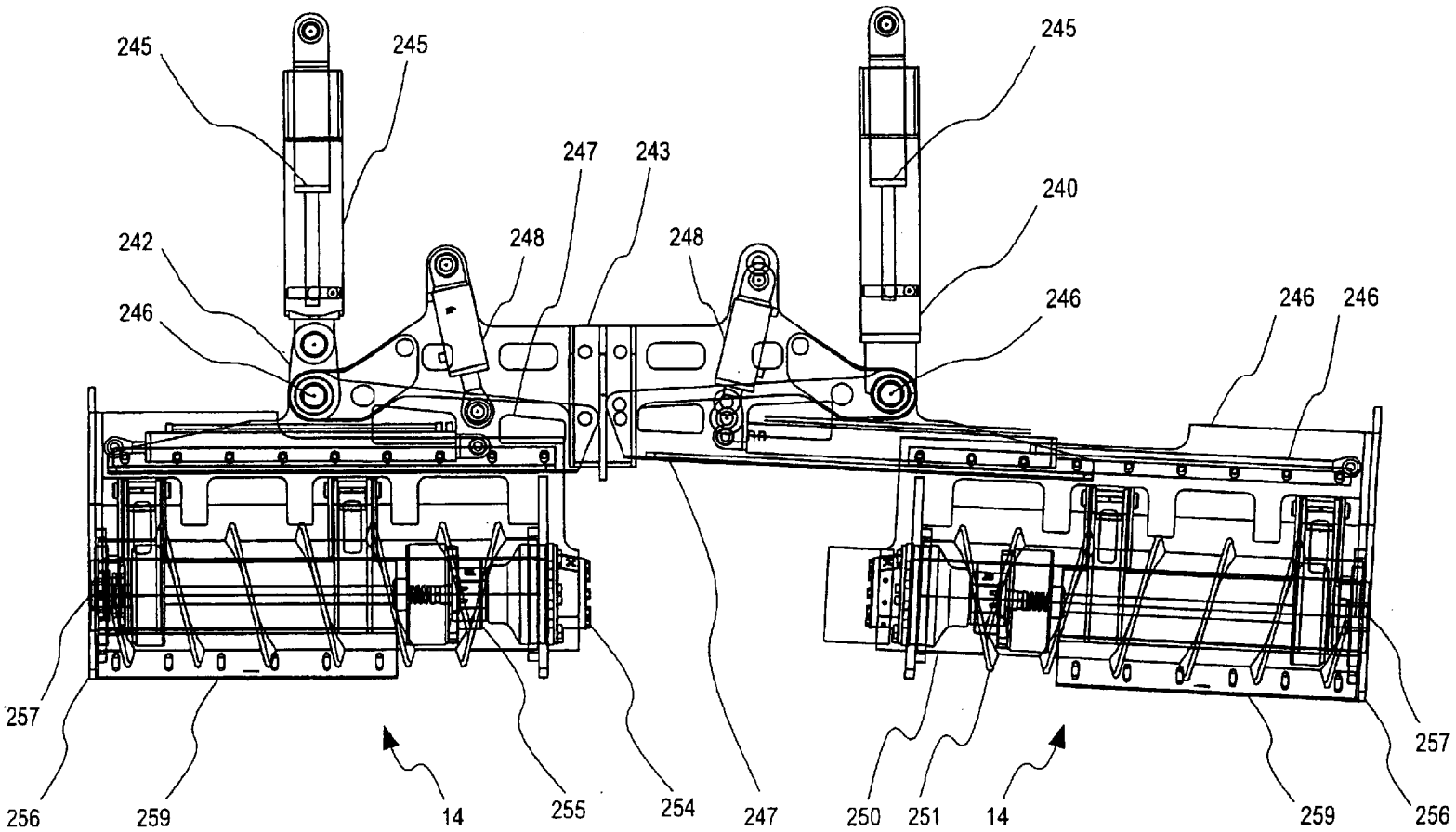
Figure 43:
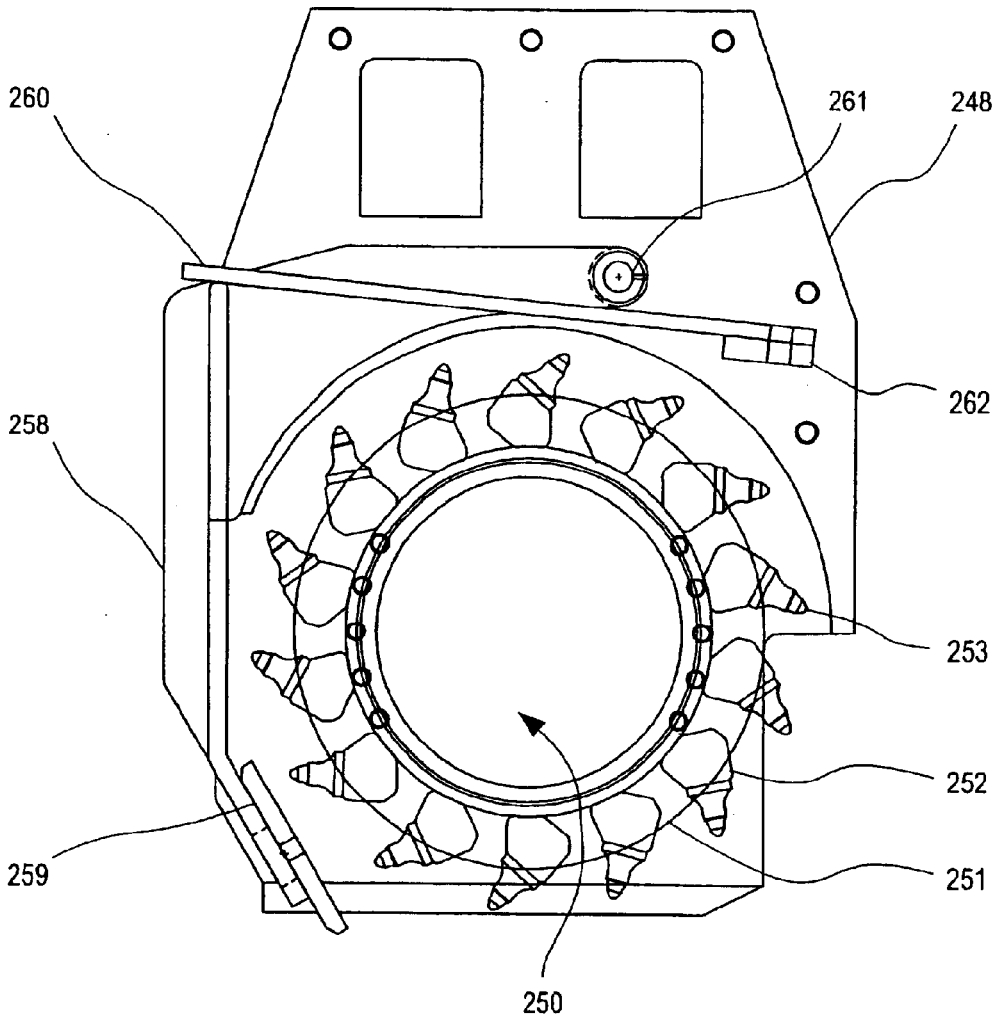
Figure 44:
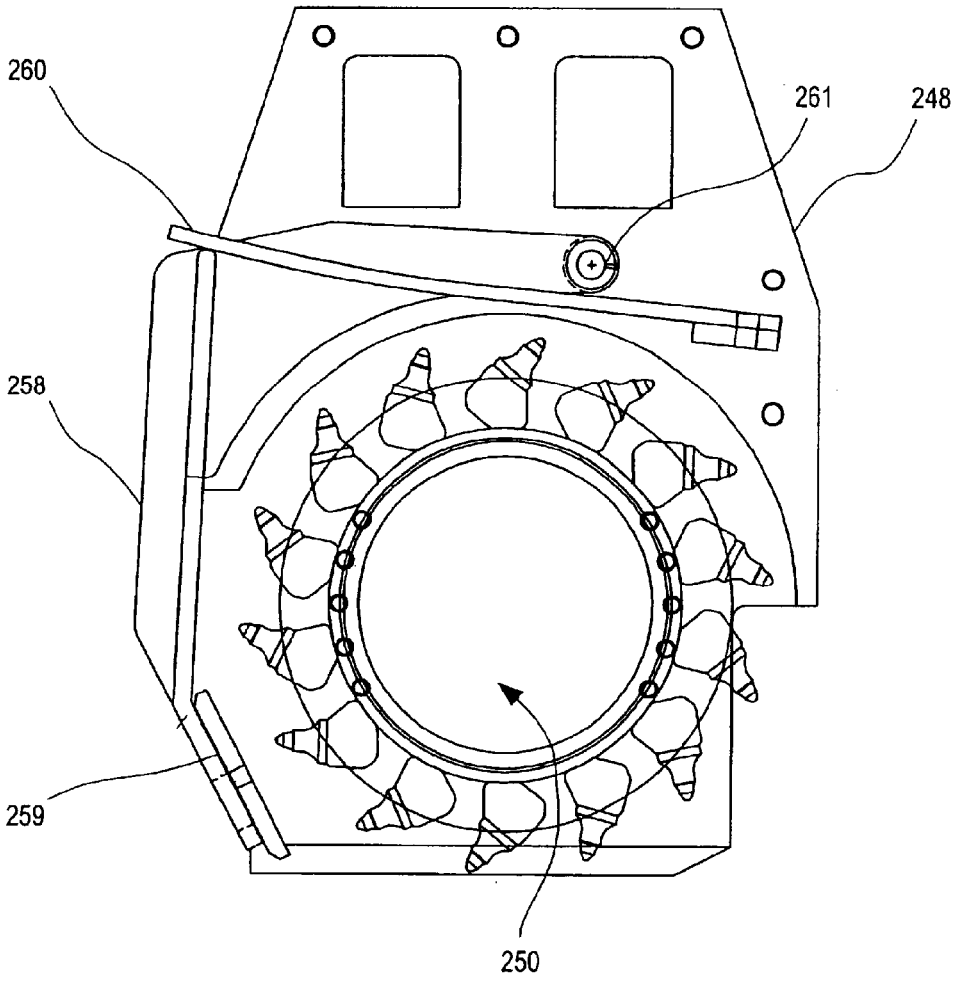

FIG. 42 shows the extension mills 14 (looking from the rear of the Recycling Machine). They are attached to the Recycling Machine's mainframe 3 by R.H. sliders 240, L.H. slider 241 and wobble link 242. Sliders 240 and 241 slide through adjustable wear plates (not shown) attached to the Recycling Machine's mainframe 3, preventing wear to the mainframe. The cross frame 243 is raised, lowered and tilted by two hydraulic cylinders 245, mounted inside the sliders 240 and 241. The wobble link 242 prevents the sliders from binding when the cross frame 243 is fully tilted. Pins 246 are the pivots for the cross frame 243 and the left and right crown frames 247. The hydraulic cylinders 248 are attached to the cross frame 243 and the crown frames 247 allowing positive and negative, left and right crowning (tilt) of the crown frames 247, independently of the cross frame 243. The extension frames 248 are slide in and out (varying the extension mill's width of cut) on the crown frames 247 by hydraulic cylinders 249 attached between the crown frames and the extension frames. Being able to independently raise, lower, tilt, crown, and extend the mills provides complete control over the extension mills when working with adverse conditions, such as, changes to grade and/or slope, working around iron utility structures in the asphalt surface, processing driveways, intersections, varying pavement width and damaged curbs FIGS. 43 and 44 show side views of the extension mills. The two, extension mill rotors 250 feature shallow flighting 251, tooth holder 252 and replaceable carbide teeth 253 and rotate in a down-cut direction (teeth impinge down on to the heated surface). The rotors 250 are driven by a direct drive, hydraulic motor 254, through coupling 255. End plates 256 incorporate the rotor support/thrust bearing 257 used to support the non-driven end of the rotors. The rotors 250 are quickly removed for servicing by removing the end plates 256, allowing the rotor's couplings 255 to slide off the splined shafts of hydraulic motors 254. The rotors float free on the hydraulic motor's splined drive shafts, while bearings 257 absorb all end-thrust. Asphalt flow is towards the drive end of the rotors (center of machine) with the asphalt being discharged through openings in the blade bodies 258 into the main mill's rotor. The rotors mill the heated and loosened asphalt in a down-cut direction to reduce the conveying efficiency, thereby causing the asphalt to build up in front of the rotors. The build up of asphalt increases the mixing/steam release time and provides a degree of surge capacity when milling through high areas, allowing the feed of milled asphalt into the main mill's rotor to remain fairly consistent. The down-cut feature of the rotors also prevents damage to the mill rotor's carbide teeth and iron utility structures located in the asphalt. The hydraulic system (initiated by the ground operator) may be used to reduce the hydraulic cylinder's 245 downward pressure (force), while rotor speed and cutting torque are also reduced to allow the rotors to float and freewheel over obstructions. An on-board computer may control this operation. Attached to the blade bodies 258 are adjustable blades 259. The flat springs 260, force bodies 258 and blades 259 on to the milled surface, scraping and collecting the fine asphalt, for processing. Current equipment generally leave a layer or patches of fine asphalt and/or rejuvenator fluid behind the mills (rotary scarifiers), resulting in varying quality of the reworked (recycled) asphalt and eventual bleeding of the finished, compacted surface (mat).

FIG. 43 shows a blade body 258 in the relaxed position. FIG. 44 shows the blade body in the maximum up position having pivoted around pin 261 and bending the flat spring 260. The adjustable blade 259 is set below grade (grade is established by the mill rotor's carbide teeth 253 when milling) to pre-load the flat spring 260 thereby keeping a constant force on the blade 259 and forcing it into contact with the milled surface. The flat spring 260 is anchored (bolted) to the extension frame 248 by attachment plate 262 and permits the up and down movement of the blade while maintaining a constant force on the blade. The flat spring's fulcrum point is the underside of the blade bodies pivot boss, pivoting around pin 261.

Figure 45:
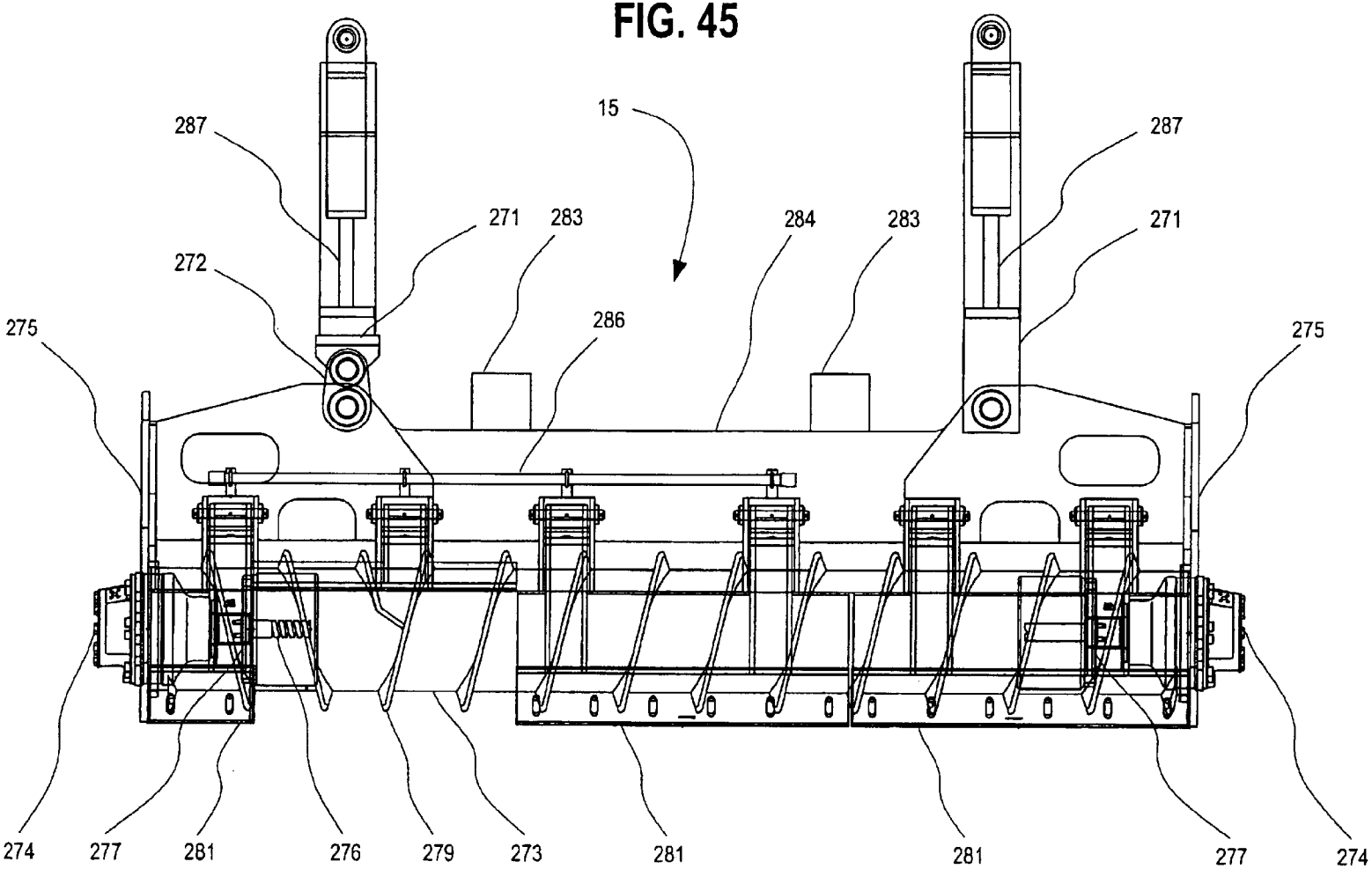
Figure 46:
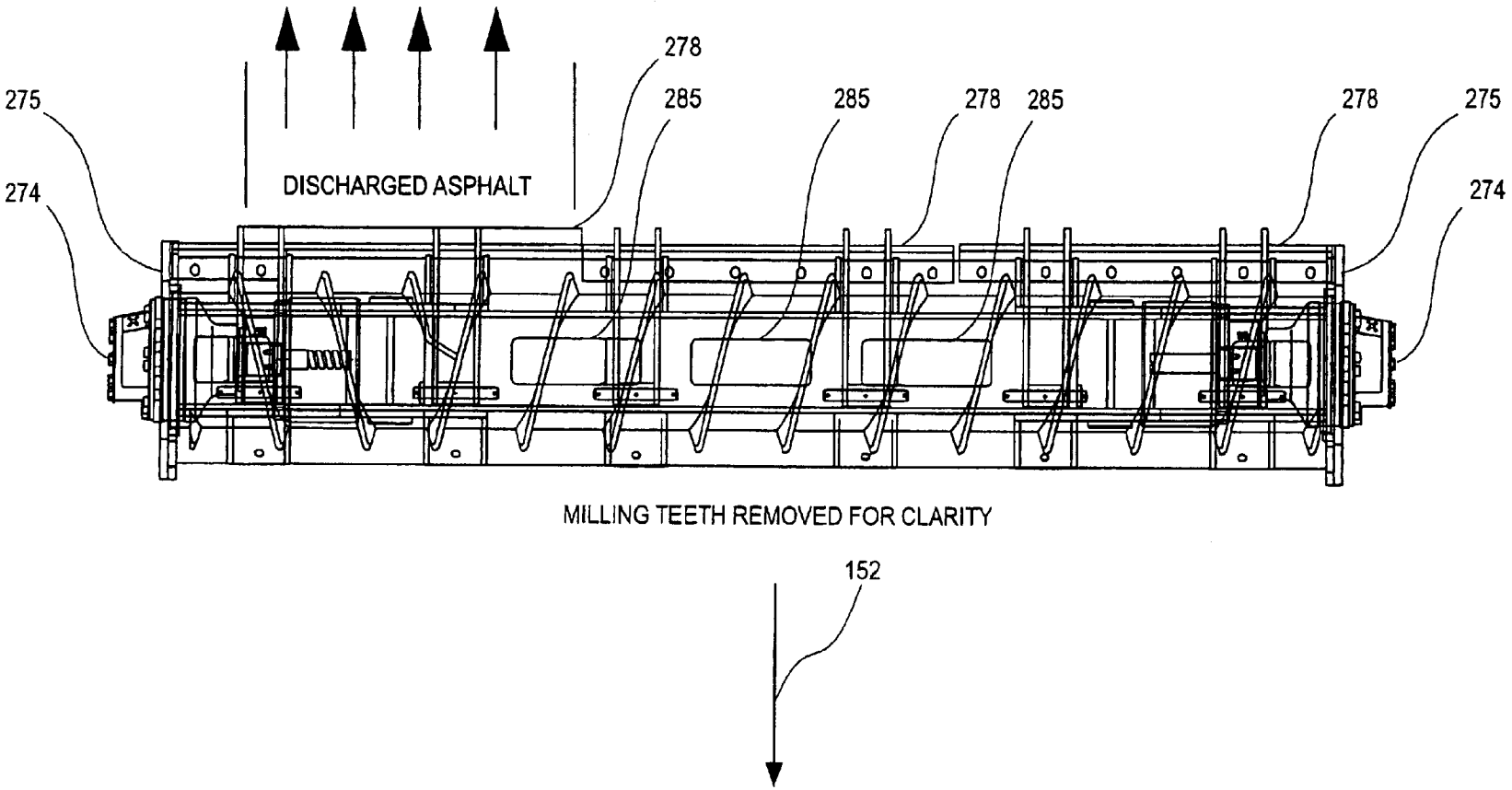
Figure 47:
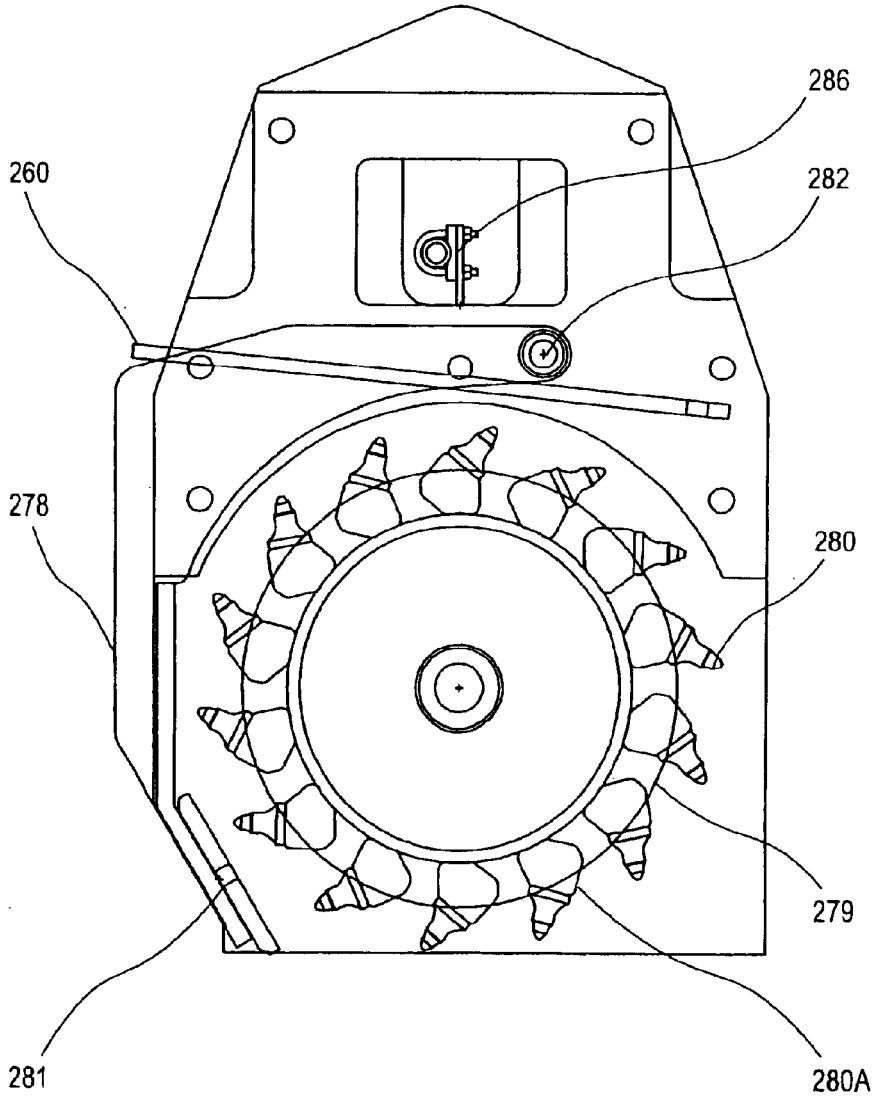

FIGS. 45, 46 and 47 show the main mill assembly 15 attached to the Recycling Machine's mainframe 3 by the R.H. slider 270, L.H. slider 271 and wobble link 272. The sliders 270 and 271 slide through adjustable wear plates (not shown) attached to the mainframe 3 preventing wear to the mainframe. The rotor assembly 273 is driven and supported at either end by two direct-drive, hydraulic motors 274. The motors are attached to removable end plates 275, allowing the rotor to be quickly removed for servicing by removing one of the end plates. The rotor assembly 273 is spring loaded by spring 276 (in one direction) and floats on the hydraulic motor's 274 splined drive shafts. The hydraulic motors provide main support and one takes the thrust generated by the rotor assembly 273. The couplings 277 allow for rotor misalignment, deflection and thermal expansion. Asphalt flow is towards one end of the rotor with asphalt discharge through the blade body 278 into the offset pug mill's front rotor. The shallow rotor flighting 279, together with closely spaced carbide teeth 280 and holders 280A milling in a down-cut direction, reduce asphalt conveying efficiency, thereby causing the heated asphalt to build up in front of the rotor. The build up of milled asphalt increases mixing/steam release time and provides a degree of surge capacity when milling through high areas, allowing the flow of milled asphalt into the pug mill's front rotor to remain fairly consistent. The down-cut feature of the rotor also prevents damage to the mill rotor's carbide teeth and iron utility structures located in the asphalt. The blade bodies 278 are forced down by flat springs 260. The blades 281 pivot around pin 282 and operate in the same manner as shown in FIGS. 43 and 44. A venturi (not shown) in the air extraction system creates a negative air pressure at vent tubes 283 and in the boxed in mainframe 284. The mainframe 284 has cut outs 285 located directly above the rotor assembly 273 allowing rejuvenator fluid to be sprayed directly on to the spinning rotor assembly by spray bar 286.

Rejuvenator fluid is thereby, prevented from direct contact with the milled surface while the spinning rotor assembly spreads the fluid, providing maximum coverage to the milled asphalt. Steam released from the hot, tumbling asphalt also rises through cutouts 285, mainframe 284 and vent tubes 283. The air extraction system vacuums or draws off and vents the released steam and other fumes to the top of the Recycling Machine. Other types of vacuum and extraction devices known to those of skill in the art may be used as well. An emission control system for removing fumes and other hazardous materials may also be coupled to vent tubes 283. An emission control system for removing fumes and other hazardous materials may also be on the extension mills.

The mainframe 284 is raised, lowered and tilted by hydraulic cylinders 287 mounted inside the sliders 270 and 271. Control of the hydraulic cylinders is manual or by automatic grade controls as discussed before.

Figure 48:
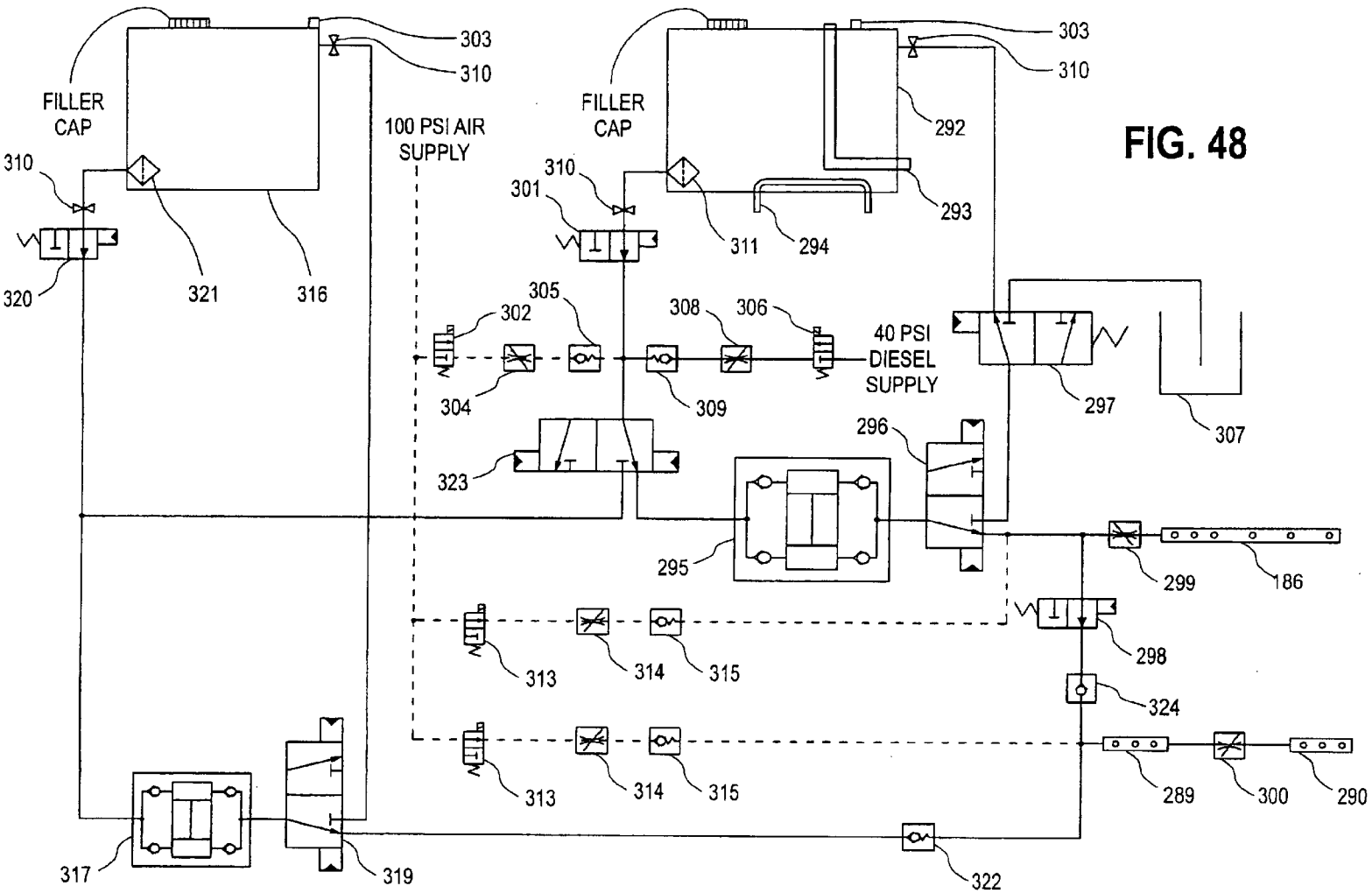

FIG. 48 shows the hydraulic schematic for the Recycling Machine's fluid application system. Current machines use positive displacement pumps (gear, vane and roller) fitted with variable speed drive systems to pump and meter only rejuvenator fluid. The application rate of the rejuvenator fluid is generally controlled by operator input (distribution rate, liters/sq. m.) and by monitoring the Recycling Machine's processing speed (distance traveled). Distance traveled, by itself, provides inaccurate and inconsistent results as the volume of asphalt being processed changes constantly as density, depth of cut, pavement profile and width of cut vary. The rejuvenator pump/motor RPM (monitored by electronic pickup) and/or an electronic flow meter measure and control (microprocessor) the rejuvenator fluid application rate. Both systems (either measuring RPM or flow) can produce inaccurate results and are limited to a narrow viscosity range. Both systems also suffer from contamination, as most rejuvenator fluids are unfiltered or not filtered to the level required by positive displacement hydraulic pumps and flow meters containing moving parts. Placing full flow filters into the system reduces contamination, however, constant monitoring of the filter's condition is required, as are frequent filter changes. The more accurate of the two systems is the variable speed, positive displacement pump with an in-line flow meter to monitor/control system flow (microprocessor). Flow meters are available without moving parts, however, they are very expensive and their maximum temperature range is limited at present. Systems using only a variable speed, positive displacement pump with electronic monitoring and control are inaccurate. The pump flow rate changes as internal wear increases, rejuvenator fluid temperature changes (viscosity change) and pressure differential across the pump (delta P) caused by filter restriction increases. Both systems are limited to the lighter types of rejuvenator fluids that do not require heating.

Figure 49:
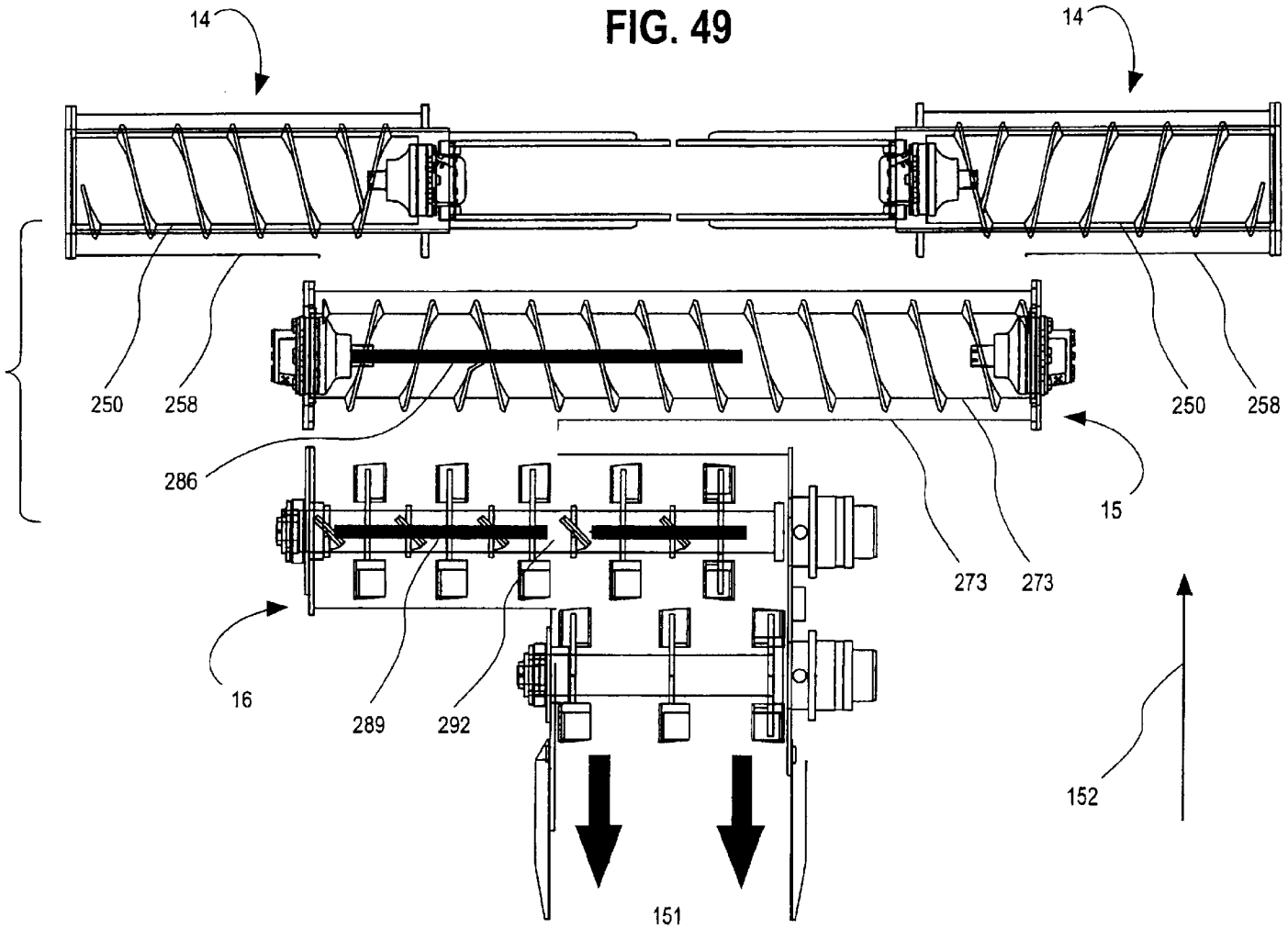
Figure 50:
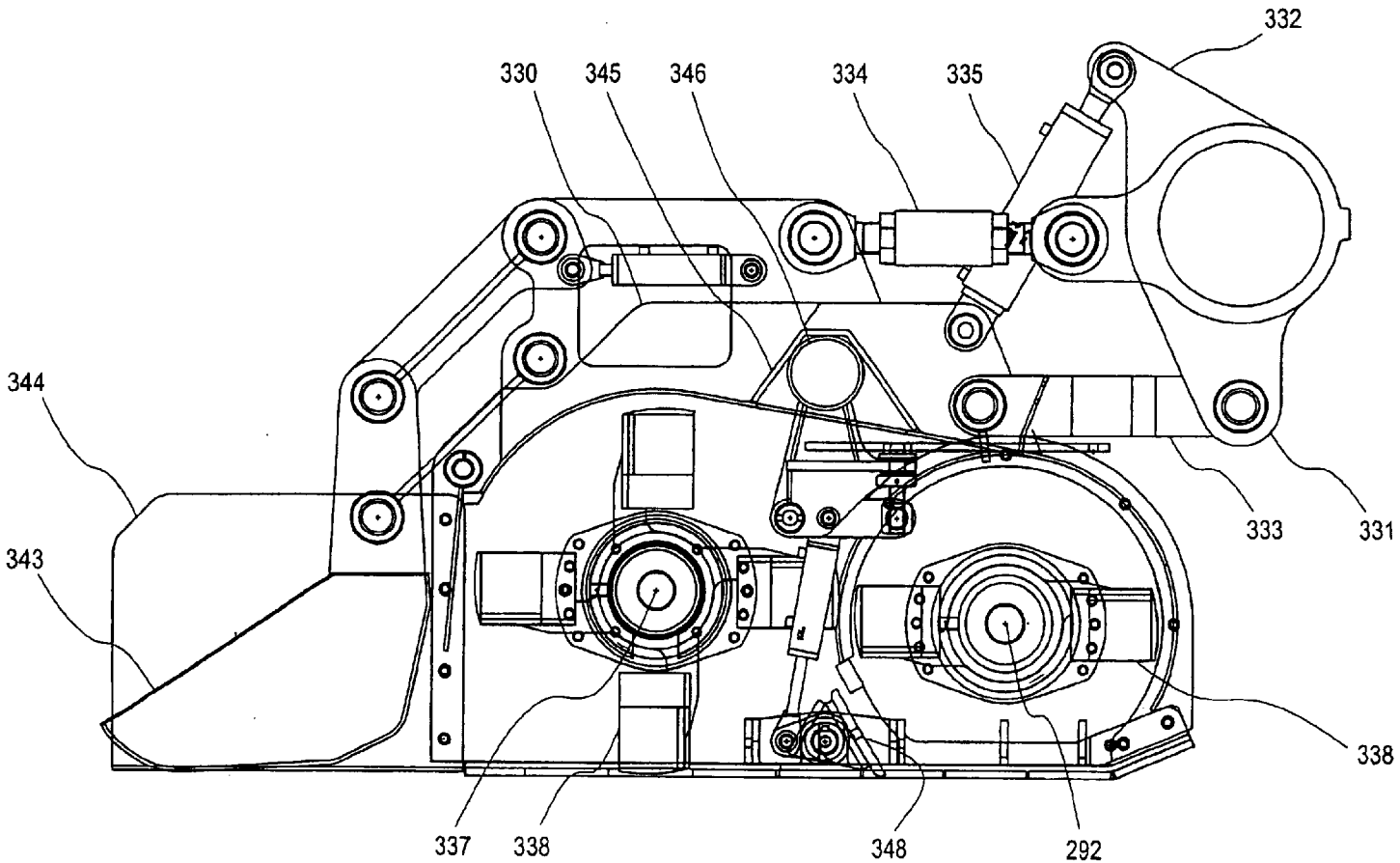
Figure 51:
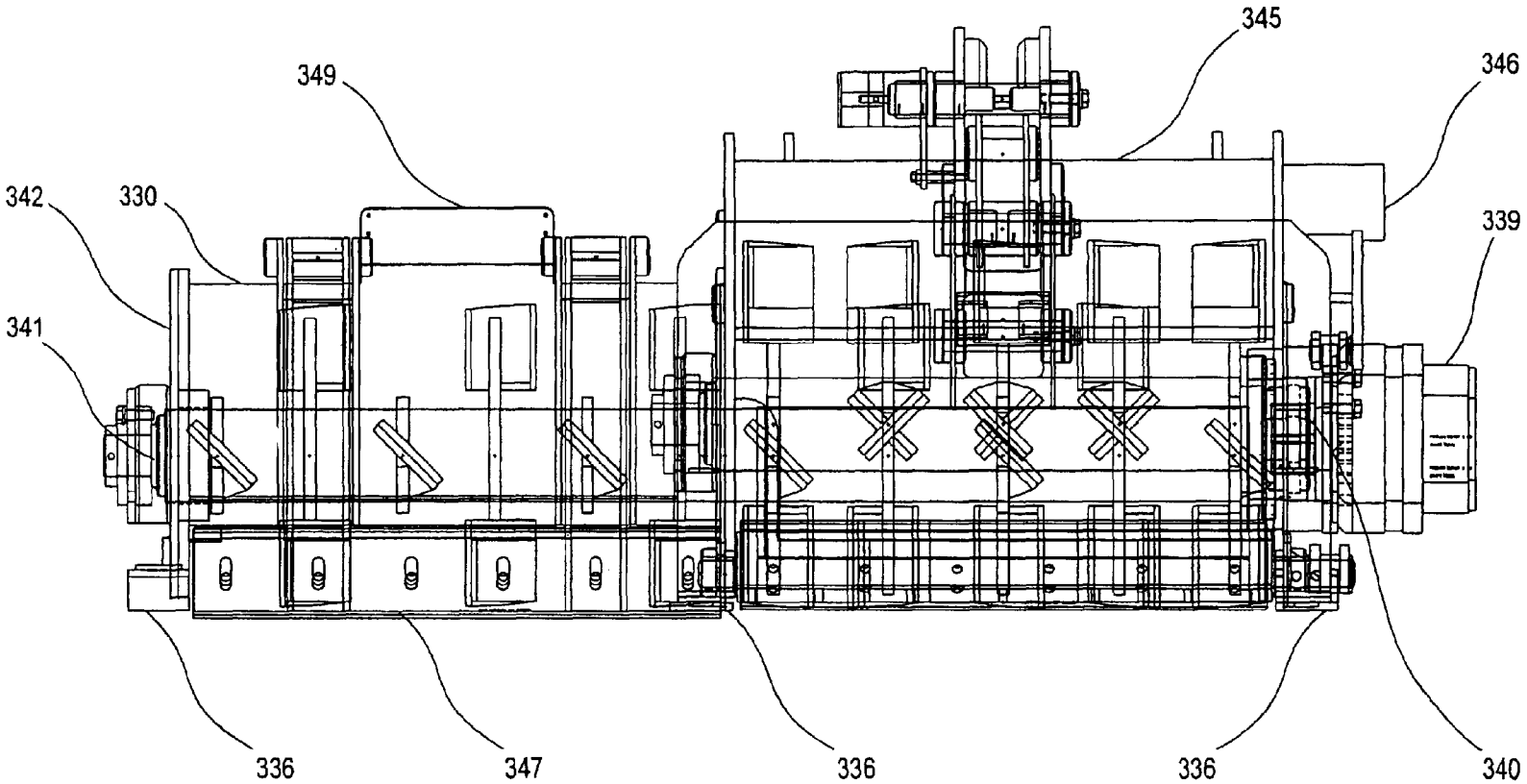
Figure 52:
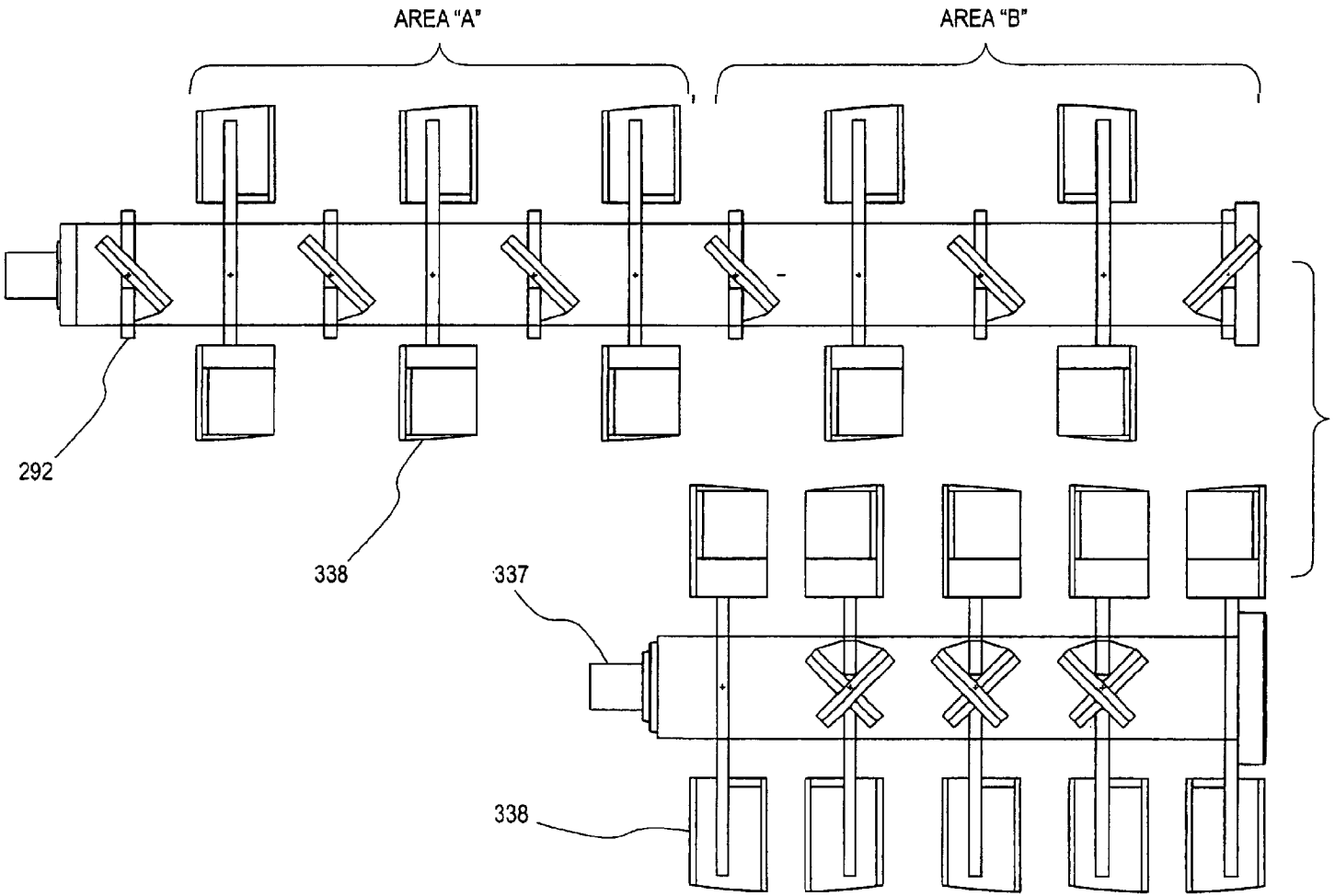
Figure 53:
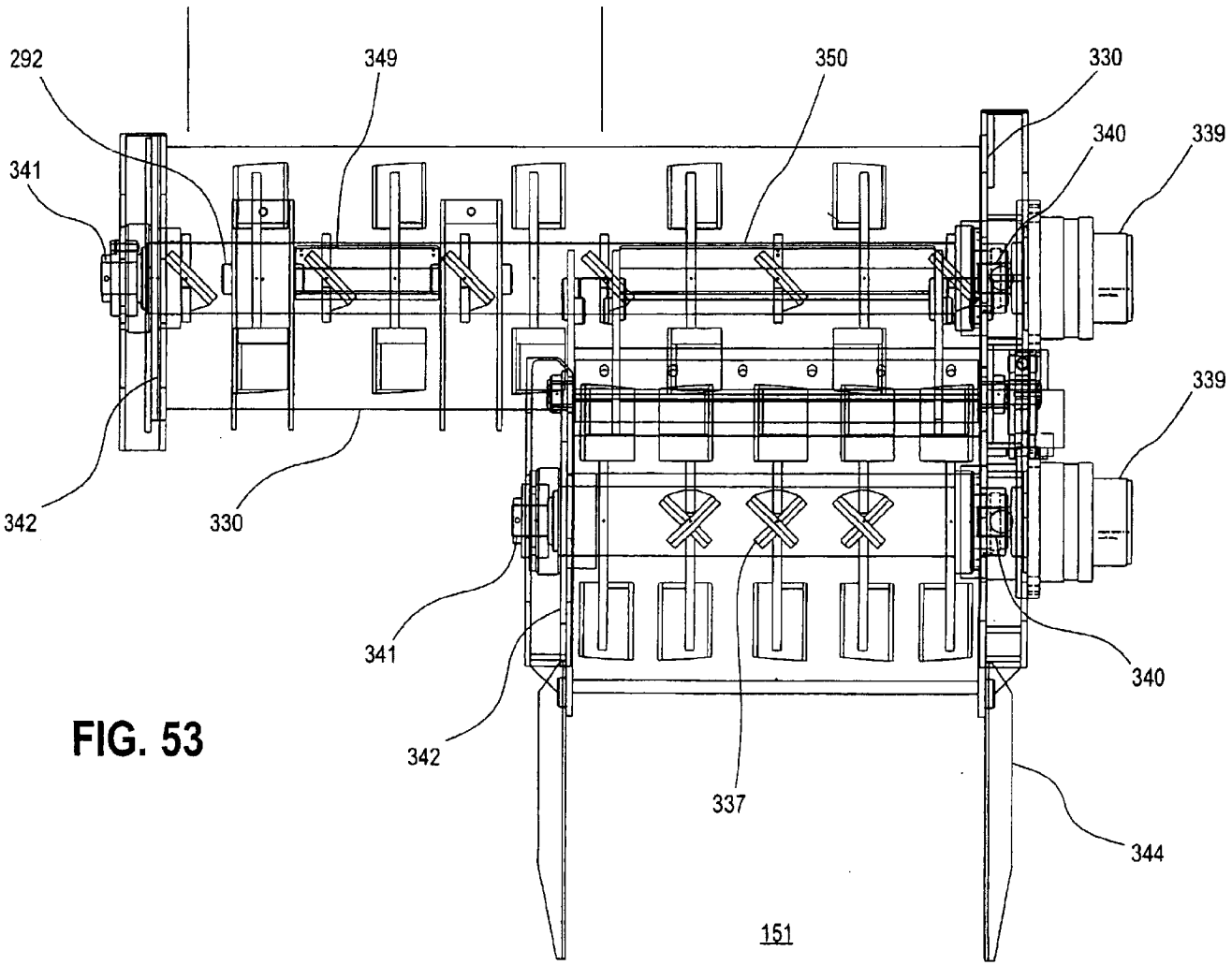

FIG. 48 shows a system used to accurately meter and dose light (unheated), heavy (heated) rejuvenator fluids and polymer liquids. An on-board computer may be used to control and monitor all of the functions of the application system. FIG. 49 shows the liquid spray bar 286 mounted above the front rotor assembly 273 on the main mill and liquid spray bars 289 and 290 mounted above the front rotor assembly 291 of the pug mill 16. Spraying fluid directly on to the rotating rotor assemblies distributes the fluid over a greater area and reduces the possibility of the fluid coming into direct contact with the milled, base surface. Air is also used to aerate the liquids (described in detail later) exiting the spray bars, providing even greater coverage. The rejuvenator fluid is stored in a heated, insulated and pressurized tank (0.1–0.5 psi) 292 on-board the Recycling Machine. An automated, propane fired burner 293 heats the tank (only required for viscous fluids). The tank is also fitted with heat exchanger tubes 294 (mounted in the tank bottom). When the rejuvenator fluid temperature (monitored by the on-board computer) is below a preset temperature the returning high temperature hydraulic oil from the Extension mills, main mill and pug mill motors, case drain (internal leakage), is diverted through the heat exchanger tubes 294, thereby heating the rejuvenator fluid. An on-board computer may be used to prevent reverse heat transfer (rejuvenator fluid heating the hydraulic oil when the propane heater is used) by diverting hydraulic oil flow around the in-tank heat exchanger 294. As shown in FIG. 50, the on-board computer processes information received from the pug mill's variable area discharge, windrow forming ski 343 (asphalt volume measurement), rejuvenator tank temperature (correction factor), operator input (distribution rate, liters/ton) and the Recycling Machine's distance traveled (m/min.) which may be obtained by a rotary-encoder located on one of the wheels. An air operated, positive displacement, diaphragm pump 295 (electronically pulsed by the on-board computer) pumps and meters the fluid stored in the rejuvenator tank 292 delivering it to a hydraulically operated two-way valve 296. Valve 296 allows fluid to be directed either to the main mill and/or the pug mill spray bars or returned to the tank through two-way valve 297. Viscous rejuvenator fluids require constant heating to prevent fluid setup. The diaphragm pump 295 runs (pulsed) continuously, returning the rejuvenator fluid back to the tank (when not required by the process), keeping the diaphragm pump, lines, pipes and valves hot. The on-board computer calculates and stores (in memory) the quantity of fluid used when the rejuvenator fluid exits the main mill and/or pug mill spray bars. Normally closed shut off valve 298 (on-board computer controlled) opens when sufficient milled asphalt is flowing through the pug mill's front rotor. Adjustable flow control valve 299 alters the ratio of rejuvenator fluid delivered to the main mill and/or pug mill spray bars 289 and 290 when shut off valve 298 is open. At startup (no asphalt flowing through the pug mill) shut off valve 298 is closed allowing all of the rejuvenator fluid (low flow) to flow from the main mill's spray bar 286. As the volume of asphalt flowing through the pug mill increases, the on-board computer opens shut off valve 298. The sprayed rejuvenator fluid (staged) follows the flow of asphalt through the main mill 15 and the pug mill 16, allowing accurate and complete mixing of the rejuvenator fluid, added aggregate additives and milled asphalt. The spray bars 286, 289 and 290 (as shown in FIG. 49) are small-bore, varying diameter steel tubes with drilled orifices of varying sizes and spacing. As the rejuvenator fluid flow rate increases (greater volume of milled asphalt), pressure in the spray bars increases, forcing the fluid further along the bars. The main mill's spray bar is supplied fluid at one end (above the offset, asphalt discharge to the inlet of the pug mill's front offset rotor) and is equipped with spray orifices of decreasing size and increased spacing as the fluid travels along the spray bar. As the fluid flow increases, pressure in the spray bar increases, forcing the fluid further along the spray bar towards the center of the main mill. This feature makes sure that fluid is sprayed into the greatest concentration (volume) of milled asphalt, preventing fluid contact with the milled surface. The spray bar should not extend past the coverage area of the pug mill as shown in FIG. 49. Located between the pug mill's spray bars 289 and 290 is an adjustable flow control valve 300 used to balance the liquid's rate of flow between the front rotor's spiral paddle section (asphalt inlet to pug mill from main mill's offset discharge)) and the alternating paddle section located in the pug mill's mixing chamber. Generally, the flow control valve 300 only comes into play when the rejuvenator flow rates are in the higher range or when polymer additives are being added, as described later. Spray bar tube size and hydraulic supply hoses are small in diameter to reduce the volume of liquid to a minimum, thereby reducing the chance of spray bar drip. Viscous rejuvenator fluids require purging from the diaphragm pump, lines, pipes and valves during periods of inactivity or after use (end of shift) to prevent setup. The use of compressed air, followed by diesel fuel to dilute and clean, prevents fluid setup. While purging, fluid flow to the spray bars is shut off by the two-way valve 296. Rejuvenator fluid is diverted too the two-way valve 297 and then back to the storage tank 292. The on-board computer controls the complete purging and cleaning cycle. The fluid supply to the positive displacement pump 295 is shut-off by the N.C. shut off valve 301 (pump stopped). Metered compressed air flows through the N.C. shut-off valve 302 into the inlet line of the diaphragm pump, lines, pipes and two-way valves 296 and 297, forcing the fluid back to the rejuvenator storage tank 292. The top of the tank is fitted with a low-pressure relief valve (0.1–0.5 psi) 303, which allows the compressed air to escape. Adjustable, air flow control valve 304 limits the maximum amount of air flow and the one way check valve 305 prevents rejuvenator fluid from entering the air supply system. After air purging, the fluid return line to the tank (through the two-way valve 297) is closed, preventing rejuvenator fluid from flowing back (reverse flow) through the system. The two-way valve 297 now connects, through a hose to a removable fluid catch container 307. Metered diesel fuel flows through the N.C. shut-off valve 306 into the diaphragm pump's, inlet line. Diesel (along with the air already purging the system) flows into the diaphragm pump, lines, pipes and two-way valves 296 and 297, diluting any remaining rejuvenator fluid and flushing it into the catch container 307 for disposal. Adjustable diesel flow control valve 308 limits the maximum amount of diesel flow and the one way check valve 309 prevents rejuvenator fluid from entering the diesel supply system. During flushing and cleaning the diaphragm pump is intermittently cycled during the diesel injection stage to help clean the two diaphragms and ball check valves. After flushing, valves 297, 302 and 306 are automatically closed. For safety and servicing the rejuvenator tank outlet and return connections are fitted with manually operated ball type shut off valves 310. Tank air pressure automatically bleeds down when the Recycling Machine is not in use.

The positive displacement, diaphragm pump 295 delivers rejuvenator fluid accurately, as each stroke delivers an absolute volume. The pump should be stainless steel with high temperature diaphragms. Air pressure (0.1–0.5 psi) in the storage tank 292 applies a pressure to the inlet of the diaphragm pump, reducing the possibility of cavitation. The pump can accurately pump fluid with particle sizes up to ⅛" in diameter, however, an in-tank wire mesh strainer 311 limits particle size to less than 50 mesh. As mentioned earlier, spraying the rejuvenator fluid directly on to the main mill's rotor and pug mill's front rotor provides maximum coverage and mixing with the heated, milled asphalt. Also, by reducing direct fluid contact with the milled base surface, bleeding of the finished asphalt surface is eliminated. The rejuvenator fluid also lubricates the main mill's milling teeth and holders, preventing the teeth from sticking (not turning) in their holders, thereby reducing uneven wear. Positive shut down of the rejuvenator fluid flow (at the spray bars) by the two-way valve 296 almost eliminates fluid dripping by preventing the rejuvenator system components from leaking down. The N.C. shut-off valve 312 supplies air to the main mill spray bar 186 to be mixed (depending on the type of fluid) with the rejuvenator fluid (at the outlet of two-way valve 296), causing it to aerate. Aerating some rejuvenator fluids provides better coverage (reduced droplet size) of the liquid to the milled asphalt. The air continues to flow (if previously being mixed with the rejuvenator fluid) after the two-way valve 296 is closed (fluid flow shut off) thereby blowing (purging) the remaining fluid out of the spray bars. The N.C. shut-off valve 313 supplies air to the pug mill spray bar 289 and 290 to be mixed (depending on the type of fluid) with the polymer liquid, causing it to aerate. The N.C. shut-off valve 312 and 313 remain on after the liquid supply is stopped, providing additional air as the Recycling Machine slows to a stop. This allows the complete purging of the spray bars of fluid by the time the Recycling Machine has stopped. The air supply is automatically shut-off after an adjustable time delay. The N.C. shut off valves 312 and 313 also supplies air blasts while the purging and cleaning cycle is underway. Adjustable air flow control valves 314 limits the maximum amount of air flow (fluid aeration) and the one way check valves 315 prevents rejuvenator fluid and polymer liquid from entering the air supply system. The on-board computer monitors the volume of asphalt being processed through the pug mill and together with the programmable rejuvenator flow rate (determined by pre-engineering of the asphalt to be recycled), produce consistent and accurate metering of the rejuvenator fluid. Proper mixing and application of rejuvenator fluid is critical to the process. Excess fluid will prevent the recycled asphalt from setting up when compacted by the rolling equipment. Too little fluid will not rejuvenate the recycled asphalt to pre-engineered specifications. Polymer liquid (used in Superpave applications) is applied to the recycled asphalt by the addition (optional) of the supplemental liquid application system. Polymer liquid is stored in a non-heated, pressurized tank 316 mounted to the front, clip-on frame or the main-frame 3 of the Recycling Machine. An air operated, positive displacement, diaphragm pump 317 (electronically pulsed by the on-board computer) pumps and meters the fluid stored in the supplemental tank 316 delivering it to a hydraulically operated two-way valve 319. N.C shut-off valve 320 shuts off the supply flow to pump 317 automatically during system shut down and air flushing. The positive displacement, diaphragm pump 317 delivers liquid accurately, as each stroke delivers an absolute volume. Air pressure (0.1–0.5 psi) is applied to the storage tank 316 to reduce the possibility of cavitation of the diaphragm pump 317. The pump can accurately pump fluid with particle sizes up to ⅛" in diameter, however, an in-tank wire mesh strainer 321 limits particle size to less than 50 mesh. Hydraulically operated two-way valve 319 allows liquid to be directed either to the pug mill's spray bars 289 and 290 or returned to the tank 316. Check valve 322 prevents rejuvenator fluid and purge air from reverse flow. In normal operation the pug mill's spray bars 289 and 290 receive rejuvenator fluid from the pump 295 and polymer liquid from pump 317 with or without aeration (using compressed air). The two-way valve 323 allows air purging of pump 317, valve 319, check-valve 322 and the pug mill's spray bars 289 and 290. Purging air is supplied through N.C. shut-off air valve 302, flow control valve 304, one way check valve 305 and hydraulically operated two-way valve 323. Hydraulically operated two-way valve 319 is cycled while air purging, allowing air to first force liquid back to the tank 316 and secondly purge the pug mill's spray bars 289 and 290. The top of the storage tank 316 is fitted with a low-pressure relief valve (0.1–0.5 psi) 303, which allows the compressed air to escape A one way check valve 324 prevents purging air and polymer liquids from reaching the main mill's spray bar 186. The one way check valve 324 also prevents polymer liquid from reaching the main mill's spray bar 186 when only polymer liquid is being sprayed in the pug mill. The tank discharge and return lines are fitted with shut-off valves 310 for system servicing and positive shut off. The supplemental application system is controlled and monitored by the on-board computer and is programmed to execute and apply a predetermined formula. Menus provide operator input for the varying rejuvenator fluids and polymer liquids being applied, application rates and flushing cycles. Electronic readouts (screen) provide information on application rates, accumulated totals, tons of recycled asphalt processed, distance traveled, asphalt temperature, tank temperature and system status.

FIGS. 50, 51, 52 and 53 shows the offset pug mill 16 used for the final mixing, moisture removal (steam) and volume measurement of the milled (recycled) asphalt. The main housing 330, is attached to the Recycling Machine's mainframe 3 draft tube by plates 331 and 332. The bottom links (two) 333, features plain replaceable steel bushings and threaded joints, allowing the links to twist and turn. The bottom links 333 prevent pug mill side movement, but allow for raising/lowering and tilting. The top links (two) 334, feature spherical bearing at both ends, allowing movement in all directions, and are adjustable in length, allowing the pug mill to be set flat to the milled, asphalt surface. The hydraulic cylinders (two) 335, attached to plates 332 and main housing 330, raise and lower the pug mill. The cylinders 335 provide adjustable (hydraulic) down pressure allowing the pug mill to float but preventing it from riding up when full of asphalt. Three skids 336 attach to the main housing 330 and are responsible for maintaining the front rotor assembly 292 and the rear rotor assembly 337 paddle's 338 distance to the milled surface. Skid wear is low as the hydraulic down pressure is balanced against the lifting action of pug mill, while mixing. Attached to the offset front rotor assembly 292 and the rear rotor assembly 337 are paddle assemblies 338 fitted with replaceable carbide wear pads. The paddle layout of the offset, front rotor assembly 292 has two distinct areas. Area FIG. 52 "A" consists of paddles (2 paddles per arm), forming a double spiral with spaces, resulting in an inefficient conveying and mixing auger. Area "B" consists of left and right facing paddles (two and four paddles per arm) used for mixing and tumbling the asphalt and additives. The rear rotor assembly 337 faces area "B" of the offset front rotor assembly 292. The rear rotor assembly diameter is larger than the front rotor assembly and provides improved mixing and greater material throughput than previous, equally sized rotors. Hydraulic motors 339 (attached to housing 330) and drive couplings 340 directly rotate rotor assemblies 292 and 337 in a down-ward direction, thereby reducing damage to the paddles and iron utility structures (compared to up-ward rotating rotors) located in the asphalt pavement to be recycled. The rotor assemblies end thrust and end support is by bearings 341, attached to the end plates 342. The end plates 342 allow for the quick and easy removal of the rotors assemblies for servicing. Rotor speed is variable and independent of the Recycling Machine's ground speed, or optionally, tied to ground speed. The non-intermeshing rotors do not require timing, as in the case of intermeshing rotors used in conventional pug mills, allowing rotational speeds to be set individually, promoting better mixing and greater moisture removal (steam).

The windrow forming ski 343, located between the windrow forming plates 344, causes resistance to asphalt flow through the pug mill's discharge, allowing the pug mill chamber to become loaded with asphalt. The rotors assemblies 292 and 337 tumble the asphalt and additives from the alternating left and right hand paddles, providing complete mixing and steam release. Resistance to asphalt flow through the pug mill also causes resistance to flow through the main mill, thereby increasing contact time between the asphalt, additives and mechanical mixing elements (mill carbide teeth and pug mill paddles). Close operating distances between the extension mills, main mill and the pug mill reduce the asphalt's heat loss and result in lower emissions. The main housing 330 incorporates a plenum chamber 345 and a steam pipe 346. The production of negative air pressure at the pipe 346 is by a venturi (not shown), using the heater box blower, air supply. The tumbling and restricted asphalt enclosed in the pug mill's mixing chamber maintains the asphalt's temperature and together with the negative pressure, air extraction system, reduces the level of moisture in the asphalt. Blade 347 operates in the identical manner to main mill and extension mill's blade assemblies, its function being, to scrape the previously milled surface (main mill) and collect the fine asphalt for complete mixing.

Located between the two rotor assemblies 292 and 337 and scraping the complete width of the milled surface covered by the pug mill mixing chamber is the trip blade 348. The trip blade scrapes the milled surface, picking up the asphalt missed by the pug mill's front rotor paddles. Rejuvenator fluid and polymer liquid inlets 349 and 350 are located directly above the front rotor assembly (spray bars are not shown).

Figure 54:
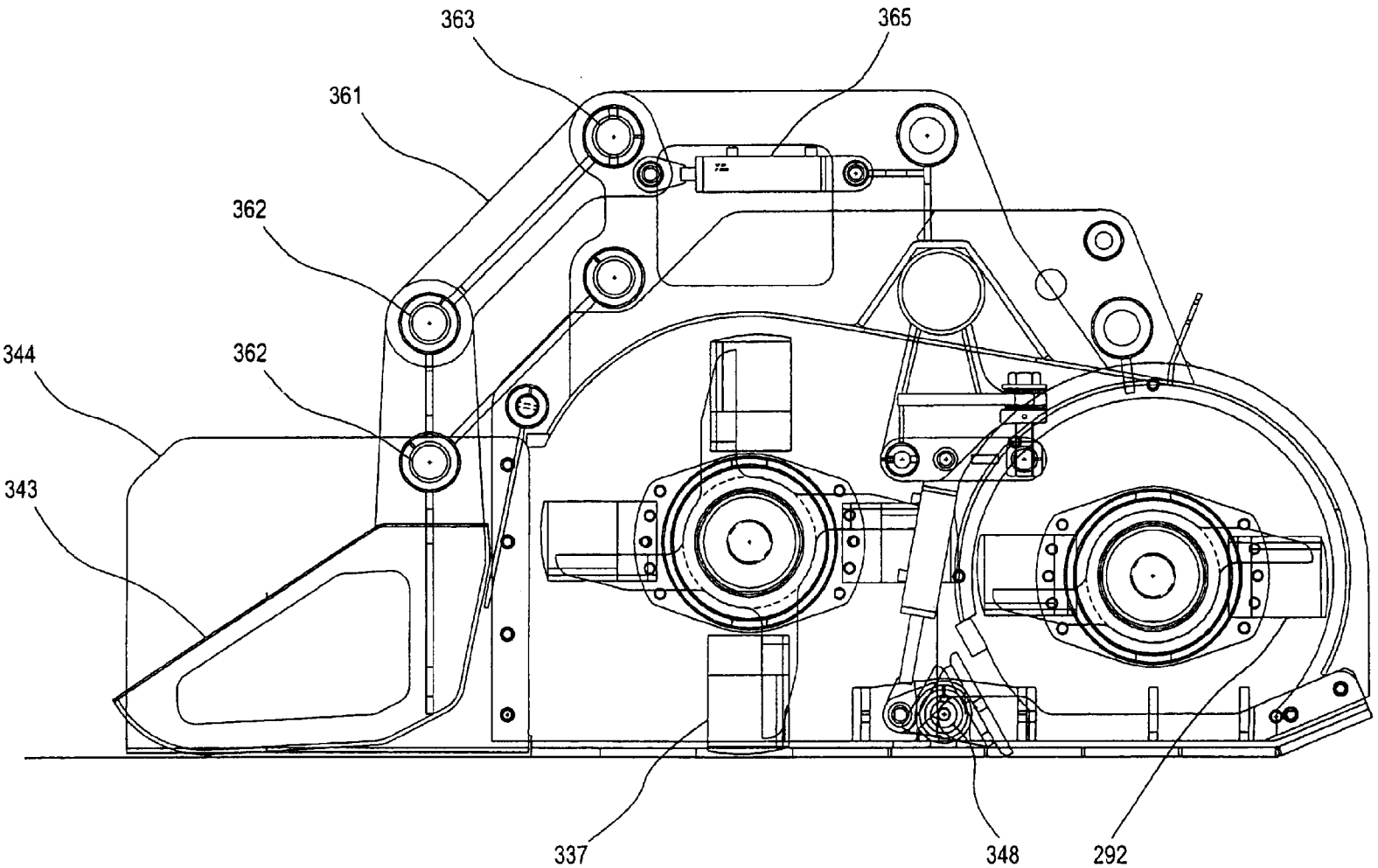
Figure 55:
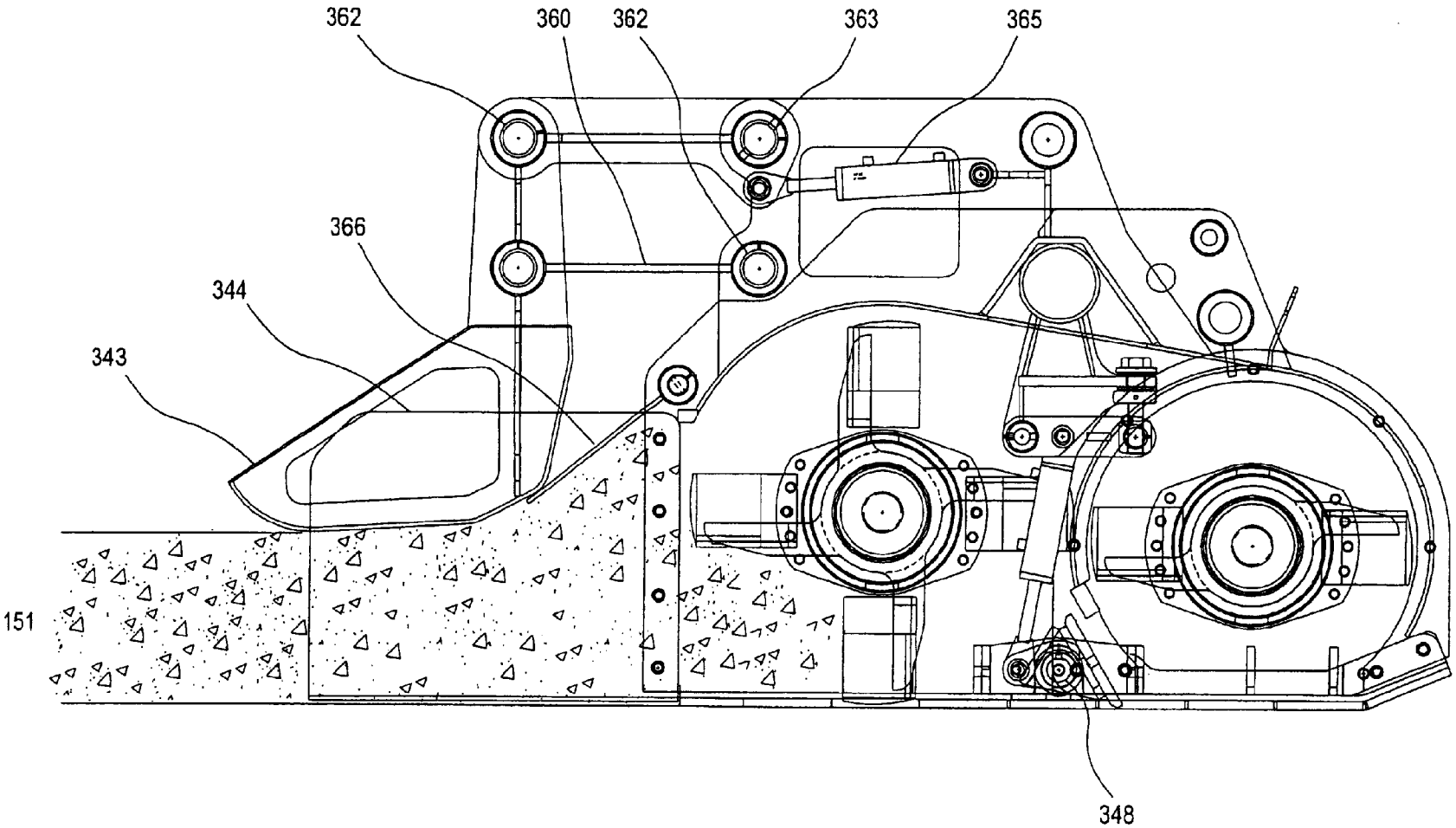
Figure 56:
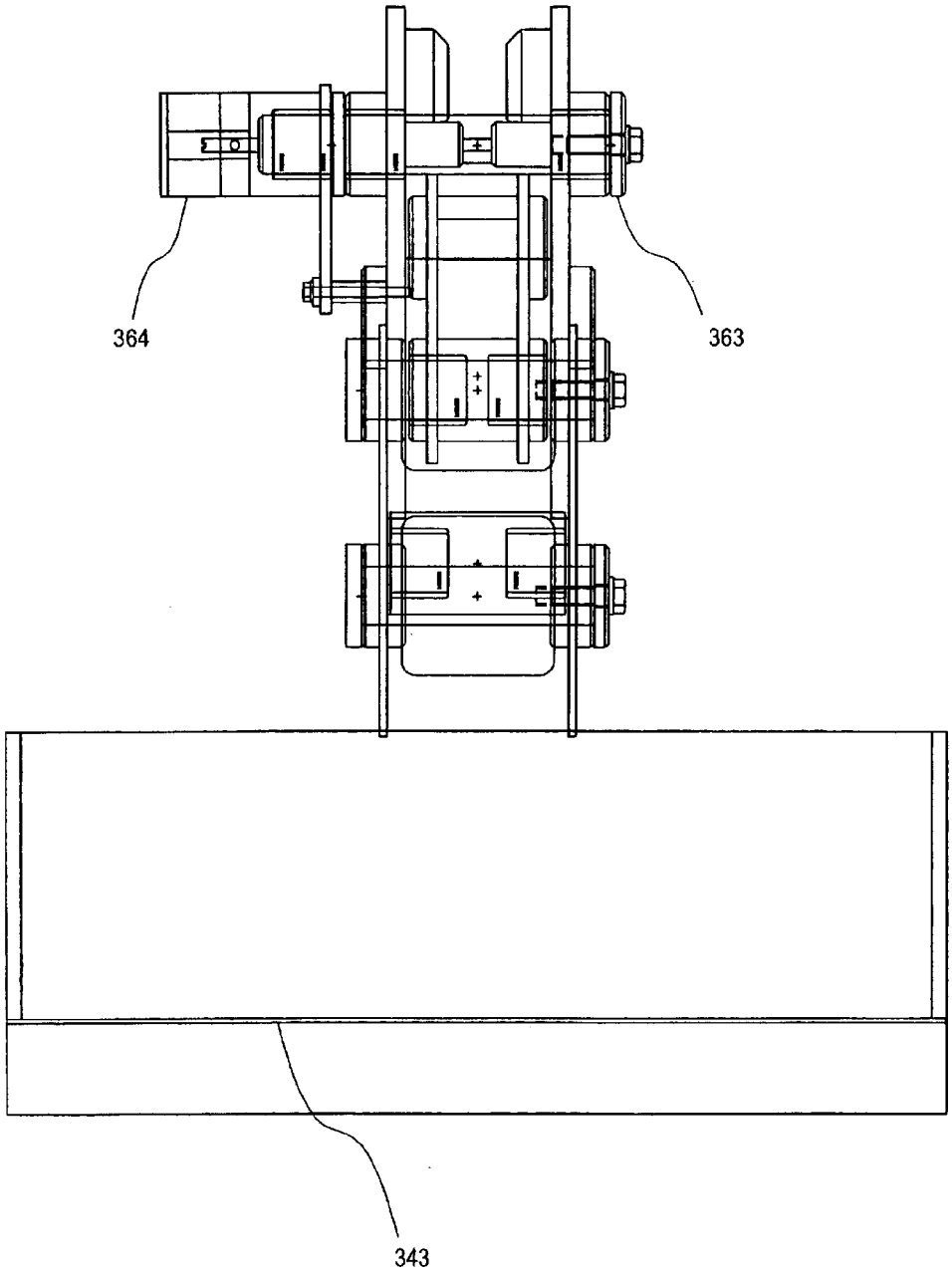

FIGS. 54, 55 and 56 show the windrow forming ski 343, bottom link 360, top link 361, link pins 362, top pivot pin 363, electronic sensor 364, counterbalance hydraulic cylinder 365 and door 366. The links 360 and 361 form a parallelogram linkage, keeping the windrow-forming ski 343 parallel to the milled asphalt's grade. The on-board computer adjusts the hydraulic pressure in the cylinder 365 electronically by measuring the pressure required to hydraulically drive the pug mill's rear rotor assembly 337. It is also possible to electronically measure the front rotor assemblies 292 drive pressure to adjust the hydraulic pressure in cylinder 365. Hydraulic drive pressure increases as the volume of asphalt in the pug mill's mixing chamber increases. Hydraulic pressure in cylinder 365 increases proportionally to the rear rotor's drive pressure and tries to pivot the top link 361 around the top pivot pin 363, reducing the effective down force of the windrow-forming ski 343. The pressure in the hydraulic cylinder never reaches a high enough value to physically lift the windrow-forming ski. Less down force on the windrow-forming ski reduces the resistance to the recycled asphalt's flow under the windrow-forming ski, allowing a greater volume of recycled asphalt to by forced out of the mixing chamber by the rear rotor assembly 337. A reduction of hydraulic drive pressure in the rear rotor assembly causes the hydraulic pressure in cylinder 365 to be reduced, increasing the resistance to flow of recycled asphalt under the windrow-forming ski. The windrow-forming ski maintains a balance between the volume of recycled asphalt in the mixing chamber and the hydraulic pressure driving the rear rotor assembly. The rear rotor's hydraulic drive pressure remains fairly consistent once the mixing chamber has initially filled. The windrow-forming ski forms a slightly compacted, asphalt windrow with a flat top section, resulting in the accurate volume measurement of the recycled asphalt, reduced emissions, maintained heat and reduced segregation by preventing the larger aggregate (stone) from rolling down the windrow's sides.

Thus, the system described above prevents the pug mill's rotors from stalling to ensure proper mixing and retention of asphalt mix. In other words, when not enough material is in the pug mill, the system will sense a decrease in resistance in the rotors causing the windrow-forming ski to move downward to restrict the flow of material exiting the pug mill so as to retain the material in the pug mill for improved mixing as well as steam and fume extraction. When too much material is in the pug mill, the system will sense an increase in drive pressure. This will cause the pressure being exerted by the windrow-forming ski on the material exiting the mill to decrease.

Another way to accomplish this is to raise and lower the ski in response to the rotor pressure. When the rotor pressure is high, the ski is raised. When the rotor pressure is low, the ski is lowered.

The varying asphalt volume passing under windrow-forming ski 343 raises and lowers the windrow-forming ski, rotating the top pivot pin 363, attached to the top link 361. Electronic sensor 364 measures the rotation of the top pivot pin 363, producing an electronic signal used by the on-board computer for processing the amount of rejuvenator fluid and/or polymer liquid to be added to the old asphalt and added aggregate. The electronic signal is proportional to the height of the windrow-forming ski 343. The pug mill's discharge width is constant and together with the varying windrow-forming ski's height, calculates the volume of asphalt being processed. Door 366 is pushed back by the asphalt flow against the windrow-forming ski 343, preventing the asphalt from flowing up and past the windrow-forming ski.

Figure 57:
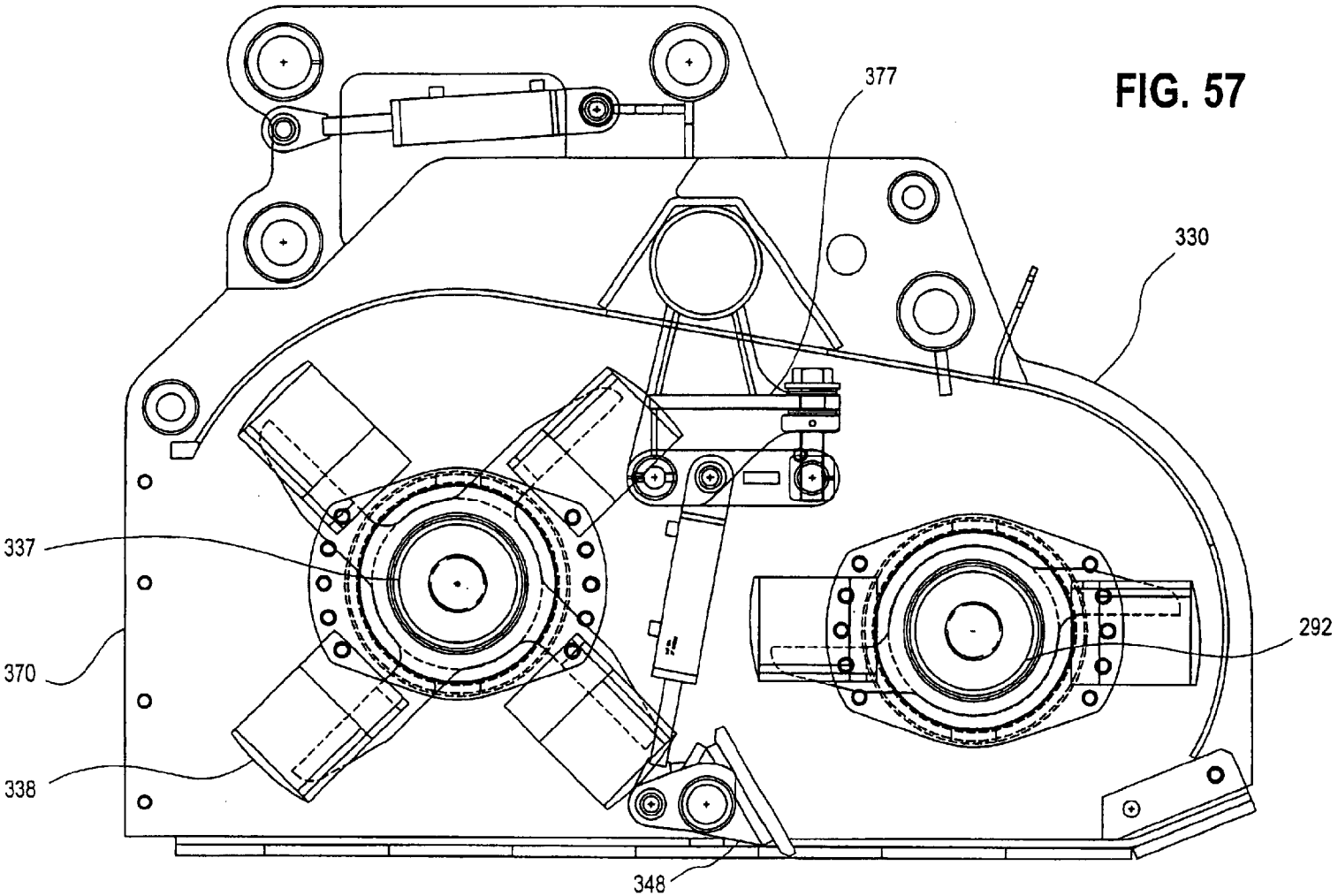
Figure 58:
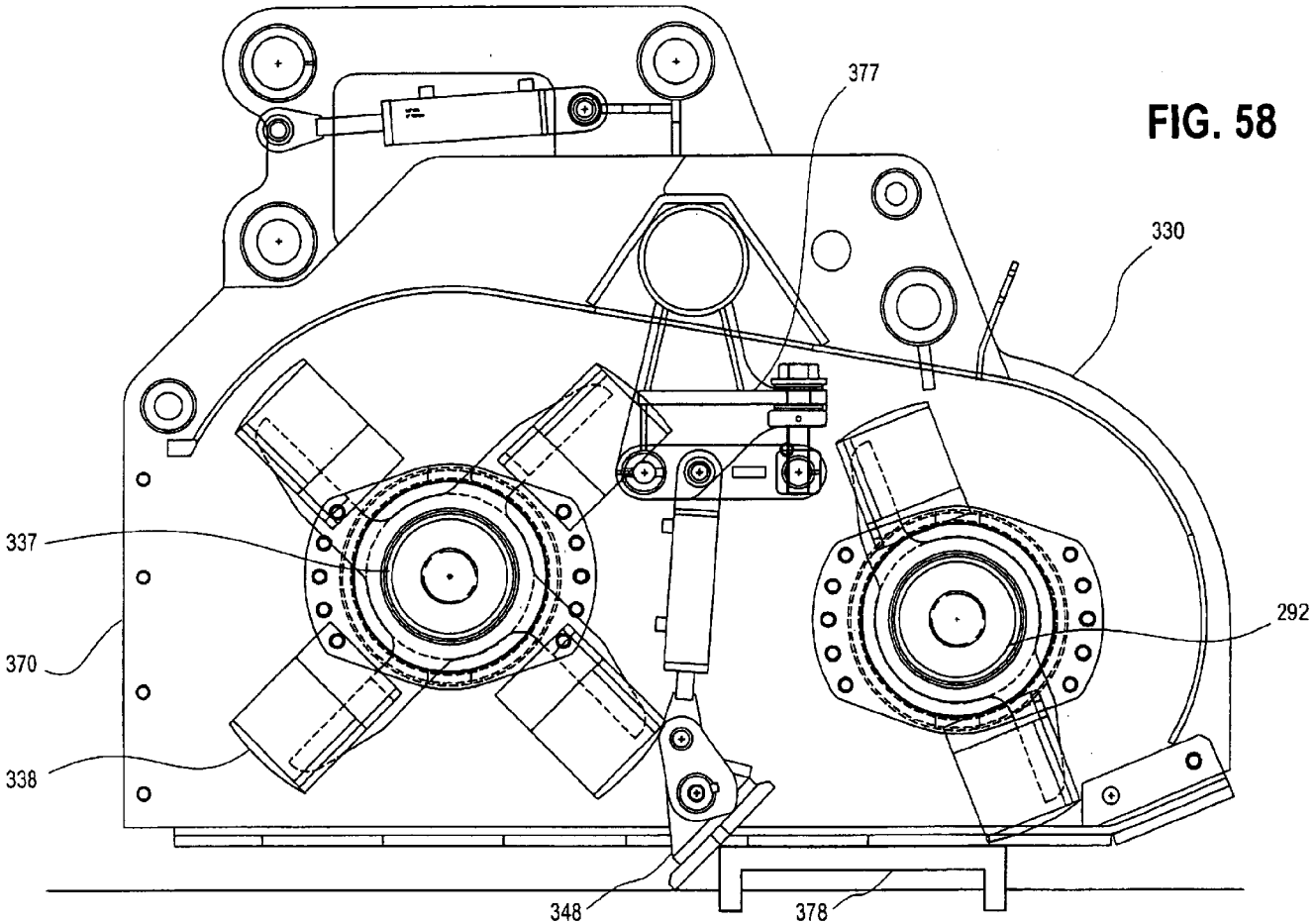
Figure 59:
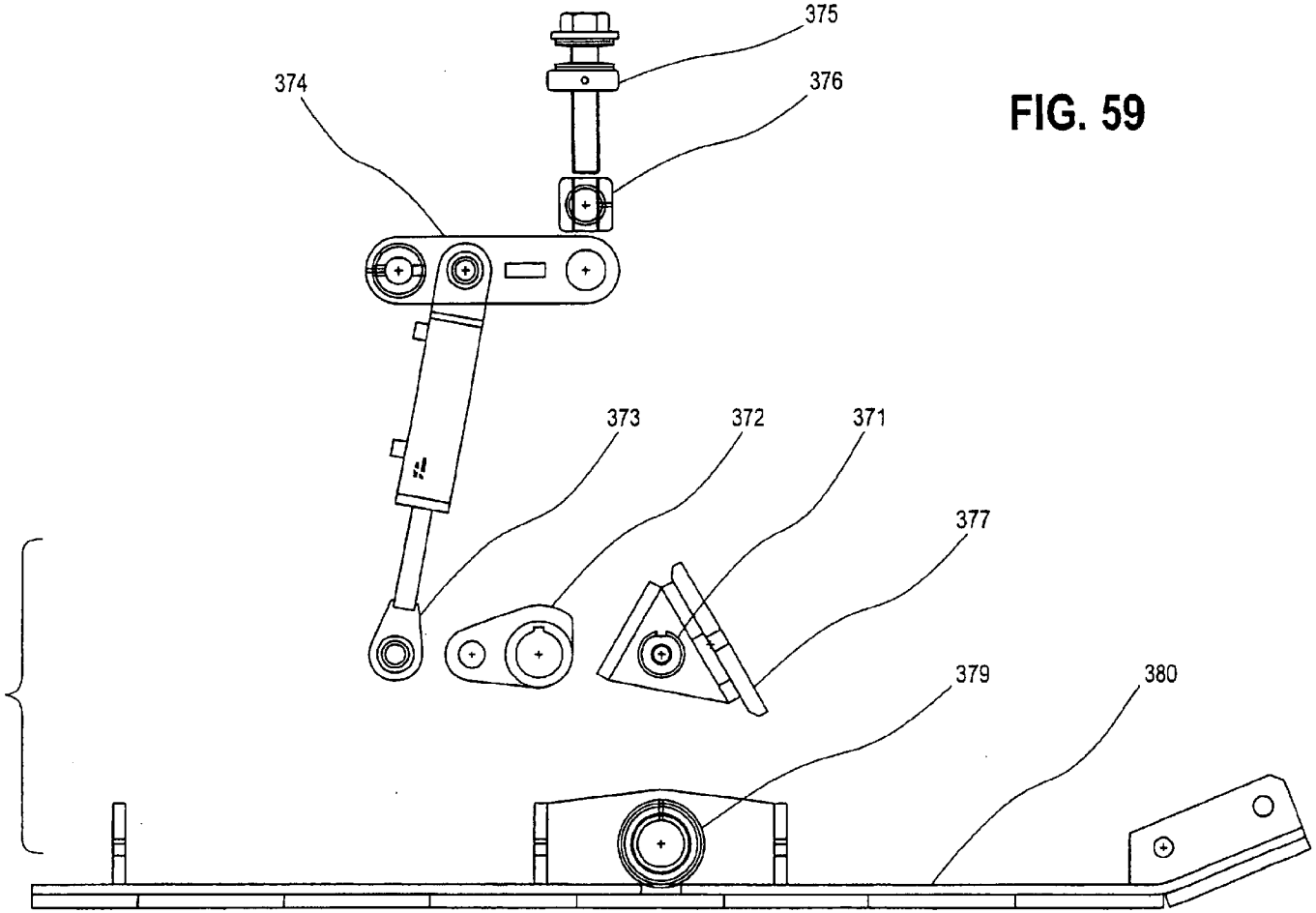

FIGS. 57, 58 and 59 show the pug mill's trip blade assembly 348 in its working and tripped position and also in an exploded view. The trip blade assembly 348 is located between the pug mill's front rotor assembly 292 and the rear rotor assembly 337. The trip blade is the full width of the mixing chamber 370. The trip blade scrapes the heated, milled, base surface, lifting any asphalt and additives missed by the front rotor paddles (the rotor paddles do not make contact with the milled base). As paddle tip wear increases the amount of asphalt missed would increase, reducing the mixing efficiency of the pug mill. Without the trip blade assembly 348 rejuvenator fluid and polymer liquid could not be sprayed into the pug mill as the fluid would come into direct contact with the milled base surface in the mixing chamber and would not be collected and mixed by the rotor's paddles 338 which would cause bleeding of the finished mat. The trip blade improves mixing and allows rejuvenator fluid and polymer liquid to be sprayed directly into the pug mill's front rotor 292.

The trip blade body 371 is attached to arm 372. Hydraulic cylinder 373 is attached between arm 372 and adjuster link 374. Adjuster link 374 is attached to adjuster screw 375 by threaded pivot 376 and stationary bracket 377. Adjuster screw 375 is located by stationary bracket 377 attacked to main housing 330. The trip blade body 371 is adjusted for height by turning adjuster screw 375 while raising or lowering adjuster link 374 and hydraulic cylinder 373. Hydraulic cylinder 373 is continuously pressurized (head end only) with hydraulic oil, thereby forcing the cylinder rod out to its maximum travel (bottomed out). Adjuster screw 375 can be adjusted while the pug mill is in operation, allowing fine adjustment of the blade's height. Normally the blade is set to just contact the milled surface. The trip blade is fitted with a replaceable, bolt on, carbide-faced blade 377. When the screw adjustment is at its limit the blade 377 can be lowered (blade has slots for the clamping bolts) allowing the adjuster screw 375 to be returned to the beginning of its adjustment. In the tripped position (FIG. 58), the trip blade assembly 348 has rotated sufficiently allowing the blade to ride up and over the utility structure 378. The trip blade assembly 348 is mounted and rotates in steel bushings 379 located in the left and center, wear shoes 380. Hitting a utility structure rotates the trip blade assembly and arm 372, forcing the hydraulic cylinder's rod into the cylinder 373. The cylinder's head end hydraulic oil is displaced, allowing the trip blade to rotate, changing the blade's angle-of-attack into a ramp, causing the blade to ride up and over the utility structure. Hydraulic oil re-enters the head end of the hydraulic cylinder, automatically returning the trip blade to its working position (after the utility structure is cleared). Hydraulic pressure in the head end of the hydraulic cylinder is adjustable and is used to change the amount of force required to rotate the trip blade. In normal operation, the ground operator is responsible for manually raising and lowering the working sub assemblies, thereby preventing damage to utility structures. The Recycling Machine's rakes, mills and pug mill are all designed to withstand the abuse of hitting a utility structure. The pug mill's front rotor assembly 292 rotates in a down wards direction and is the first part to contact the utility structure. If the ground operator does not raise the pug mill, the front rotor will force the pug mill up with little or no damage to the front rotor's carbide paddles. Manually raising the pug mill cuts off the pug mill's rejuvenator fluid flow (main mill continues to receive rejuvenator fluid) and the windrow-forming ski's electrical sensor 364 signal, used by the on-board computer in calculating the volume of asphalt flowing through the pug mill. The on-board computer locks to the ski's sensor signal value (before manually raising the pug mill) whenever the pug mill is raised. Polymer liquid application to the pug mill is generally not stopped if the pug mill is raised for a brief period, however if the period exceeds a preset number of seconds, flow will be stopped. Lowering the pug mill restores the pug mill's rejuvenator flow and the ski's electrical sensor signal. An electrical limit switch (not shown) monitors the trip blade's position. Tripping the blade (contacting a utility structure) automatically allows the pug mill to raise by reducing the head end, hydraulic pressure (controlled by the on-board computer) in cylinders 335. The force generated by the pug mill's front and rear rotor assemblies allows the pug mill to be forced up (away from the milled surface), thereby reducing the force of the trip blade assembly upon the utility structure.

It can be seen that iron utility structures located in the asphalt's surface are cause for concern, especially when working in city applications. Normally the Preheater operator will mark the asphalt's surface with a paint marker (spray can) indicating to the Recycling Machine operators where the structures are located. This works well, however some structures have been found to be below the asphalt's surface. To overcome the problem of dealing with iron utility structures the GPS's metal detection readings (described earlier) are used by the final Preheater (unit ahead of the Recycling Machine) and the Recycling Machine's GPS and on-board computers to automatically raise and lower the rake/blades, extension mills, main mill and the pug mill, preventing damage to the sub-assemblies and iron utility structures. For machines not equipped with the optional GPS system a metal detection boom is fitted to the front end of the Recycling Machine's mainframe 3, or attached to the front asphalt hopper assembly 190, (when fitted). The metal detection boom assembly is also fitted to the front end of final Preheater mainframe 3 (Preheater ahead of the Recycling Machine) when the rake/blade scarification system 11,12 and 13 is fitted. The metal detection boom is hydraulically adjustable in width to allow for varying processing widths.

Figure 60:
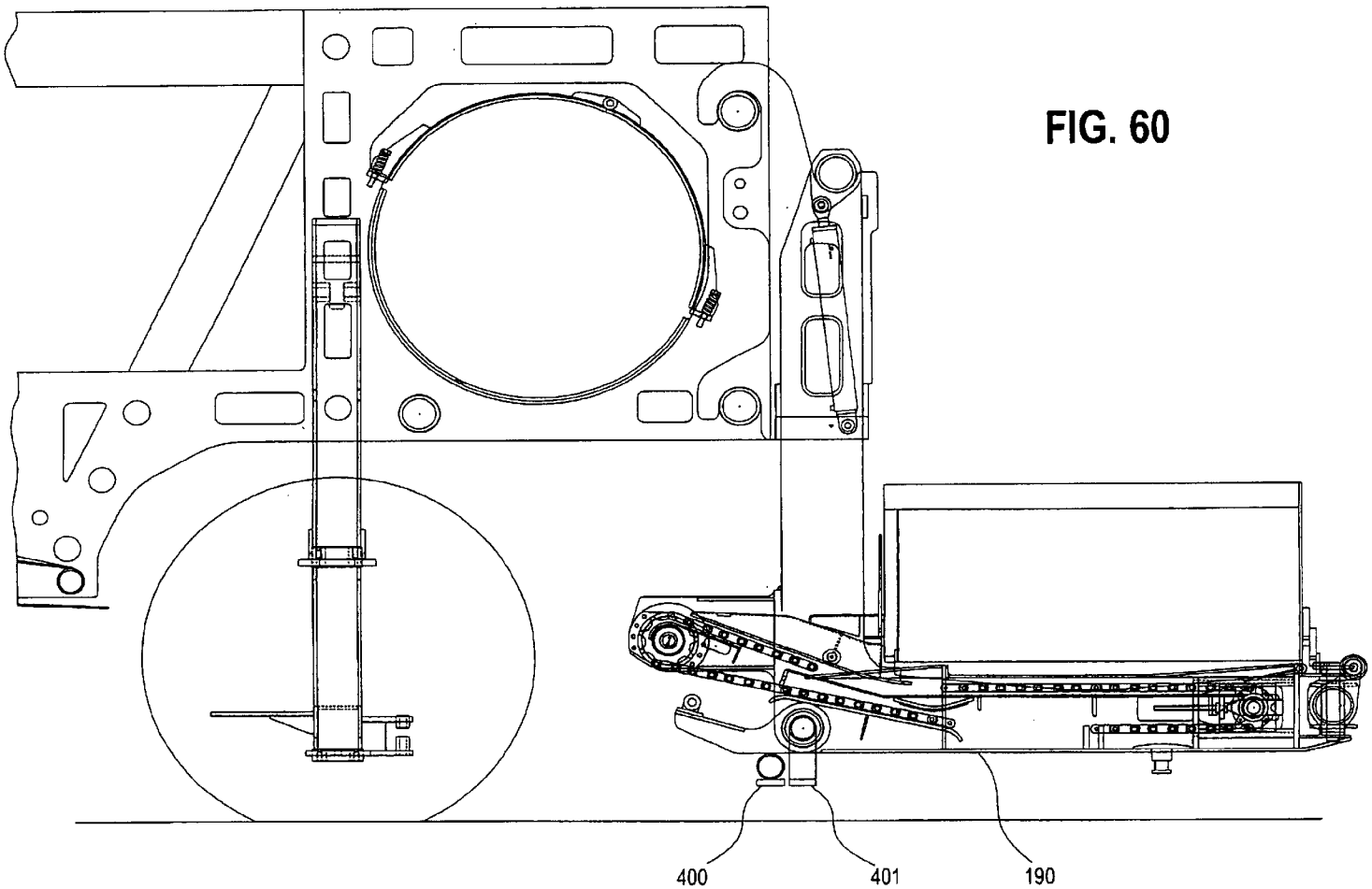
Figure 61:
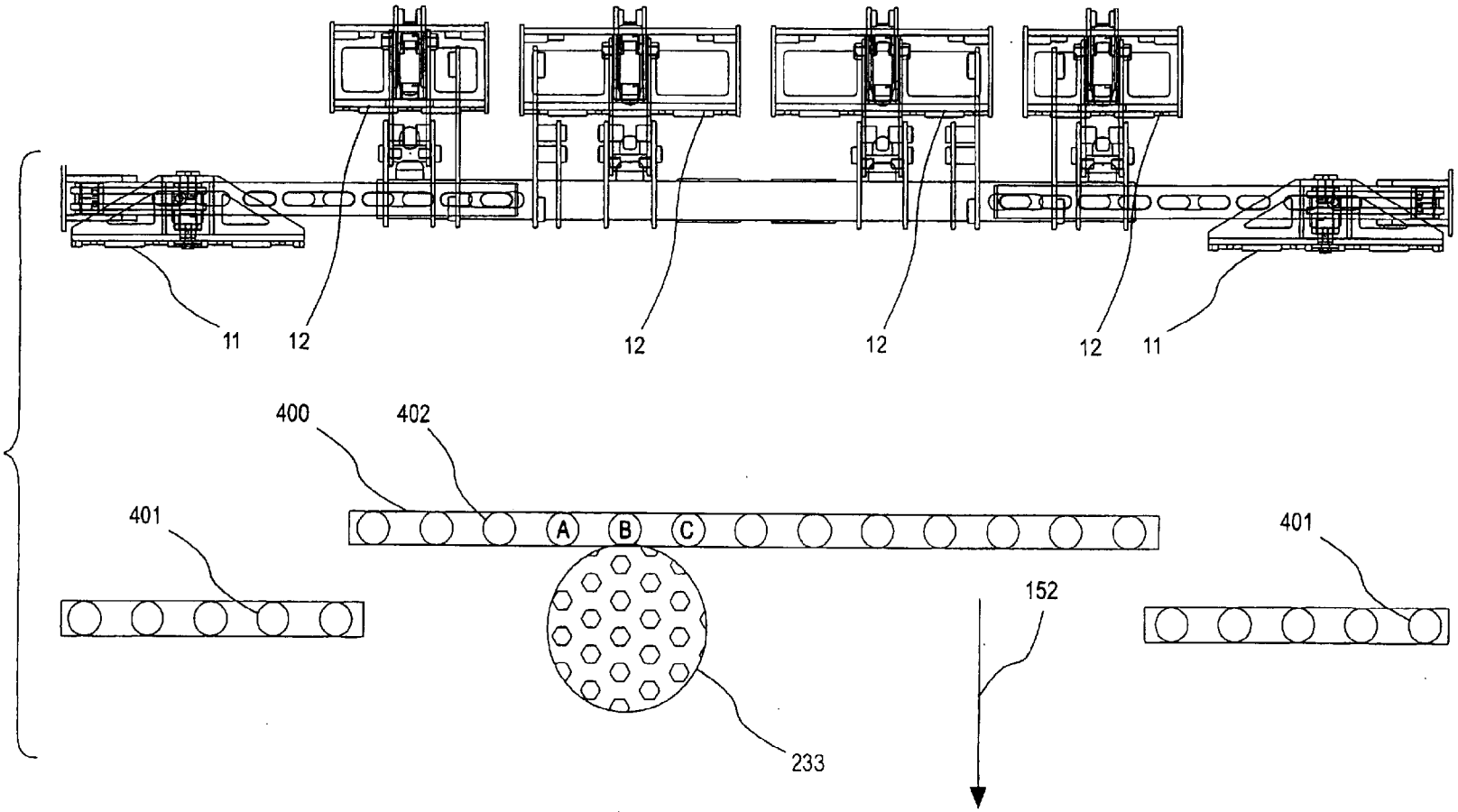
Figure 62:
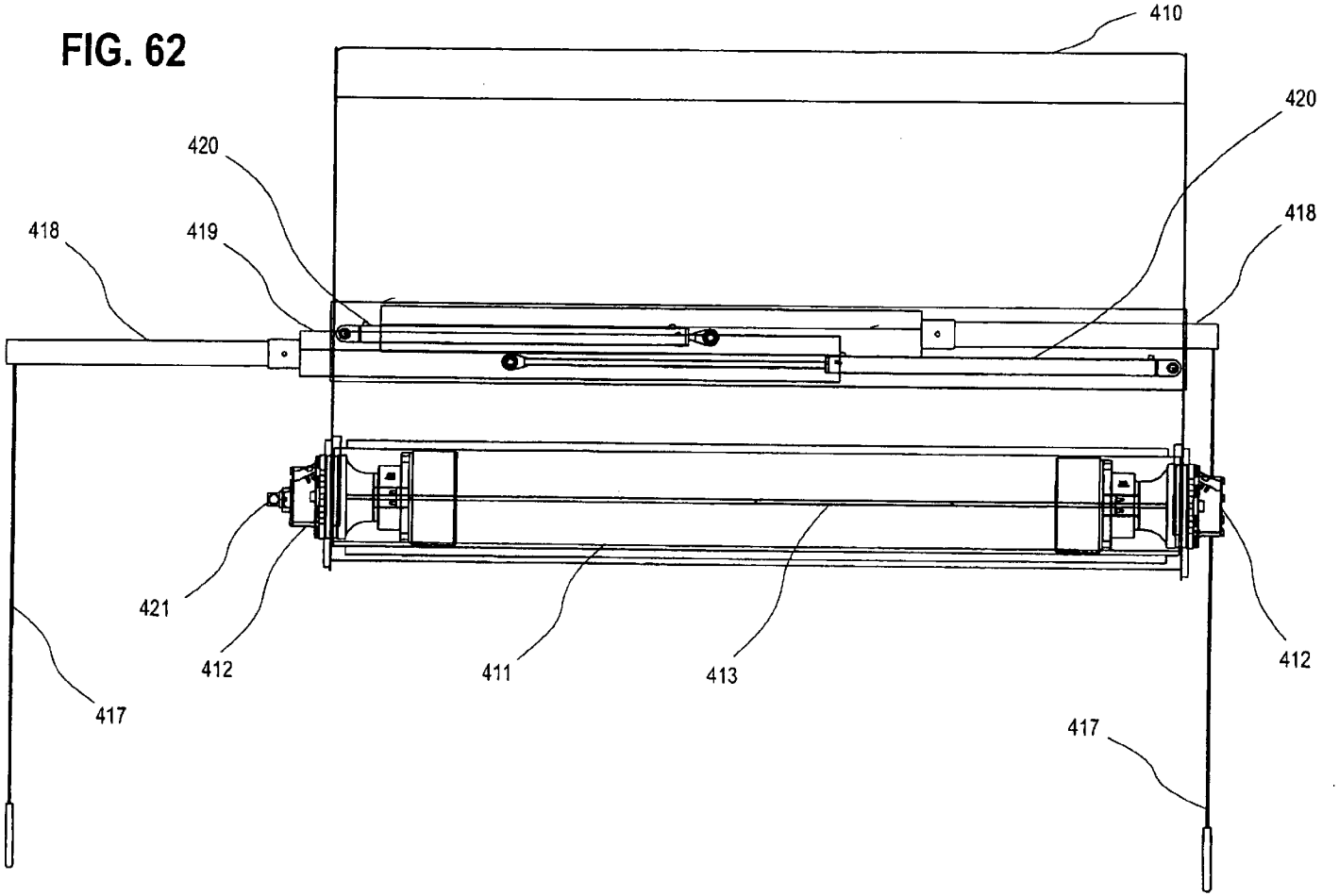
Figure 63:
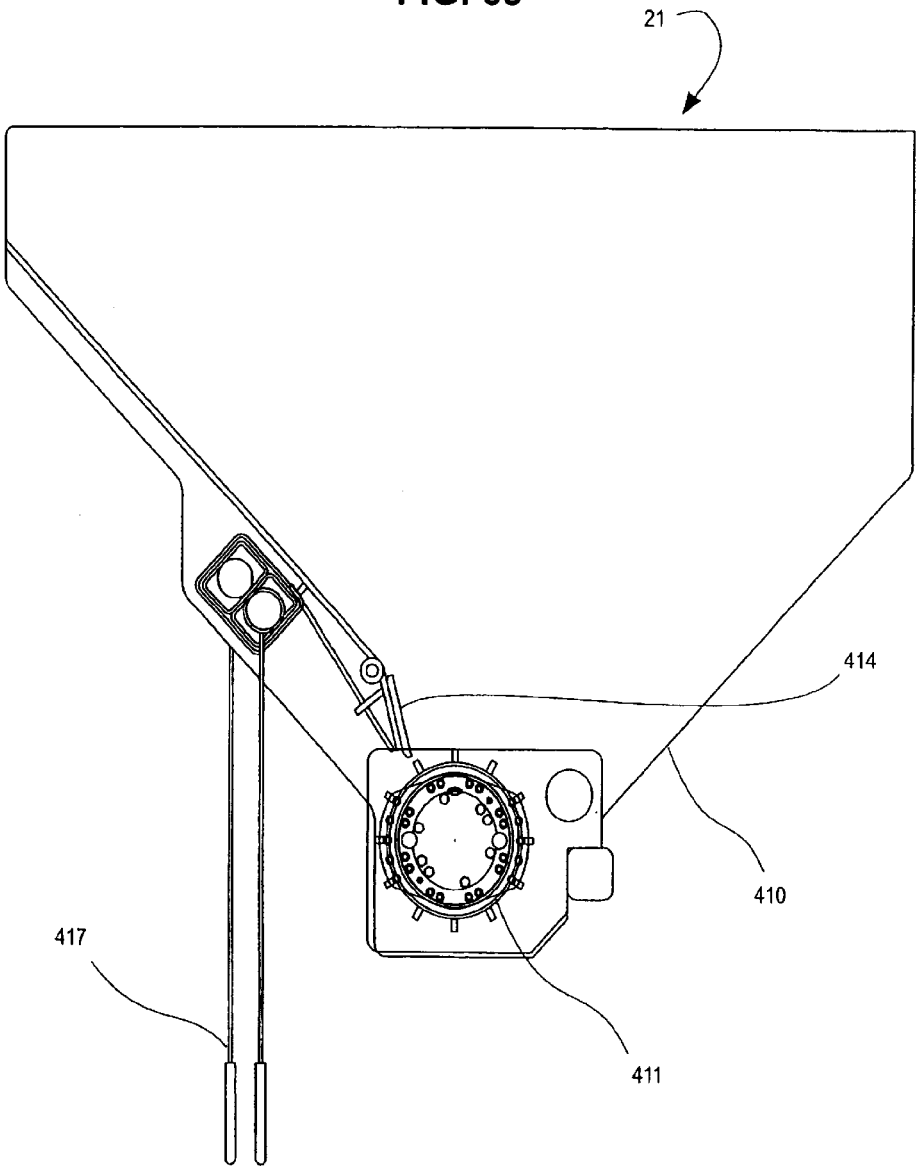
Figure 64:
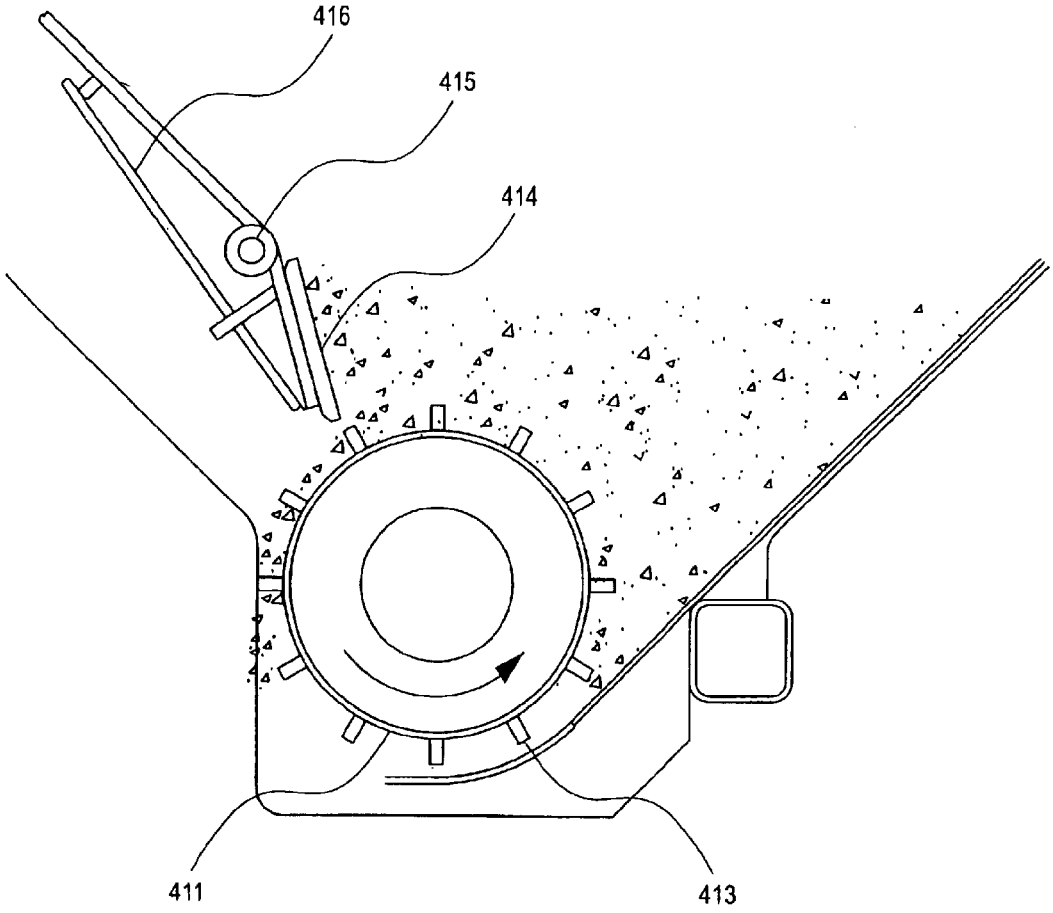
Figure 65:
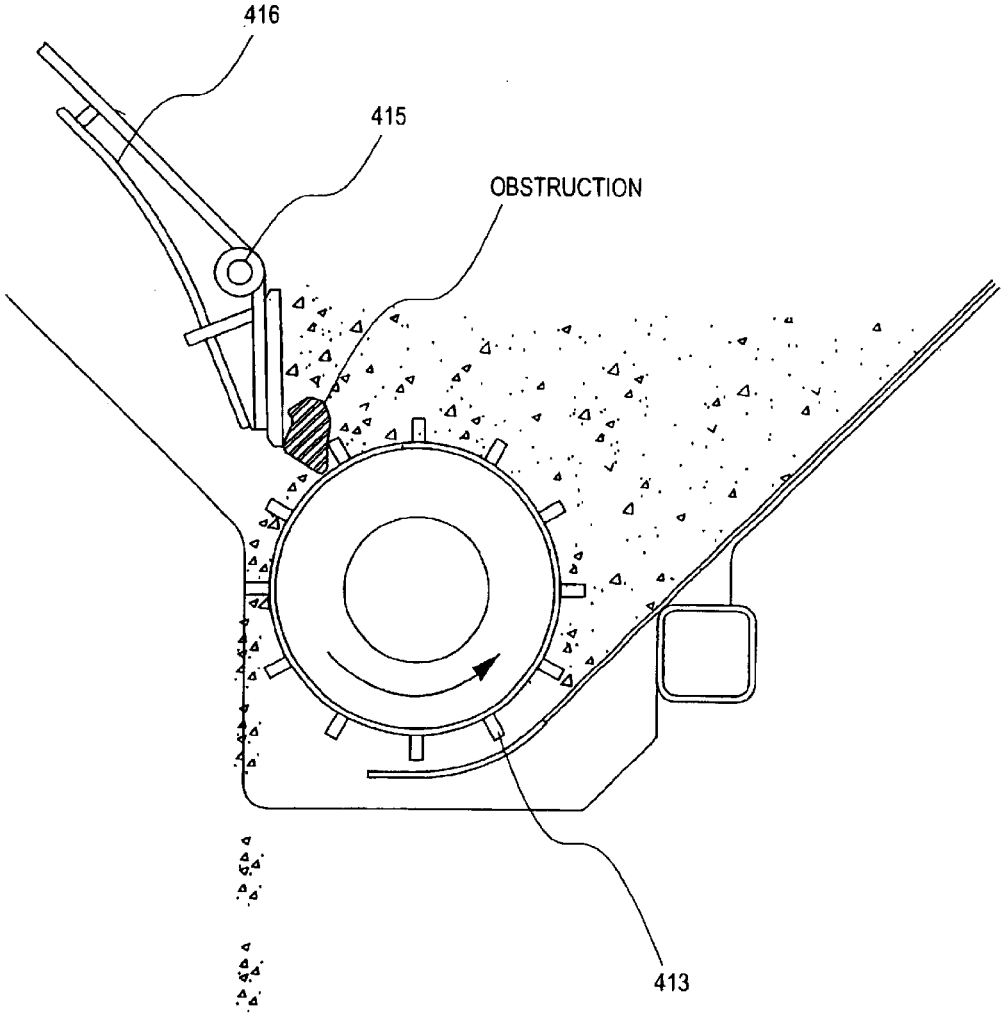

FIG. 60 shows the main metal detection boom assembly 400 and the extension metal detection boom assemblies 401, which are hydraulically extended from hopper frame 190. The booms are located at the front end of the machines where heat and moisture are at the lowest levels. FIG. 61 shows a plan view of the boom assemblies 400 and 401 fitted with a series of metal detector heads 402. The distance between the booms to the machines sub-assemblies is mechanically fixed. In the example shown the rake/blade assemblies 11 and 12 are at a set distance to the boom assemblies as are the main mill, extension mills and the pug mill. The main boom 400 is about to detect an iron utility structure 233 located in the heated asphalt's surface. Sensors 402, A, B, and C detect the structure and the electronic input is stored into the on-board computer's memory. The position (location on the mainframe 3) of the rakes/blades, extension mills, main mill and pug mill is known. The position of the sensors on the main boom 400 and extension booms 401 is fixed and known. The position of the extension booms is electronically monitored as they are hydraulically moved in and out to adjust for the varying processing width. The on-board computer calculates the distance traveled (by monitoring the Recycling Machine's drive wheel rotary encoder) and the width location of the iron structure(s) by monitoring the individual sensors 402 and the two extension boom's location and sequentially raises and lowers the appropriate rakes/blades, extension mills, main mill and pug mill, preventing damage to the structure and sub-assemblies. The same system is used for Preheater's fitted the rake/blade assemblies 11, 12 and 13, however the booms are mounted directly to the front of the Preheater's mainframe 3.

FIGS. 62, 63, 64 and 65 show the Preheater's pin-on aggregate bin 21 used to spread aggregate on to the heated asphalt's surface, ahead of the Recycling Machine. The aggregate bin (hopper) 410 typically receives aggregate from a wheel loader. The rotor assembly 411 is mounted and driven (direct drive) at both ends by two, high torque, hydraulic motors 412. The rotor assembly discharges aggregate as it rotates and it's speed is infinitely variable. The rotor assembly is fitted with equally spaced flutes 413 (bars) running the complete length of the rotor. The adjustable, rotating strike-off blades 414 controls the aggregate's depth on the flutes 413 as the rotor assembly turns. The adjustable, rotating strike-off blades can be adjusted to suit aggregates ranging from washed sand to Superpave sized stone. The flutes 413 provide a positive grip on the aggregate and prevent unwanted aggregate flow around the rotor assembly. Multiple rotating, strike-off blades are mounted across the full width of bin inline with the rotor assembly and are attached to the bin by hinges 415. Flat springs 416 force the blades into the working (normal) position. An obstruction caught between the rotor's flutes 413 causes the blade to rotate around hinge 415, allowing the obstruction to pass without damaging (rotor or blade) or stalling the rotor. Recycling continues uninterrupted. Aggregate is dropped on to the heated asphalt's surface in lines (caused by the flutes) allowing the operator and inspector to visually monitor the quantity and distribution pattern. The Recycling Machine's heater box skirts (front and rear) drag the heated aggregate and smooth (flatten) out the lines as the aggregate passes under the heater box 4, providing complete aggregate drying and surface coverage. The rotor assembly 411 and flutes 413 are manufactured using stainless steel, thus preventing rusting and sticking when using small, damp aggregate. The discharge rate is computer monitored and controlled by measuring the Preheater's groundspeed, width of pass and asphalt surface profile (depth change). The rotor's discharge rate is measured and calibrated (lbs./cu. ft./1 RPM of the rotor assembly) by placing measuring pans on the asphalt's surface to catch the aggregate. The Preheater is used to heat and dry out the aggregate prior to electronic weighing. The dry weight is calculated and entered into the on-board computer as a reference. The operator selects the application rate (lbs./cu. ft.) as determined by prior laboratory testing of the asphalt and the depth of processing to be performed by the Recycling machine (inches). The rotor assemblies width is fixed, therefore the application rate can not be determined only by the distance traveled but must use distance traveled, processing width and asphalt profile (depth change) in the calculation. The wider the Recycling Machine's processing width or the greater the asphalt's processing depth, the faster the rotor assembly 411 must rotate to maintain the correct application rate and visa versa. High sections (greater volume of asphalt to be processed) will require more aggregate, while low sections will require less. One method to input the width of the road being encountered is to outfit the rake assemblies 11 and 12 with linear variable differential transducers (LVDT) to calculate the overall width of the rake assembly, which should match the width of the road. For width measurement with a Preheater that is not fitted with the rake scarification and blade collection system the operator uses two hydraulically operated weighted markers 417 attached to ABS (plastic) extendable arms or pipes 418, sliders 419 and hydraulic cylinders 420. The replaceable ABS arms 418 prevent damage to the sliders 419 if contact with solid objects, such as trees, poles etc., occur. As processing width varies the Preheater operator simply moves the weighted markers 417 in and out by supplying hydraulic oil to either hydraulic cylinder 420 attached to the sliders 419. The right marker normally would hang above the edge of curb (gutter) and left marker, the center of the road. Individually monitored (electronically) sliders 419 provide processing width information to the on-board computer. The electronic sensor 421, measures the actual rotor assembly speed in relation to the stored (calculated) reference speed (closed loop), insuring that the rotor assemblies speed remains correct, even under varying load conditions. This measuring system insures accurate width measurement, without the operator ever having to get off the Preheater and physically measure (with a tape measure) and manually enter the width into the on-board computer. Of course, other mechanical devices known to those of skill in the art may be used to measure the width of the road as well. For Preheaters fitted with the optional rake scarification and blade collection system the width measuring system's weighted markers, pipes, sliders and hydraulic cylinders are not required. Instead, the position of the extension rakes 11 is electronically monitored. The extension rakes are hydraulically extended or retracted by the operator as the width of processing (scarification) varies. If the rake scarification system is not required the operator uses the rake extensions as markers (rake teeth not lowered).

When the aggregate bin is attached to the front of the Recycling Machine the width and profile measuring system can be used as described below. It is also possible to use the pug mill's material measuring system as the reference for the volume of aggregate to be deposited. The Recycling Machine's on board computer is programmed for the amount of aggregate required (percentage of recycled asphalt being processed). As the volume of processed asphalt increases so does the discharge rate of the aggregate bin. A decrease in the volume of processed asphalt causes a reduction in aggregate being discharged. This system is not as accurate as the profile and width measuring system (described below) as the pug mill's measuring system is some distance behind the discharge of the aggregate bin's discharge. However on highway type work with good grade accuracy will remain high.

Figure 66:
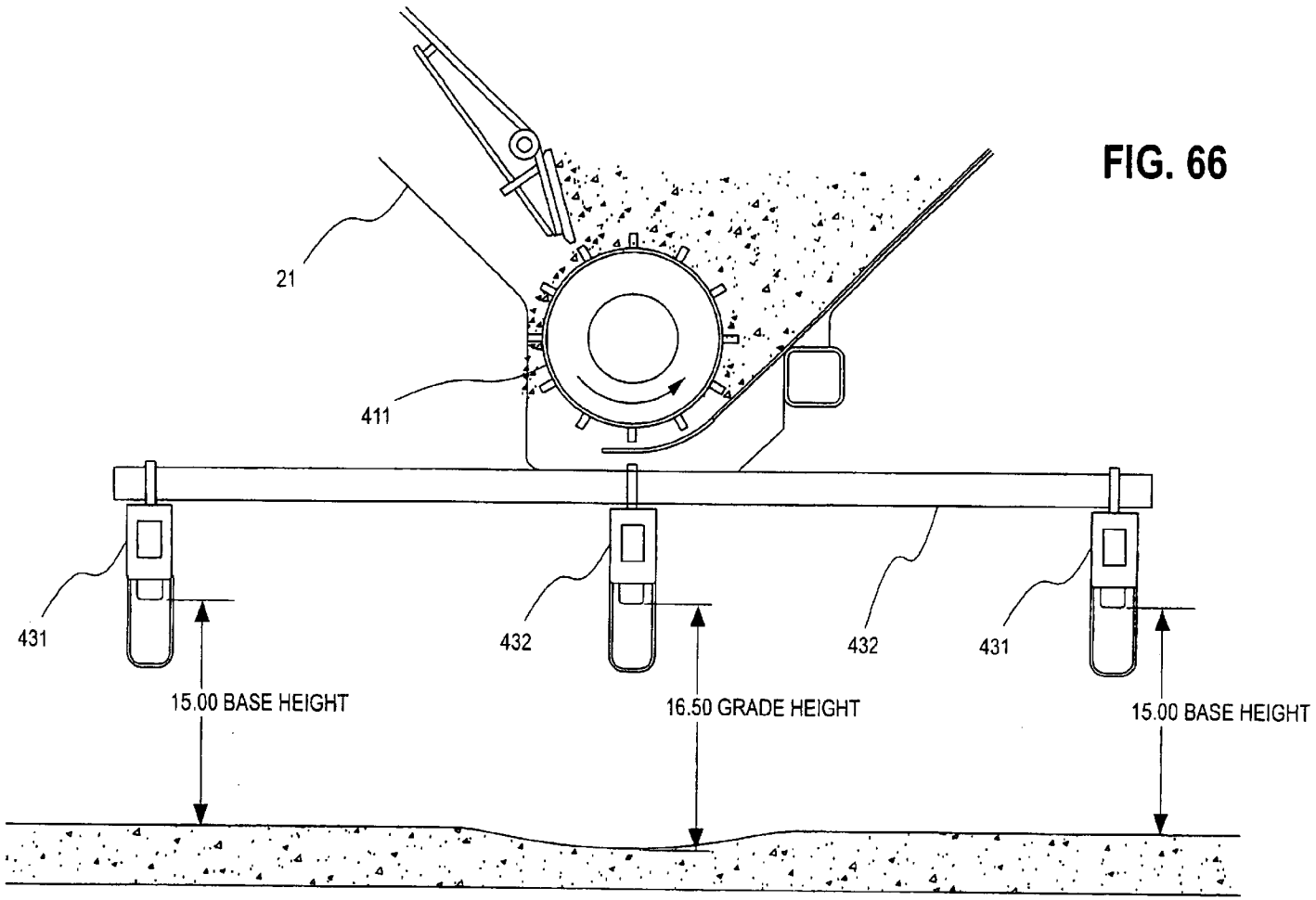

FIG. 66 shows the surface profile measuring system attached to the aggregate distribution bin 21. Two averaging beams 430 (one on either side at the rear of the Preheater) are fitted with three sonic (beam) sensors targeting the heated (scarified or non-scarified) asphalt surface. Each beam has two base height sensors 431, (one at the front and rear of the beam) and one grade height sensor 432 located in the center of the beam. The grade height sensor 432 is located under the centerline of the aggregate bin's discharge rotor assembly 411. The on-board computer processes and stores the individual height readings of the front and rear base height sensors 431 (the actual height is not important) in relation to distance traveled (electronic pickup on Preheater drive wheel). The grade height sensor's 432 height is compared to the base height of the front sensor 431. The rear sensor 431 provides a correction factor to the system, i.e. if the operator lifted the front of the Preheater to its upper limit while processing. Beams 430 would be tilted back resulting in the rear sensor height being less than the front sensors and also the grade height sensor 432. The front base height sensor 431 provides cleaner target distance information than the rear sensor, due to the fact that the rear sensor is also measuring the lines of deposited aggregate. The programming code recognizes the varying height of the lines of aggregate and the base surface and provides in a consistent (filtered) reference. The difference between the base height and grade height is referred to as reference height. The two reference heights (left and right averaging beams) are then averaged and used by the on-board computer to correct for grade changes such as bumps and depressions. The accuracy of the system does not change when the operator raises or lowers the Preheater while working. The profile measuring system improves the accuracy of the aggregate distribution system when working with poor surface grades. For greater accuracy the number of averaging beams can be increased across the width of the asphalt being processed. The profile measuring system duplicates the grade profile to be milled by the Recycling Machine when operating on automatic grade and slope controls. For instance, a depression 3 feet wide by 2 inches deep across the width of the asphalt being processed would cause the volume of aggregate applied at the depression to be reduce as the amount of material to be milled to grade when reaching the depression will also be reduced. Without the profile measuring systems correction factor the distribution rate for aggregate would be based purely on the processing width and operator input for depth and would have resulted in excessive aggregate at the depressed area. A bump would have the reverse effect by providing too little aggregate for the amount of asphalt being milled to grade. Of course, other mechanical based systems may be used in place of the sensors.

Other systems and equipment spread aggregate (as noted before) by only measuring the distance traveled and therefore are not accurate. Systems that do not add aggregate are not capable of 100% Hot In-place Recycling of asphalt pavement while meeting pre-engineered specifications. The Remix method (mixing a percentage of new asphalt with the old asphalt) has become popular as the accurate control of rejuvenator fluid, addition of aggregate and the complete mixing of additives and asphalt are not required to the same degree as with 100% HIR.

Figure 67:
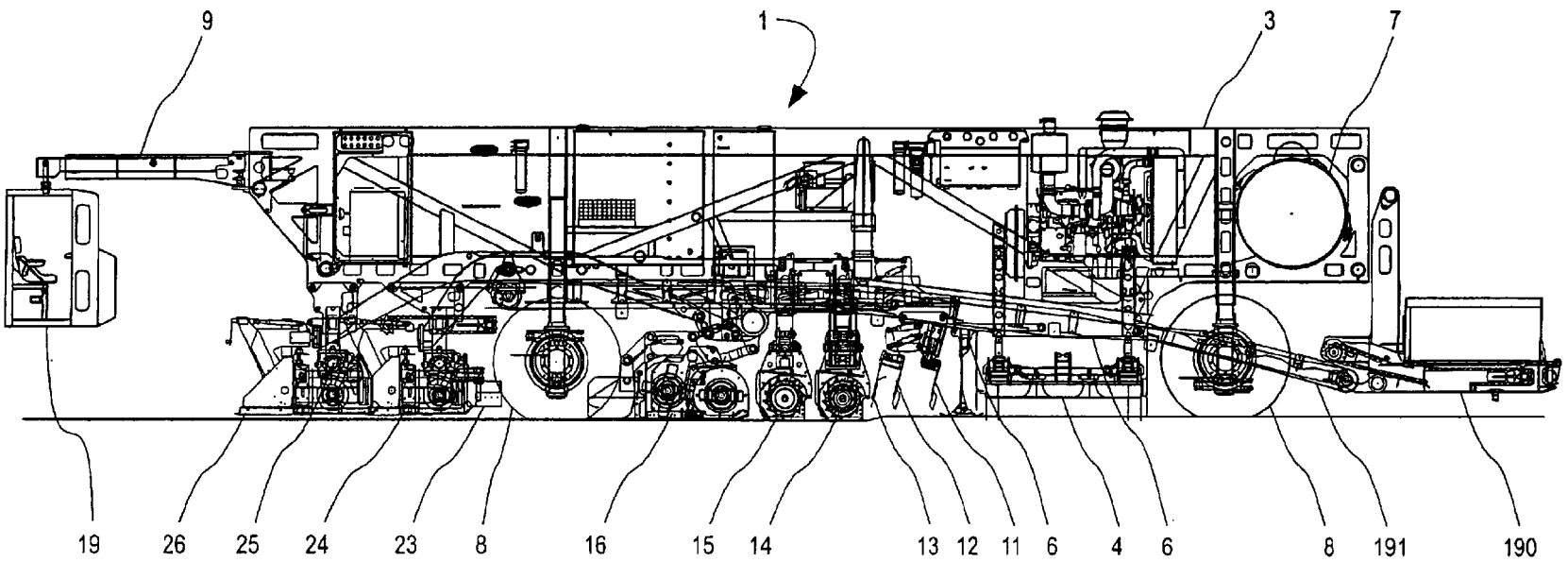

FIG. 67 shows the Recycling Machine configured for 100% HIR with an integral overlay. The sub-component numbers from 1 to 16 are the same as described in the above. For the Integral Overlay method, of the sub-assemblies which may be used are the primary auger/divider/strike-off blade 23, primary screed/tow arms 24, secondary auger/strike-off blade 25 and secondary screed and tow arms 26. The clip-on front asphalt hopper 190 and the central conveyor 191 and shuttle conveyor 29 are required to bring new asphalt to the secondary auger/strike-off blade 25 and secondary screed assembly 26. The Recycling Machine's mainframe 3 is designed to incorporate the additional sub-assemblies, without having to be modified.

Figure 68:
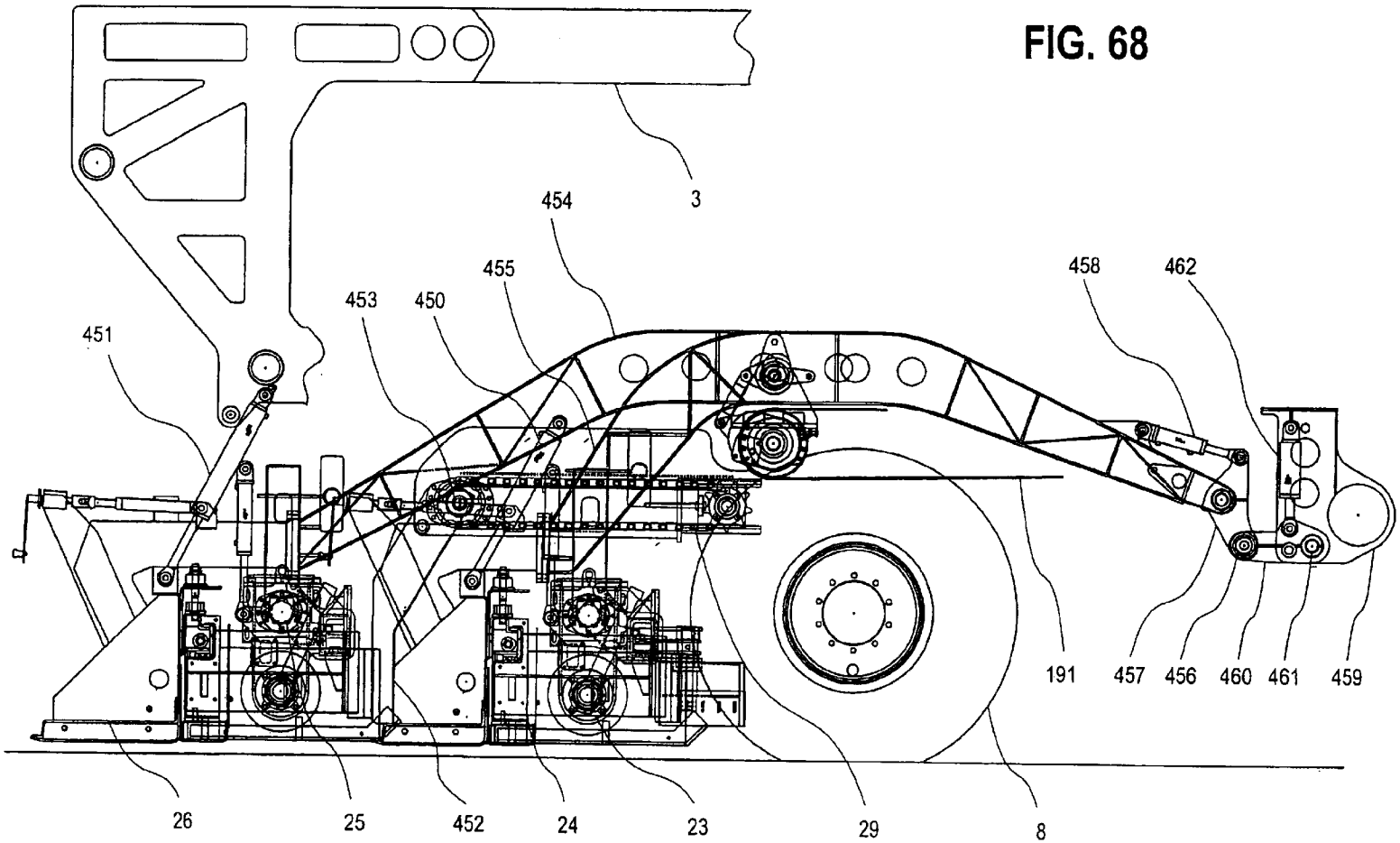
Figure 69:
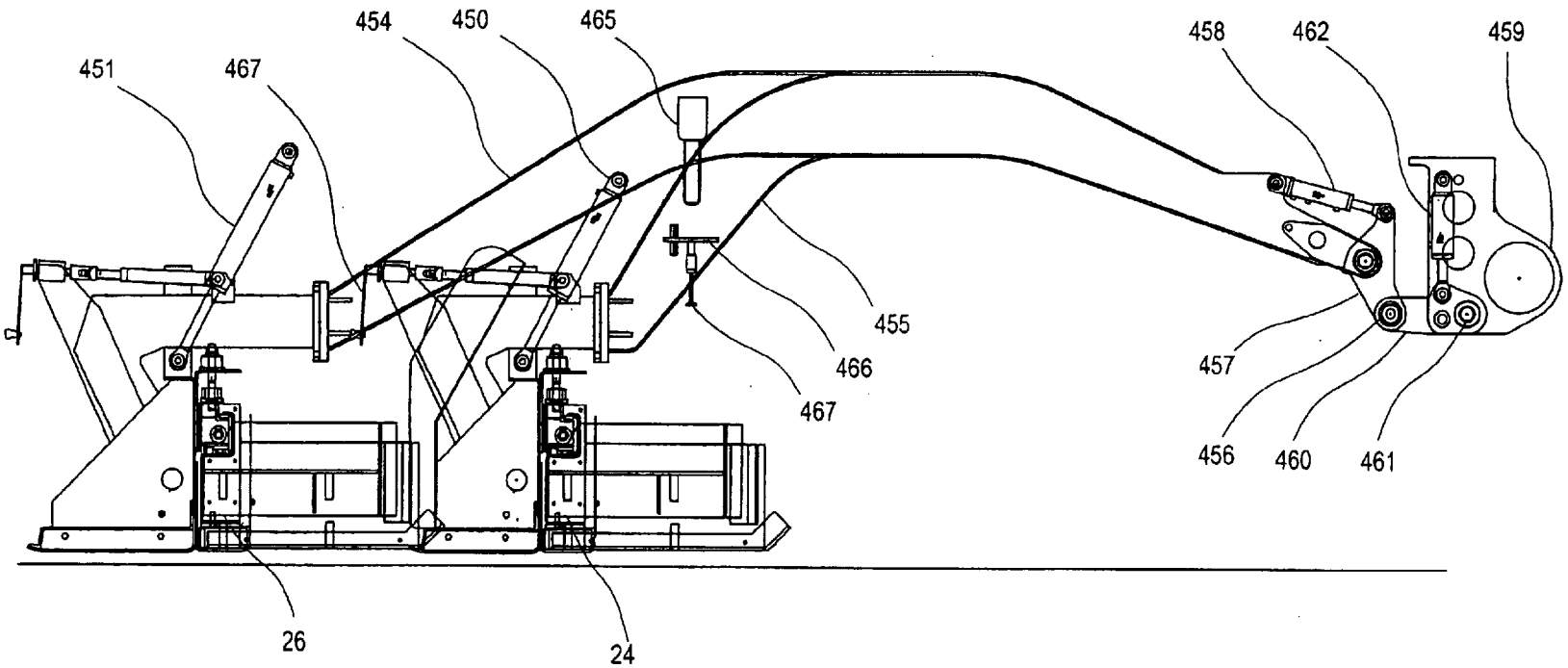

FIGS. 68 and 69 show a close up view of the rear end of the Recycling Machine set up for the Integral Overlay method. The primary auger/divider/strike-off blade 23 incorporates the shuttle conveyor 29 that directs new asphalt from the central conveyor 191 to the secondary auger 25 and screed assembly 26 or to the primary auger/divider/strike off blade 23 and screed assembly 24. The position of the shuttle conveyor can be manually, or, automatically controlled (hydraulically moved towards the back end of the machine) by the on-board computer allowing new asphalt (delivered by the central conveyor) to spill off the front end of the shuttle conveyor into the primary auger/divider/strike off blade assembly when insufficient recycled asphalt is available to maintain the correct head of asphalt in front of the primary screed assembly. The design of the shuttle conveyor allows new asphalt to be delivered to both the primary and secondary auger and screed assemblies at the same time as the on-board computer monitors the asphalt requirements for both the primary and secondary operations and will increase the central conveyors delivery rate to match the increase demand. New asphalt can spill off the front of the shuttle conveyor while it is also conveying asphalt to the secondary operations. Four hydraulic cylinders 450 and 451 attach the primary and the secondary screed to the Recycling Machine's mainframe 3. The primary auger/divider/strike-off blade 23 is identical in construction and operation as described. The secondary auger/strike-off blade assembly is identical in construction, except that the divider is not attached. Electronic asphalt level sensors are fitted to the secondary auger/strike-off blade assembly 23 and move the new asphalt away from the chute 452. As mentioned before, an electronic, proportional sensor monitors the level of asphalt in the chute 452 and the on-board computer controls the flow of new asphalt from the front asphalt hopper assembly 190, central conveyor assembly 191 and the shuttle conveyor 29 into the chute 452. The shuttle conveyor 29 is driven by hydraulic motor 453 and is electronically matched in speed to the central conveyor's speed. The primary and secondary screeds are attached to the primary and secondary tow arms 454 and 455. Both of the tow arms are attached to the same pickup point 456, which is part of the fulcrum arm 457. Attached between the fulcrum arm 457 and the secondary screed tow arm 454 is the hydraulic cylinder 458 (one on both sides of the machine). The primary screed tow arm 455 does not require a hydraulic cylinder. The hydraulic cylinder is modified with a third port, allowing the rod's piston to float against a small flow (0.5 to 1 GPM) of high-pressure oil entering at a specific point in the cylinder barrel. The Recycling Machine pulls along the screed assemblies that are attached to the machine's mainframe 3 by housing 459, horizontal fulcrum 460, fulcrum-arm 457 and the screed's tow arms 454 and 455. The horizontal fulcrum 460 can be pinned to the housing 459 if automatic grade controls are not required. The hydraulic cylinder 462 is attached between the horizontal fulcrum 460 and the housing 459 and receives hydraulic oil from the automatic grade control system (described in detail before). The horizontal fulcrum 460 is raised and lowered (by pivoting around point 461) by hydraulic cylinder 462, which in turn raises and lowers the horizontal fulcrum's pivot point 456. The screed tow arms are attached to pivot 456.

Figure 70:
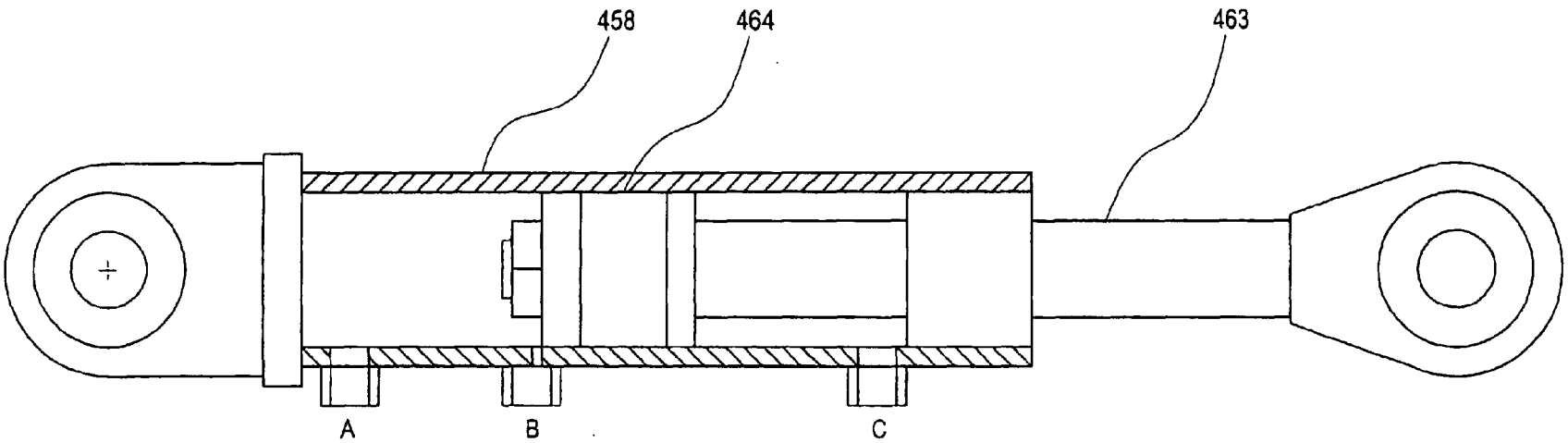

FIG. 70 shows a cross section of hydraulic cylinder 458. Hydraulic oil enters the cylinder barrel at port "A" at a controlled flow rate of 0.5 to 1 GPM. The maximum pressure is limited to 3000 psi. The oil flow entering port "A" is allowed to exit port "B". Port "C" is connected to tank (low pressure). As the rod 463 is pushed into the cylinder the attached piston 464 begins to block off the oil passage at port "B". The force pushing on rod 194 determines the hydraulic pressure at port "A", which changes with the load on the screeds. Hydraulic pressure balances the load (pull). Two electronic pressure transducers monitor the pressures in each the two hydraulic cylinders (one on the left and right side, secondary tow arms). This pressure is graphically shown on the machine and the screed operator's terminal as a bar graph and is used in balancing the load on the screeds. This can be accomplished by the offset of the Recycling Machine and the screed's extension position. For example, if the left extension is extended to two feet and the right extension is not extended, the pull on the left side of the screeds will be greater. This causes the machine to be pulled to the side with the greatest load, resulting in constant steering corrections at the rear steering axle. The solution is to move the machine over to the left and extend the right extension and retract the left extension. The on-board computer also uses the transducer information to make small adjustments to the tow arm position by raising or lowering the tow arm pivot point 456 by controlling the operation of the hydraulic cylinder 462. An electronic sensor measures the position of the horizontal fulcrum 460. This feature is generally only used when the Recycling Machine is operating with the one screed assembly and with no automatic grade controls (city streets). With the single screed configuration the on-board computer makes small changes to the position of the tow arm pivot point to compensate for the varying load on the screed assembly. If the pressure increases in one or both of the cylinders 458 the horizontal fulcrum 460 will lower the tow arm pivot point. The ratio of pressure increase in the hydraulic cylinder 458 and the amount of movement of the horizontal fulcrum 460 are programmed into the on-board computer, and can be simply changed. The other function of hydraulic cylinder 458 is to prevent unwanted feedback into the screed assemblies. This can happen when a truck driver backs the dump truck too fast into the front asphalt hopper causing the Recycling Machine to be pushed back. When this happens the cylinder's rod 463 and piston 464, are pulled out of the cylinders until the pistons hit the end of the cylinders. This gives plenty of travel and prevents the screed(s) from being pushed backwards. A make-up valve, located in the hydraulic manifold takes care of oil cavitation at port "A". As soon as the Recycling Machine moves forward again the rod and piston is forced back into the "B" port position.

FIG. 69 shows the primary 24 and secondary 26 screed assemblies. The secondary screed 26 is allowed to float and features the same weight transfer system, as described earlier. The primary screed 24 requires no grade or slope controls and is also allowed to float, but not to the same degree as the secondary screed. The primary screed 24 senses the position of the secondary screed 26 through two proportional, hydraulic or electronic sensors 465 (electronic sensor are shown). The sensors are attached to the left and right side of the secondary screed tow arms 454 and sense the position of the left and right side of the primary screed tow arms 455. The height of the sensor plates 466 can be adjusted by adjuster screw 467 to set the height differential between the primary and the secondary screed assemblies, which is generally ½" to 1½". The two screed sensors send information to the on-board computer, which in turn operates two hydraulic, 4-way, proportional, directional control valves. The secondary screed is the master while the primary is the slave and tries to match every move made by the secondary screed (master). The secondary screed is the master since it is the screed, which sets the final grade of the finished surface. To accomplish this the primary screed is attached to the Recycling Machine's mainframe 3 by two hydraulic cylinders 450 and the secondary screed by cylinders 451. The four hydraulic cylinders prime function is to raise and lower both of the screeds. The secondary screed cylinders are allowed to float (move up and down freely) as all of the cylinder's hydraulic ports are connected to tank (return hydraulic oil) when laying asphalt. The primary screed's cylinders are also allowed to float; however the hydraulic cylinder's ports are connected to tank through flow control valves. The sensors that are attached to the left and right side of the secondary screed's tow arms 454, sense the position of the left and right side, sensor plates 466, that are attached to the primary screed's tow arms. The varying height differential is used by the on-board computer to controls the proportional valves (variable flow depending on the sensor output) which send a varying flow of hydraulic oil to the rod or head end of the hydraulic cylinders 450. Oil is also flowing through the flow control valves. The greater the flow of hydraulic oil, the greater the pressure differentials across the flow control valves. The varying pressure differential influences the position of the primary screed assembly. The screed sensors will eventually turn off the proportional valves when the primary screed reaches the set point (differential height). The crank handles 467 on the primary screed can be adjusted to manually set the depth of asphalt being laid in relation to the secondary screed 26 if the system is being run in the manual mode. The crank handles must also be initially, manually adjusted in the automatic mode to make sure that the screed plates are operating at the correct angle, otherwise excessive screed plate wear will occur. To assist in the correct adjustment of the crank handles 467, LED's (light emitting diodes) located on the control panels (on either side of the machine); monitor the operation of the two proportional valves. When the cranks are set properly and the primary screed is laying the correct differential of asphalt, no LED's will be on. The primary screed is setting its own height (grade). An example; the LED indicating that hydraulic oil is being supplied to the rod end, of the left side cylinder is on (the screed is low on that side), indicating to the operator that the crank handle for that side of the screed must be turned to raise the screed. The flow control valves allow the primary screed's cylinders to float in the same manner as the secondary screed's cylinders. The flow of oil through the flow control valves is approximately 1 to 2 GPM. This low rate is sufficient to allow the screed to float and find its own level, while at the same time, allowing the oil flow from the proportional valves to build up pressure in the appropriate cylinder.

One of the major problems associated with this type of recycling equipment has been the transportation to and from sites and the removal of equipment from major highways at the end of the day. Both the Recycling Machine and Preheaters are designed to be self-transportable (do not require a trailer) using a highway tractor to tow the machines.

Figure 71A:
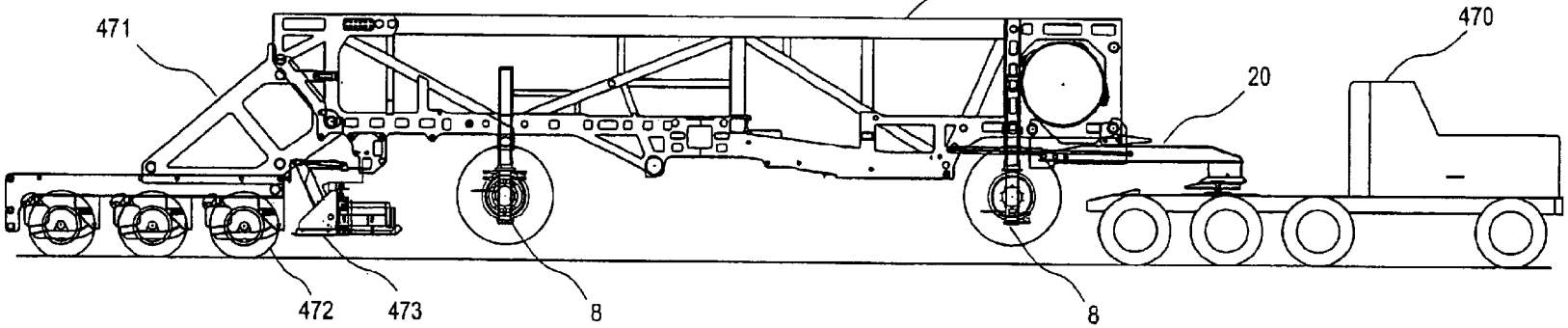
Figure 71B:
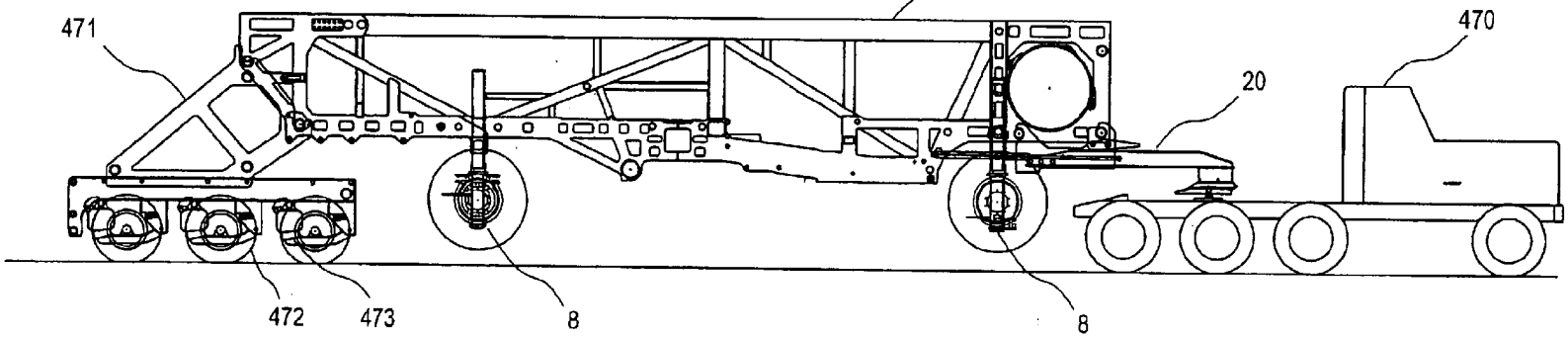
Figure 72:
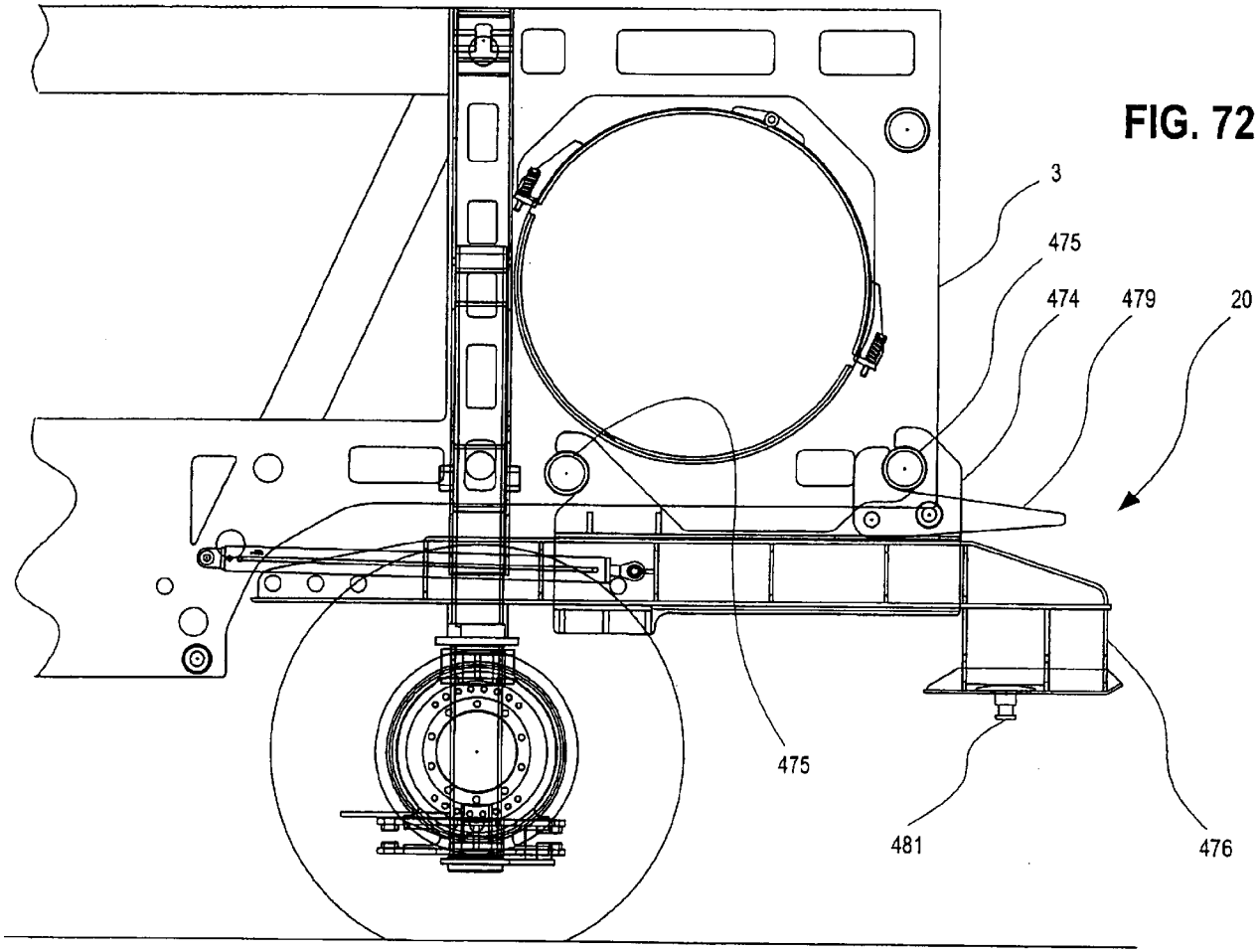
Figure 73:
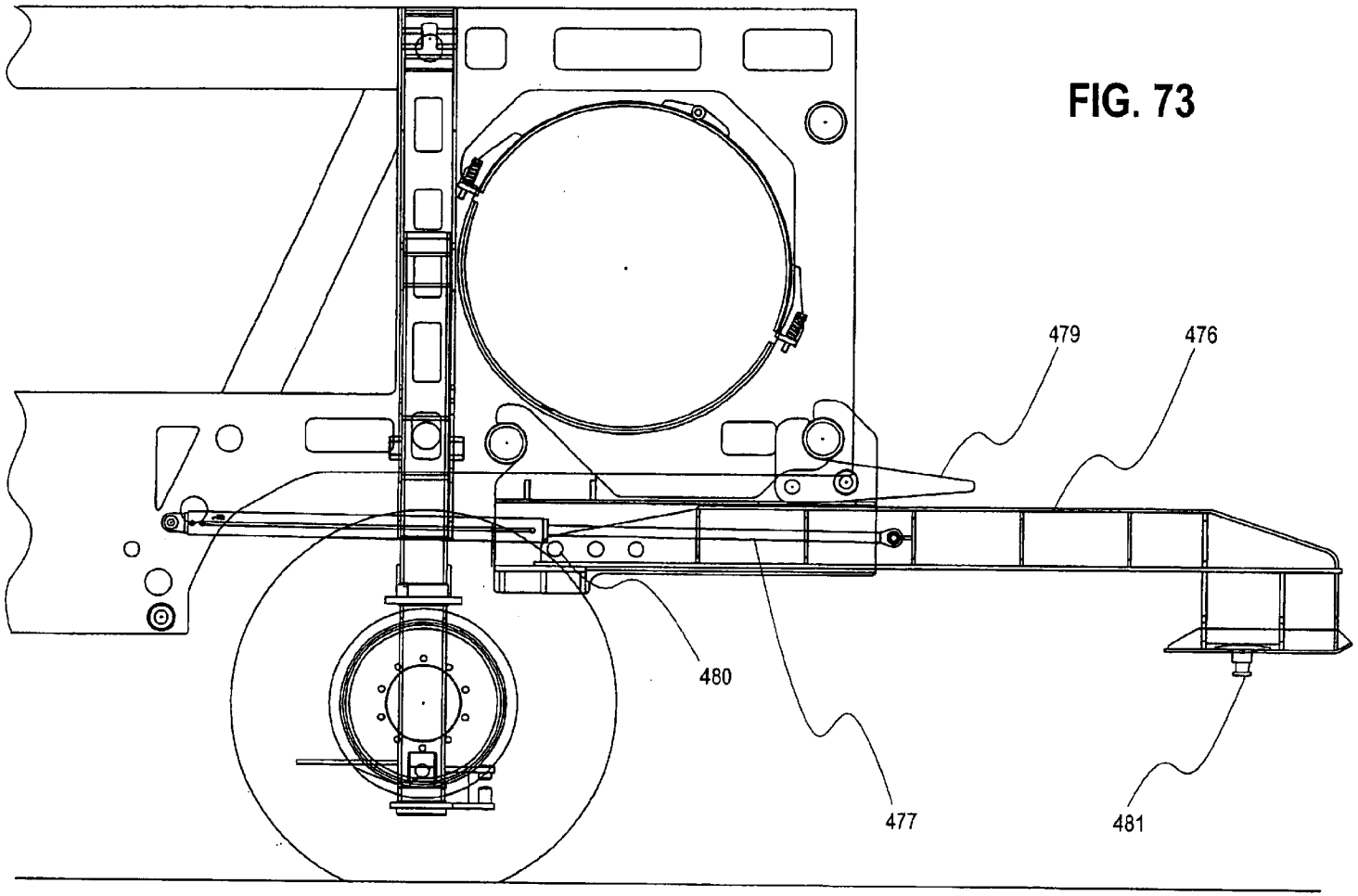
Figure 74:
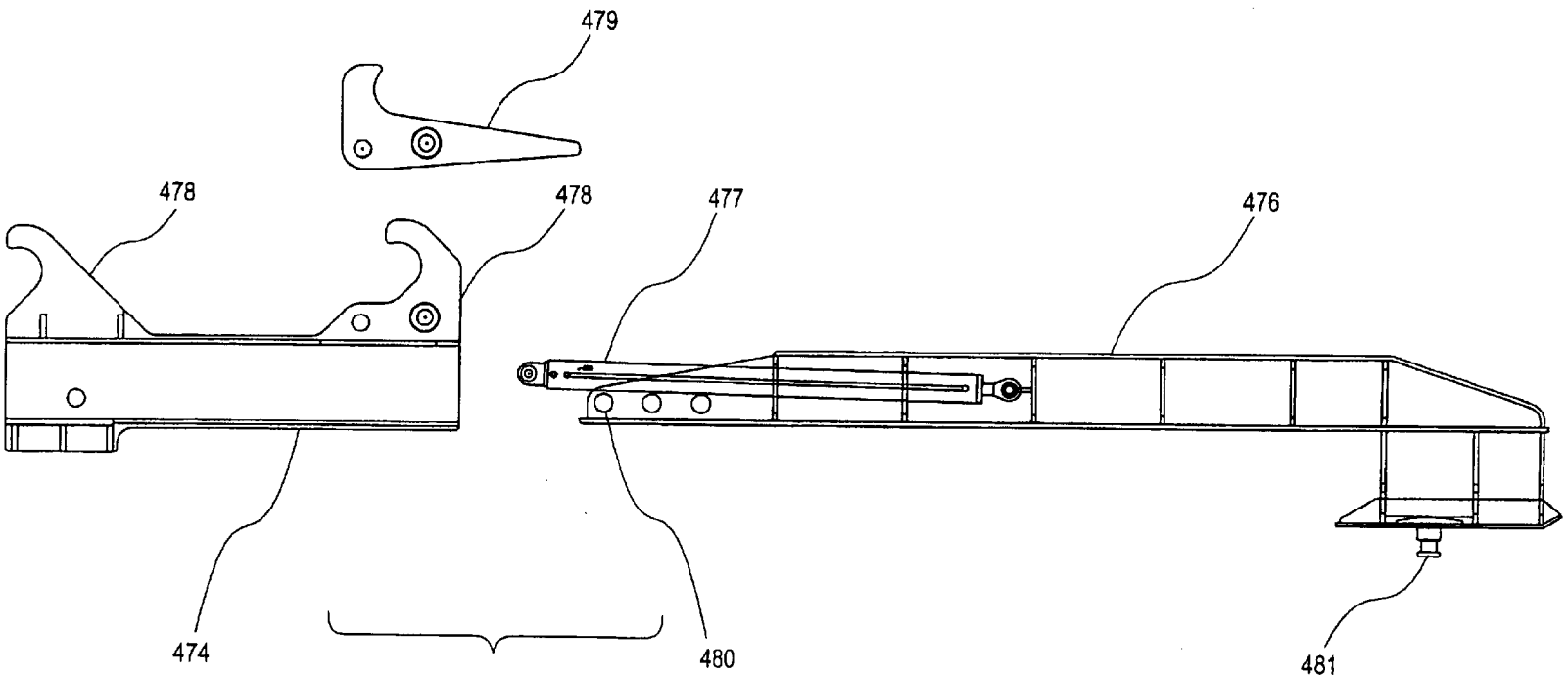

FIG. 71 shows the invention in the transportation mode.

Attached to the mainframe of either the Recycling Machine or Preheater (Recycling Machine shown with all sub-assemblies removed for clarity, except the screed assembly 473), is the clip-on, stinger assembly 20, shown extended and attached to the highway tractor 470. Attached to an opposite end of the mainframe 3 is the clip-on, rear transportation frame assembly 471 shown with three air-ride axle assemblies 472. The sub-assemblies of the invention are raised for the transportation position. Sub-assemblies such as screed 473 may be removed when weight and length restrictions prevent the device from being shipped as a complete unit, as shown in the lower view.

Figure 75A:
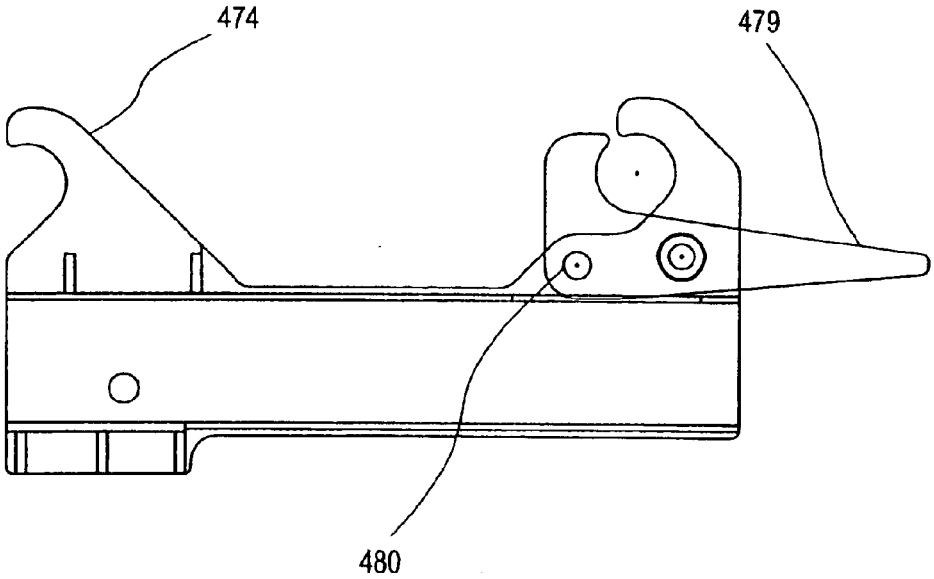
Figure 75B:
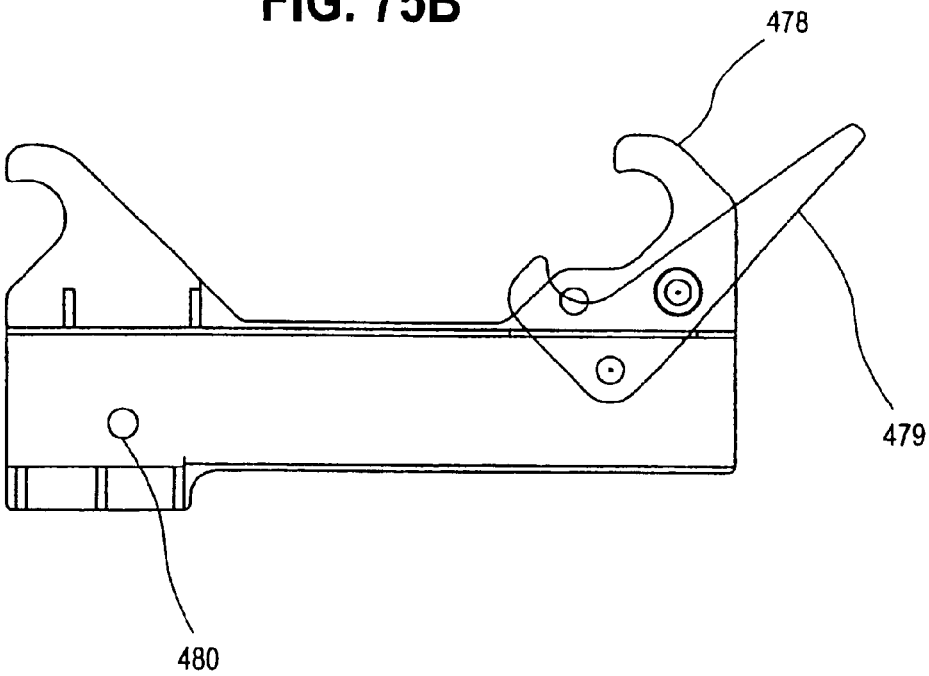

FIGS. 72, 73 74 and 75 show the clip-on stinger assembly 20 in the normal working mode "A" in the transportation mode "B" and an exploded view "C" and "D". The stinger has a clip-on support frame 474, which is attached to the mainframe's 3 two bottom cross tubes or attachment points 475. The support frame 474, which is attached without the stinger boom 476 or hydraulic cylinder 477 being in position. The support frame 474 is designed with left and right side hook plates 478, allowing the frame to hang on the cross tubes 475. Two safety latches 479 (one on either side) are used to secure the support frame 474 to the mainframe 3. FIG. 75 shows the safety latch in the closed position (top) and in the open position (bottom). The safety latch is pinned into position by two safety pins through holes 480. The safety latches must be in the closed position before the stinger boom 476 can be fitted. This design feature provides a failsafe locking arrangement as the support frame 474 cannot be removed without first removing the stinger boom 476. In the unlikely event of both safety pins being removed or falling out, the safety latches 479 are still secured by the top surface of the stinger boom 476. The hydraulic cylinder 477 is attached between the mainframe 3 and the stinger boom 476 and is used to extend or retract the stinger boom. The stinger boom is held in the extended (transportation) position by the hydraulic cylinder 476 and also pinned to the support frame 309 by two safety pins (one on either side), which are fitted into safety pin holes 480. Attached to the stinger boom is the $5^{th}$ wheel pin 481 that attaches to the highway tractor's $5^{th}$ wheel plate.

Figure 76:
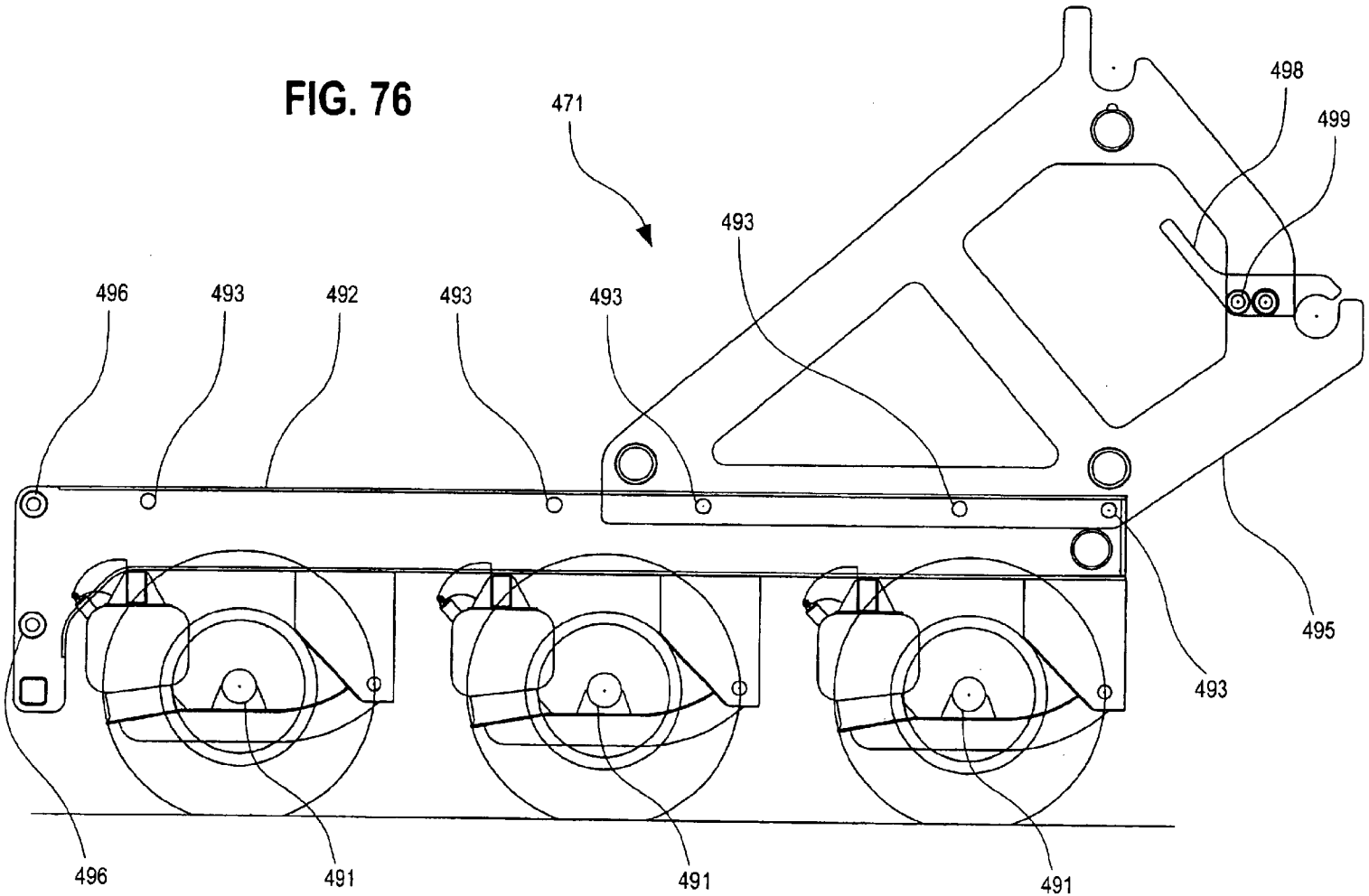
Figure 77:
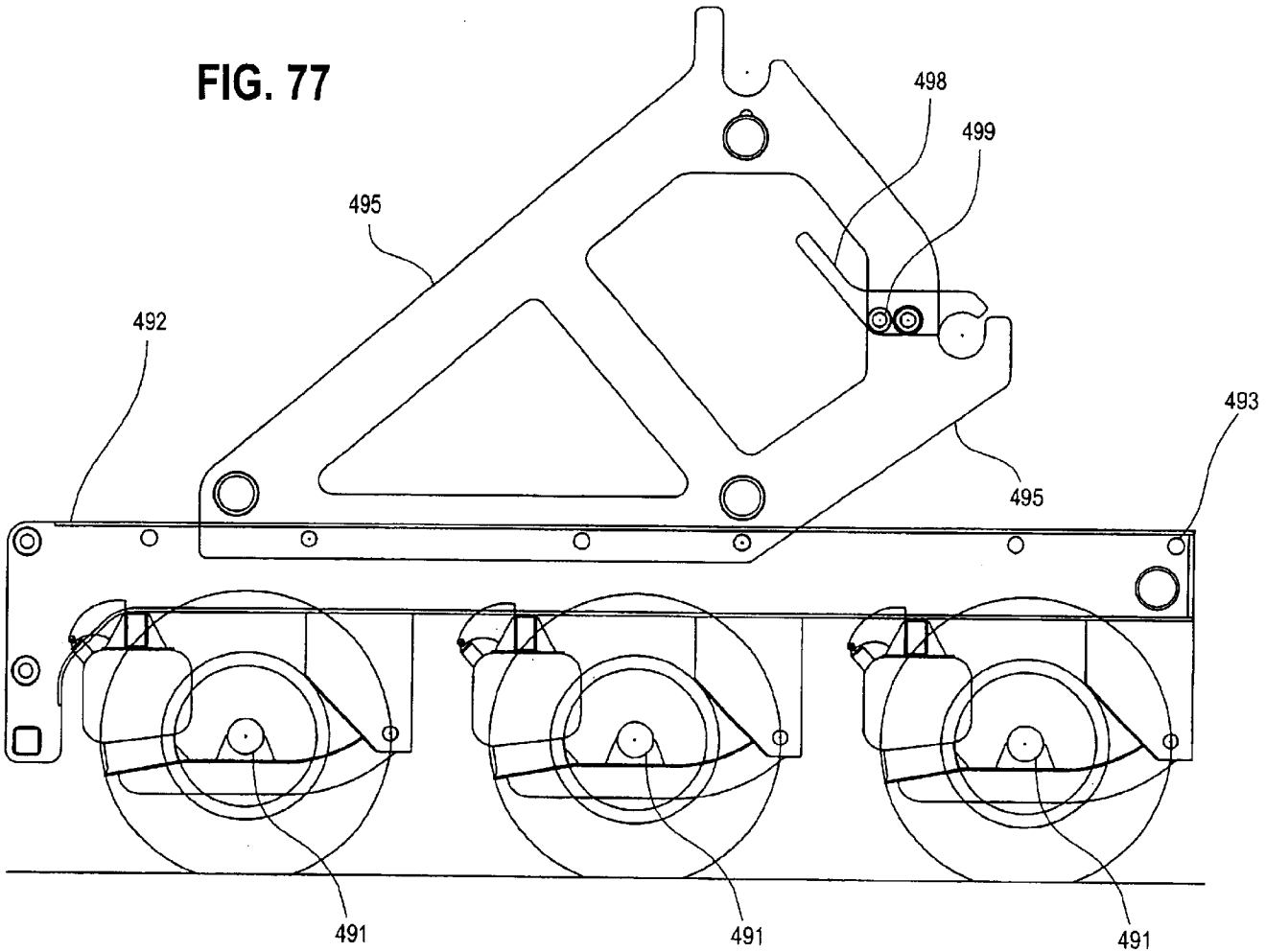
Figure 78:
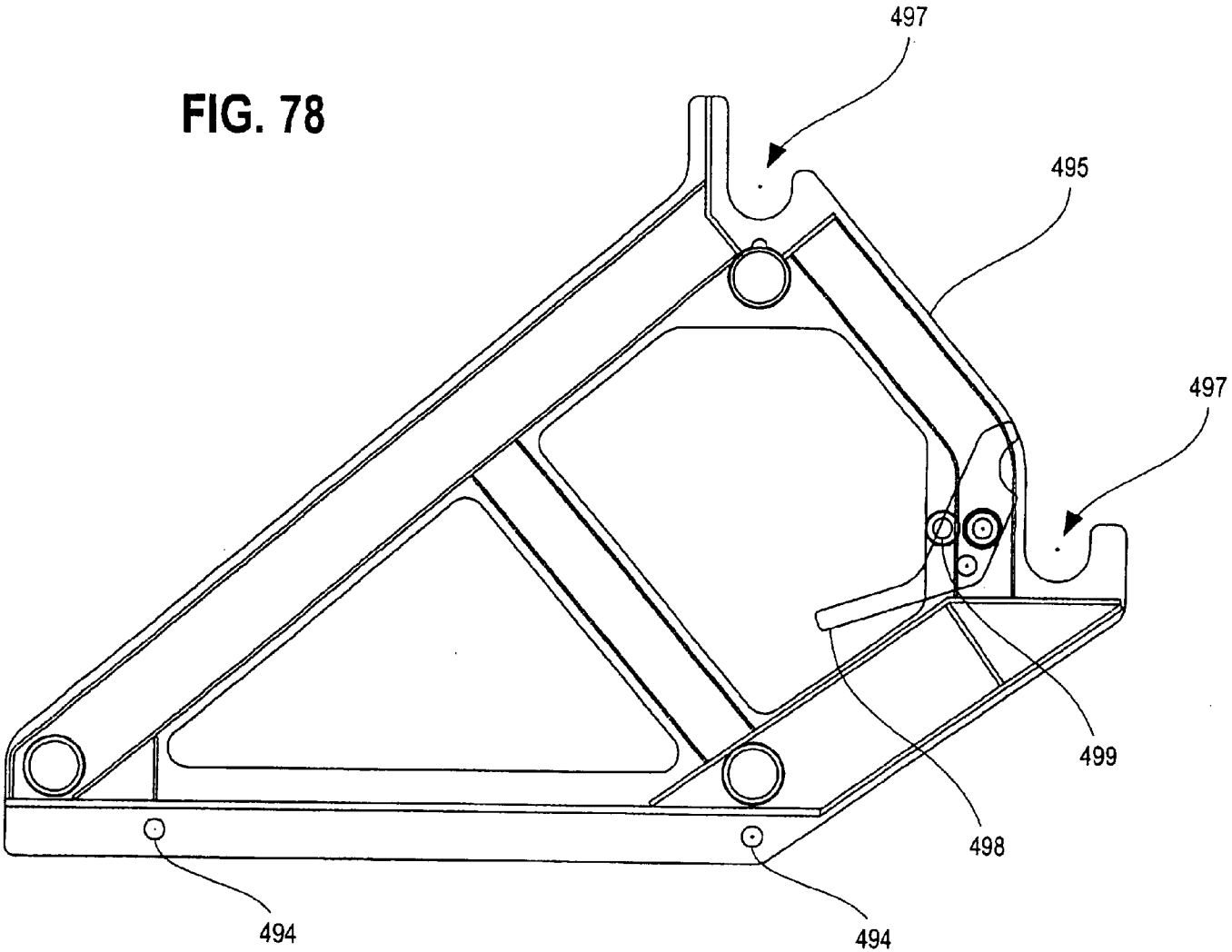

FIGS. 76, 77 and 78 show close up views of the clip-on rear transportation frame assembly 471. The air-ride axle assemblies 491 are attached to the sliding frame 492. Holes 493 are located along the sliding frame at spaced intervals and line up with equally spaced holes 494 in clip-on support frame 495. Four pins (not shown) attach the sliding frame 492 to the clip-on support frame 495. FIG. 76 shows the position of the sliding frame and clip-on support frame in a configuration for use when all of the machine's sub-assemblies are attached for transportation. FIG. 77 shows the position of the sliding frame and clip-on support frame when sub-assemblies have been removed. In some states, weight restrictions prevent heavy axle loads from being used, necessitating the removal of sub-assemblies. As mentioned earlier, the three axle, sliding frame can be replaced with a four axle, sliding frame, without having to change the clip-on support frame. Also the sliding frame is fitting with four pin bosses 496 at the rear end allowing a pin-on attachment axle assembly to be fitted. This is generally required in northern climates when half load seasons are used. The clip-on support frame is attached to the Recycling Machine or Preheater's mainframes 3 by lowering the mainframe's 3 rear cross tubes FIG. 2, 22 into the top and bottom saddles (four) 497. Two safety latches 498 are used to secure the clip-on support frame 495 to the machine's mainframe 3. Two locking pins (not shown) are installed and secured through holes 499, preventing the safety latches from moving. The design is such that the weight of the machines is sufficient to keep the clip-on support frame attached to the machine's mainframe. The safety latches provides a failsafe attachment system. FIG. 78 shows the clip-on support frame 495 with the safety latches 498 in the open position, allowing the machine's mainframe to be lowered into the saddles 497. The ability to position frame 492 with respect to frame 495 allows for flexibility in positioning and weight loads over the axles.

Figure 79:
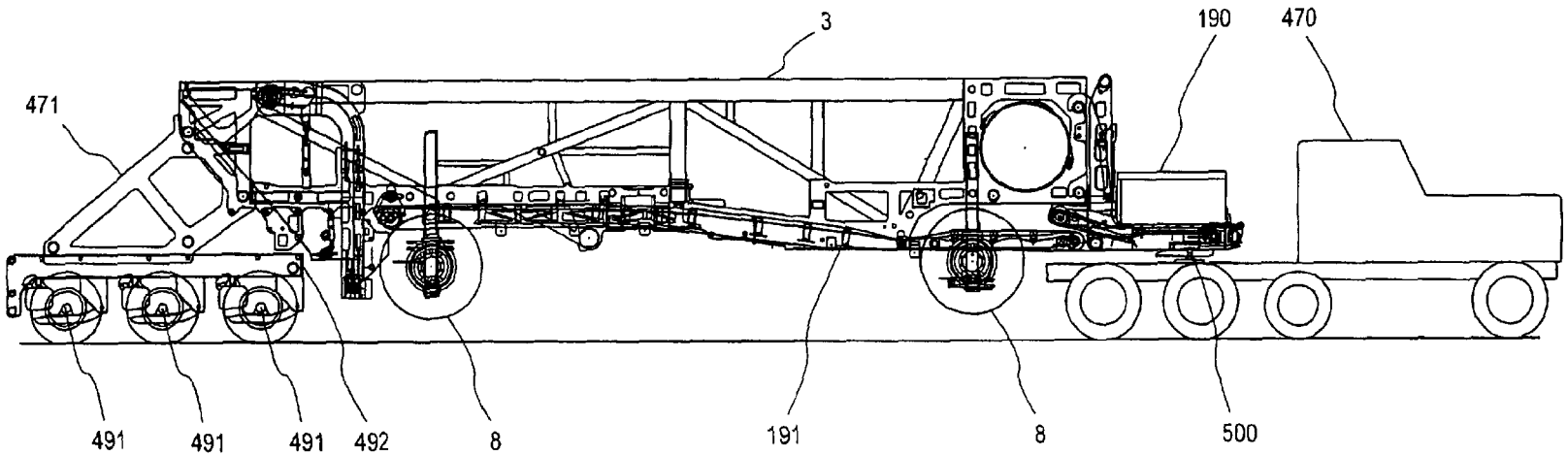
Figure 80:
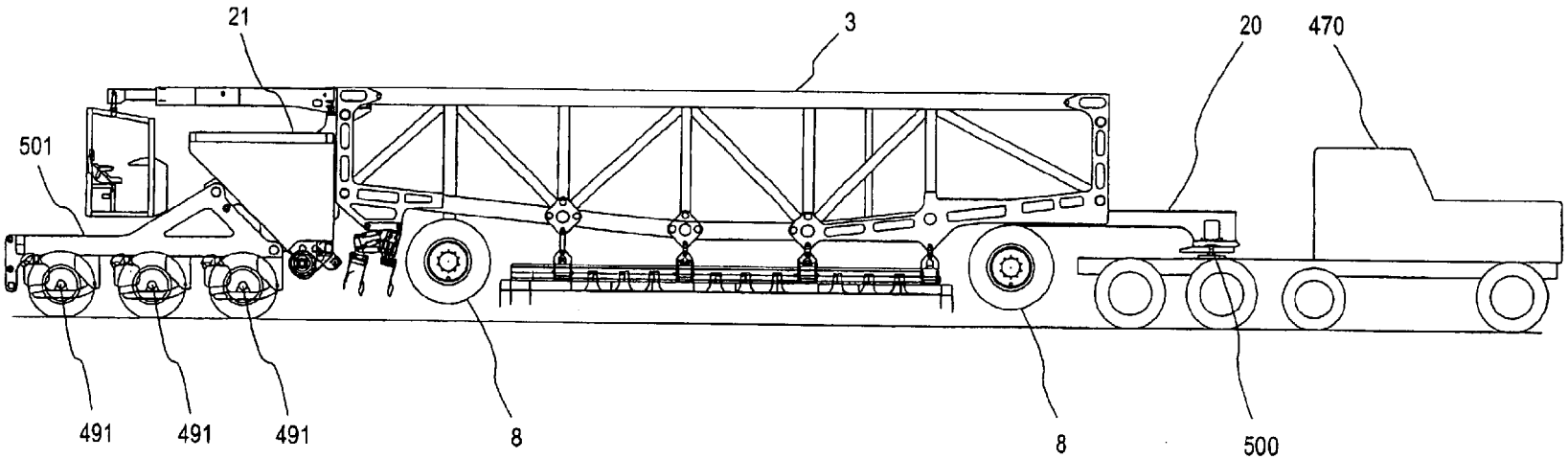

FIG. 79 shows the Recycling Machine 3 (all major sub-assemblies removed for clarity) fitted with the clip-on, front asphalt hopper/$5^{th}$ wheel pin 190 and the central conveyor 191, both described in detail before. When 190 and 191 are attached to the Recycling Machine the clip-on stinger assembly 20 is not required as the clip-on, front asphalt hopper is fitted with a $5^{th}$ wheel pin attachment allowing the tractor 470 to reverse and lock into the $5^{th}$ wheel pin 500 for transportation when said hopper is in a raised position. For normal paving operations, the bin will be in a lowered position as shown in the drawings. A rear clip-on transportation frame 471 transports the rear end of the Recycling Machine or the Preheater, when the clip-on aggregate bin 21 is not attached. Generally only one Preheater is fitted with the aggregate bin 21. For transportation, the bin may be removed and the clip-on rear transportation frame assembly 471 attached, or a fixed frame, clip-on transportation frame 501 (as shown in FIG. 80) may be attached to the aggregate bin, cross tubes FIG. 3, 22. The aggregate bin remains attached to the Preheater's mainframe tubes 22. The Recycling Machine and Preheaters hydraulic system is used to retract all of the attached sub-assemblies (including the front and rear axle assemblies 8) once the transportation frames and tractors have been attached, providing the necessary ground clearance for highway transportation.

Changes may be made to various components and the interconnecting thereof as described in the disclosure or the preferred embodiment, without departing from the spirit and scope of the present invention.

What is claimed:

1. A hot-in-place recycling and repaving machine for recycling and repaving an existing asphalt-based pavement, comprising:

at least one preheater unit for heating a surface of the pavement;

a first set of scarifying rakes for scarifying the heated surface of the pavement in a first scarification process;

an aggregate bin for dispensing new aggregate onto the heated and scarified asphalt surface to form a recycled, preheated asphalt and aggregate mixture; and a recycling machine comprising:

a. one or more heaters for heating the recycled preheated asphalt and aggregate mixture to within a predetermined temperature range;

b. a second set of scarifying rakes for scarifying the recycled heated asphalt in a second scarification process which premixes the recycled asphalt and aggregate mixture and forms a new recycled asphalt and aggregate mixture;

c. a plurality of extension mills for milling the pavement surface to grade and width by applying a mixing application of the new recycled asphalt and aggregate mixture;

d. a main mill for remilling the pavement surface to grade by applying a mixing application of the new recycled asphalt and aggregate mixture;

e. a first rejuvenator fluid containing first liquid additives introduced to the to the new recycled asphalt and aggregate mixture of the main mill from a rejuvenator supply associated with the main mill and comprising part of the rejuvenator application system, the rejuvenator application system including rejuvenator spray bars;

f. a pug mill receiving the new recycled asphalt and aggregate mixture of the main mill;

g. a second rejuvenator fluid containing second liquid additives introduced to the new recycled asphalt and aggregate mixture of the pug mill using the rejuvenator application system, the pug mill having first and second downwardly rotating rotors for mixing, wherein a substantially homogenous mixture of rejuvenator-enriched, recycled asphalt and aggregate windrow is formed; and h. at least one screed for laying the homogeneously mixed windrow to grade.

2. The hot-in-place recycling and repaving machine of claim 1, wherein the rejuvenator spray bars have varying diameter holes communicating with tubes of the rejuvenator application system carrying the rejuvenator fluid, to better control rejuvenator fluid flow to appropriate spray locations as determined by pressure drops within the tubes and across the holes.

3. The hot-in-place recycling and repaving machine of claim 1, wherein the rejuvenator spray bars include distribution holes for discharging rejuvenator fluid directly onto rotors of the main mill and the pug mill, thereby reducing direct spillage of the rejuvenator fluid onto the surface of the new recycled asphalt and aggregate mixture.

4. The hot-in-place recycling and repaving machine of claim 1; wherein the rejuvenator spray bars are purgable with blasts of forced air prior to stopping movement of the recycling machine, thereby reducing direct spillage of the rejuvenator fluid onto the surface of the new recycled asphalt and aggregate mixture.

5. The hot-in-place recycling and repaving machine of claim 1, wherein rejuvenator spray bars associated with the pug mill are fitted with a flow control device for controlling the flow rate of rejuvenator fluid in proportion to a level of volume of asphalt flowing through the pug mill.

6. The hot-in-place recycling and repaving machine of claim 1, wherein the rejuvenator fluid flow rate occurs in two stages, as directed by an on-board computer: at a predetermined lower volume asphalt level, rejuvenator fluid only enters the main mill; at a predetermined higher volume asphalt level, rejuvenator fluid enters the pug mill.

7. The hot-in-place recycling and repaving of machine claim 1, wherein the rejuvenator application system further comprises rejuvenator spray bars associated with the pug mill having a shut-off device for preventing the rejuvenator fluid from entering the spray bars from the rejuvenator supply of the main mill.

8. The hot-in-place recycling and repaving machine of claim 1, either of the preheater or the recycling machine further comprising a boom and an operated cab attached to a distal end of the boom.

9. The hot-in-place recycling and repaving machine of claim 1, wherein either or both of the heater of the recycling machine or the preheater comprises a plurality of individually controlled electronic burners which are each connected to at least one temperature sensor, the at least one temperature sensor causing the burners to individually deactivate if a predetermined maximum temperatures is reached and individually reactivate when a predetermined minimum temperature is reached.

10. The hot-in-place recycling and repaving machine of claim 1, wherein either or both of the heater of the recycling machine or the preheater includes a plurality of individually controlled electronic burners which are each connected to at least one flame sensor, the at least one flame sensor causing the burners to individually deactivate when a flame is detected.

11. The hot-in-place recycling and repaving machine of claim 1, wherein either or both of the heater of the recycling machine or the preheater includes a plurality of individually controlled electronic burners each having:

an air inlet passage which has a section with a reduced cross-sectional area to increase the velocity of air flow in the burner;

an air supply valve which restricts air flow so as to increase the fuel-to-air mixture in the burner; and a valve to modulate gas flow to the burner.

12. The hot-in-place recycling and repaving machine of claim 1, wherein one or both of the heater of the recycling machine or the preheater includes a plurality of individually controlled electronic burners which are programmed to operate with a predetermined number of active burners for normal operation, and programmed to operate with additional burners for providing additional heat when certain predetermined conditions have been satisfied.

13. The hot-in-place recycling and repaving machine of claim 1, further comprising first and second screeds, the first screed being positioned to create a mat of material overlying a mat of material created by the second screed.

14. The hot-in-place recycling and repaving machine of claim 13, wherein the first screed is a slave and the second screen is a master.

15. The hot-in-place recycling and repaving machine of claim 13, further comprising electric-over-hydraulic or pure hydraulic means for maintaining a substantially constant spacial differential between the first and second screeds.

16. The hot-in-place recycling and repaving machine of claim 13, wherein the first and second screeds are connected to individual screed arms.

17. The hot-in-place recycling and repaving machine of claim 16, wherein the individual screed arms are connected to the same adjustable tow point and are used to position the screeds.

18. The hot-in-place recycling and repaving machine of claim 16, wherein the individual screed arms are fitted with hydraulic cylinders used to measure force.

19. The hot-in-place recycling and repaving machine of claim 1, further comprising a surge bin having a vertical elevator.

20. The hot-in-place recycling and repaving machine of claim 19, wherein the vertical elevator may be positioned within the windrow so as to convey the windrow into the surge bin.

21. The hot-in-place recycling and repaving of claim 19, wherein the vertical elevator is adapted to communicate with a central belt or drag chain conveyor to add new asphalt to the surge bin.

22. The hot-in-place recycling and repaving machine of claim 21, wherein the vertical elevator conveys asphalt up the front face of the conveyor.

23. The paving machine of claim 21, wherein the vertical elevator is adapted to collect asphalt from both the conveyor and the windrow for storage in the surge bin.

24. The paving machine of claim 19, wherein the surge bin has an opening for receiving asphalt from an external source.

* * * * *